US009373211B2

(12) United States Patent
Rose, Jr. et al.

(10) Patent No.: US 9,373,211 B2
(45) Date of Patent: Jun. 21, 2016

(54) LARGE BOTTLE VENDING APPARATUS AND METHOD

(71) Applicants: R. Edward Rose, Jr., Hingham, MA (US); R. Edward Rose, III, Hingham, MA (US); Michael James Verrochi, Norwell, MA (US); Jay Ray, Hampden, MA (US); Frank Dinoia, Hampden, MA (US); Bob O'Brien, Hampden, MA (US); Eric Quattrocelli, North Brookfield, MA (US); Warren Black, Hampden, MA (US); Ryan Horgan, Northborough, MA (US); Burleigh Hutchins, West Brookfield, MA (US)

(72) Inventors: R. Edward Rose, Jr., Hingham, MA (US); R. Edward Rose, III, Hingham, MA (US); Michael James Verrochi, Norwell, MA (US); Jay Ray, Hampden, MA (US); Frank Dinoia, Hampden, MA (US); Bob O'Brien, Hampden, MA (US); Eric Quattrocelli, North Brookfield, MA (US); Warren Black, Hampden, MA (US); Ryan Horgan, Northborough, MA (US); Burleigh Hutchins, West Brookfield, MA (US)

(73) Assignee: BlueRock Ventures, LLC, Norwell, MA (US)

( * ) Notice: Subject to any disclaimer, the term of this patent is extended or adjusted under 35 U.S.C. 154(b) by 439 days.

(21) Appl. No.: 13/651,353

(22) Filed: Oct. 12, 2012

(65) Prior Publication Data

US 2014/0103062 A1 Apr. 17, 2014

Related U.S. Application Data

(63) Continuation-in-part of application No. 13/407,452, filed on Feb. 28, 2012, now abandoned.

(60) Provisional application No. 61/654,585, filed on Jun. 1, 2012, provisional application No. 61/568,661, filed on Dec. 9, 2011, provisional application No. 61/560,835, filed on Nov. 17, 2011, provisional application No. 61/546,091, filed on Oct. 12, 2011.

(51) Int. Cl.
*G07F 11/00* (2006.01)
*B65H 1/00* (2006.01)
(Continued)

(52) U.S. Cl.
CPC ..... *G07F 11/30* (2013.01); *G07F 7/0609* (2013.01); *G07F 11/28* (2013.01); *G07F 11/34* (2013.01)

(58) Field of Classification Search
CPC ..... G07F 11/30; G07F 7/0609; G07F 11/28; G07F 11/34
USPC ..... 221/1, 288, 124, 66, 192, 312 R; 194/205, 212
See application file for complete search history.

(56) References Cited

U.S. PATENT DOCUMENTS 1,004,998 A * 10/1911 Crecelius ..... B65G 59/067 193/27

(Continued)

FOREIGN PATENT DOCUMENTS

FR 2 599 723 A1 12/1987
FR 2641887 A1 * 7/1990

(Continued)

*Primary Examiner* — Rakesh Kumar
(74) *Attorney, Agent, or Firm* — Lorusso & Associates

(57) ABSTRACT

A combination vending/return apparatus and method. The apparatus includes a series of rows and columns for receiving, storing and dispensing unfilled and filled large-volume water-containing bottles from and to consumers. The apparatus includes a computer-operated vending keyboard for making bottle selections for purchase and returns, and to handle electronic payment and credit transactions. Also included is a method to vend large-volume water bottles and retrieve used and emptied large-volume water bottles.

19 Claims, 115 Drawing Sheets

(51) Int. Cl.

| | |
|---|---|
| ***B65H 3/44*** | (2006.01) |
| ***G07F 11/30*** | (2006.01) |
| ***G07F 7/06*** | (2006.01) |
| ***G07F 11/28*** | (2006.01) |
| ***G07F 11/34*** | (2006.01) |

(56) References Cited

U.S. PATENT DOCUMENTS 2,260,643 A * 10/1941 Rosan ..... G07F 7/0609 211/59.2
2,496,304 A * 2/1950 Muffly ..... F25D 17/02 194/277
2,562,015 A * 7/1951 Cattanach ..... G07F 11/32 194/244
2,711,241 A * 6/1955 Abrahamsen ..... F25D 25/00 193/27
2,996,344 A * 8/1961 Garman ..... A47F 1/087 229/122
3,028,045 A * 4/1962 Smith ..... G07F 11/42 221/10
3,062,405 A * 11/1962 Le Blanc, Jr. ..... F25D 25/04 198/799
3,141,571 A * 7/1964 Moore ..... G07F 11/34 221/195
4,285,426 A * 8/1981 Cahill ..... G07F 7/0609 100/902
4,687,119 A * 8/1987 Juillet ..... G07F 9/105 221/101
4,712,712 A * 12/1987 Garden ..... A63B 47/002 221/151
4,778,042 A * 10/1988 Warren ..... G07F 11/58 194/212
4,784,251 A * 11/1988 DeWoolfson ..... G07F 7/0609 194/209
4,986,441 A * 1/1991 Kanbe ..... G07F 11/58 221/130
4,998,628 A * 3/1991 Ross ..... A47F 1/087 211/59.2
5,009,329 A * 4/1991 Farrentine ..... G07F 11/34 221/175
5,046,639 A * 9/1991 Deberry ..... F42B 39/002 221/127
5,080,256 A * 1/1992 Rockola ..... G07F 11/34 193/2 A
5,199,598 A * 4/1993 Sampson ..... G07F 11/28 221/194
5,247,798 A * 9/1993 Collard, Jr. ..... F25B 21/02 221/266
5,356,033 A * 10/1994 Delaney ..... A47F 1/087 221/150 R
5,829,630 A * 11/1998 Fernald ..... G07F 7/0609 193/35 S
6,152,323 A * 11/2000 Immel ..... B65G 1/08 221/129
6,173,582 B1 * 1/2001 Hixson ..... A47F 1/087 62/3.64
6,206,237 B1 * 3/2001 Dillon ..... B65G 1/08 221/193
6,223,934 B1 5/2001 Shoenfeld
6,286,715 B1 * 9/2001 Ziesel ..... G07F 9/02 221/171
6,598,760 B1 * 7/2003 Wilson ..... A47F 1/08 221/131
6,637,604 B1 * 10/2003 Jay ..... A47F 1/12 211/59.2
6,834,691 B2 * 12/2004 Goldin ..... B67D 1/1245 141/363
7,303,095 B2 * 12/2007 Nagelski ..... A47F 1/087 221/256
7,513,390 B2 * 4/2009 Artsiely ..... G07F 11/30 221/151
7,757,890 B2 * 7/2010 Alford ..... G07F 11/18 221/151
7,913,860 B2 * 3/2011 Merl ..... G07F 11/16 211/59.2
7,975,875 B2 7/2011 Borzym
8,028,855 B2 * 10/2011 White ..... G07F 11/10 221/191
8,083,078 B2 * 12/2011 Omura ..... B65G 1/06 211/51
8,113,382 B1 * 2/2012 Piersant ..... G07F 7/0609 221/102
8,387,771 B2 3/2013 Boydston et al.
8,469,228 B2 * 6/2013 Adams ..... G07F 7/0609 211/129.1
8,757,433 B2 * 6/2014 Machers ..... G07F 11/20 211/59.2
8,757,434 B2 * 6/2014 Roekens ..... A47F 3/0491 194/229
8,851,302 B2 * 10/2014 Burton ..... A47F 1/087 211/59.2
2001/0037838 A1 11/2001 Hasenkopf
2002/0043509 A1 * 4/2002 Lajeunesse ..... A47F 7/28 211/59.2
2003/0146235 A1 * 8/2003 Peeler, Jr. ..... G07F 11/42 221/123
2004/0249502 A1 12/2004 Truong et al.
2005/0189370 A1 * 9/2005 Carter ..... G07F 11/165 221/123
2006/0217836 A1 9/2006 Poliner
2007/0012541 A1 * 1/2007 Boydston ..... G07F 7/0609 194/205
2008/0097770 A1 4/2008 Low
2008/0121492 A1 * 5/2008 Kreitz ..... G07F 7/0609 194/205
2008/0223871 A1 * 9/2008 Leonetti ..... G07F 11/42 221/221
2008/0308383 A1 12/2008 Boydston et al.
2009/0084810 A1 * 4/2009 Borzym ..... A47F 1/087 221/66
2009/0140000 A1 * 6/2009 Davis, Jr. ..... G07F 7/0609 221/2
2011/0060693 A1 * 3/2011 Consiglio ..... G06Q 10/30 705/308
2012/0222938 A1 * 9/2012 Rose, Jr. ..... G06Q 20/18 198/572
2014/0103062 A1 * 4/2014 Rose, Jr. ..... G07F 7/0609 221/124
2014/0312051 A1 * 10/2014 Rose, Jr. ..... G07F 11/30 221/124

FOREIGN PATENT DOCUMENTS

FR 2721813 A1 * 1/1996
WO WO 92/04969 4/1992
WO WO 2007/100400 9/2007

* cited by examiner

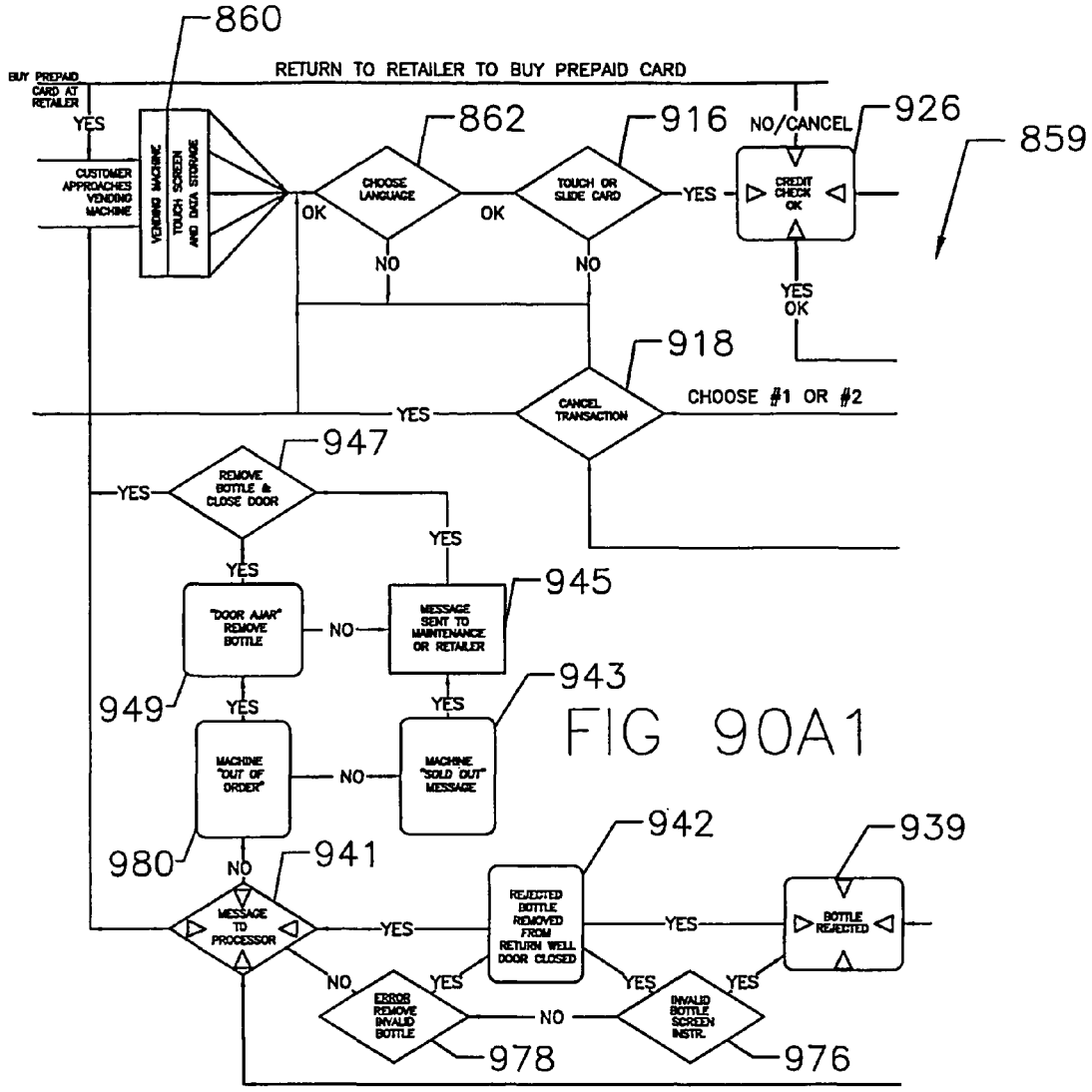
FIG 90A1

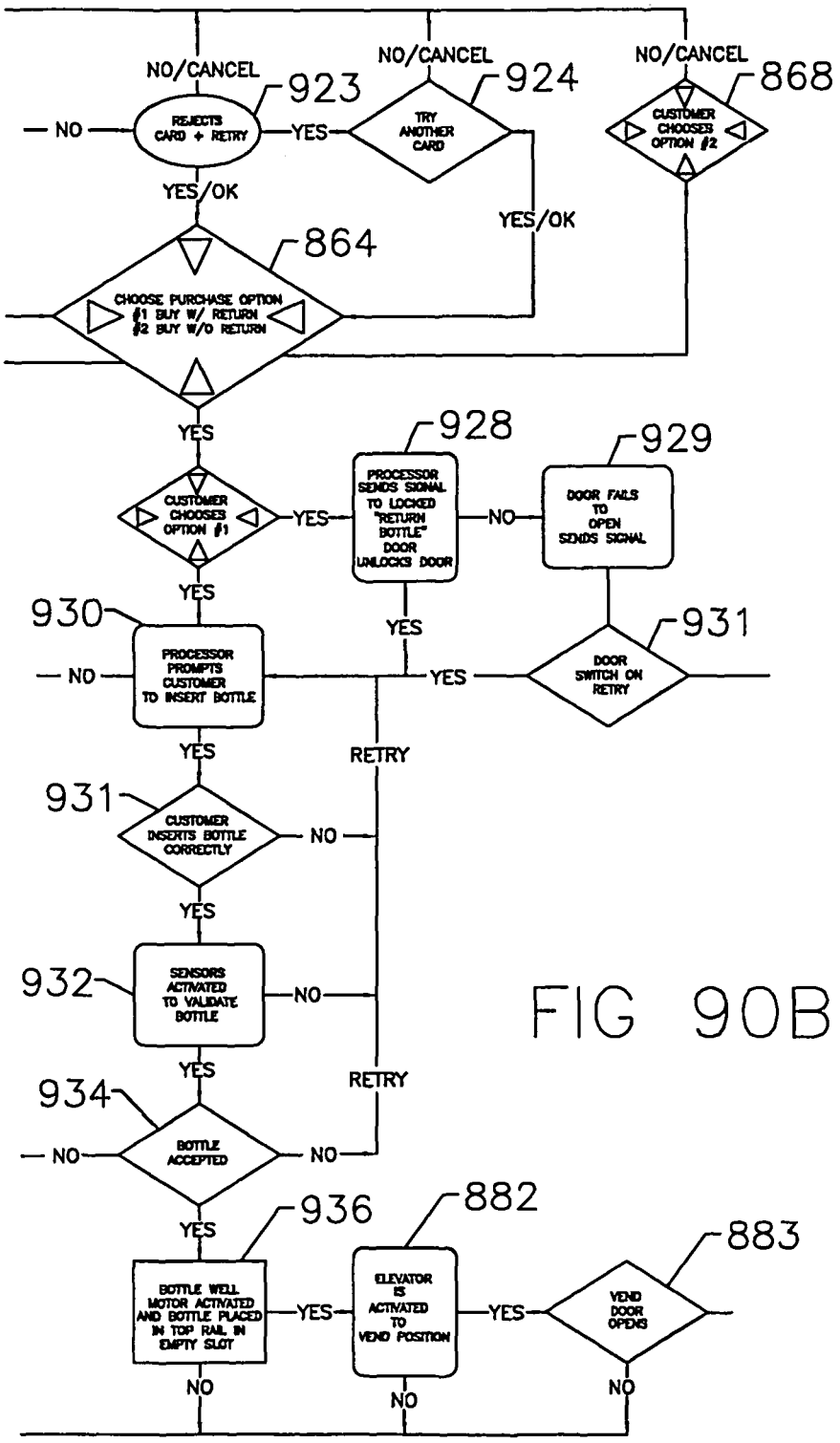
FIG 90B1

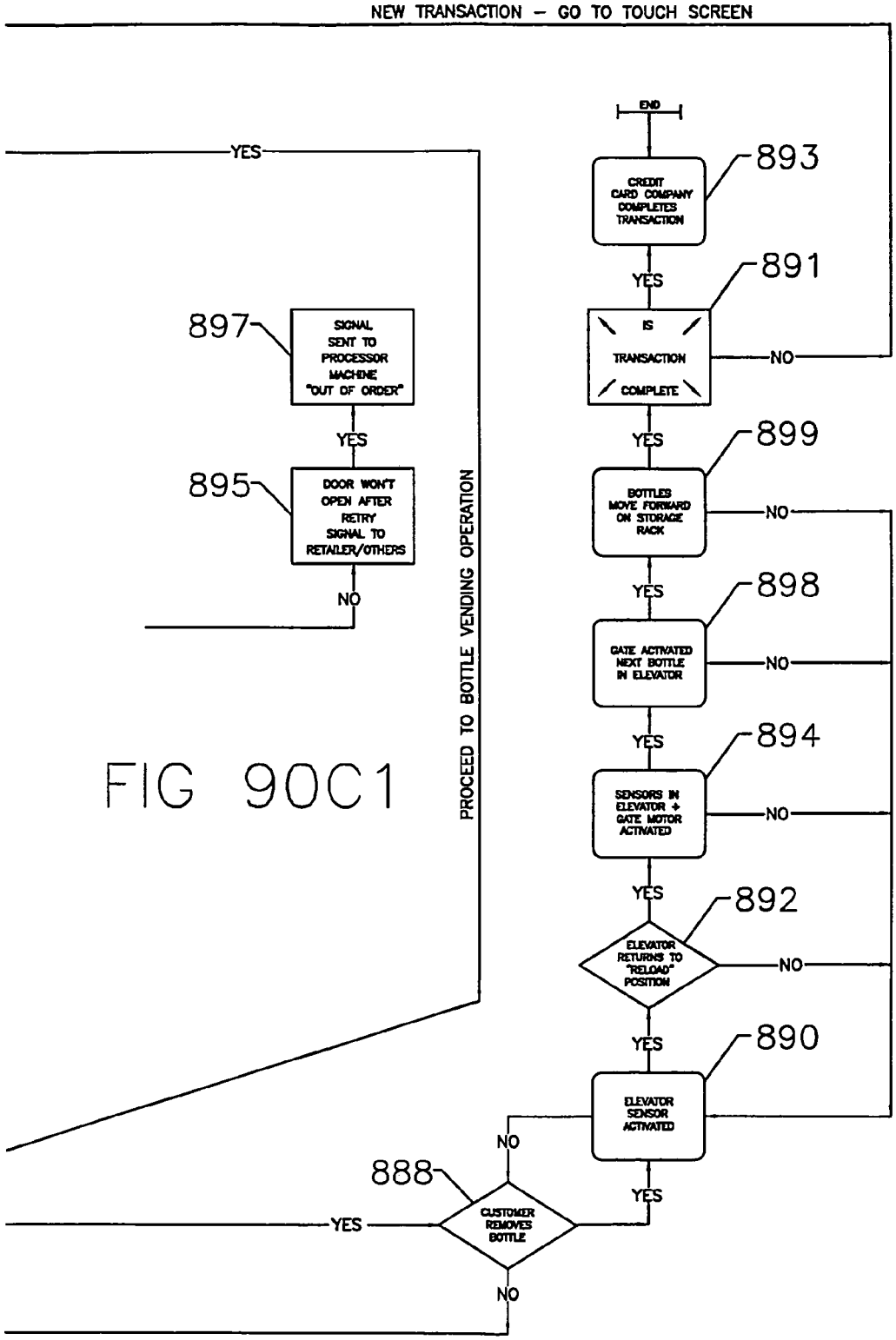
FIG 90C1

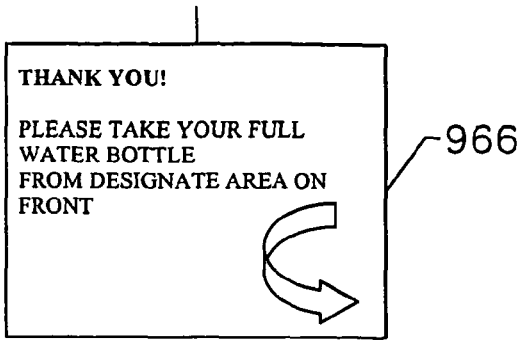
PROBLEMS THAT CAN HAPPEN WITH THE OPTION RETURNING AN EMPTYBOTTLE
FIG 91B
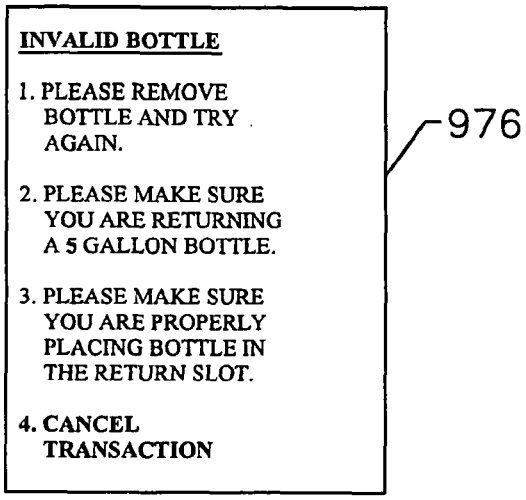
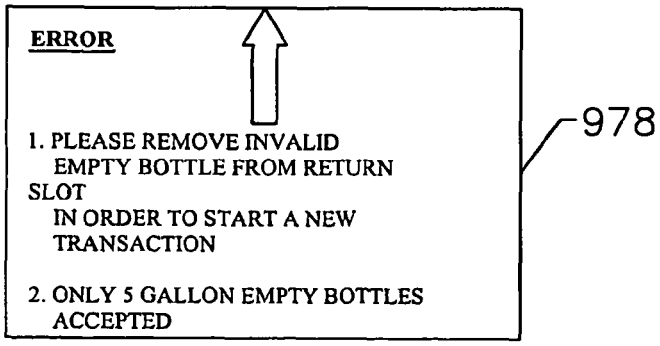

PROBLEMS THAT CAN HAPPEN WITH BOTH OPTIONS

979

ERROR

"DOOR AJAR"

980

OUT OF ORDER

GO TO WEBSITE

WWW.AQUAEXPRESSVENDORS.COM

FIG 91C

982

CREDIT ERROR!

PLEASE CONTACT YOUR FINANCIAL INSTITUTION

IF THE CANCEL TRANSACTION BUTTON WAS PUSHED

984

TRANSACTION CANCELED

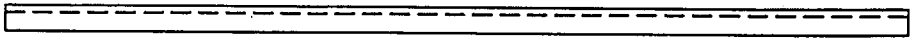
FIG 135
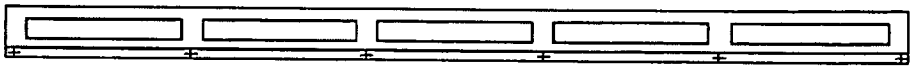
FIG 134
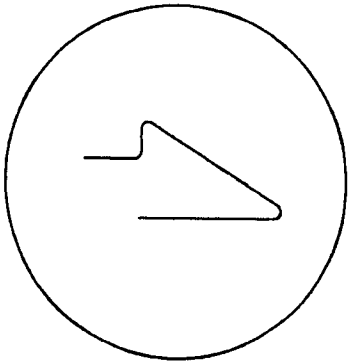
FIG 136
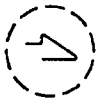

LARGE BOTTLE VENDING APPARATUS AND METHOD

CROSS-REFERENCE TO RELATED APPLICATIONS

This application claims the benefit of U.S, Provisional Application Ser. Nos. 61/654,585, filed Jun. 1, 2012; 61/568,661, filed Dec. 9, 2011; 61/560,835, filed Nov. 17, 2011; and 61/546,091, filed Oct. 12, 2011, This application is a continuation in part of U.S. Regular Utility application Ser. No. 13/407,452, filed Feb. 28, 2012. The contents of all the prior patent applications listed herein are incorporated in their entirety herein by reference.

FIELD OF THE DISCLOSURE

The disclosure relates generally to a vending apparatus for vending consumable goods and for receiving emptied reusable containers for the consumable goods. More specifically, the disclosure relates to an apparatus for vending large volume water bottles and receiving emptied re-sanitizable and reusable bottles.

BACKGROUND OF THE DISCLOSURE

Potable, portable water has become an increasingly sought-after and commonplace commodity by modern day consumers. Whether natural spring water or purified and/or re-mineralized drinking water, to address varying consumer demands for convenience and availability, water vendors have developed a number of bottle sizes and approaches for dispensing and delivering water. One such approach described more fully below uses established food stores, e.g., supermarkets and wholesale establishments, within which bottled water in varying sizes is offered on store shelves. A second approach is to offer larger 3 and 5 gallon bottles, often stacked independently of the market's shelves due to their considerable weight, which are to be used with water coolers for dispensing.

For companies involved in the home and office water delivery business, competition with respect to price, service, contract terms, availability of product, consistency of product, permitting in and out of state, delivery expenses including the acquisition of, or lease of, government approved trucks, fuel costs, tolls, taxes, maintenance and repair, labor and labor related benefits all add considerably to the cost of the delivered water. Additional costs such as a sales force, bookkeeping department, plant inventory, delivered inventory, truck-loaded inventory, FIFO handling of product inventory, further add to the cost. Regional weather issues can affect deliveries to homes, offices and apartment buildings.

An additional problem is the use of rented water coolers. Companies providing on-site delivery services that rent coolers to their customers have to deal with repair and maintenance, cleaning, billing and collection of rental fees.

A yet further set of issues with respect to the home/office delivery business concerns state permitting practices and procedures. States vary considerably in their permitting requirements such that one company may decide against doing business in certain states to avoid disparate permitting requirements.

Distribution of particular brands of water for home/office delivery may be further restricted by geographical considerations, such as distance from a bottling facility. Many homes and businesses may be outside the feasible mileage radius of the bottling plant to warrant delivery at a competitive or acceptable price. The end result is the delivery of bottles and coolers along with all the related costs creates a fractionalized cost model that requires high volume to achieve low margins.

Similar problems surface with the distribution of 3 and 5 gallon bottles through supermarket and wholesale club stores. "Centralizing" distribution does centralize costs and simplify bottle delivery and empty bottle pickup. It also reduces or eliminates many of the other problems associated with home/office delivery. Problems such as billing and collection, however, still remain, even though on a centralized, e.g., consolidated manner, the bottler is invoicing the supermarket and wholesale stores versus invoicing the individual home and/or office customers. One solution to the invoicing issue is to rely on the retailer to electronically transfer funds directly and automatically. This has become increasingly popular with the advent of e-commerce.

In this particular model of distribution, the customers serve themselves and prepay for the bottled water product at a central location versus being invoiced separately at dispersed locations for the delivered purchase and/or cooler rental. In most cases, the customer will also be required to prepay for the bottle when purchased. Furthermore in this distribution model, the particular retailer and not the customer governs the location and hours of operation. As an added difficulty/inconvenience, the customer must handle the product in order to get the 3 and/or 5 gallon bottle to their vehicle from inside the store while often simultaneously shopping for other items inside the store (depending upon whether it's a grocer or retailer, this can be a significant limitation). And often times, this will result in a separate trip back and forth to the vehicle and back and forth to customer service to return empties, and in some cases, to receive a voucher to present to a cashier as a credit against the purchase of a new bottled water product and then out to the vehicle (or continue to shop inside the store before travelling back to the vehicle). This can have the unfortunate effect of limiting sales and causing probable inconvenience.

This model of distribution has significant temporal and convenience limitations as it relies entirely on the individual store hours and on the location(s) of the stores. A further inconvenience and limitation is the location(s) inside those stores where bottles are returned and where bottles are purchased and retrieved. Added to this is the common practice of using vouchers to confirm bottle returns for a return-bottle credit, which, if lost, cannot be used to obtain a credit against a subsequent purchase of a filled bottle.

A substantial reason why water bottles are sold in stores is due to the effect of climate and weather on water. If left exposed to the elements—even in sealed containers—water can freeze, get stolen, and/or overheat. In the alternative, even if the bottled water were to be stacked outside the store on the sidewalk (so to speak) for purchase, it would have to be brought back into the store at closing to reduce the risk of theft and to prevent freezing in colder climates. By way of example, there can be as many as 75-100 bottles stacked on the shelves of wholesale clubs. If not left inside the store, but displayed for sale outside, the bottles would need to be taken in each and every night. It should come as no surprise that water bottles sold by wholesale clubs are more likely to sell the bottles from store racks/shelves inside the club facilities.

Not only does this model create extra effort and handling for the customer, just as importantly, it places a constant burden on the retailer as it can involve the ongoing and tedious tasks of price-labeling, of handling the piles of empties and of planning the use of valuable floor/shelf space in designated "water aisles" such as those found in a supermarket or a Wal-Mart store. The same burden is experienced when the bottles are placed on separate shelving or pallets in retail stores such as Home Depot, or Lowe's, or in food clubs such as B.J.'s Wholesale Club, Sam's Club, Costco, etc. These problems are exacerbated by the fact that these self-serve products weigh about 44.5 lbs. per five gallon bottle and about 25.5 lbs. per 3 gallon bottle. This creates significant handling logistics for both the consumer and the store. For example, a 5 gallon bottle typically takes up an 8"D-10½" D×13"H space for a 3 gallon bottle and an 11"D×20"H space for a 5 gallon bottle. Sales of, and even profits derived from, this product can sometimes be negated by the extra handling and "shelf-space" required.

Several other problems involving this distribution model are not readily apparent. For example, in the case of a grocery store, the customer must carry the 45 lb. and/or 25 lb. bottles around the store in a grocery cart, wait in line for a check-out clerk and then bring the bottle out to his or her vehicle sometimes in snow, ice or rainy weather conditions and across a parking lot to their parking space which could be several hundred feet or yards away. This scenario repeats itself in the wholesale and retail stores and only worsens because the customer must park their car; bring any empties to the "customer service area" to redeem their deposit(s) and get a receipt; go to the cashier (wait in another line); pay for a new bottle(s) of water; go to the location where the 3's and 5's are kept; pick them up and place them in a basket carrier and then wheel them out to their vehicle, much the same as in the supermarket model. This is not the most customer friendly or convenient delivery model and again can stifle sales because many, if not most, shoppers at supermarkets are consumers doing their weekly shopping. In this scenario, buying drinking water in large quantities is not necessarily a "destination", or convenient purchase."

In an improved form of distribution, 3 and 5 gallon bottled water can be distributed in a vending machine designed to handle both 3's and 5's of bottled water and 3's and 5's of empty returns. This is accomplished using a single piece of equipment in one location only, located outside the retailer's store on a sidewalk, "end-cap", or some other similar, customer friendly location where customers can drive up, buy and return their bottles (24/7) and be on their way, or to shop if they choose, and then purchase their water on the way out of the store.

In this novel distribution system, customers aren't reliant on retailer's hours of operation; both the bottle return and the purchase of the product are in the same machine; customers are guaranteed an FDA and Board of Health approved product "packaged" and not delivered "bulk." Customers don't have to bring their own "clean and sanitary" containers. The system is a cashless transaction which should help, if not eliminate theft because the vendor is an unmanned unit 24/7. It further provides a convenient method of payment for the consumer because they can utilize one of three or four methods of payment. If cash is preferable, the system can accept a prepaid water card, which can be purchased from the retailer. This method of payment is also compatible with retailers' cross-promotions whereas they can receive discounts off their purchase by using special retailer coupons and/or retailer "advantage" cards.

The vending apparatus is very well lighted and safe in appearance and customer-friendly to operate. The only trucking required is "on demand" because the unit is wireless and will communicate with the manufacturer's/dispatch control center when the vending apparatus is low on inventory. A "return bottle" well/window is a vendor controlled RFID or a bar coded Unique Identification Number (UID) acceptable only to that bottler's product bottles for the amount paid when first purchased. Many unnecessary and unwanted business expenses and inconveniences are now eliminated with the present disclosure. The apparatus includes clear, multilingual signage to assist customers with their purchases unlike the other models of distribution. There is no bookkeeping to speak of as the system is wireless and automated for all parties concerned. The size and shape of the vendor machine is expandable or contractible and will be dependent on the location, and re-fill delivery costs.

There are no building permits or other special permits/license fees required unlike some other types of vending and distribution systems as the vending apparatus is NAMA and U/L pre-approved before placement at their retail location(s). There are hundreds of various models and types of vending machines but almost all of those machines and kiosks that sell "packaged/bottled" water or soft drinks are "small pack" sizes and do not address the larger 3 and 5 gallon size. All other water vending machines are either "unpackaged" bulk water vending machines that require the customer to bring their own "clean, sanitary containers". These machines are heavily regulated on an individual location basis requiring, in many cases, both local and state permits and licenses from boards of health, plumbing, building and wiring inspectors as well as local water quality agencies such as the California Department of Health; the Rhode Island Board of Health; the Massachusetts Department of Environmental Protection (DEP); the New York Department of Health; the Massachusetts Board of Health; the Licensing Board of Certified Operators; just to name a few. The disclosed vending apparatus eliminates these requirements because all necessary permitting issues are already in effect before the product is loaded into the truck to deliver to the vending apparatuses at their retail location(s).

In both of the known self-service vending systems, the "Return Bottle" area is located generally in a customer service area located as one enters the retail store where the "return" is either put in a designated "Return Bottle Area" (loose and unconstrained) or in a "Return Bottle" enclosed compartment that accepts all bottles from all vendors and prints a "refund" slip to be cashed in when purchasing a new filled bottle at a location elsewhere in the store. It is then the customer's chore to push a grocery art with their bottled water which can weigh as little as 25 lbs per 3 gallon bottle or as much as 45 lbs for a 5 gallon bottle and more, depending on the number of bottles purchased, out to their vehicle located some distance from the store exit. The disclosed vending apparatus eliminates these inconveniences and problems as well.

SUMMARY OF THE DISCLOSURE

Unless specified, as used herein, large-volume water bottles shall mean reusable water bottles holding one or more gallons of fluid. In one aspect of the disclosure, a combination vending/return apparatus includes a modular vending segment including preset graded conveyor assemblies for receiving filled water bottles for vending. The conveyor assemblies are positioned adjacent to a vending shelf that presents bottles for retrieval by customers. A locked vending door is situated in a front wall of the vending segment aligned with the vending shelf to allow customer access to the bottles and to prevent unwanted bottle removal. A credit/debit/prepaid card acceptor provides a means for a customer to make purchases and receive credits for returned bottles. A completed electronic purchase transaction unlocks the vending door after which a customer can remove the purchased bottle from the apparatus. A bottle guide rail assembly and locking collars retain bottles on the conveyor assemblies in a controlled manner and allow incremental movement of bottles toward the vending shelf as purchases are made and bottles are removed.

In a return segment of the apparatus, a return chute is formed in a front face of the segment dimensioned to receive specific-sized bottle returns. A series of sensors and readers confirm the bottle type and identification information for processing a return credit to the customer's account. The combination vending segment and return segment provide one-stop complete bottled water paperless transactions other than printed receipts. In another aspect of the disclosure, the system includes access to 24/7 service to accommodate any issues resulting from a purchase/return event.

In another aspect of the disclosure, a conveyor-belt driven vending segment of a vending/return apparatus increases the number of bottles deliverable within a single apparatus. The conveyor belt assemblies can be provided in multiple rows, each of which includes a central geared bottom track in communication with a geared motor drive controlled by a central processor. The credit/debit/prepaid card acceptor sends signals to the central processor that further sends signals to the conveyor motor(s) to advance the conveyor to deliver a water bottle to a customer retrieval location. The location includes a sliding and lockable vending door for access to the purchased bottles. A shelf can be further included to enhance the convenience of purchasing multiple bottles.

In yet another aspect of the disclosure, a vending/return apparatus with a vending elevator system further increases the number of bottles deliverable from a single apparatus. Air operated, and/or electric actuators are provided to move a vending elevator along a minimum of a single horizontal axis per row, or at least two axes to received bottles positioned on multiple row and column conveyor assemblies.

In a further aspect of the disclosure, a front load and vend apparatus uses gravity fed conveyors to deliver purchased bottles to customers. The apparatus further allows vendors to retrieve returned emptied bottles from the front end from a conveyor superposed about the delivery conveyors.

In a still further aspect of the disclosure, a vending/return transaction system provides a means for conducting a paperless transaction to purchase and return bottled water and empty bottles, respectively. These and other aspects and objects of the disclosure will become apparent from a review of the appended drawings and the detailed description below.

BRIEF DESCRIPTION OF THE DRAWINGS

FIG. 90A1 is a system flow chart for retrieving and returning water bottles, and conducting a paperless transaction for the purchasing and crediting sales/return transactions according to the embodiment of the disclosure shown in FIG. 36.

FIG. 90B1 is a continuation of the system flow chart shown in FIG. 90A1.

FIG. 90C1 is a continuation of the system flow chart shown in FIGS. 90A1 and 90B1.

FIG. 91B is a continuation of the flow chart shown in FIG. 91A.

FIG. 91C is a continuation of the flow chart shown in FIGS. 91A and 918.

FIG. 111 is a side elevational view of vend door 726 shown in FIG. 110.

FIG. 112 is a front perspective view of vertical guide 718 according to one embodiment of the disclosure.

FIG. 113 is a front elevational view in partial phantom of vertical guide 718 shown in FIG. 112.

FIG. 114 is a side elevational view in partial phantom of vertical guide 718 shown in FIG. 112.

FIG. 115 is a side elevational view of ejector rod 782 according to one embodiment of the disclosure.

FIG. 116 is a side elevational view in partial phantom of ejector rod 782 shown in FIG. 115.

FIG. 117 is a front elevational view of access door 810 according to one embodiment of the disclosure.

FIG. 118 is a top view of access door 810 shown in FIG. 117.

FIG. 119 is a vertical bottle alignment guide according to one embodiment of the disclosure.

FIG. 120 is a perspective view of cradle 624 with a modified perforated body according to another embodiment of the disclosure.

FIG. 121 is a top view of cradle 624 shown in FIG. 120.

FIG. 122 is a side view of cradle 624 shown in FIG. 120.

Figure 123:
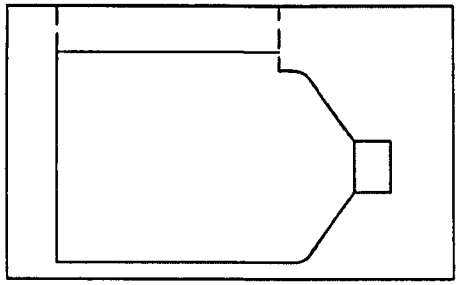

FIG. 123 is a top view of a horizontal bottle alignment guide according to one embodiment of the disclosure.

Figure 124:
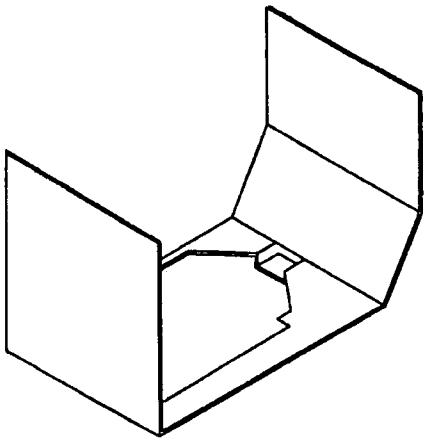

FIG. 124 is a top perspective view of the horizontal alignment guide shown in FIG. 123.

Figure 125:
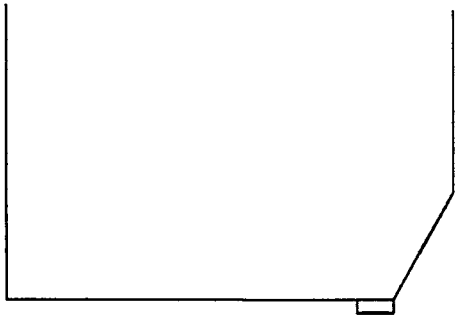

FIG. 125 is a side elevational view of the horizontal alignment guide shown in FIG. 123.

Figure 126:
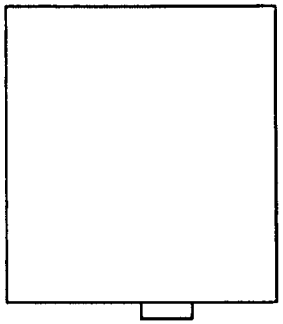

FIG. 126 is a front elevational view of the horizontal alignment guide shown in FIG. 123.

Figure 127:
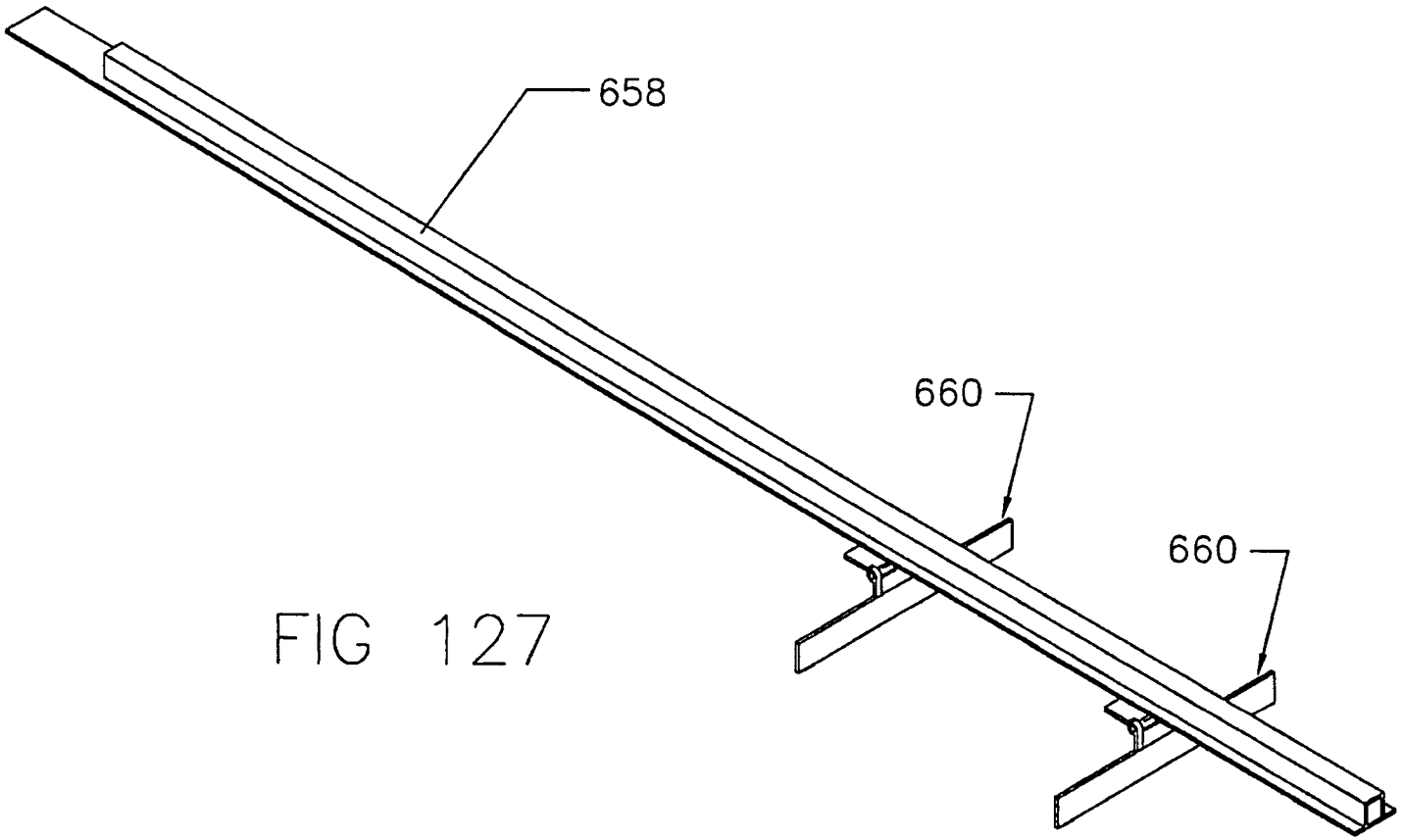

FIG. 127 is a top perspective view of a beam and inertia restrictor assembly for a first track assembly according to one embodiment of the disclosure.

Figure 128:
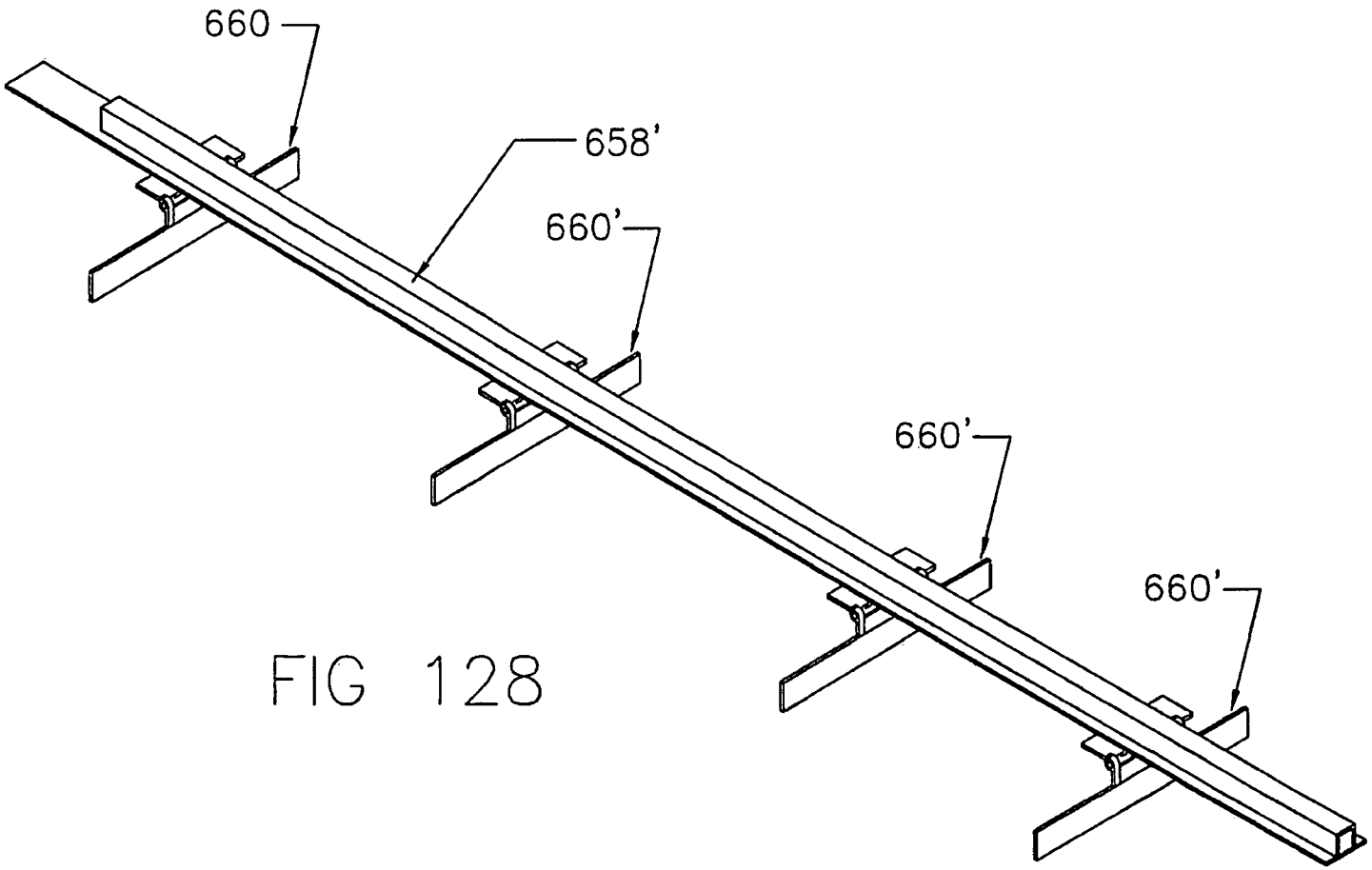

FIG. 128 is a top perspective view of a beam and inertial restrictor assembly for a second track assembly according to one embodiment of the disclosure.

Figure 129:
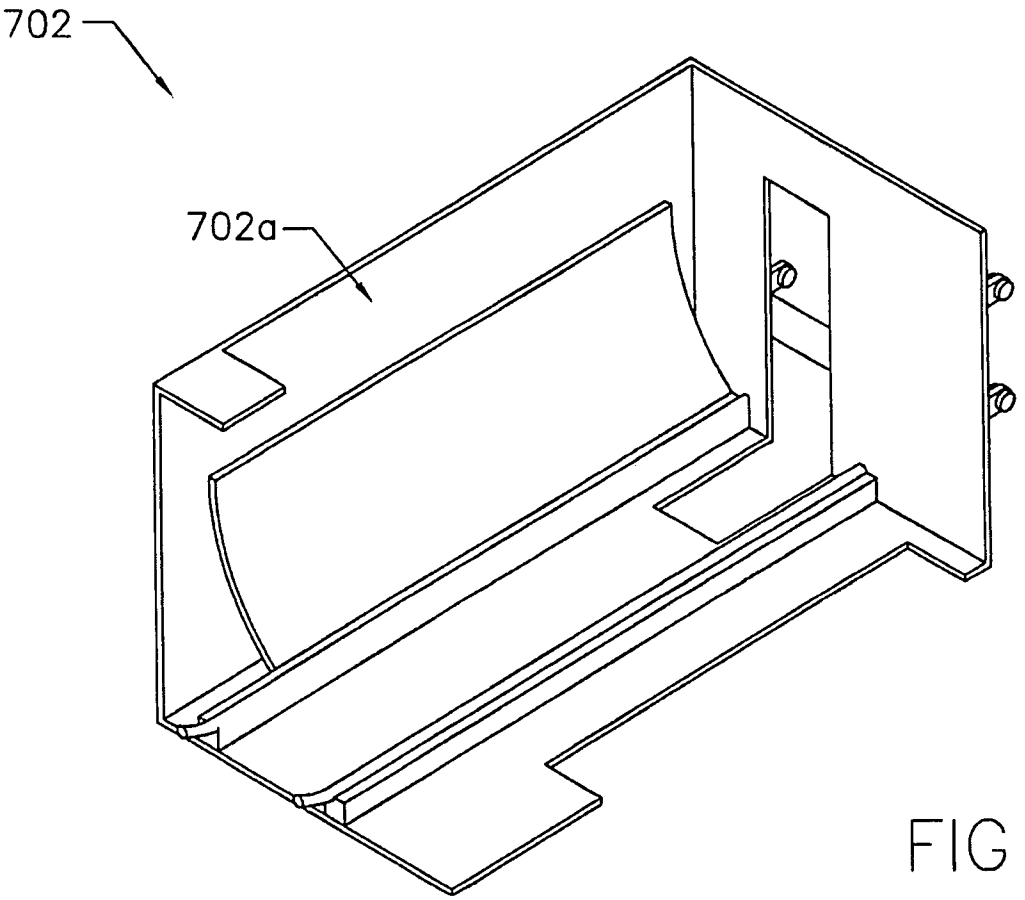

FIG. 129 is a top front perspective view of a modified elevator assembly 702 with a partial cylindrical position guide 702*a* according to another embodiment of the disclosure.

Figure 130:
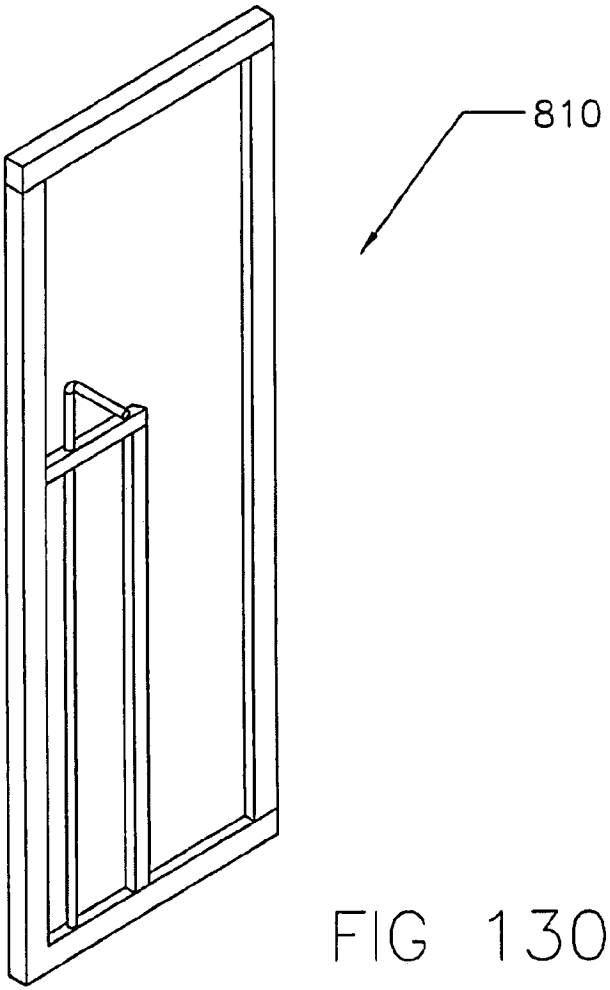

FIG. 130 is a top back perspective view of access door 810 with lock assembly according to one embodiment of the disclosure.

Figure 131:
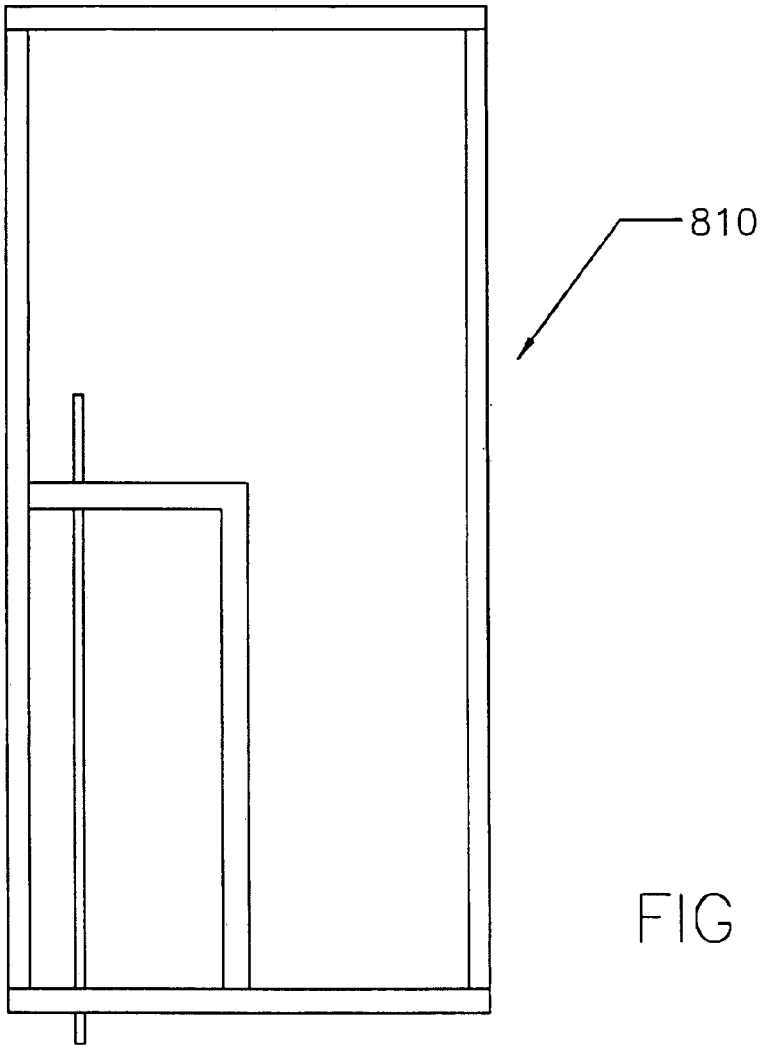

FIG. 131 is a back elevational view of access door 810 with lock assembly shown in FIG. 130.

Figure 132:
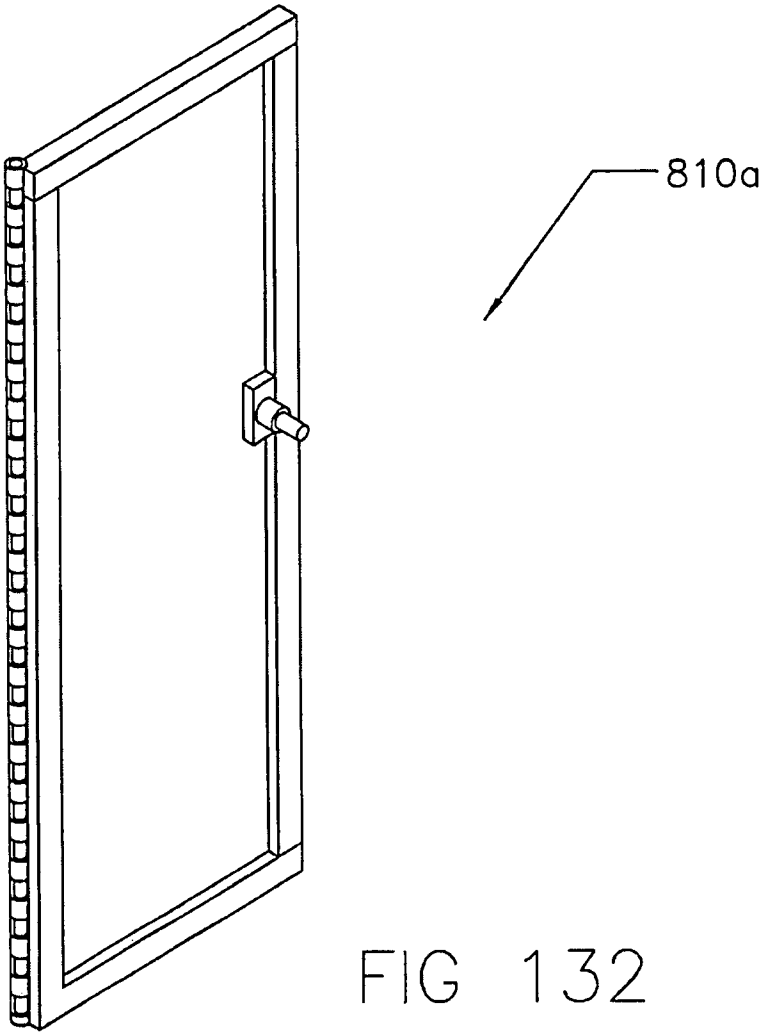

FIG. 132 is a back perspective view of access door 810*a* without lock assembly according to one embodiment of the disclosure.

Figure 133:
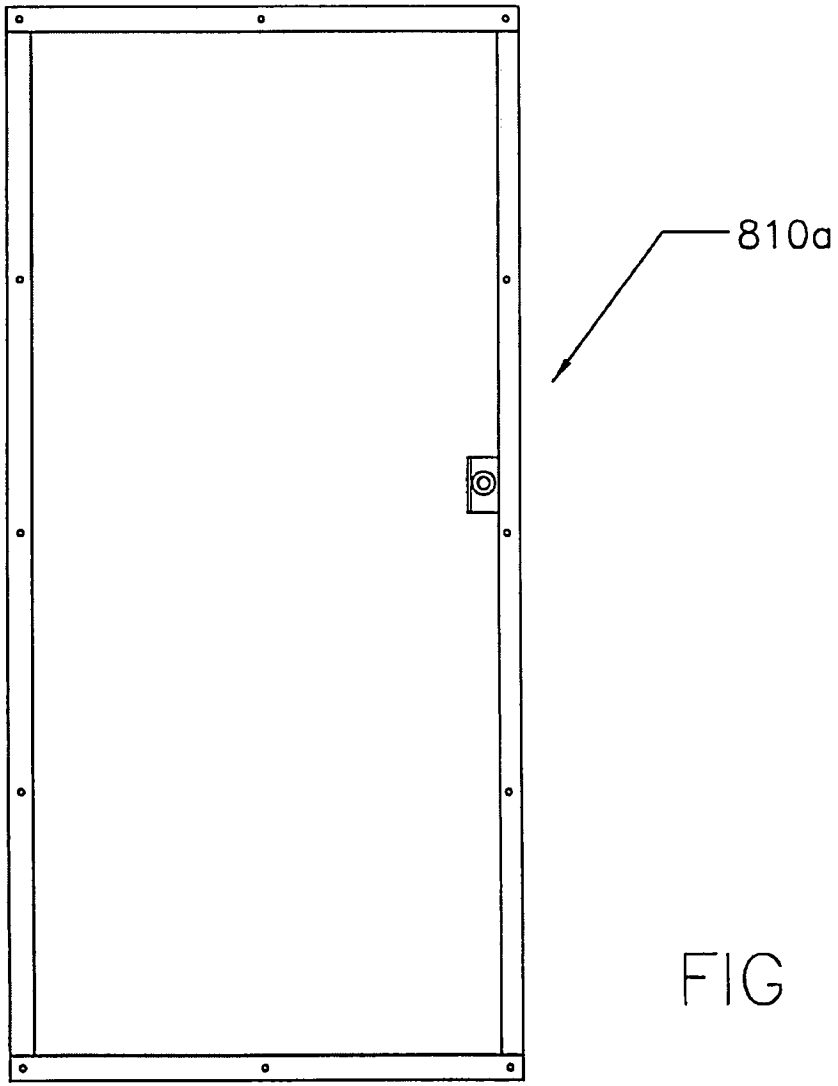

FIG. 133 is a back elevational view of access door 810*a* show in FIG. 132.

FIG. 134 is a top view of a segmented LED light strip according to one embodiment of the disclosure.

FIG. 135 is a side partial phantom view of the LED light strip shown in FIG. 134.

FIG. 136 is a side sectional view of the LED light strip shown in FIG. 134.

Figure 137:
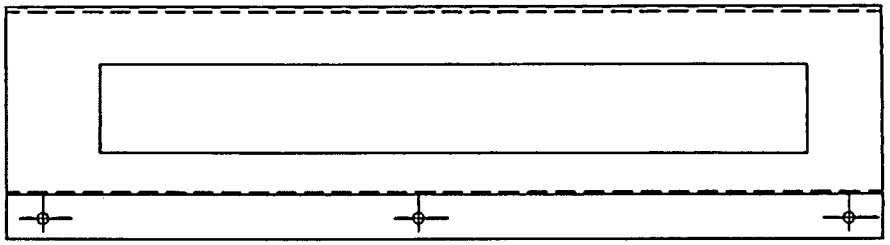

FIG. 137 is a top view of a continuous LED light strip according to another embodiment of the disclosure.

Figure 138:
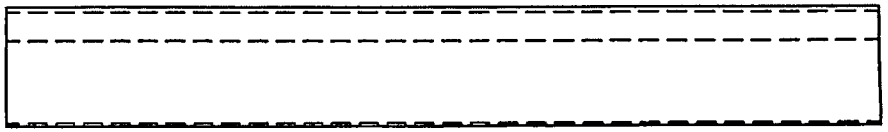

FIG. 138 is a side partial phantom view of the LED light strip shown in FIG. 137.

Figure 139:
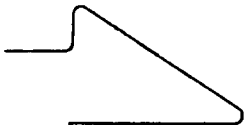

FIG. 139 is a side sectional view of the LED light strip shown in FIG. 137.

Figure 140:
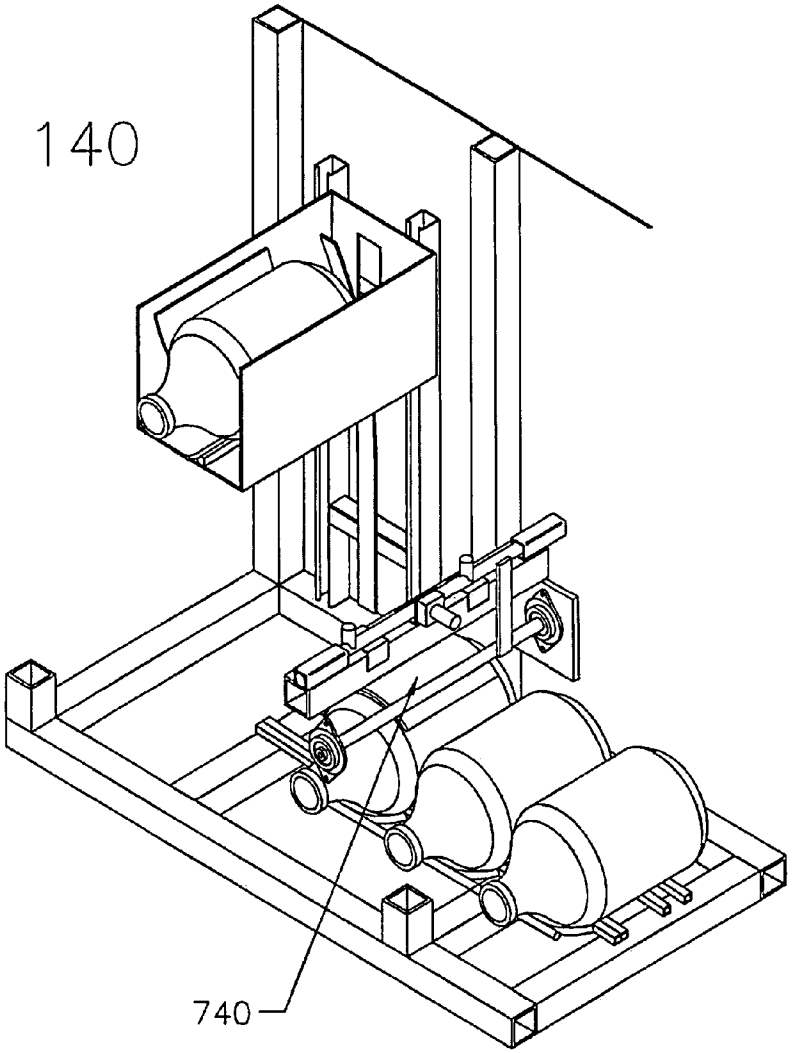

FIG. 140 is a solid model back perspective view of a lock rod and gate assembly 740 according to one embodiment of the disclosure.

Figure 141:
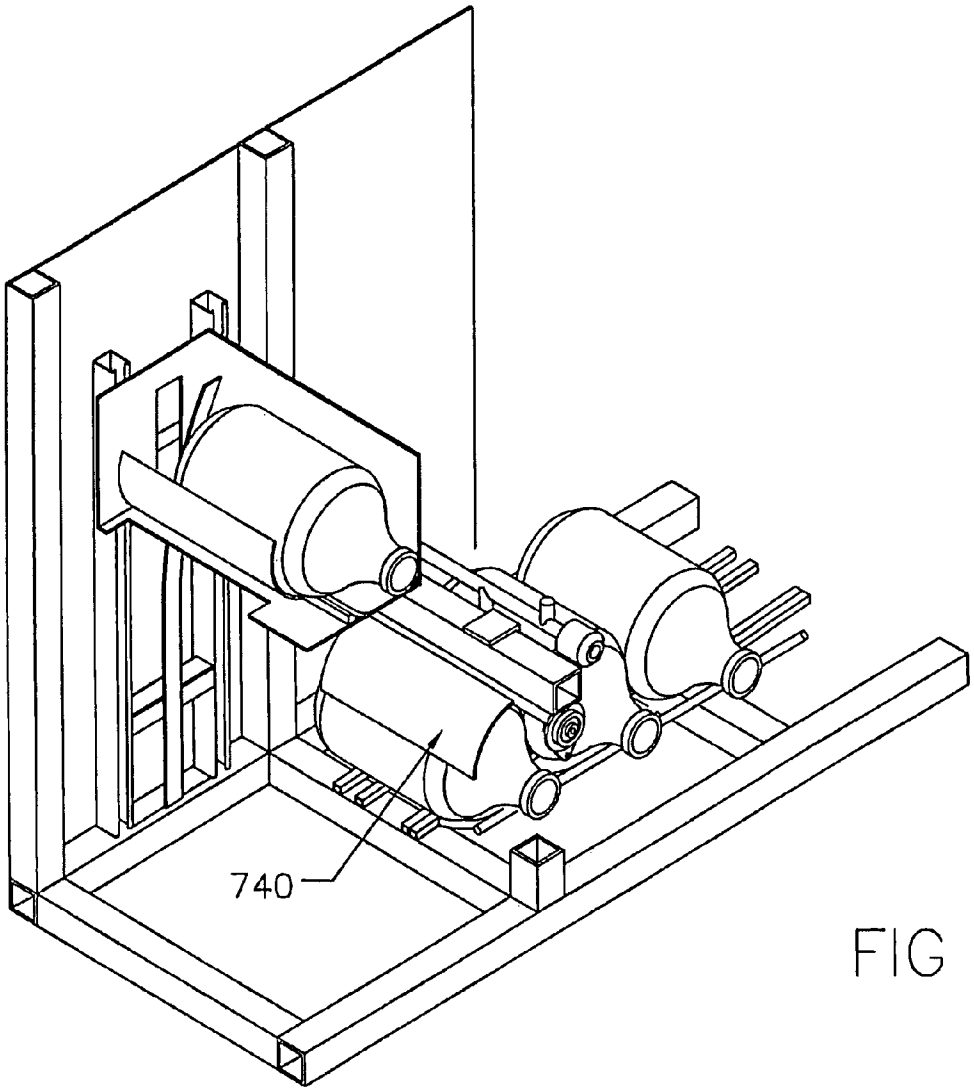

FIG. 141 is a solid model front perspective view of the lock rod and gate assembly 740 shown in FIG. 140.

Figure 142:
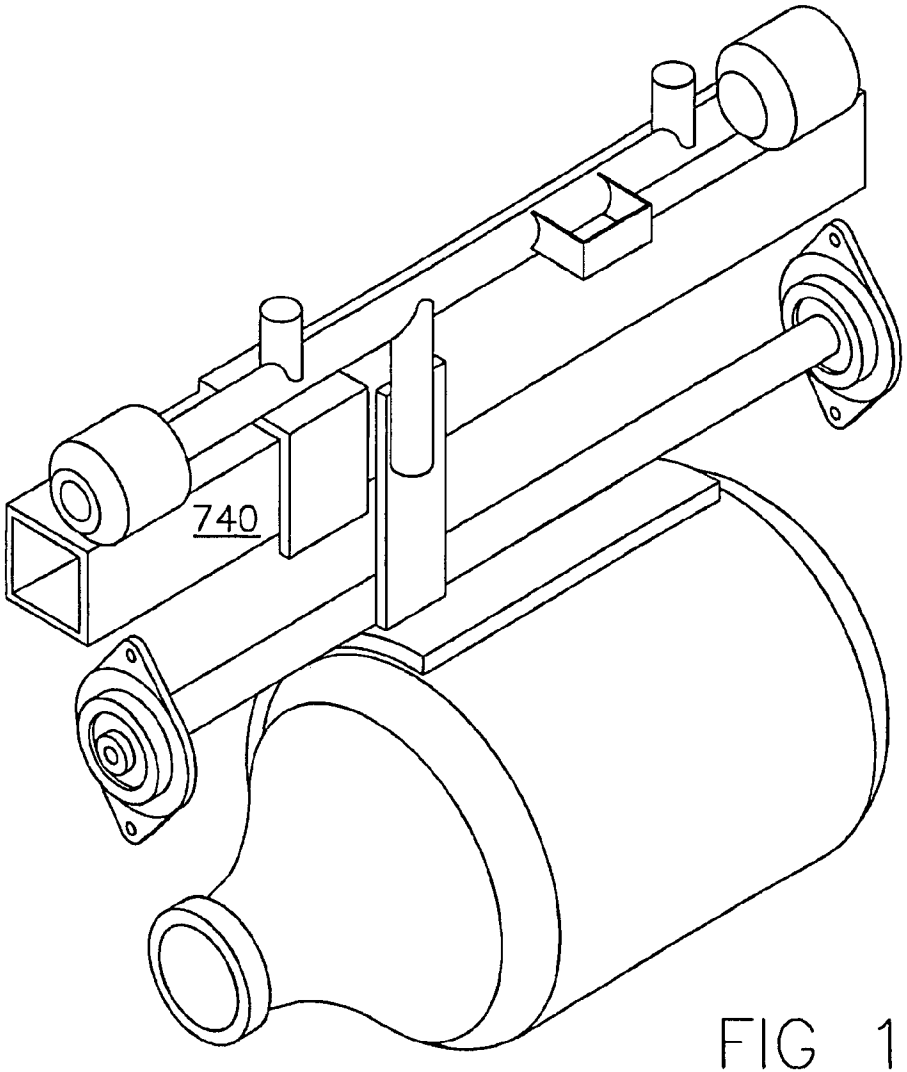

FIG. 142 is a photograph of a back top perspective view of the lock rod and gate assembly 740 shown in FIG. 140.

Figure 143:
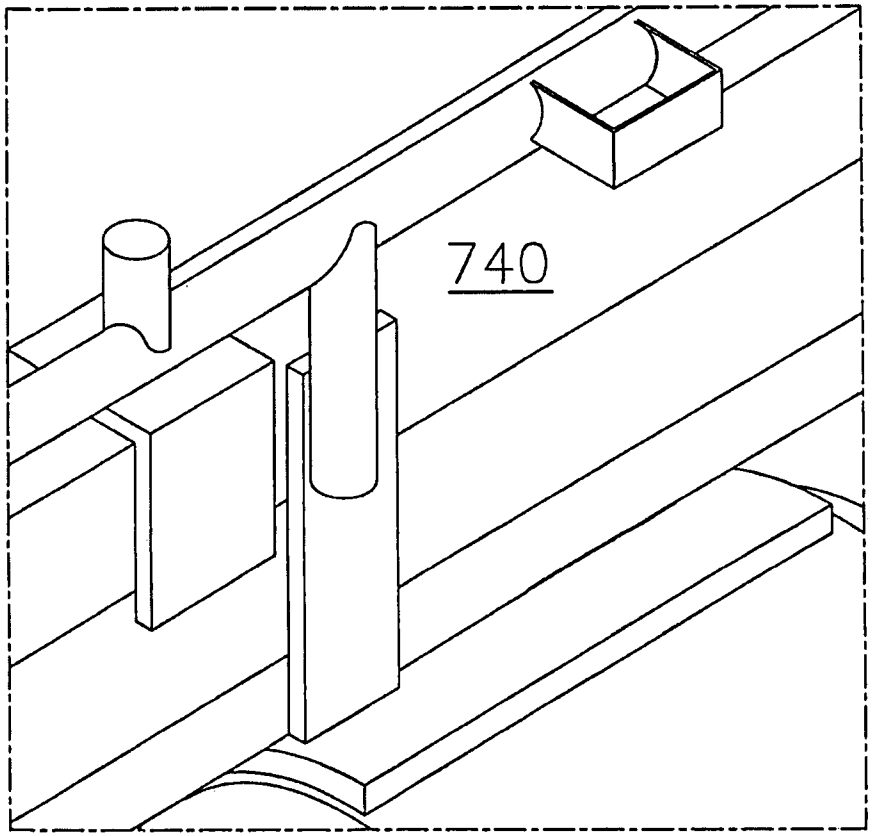

FIG. 143 is a close-up view photograph of the lock rod engagement to the gate assembly shown in FIG. 140.

Figure 144:
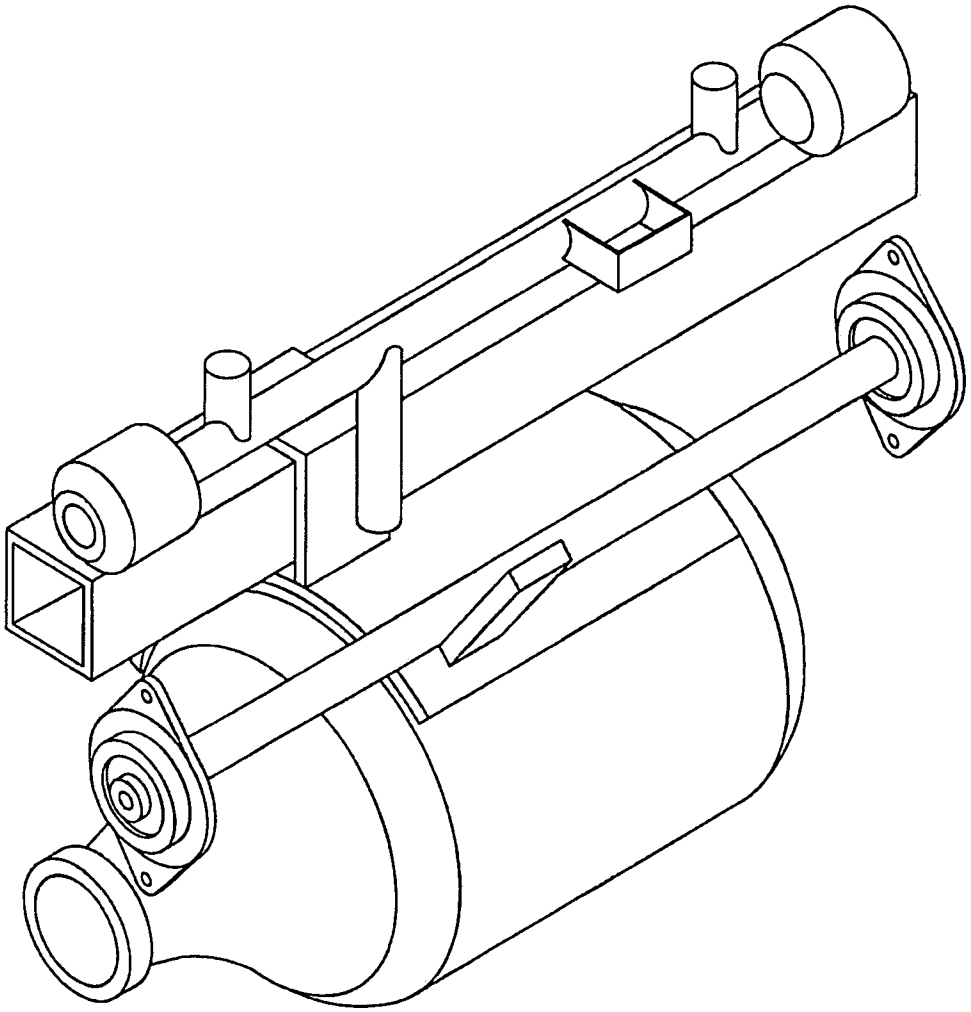

FIG. 144 is a close-up view photograph of the lock rod disengaged from the gate assembly shown in FIG. 140.

Figure 145:
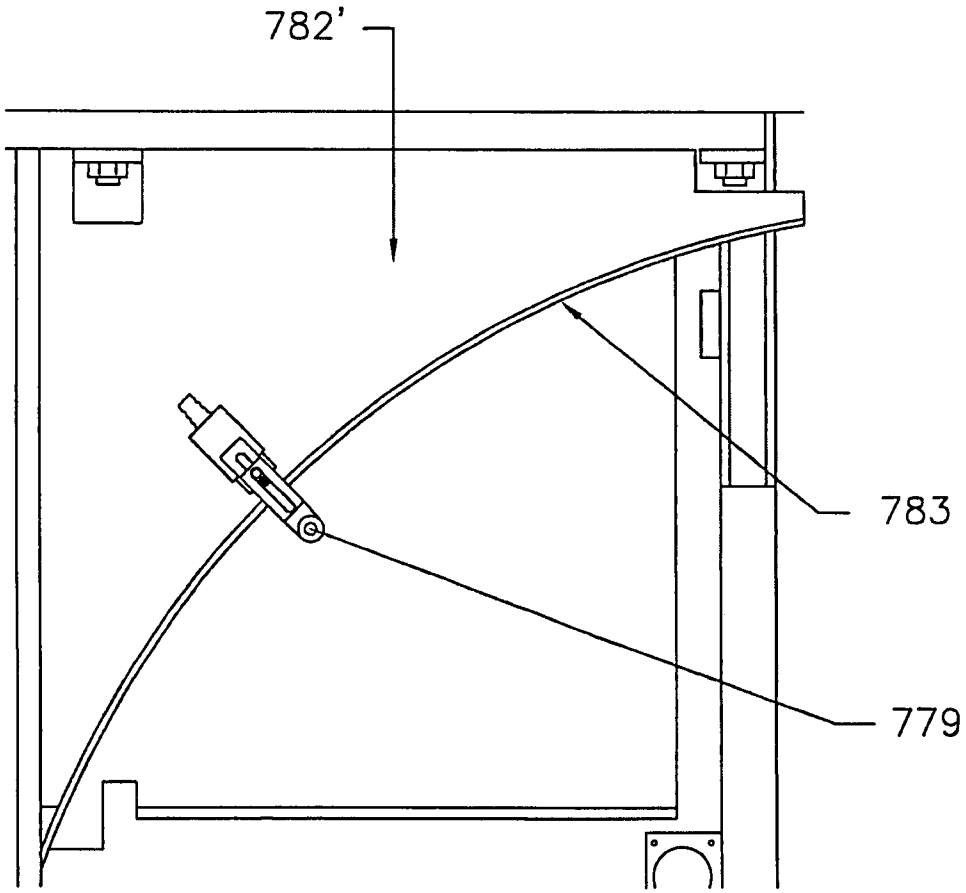

FIG. 145 is a side elevational view of an ejector plate assembly according to another embodiment of the disclosure.

Figure 146:
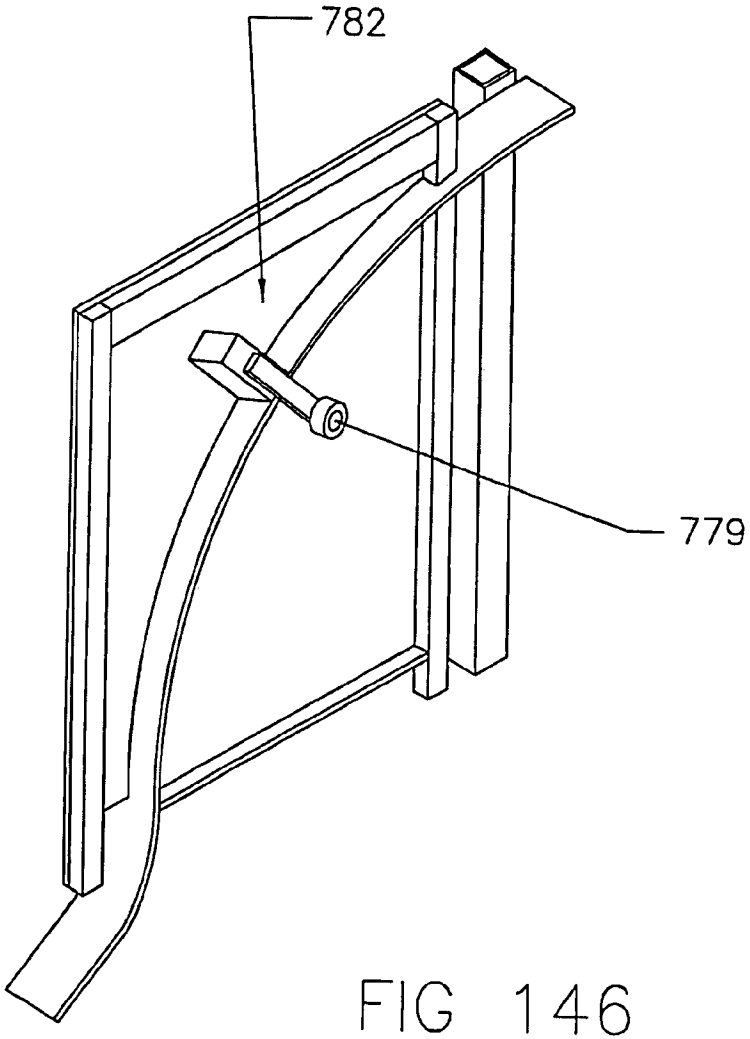

FIG. 146 is a side perspective view of the ejector plate assembly shown in FIG. 145.

Figure 147:
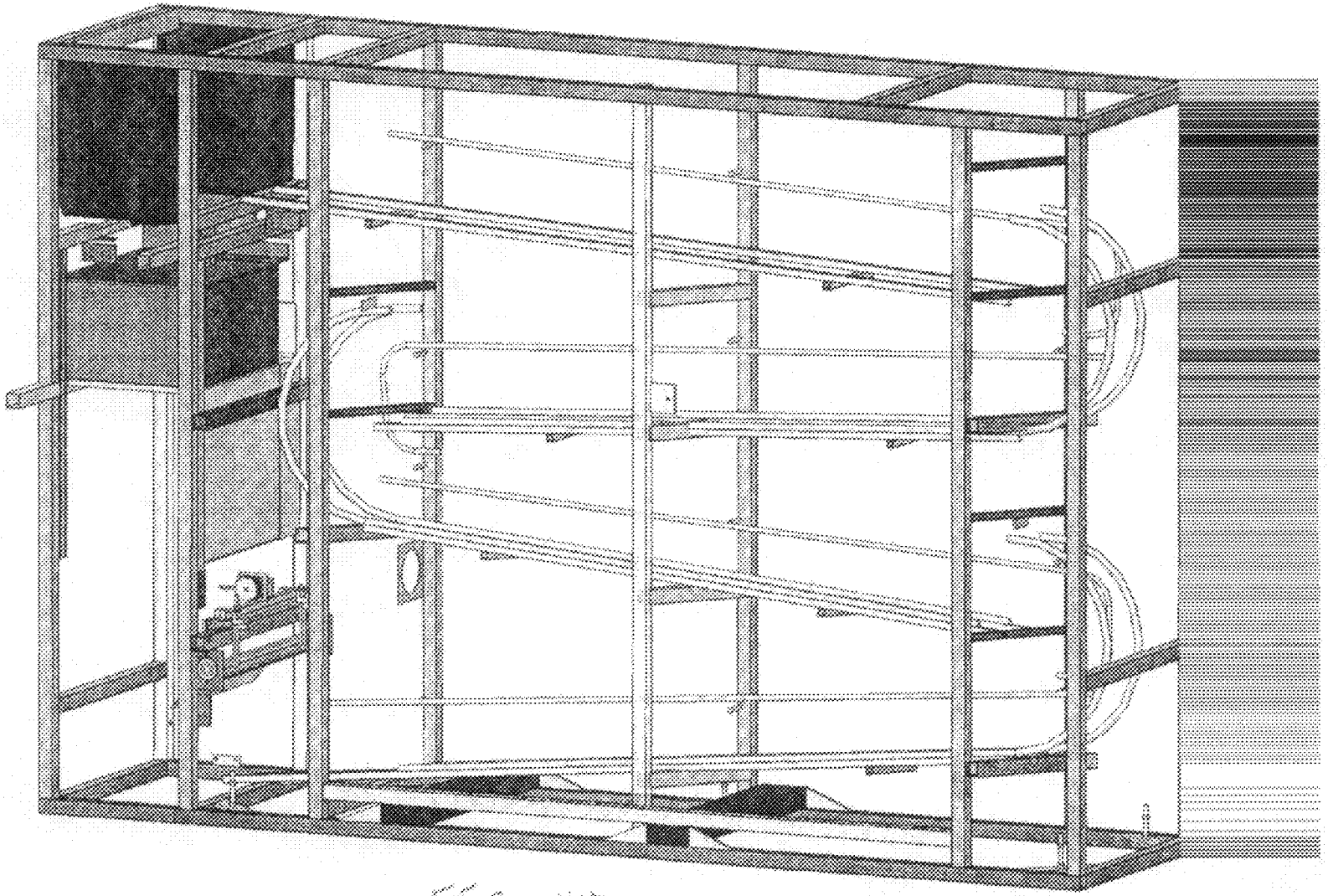
Figure 14P:
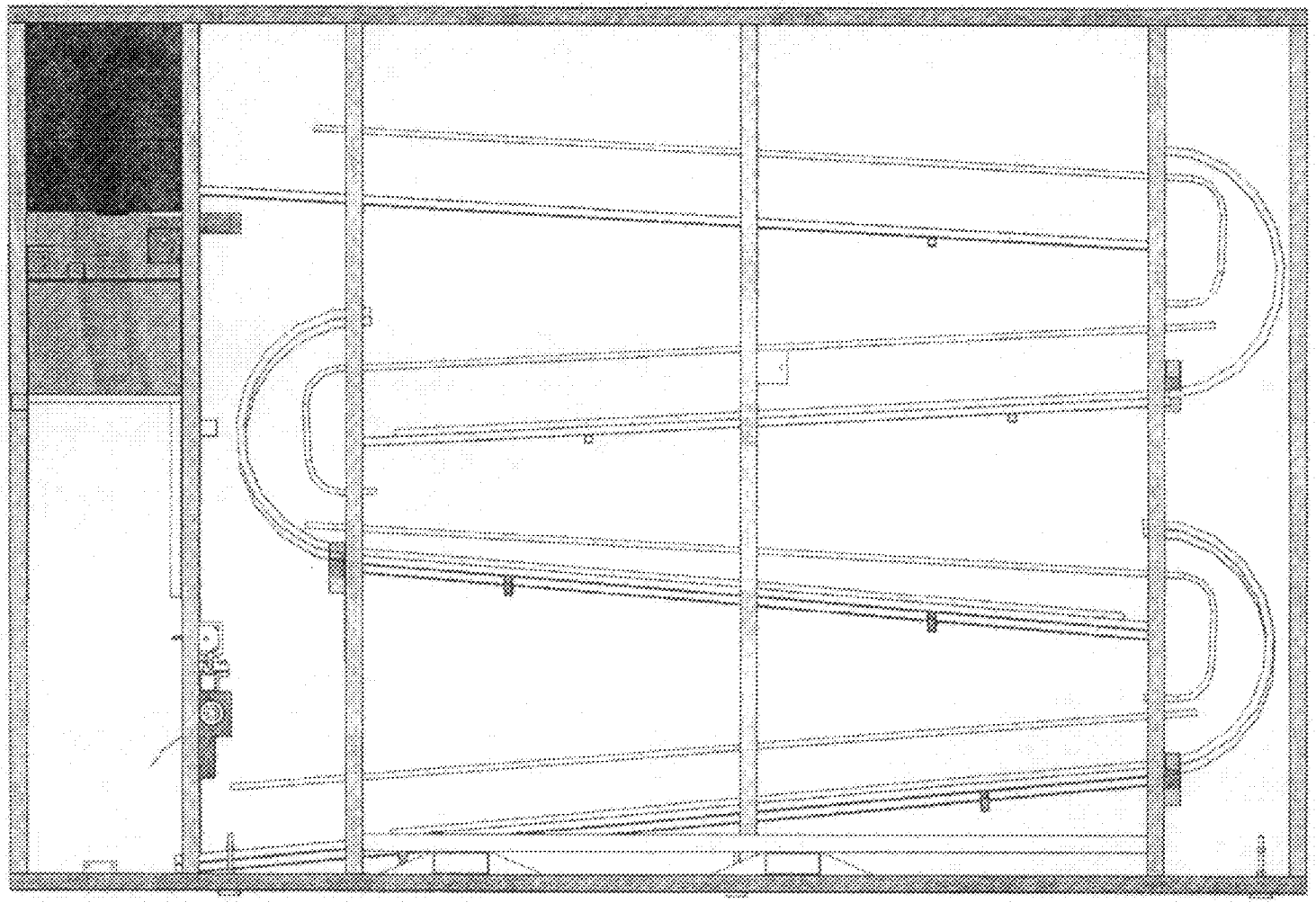
Figure 144:
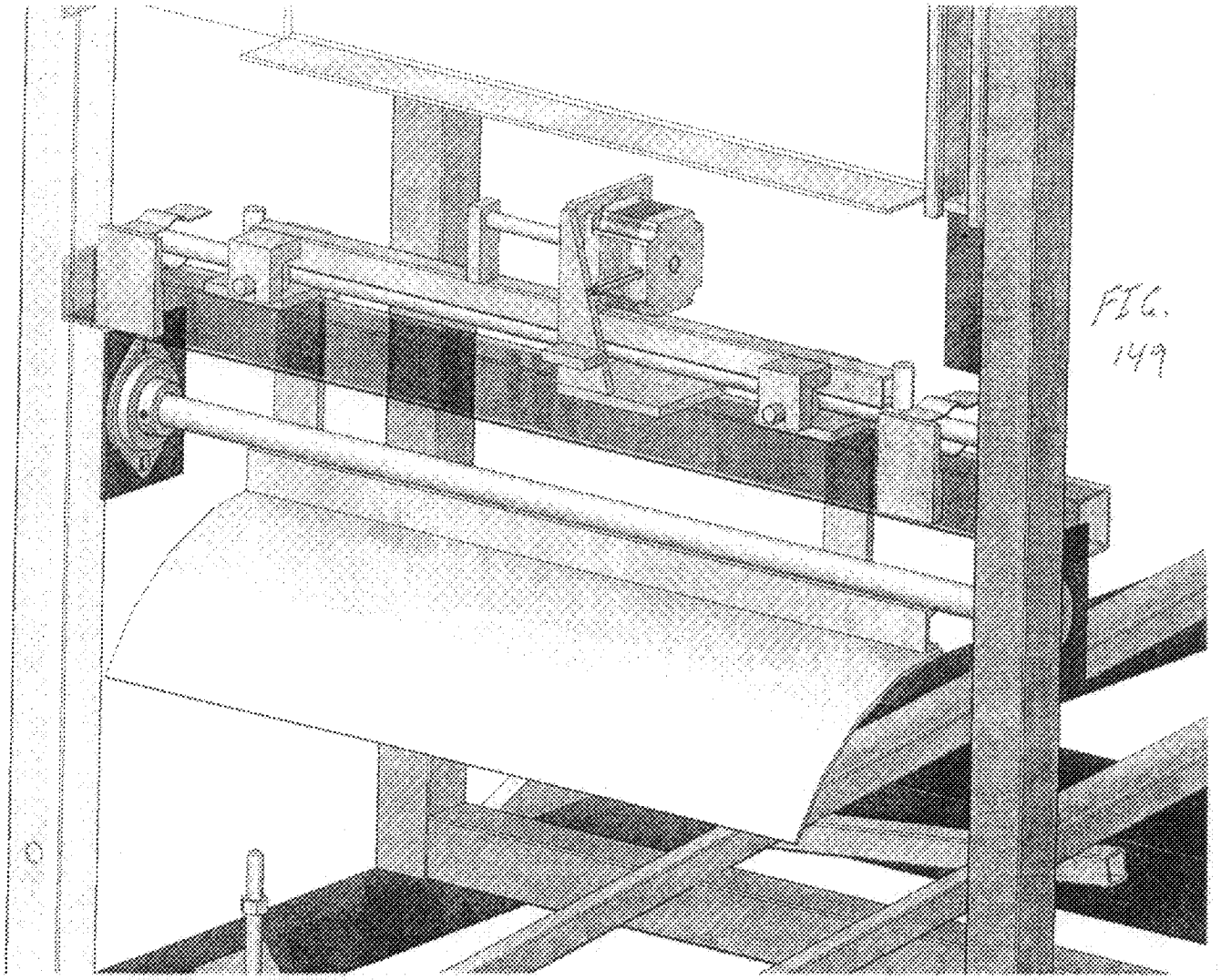

FIG. 147 is a front perspective view of a combination vend/return bottle apparatus according to a further embodiment of the disclosure.

FIG. 148 is a side elevational view of the vend/return bottle apparatus shown in FIG. 147.

FIG. 149 is a top front perspective view of a gate assembly according to a further embodiment of the disclosure.

Figure 150:
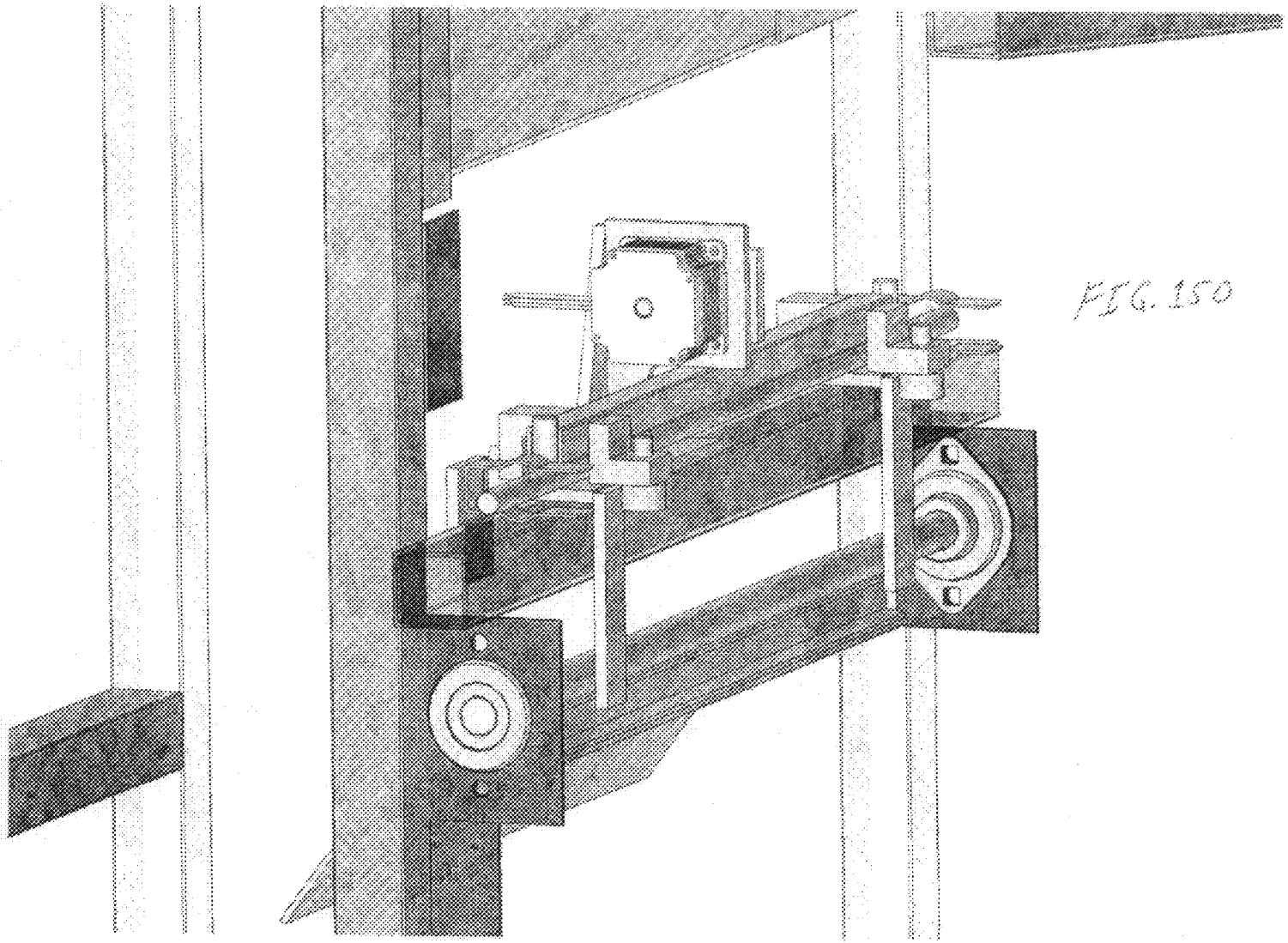

FIG. 150 is a top back perspective view of the gate assembly shown in FIG. 149.

Figure 151:
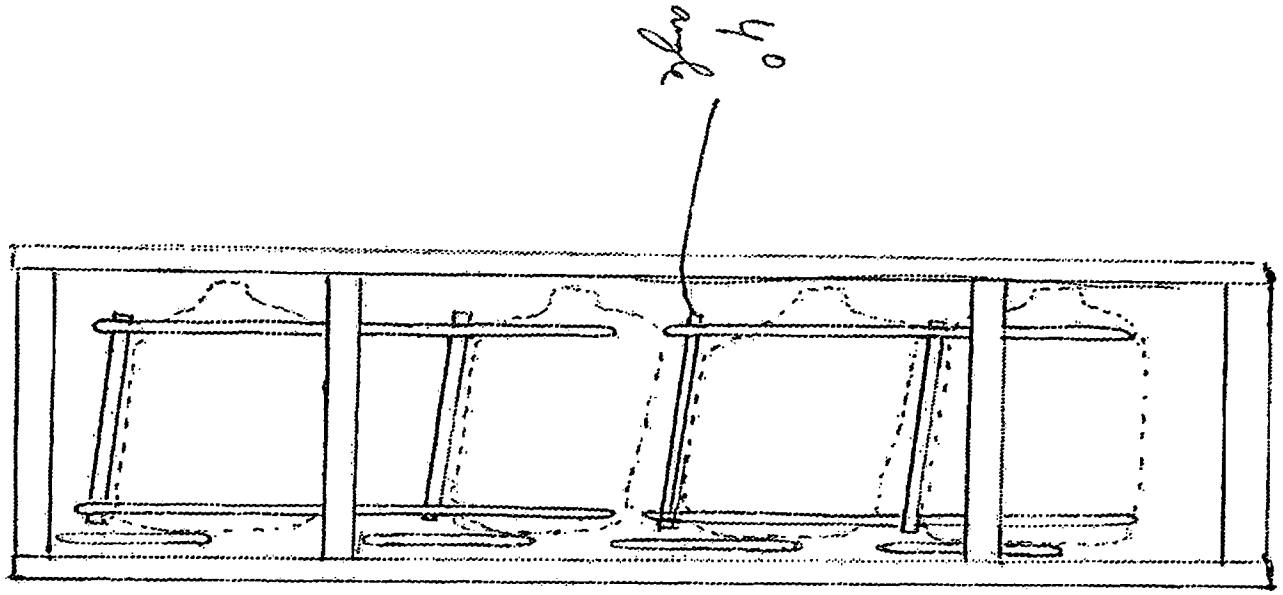

FIG. 151 is a side elevational view in partial phantom of a vend/return bottle apparatus according to a yet further embodiment of the disclosure.

Figure 152:
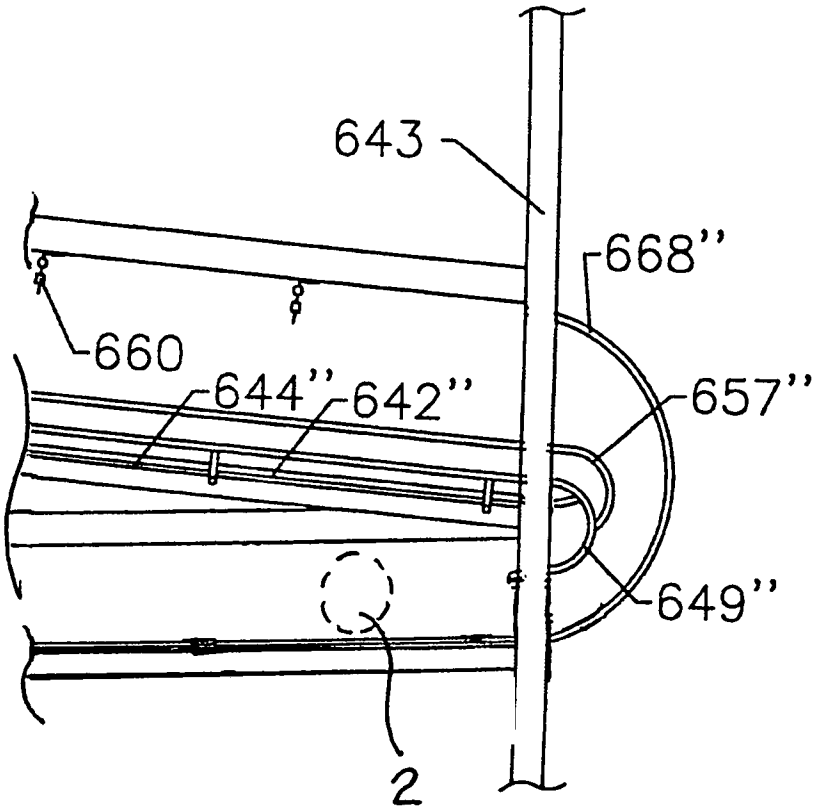

FIG. 152 is a front sectional view of a track assembly including transitional guide rails according to the embodiment of the disclosure shown in FIG. 151.

Figure 153:
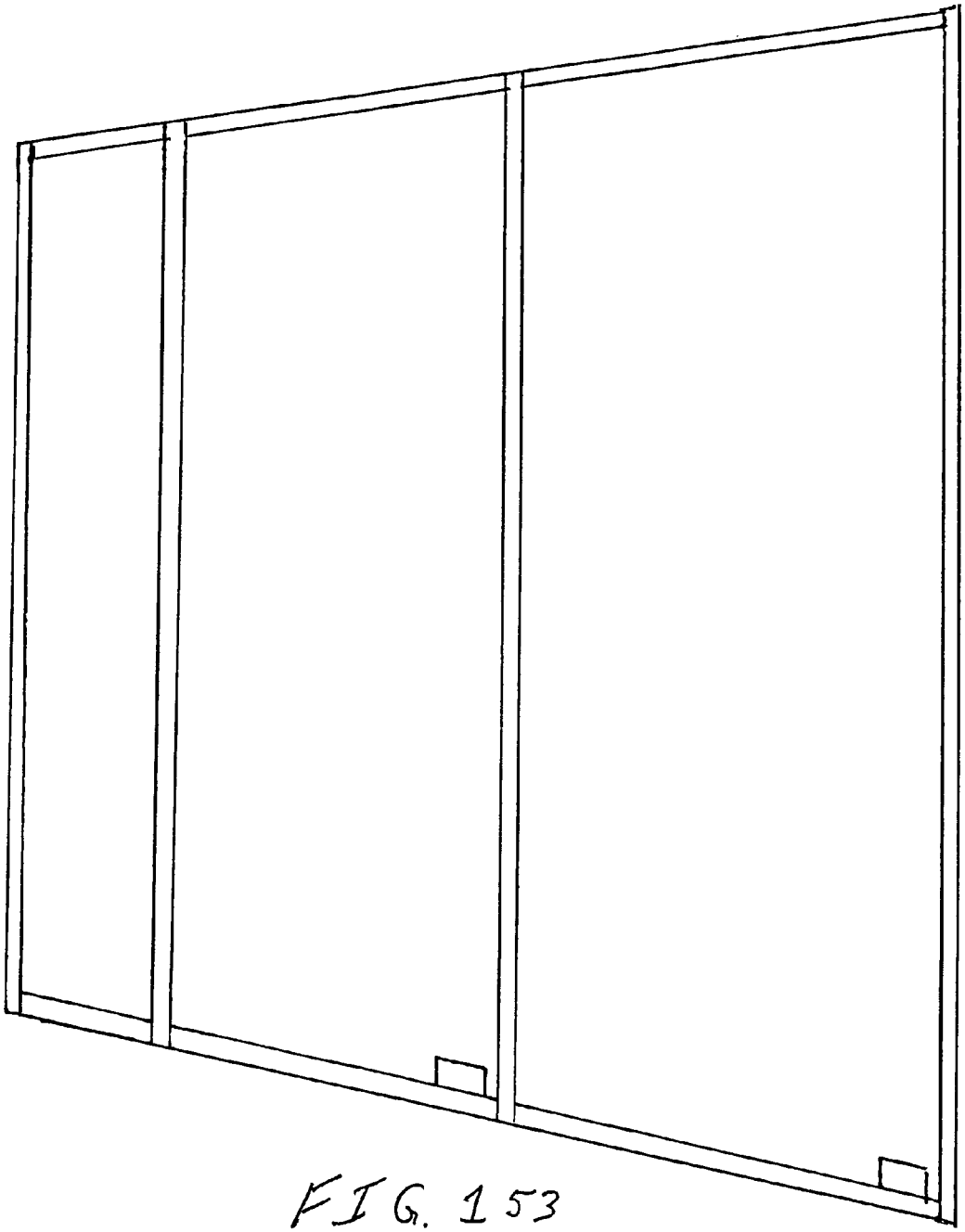

FIG. 153 is a back right perspective view of the vend/return apparatus shown in FIG. 159.

Figure 154:
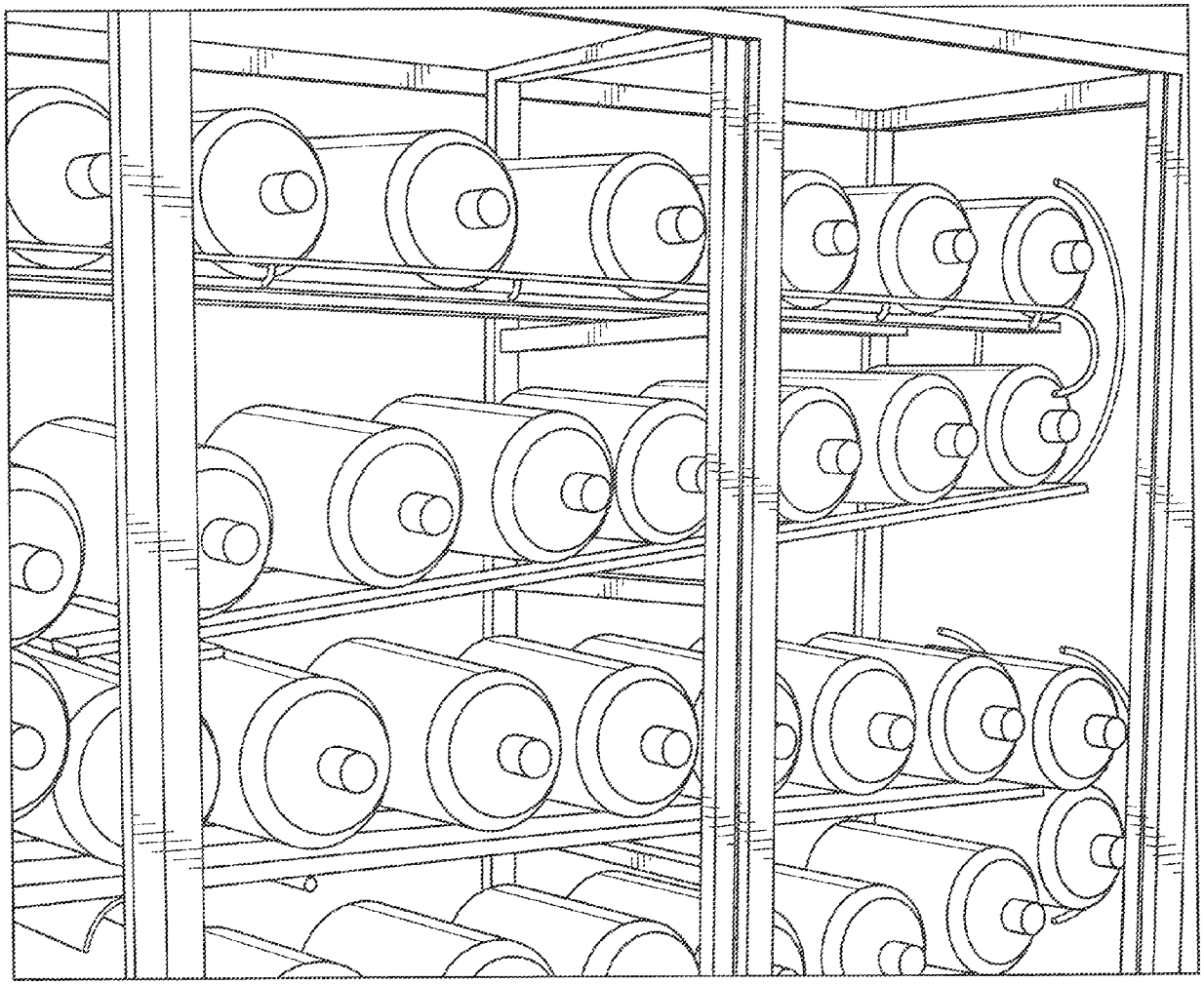

FIG. 154 is a front perspective view of the vend/return apparatus shown in FIG. 151.

Figure 155:
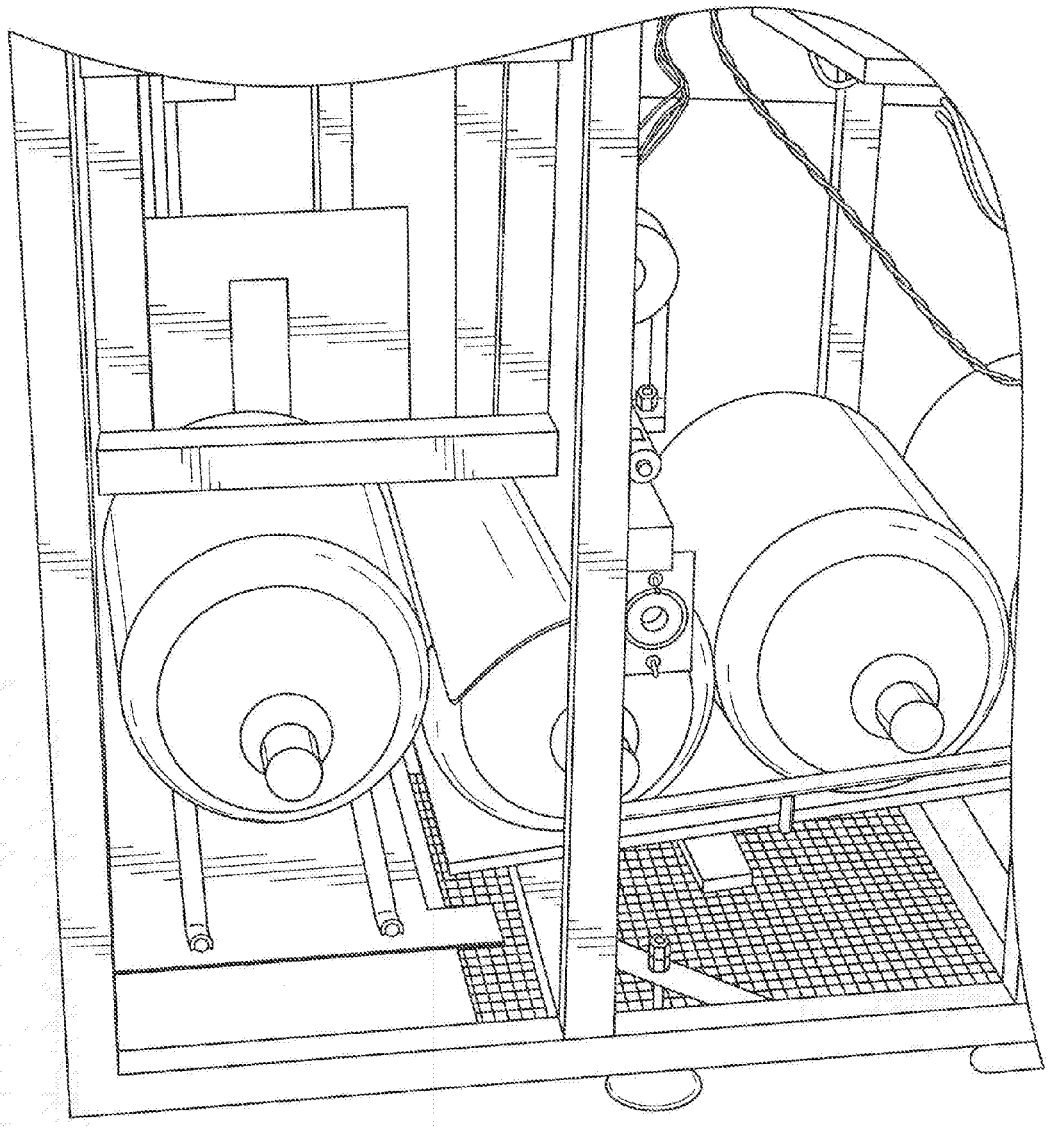

FIG. 155 is a second front perspective view of the gate assembly and elevator assembly with a full bottle loaded on the elevator according to the embodiment of the disclosure shown in FIG. 151.

Figure 156:
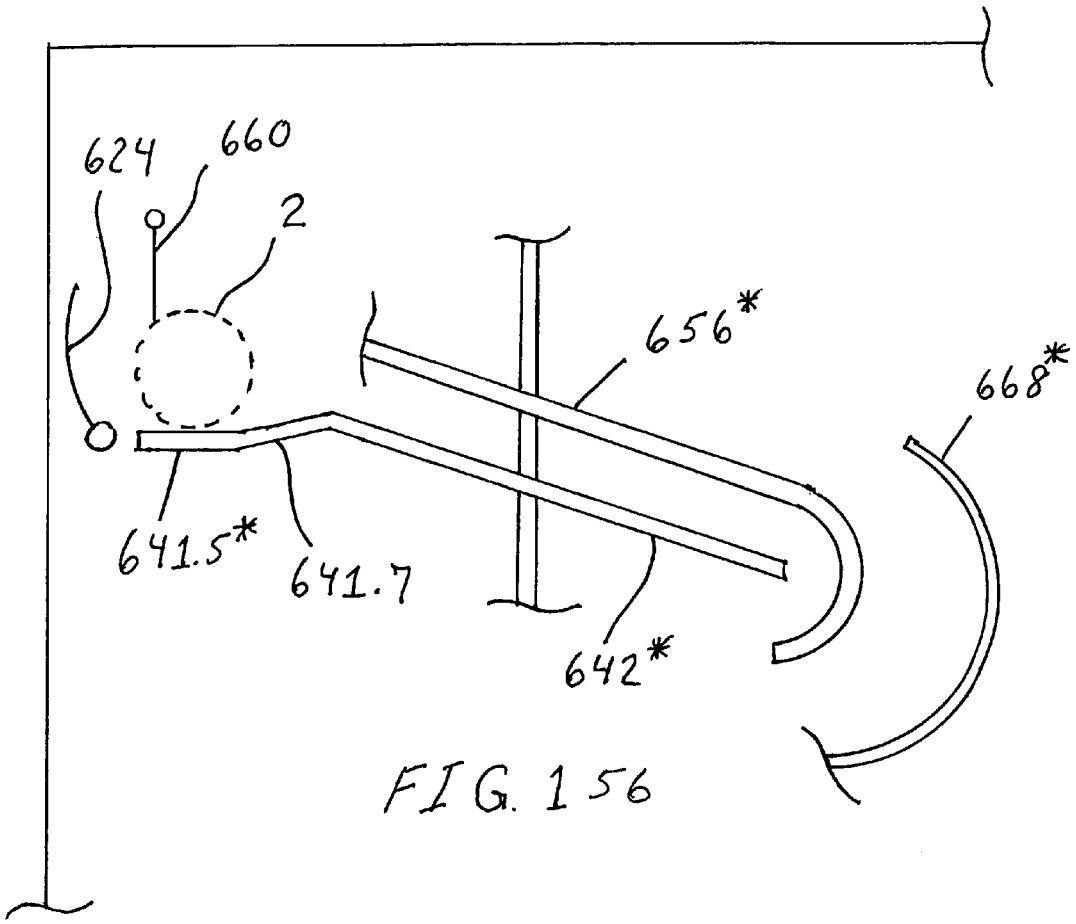

FIG. 156 is a side view of a first segment of the first track assembly having a start shelf of the vend/return apparatus according to the embodiment of the disclosure shown in FIG. 151.

DETAILED DESCRIPTION OF THE DISCLOSURE

Figure 1:
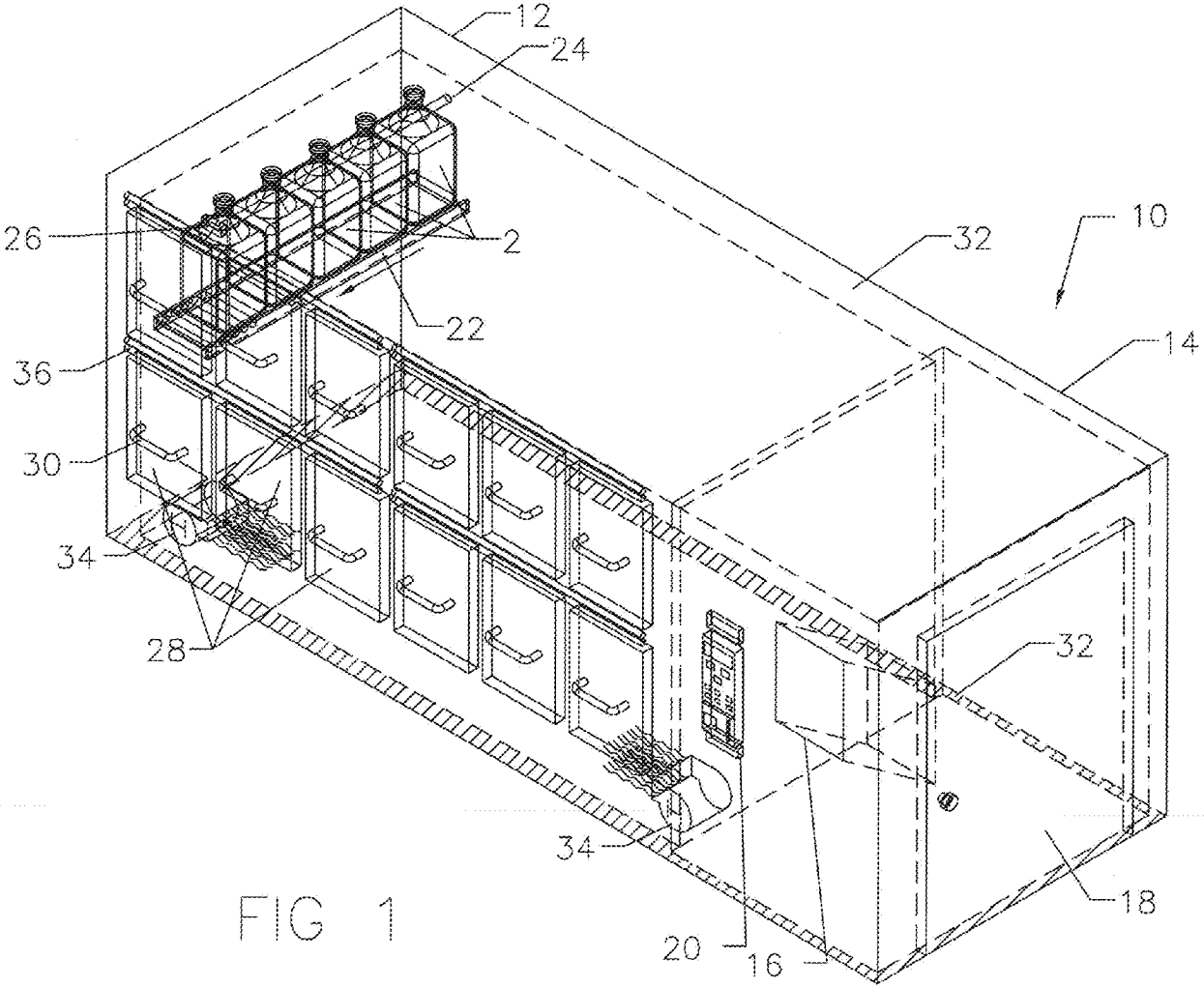
FIG. 1 is a plan view of a vending/return apparatus according to one embodiment of the disclosure.
Figure 2:
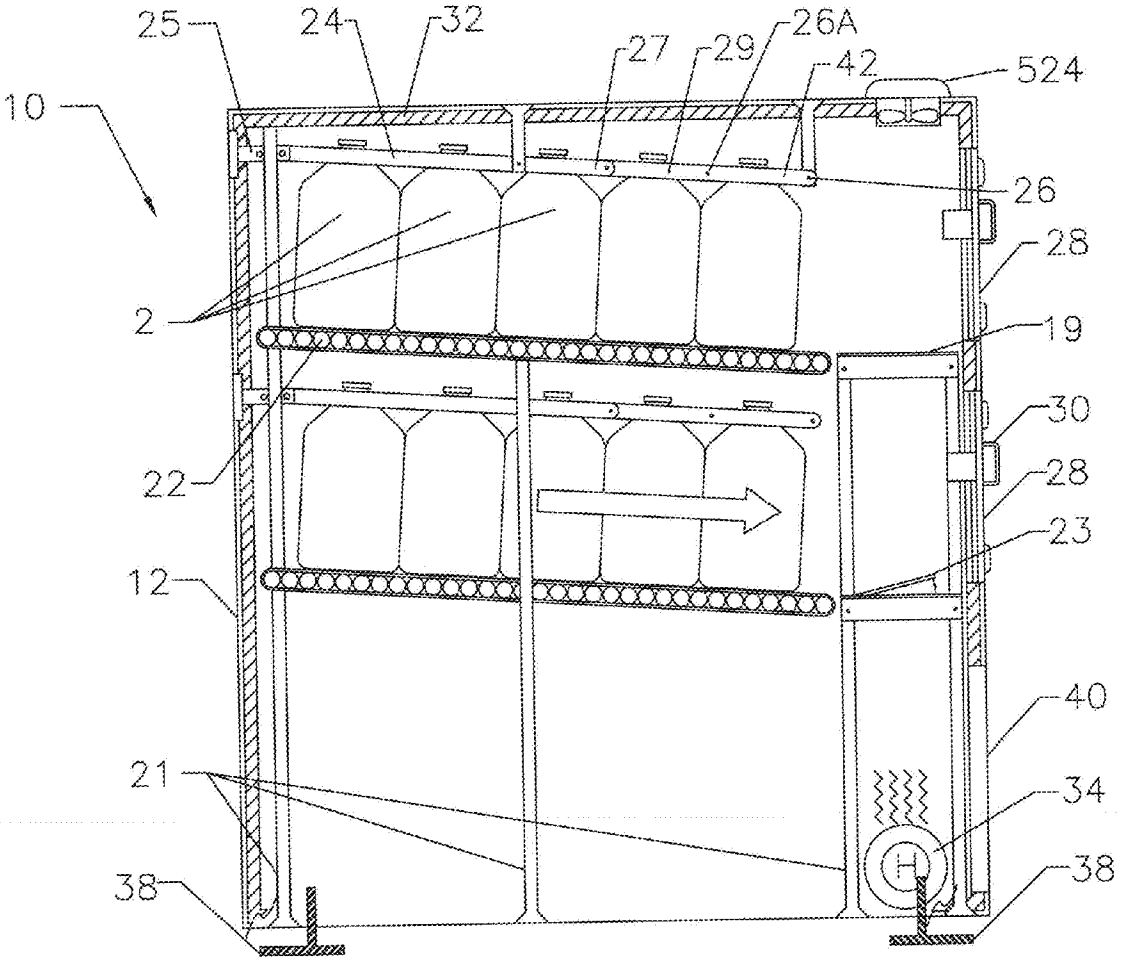
FIG. 2 is a side elevational view of the vending/return apparatus shown in FIG. 1.

In one aspect of the disclosure as shown in FIGS. 1 and 2, a combination vending/return apparatus 10 includes a bottle vending segment 12 and bottle return segment 14. Return segment 14 includes a return chute 16 for receiving empty bottles. A sensor (not shown in FIG. 1) is situated inside the chute face to sense the delivery of an emptied bottle to commence a credit transaction described hereinbelow. Emptied bottles slide down chute 16 and become deposited in return segment 14. A return door 18 allows access to the return segment space to retrieve emptied bottles for further processing, refilling, etc. A credit/debit/pre-paid water card acceptor 20 provides an electronic interface between apparatus 10 and a customer to process vending/return transactions. The details of acceptor 20 are described further herein.

Vending segment 12 includes a series of gravity-feed, roller-type conveyor assemblies 22 that permit loading and unloading of bottled water. Assemblies 22 are graded to urge bottles towards the front of segment 12 as shown in FIG. 2. Assemblies 22 are dimensioned to handle specific sizes of bottles. The dimensions are modified as needed to accommodate a wide range of bottle shapes and sizes including, but not limited to, rectangular and cylindrical. Positioned between a front edge of assemblies 12 and the front wall of segment 12 is vending shelf 19 configured to be substantially horizontal and substantially orthogonal relative to the front wall. A flapper switch 23 is positioned to extend upwardly from shelf 19 so as to be depressed and triggered by the presence of a water bottle on shelf 19. Both the conveyor assemblies 22 and vending shelves 19 are secured to and supported by an apparatus frame structure including framing members 21.

To ensure the surfaces of, and orientation of, apparatus 10 are plumb, square and level, threaded leveling pads 38 are positioned at the corners and alternatively at other selected areas of the bottom of apparatus 10. Each pad 38 is torqued to ensure proper and even weight displacement of apparatus 10.

Bottles 2 are loaded into apparatus 10 from the front of the apparatus by opening vending doors 28 (described more fully below) aligned with each vending row, and by disengaging a locking collar 26 (also described more fully below), and pivoting in an upward direction a bottle guide rail assembly 24 from a pivot hinge 25. In an alternative embodiment, the entire front panel of segment 12 can be configured as a door to allow access to all vending rows with a single door. Bottles 2 introduced into a row are urged back by each successive bottle loaded onto the row until the inner real wall of the apparatus is engaged by the back-most bottle. Once a row is fully loaded with bottles, bottle guide assembly 24 is pivoted in a downward direction so as to place locking collar 26 in contact with the front edge of the front-most bottle's neck portion.

Each row includes bottle guide 24 to keep loaded bottles aligned with conveyor assemblies 22. Bottle guide 24 includes a pair of substantially parallel rails spaced to receive the mid-neck portions of the bottles. The spacing is adjusted to allow free movement of the bottles along the length of guide 24. A front end of each rail includes an articulating arm 29 that pivots about a locking hinge pin 27 mechanically operated and electrically controlled by the processor. Each arm 29 has at a proximal end, a locking collar 26 in the form of a magnetic pin that opens and closes with a solenoid device controlled by the processor. A second pin **26*a* is positioned in arm 29 so as to come into contact with the second-most forward bottle and directly arrests forward movement of the bottle adjacent the front vending end of segment 12. Bottles distal to the front two bottles are also restrained from advancing along conveyor assemblies 22** by resting against the front bottles.

The pins are operated sequentially. The front pin is released first to allow the first bottle to travel onto the vending shelf and then closed with the second pin opening thereafter to allow the second bottle to ride down the conveyor until it comes into contact with the front pin. The bottle immediately behind the second bottle migrates via gravity or power assist into the second bottle slot. Each bottle thereafter makes a similar incremental migration toward the first position.

Aligned with each conveyor assembly is vending door 28. As shown in FIG. 1, a plurality of doors 28 may be arranged in a series of rows and columns to correspond with rows and columns of conveyor assemblies 22. Vending door 28 can be made of any resilient material such as aluminum, steel and/or any polymer products well known in the art. In one embodiment, Lexan® in a bluish color version is used for its ultraviolet light protection qualities. Shielding the bottles from UV light penetration is an important consideration in the selection of materials for the door as well as the entire unit to prevent bacterial formation or algae that can form by constant exposure to direct sunlight. The opacity of the other disclosed materials serves the same function.

Each door 28 includes a handle 30 to allow a customer to open the door to retrieve a bottle after a payment transaction has been completed as described below. An electronic door latch (shown in FIG. 2) for each door 28 maintains each door in a locked configuration to secure the bottles from unwarranted removal.

To unlock a vending door, a customer must first use a credit/debit card, or prepaid card to institute a credit/debit transaction with acceptor 20. Once a payment transaction has been completed successfully, a processor (not shown) selects a vending door to unlock based on the availability of bottles in a particular vending row. Sensors, such as photocell 42, strategically placed throughout apparatus 10 provide feedback as to the quantity and location of bottles in the apparatus. The customer is given a visual signal at each door, and/or audible message on a screen and/or via a speaker system built into apparatus 10 and connected to the processor. The message informs the customer which door has been selected. The processor then sends a signal to disengage locking collar 26 that rotates upwardly to release the front-most bottle that travels onto vending shelf 23. Once on the shelf, bottle 2 depresses flapper switch 23, which, in turn, unlocks the adjacent vending door 28 and sends a signal to the processor to re-engage locking collar 26. It should be understood all electronically manipulated components of the vending/return apparatus are controlled by the computer processor.

After locking collar 26 has been re-engaged, the second pin 26 is opened to allow the formerly second-most forward bottle to travel forward on the conveyor via gravity until the previously second-most forward bottle occupies the space formerly occupied by the first-most forward bottle. Since this is "gravity fed" the remaining bottles shift forward accordingly. The presence of the front-most bottle on the shelf that remains stationary provides an auxiliary second physical barrier to prevent the other bottles from being released onto the shelf until the front-most locking collar is re-engaged. In an alternative embodiment, one or more rollers can be electrified or motorized to assist the gravity-feed system. If power rollers are used, conveyor assemblies 22 may be configured in a substantially horizontal orientation in lieu of being "gravity fed." However, this could add substantial cost of manufacturing to the vendor unit.

To complete the bottle retrieval process, the customer grabs handle 30 and opens the door to retrieve the available bottle. Once the bottle is retrieved, flapper switch 23 resumes its start position for the next vending cycle and sends a signal to the processor to lock the door. Spring actuation urges the opened door to the "closed" position after being released by the customer, which allows the electronic latch to be placed in a locked condition. It should be understood and appreciated by those having skill in the art that flapper switch 23 can be substituted with pressure and/or light sensor switches to determine the presence of a bottle on vending shelf 23.

To better assist the customer with the purchase in any light conditions, lights 36 are positioned over each door. Lights 36 may be maintained in an "on" condition are triggered via a switch operated by vending door 28. In the latter embodiment, lights 36 turn on when door 28 is in an "open" configuration. When door 28 is closed, a surface of the door contacts and depresses the switch to turn off light 36. A light may further be provided over acceptor 20 to provide lighting assistance to a customer operating credit card acceptor 20. This light too, may be controlled to operate only when acceptor 20 has been engaged.

Because apparatus 10 may be placed in a wide variety of geographic locations with substantially different weather patterns and climates, apparatus 10 is configured to be a climate-controlled unit. Foam insulation (or an equal type of insulation) 32 lines substantially all inner walls, ceiling and floor of apparatus 10. Heating units 34 are controlled by the processor to maintain the inside temperature of apparatus 10 at a preselected temperate in cold climate conditions. Heating units 34 may be thermostatically controlled, atypical fan-type electric heaters or even the implementation of solar powered heaters. An optional access door 40 may be included in the front, side and/or back of the apparatus to allow access to the mechanical systems including the heating and cooling systems and for loading and unloading the three and five gallon bottles.

In warm climate conditions, an air conditioning unit (now shown) is incorporated into apparatus 10 and operated by the processor. Again, the inner temperature of apparatus 10 is maintained at a preselected temperature. It should be understood that apparatus 10 can be configured with both heating and air conditioning elements to provide year-round climate control of the apparatus.

Figures 3, 3A:
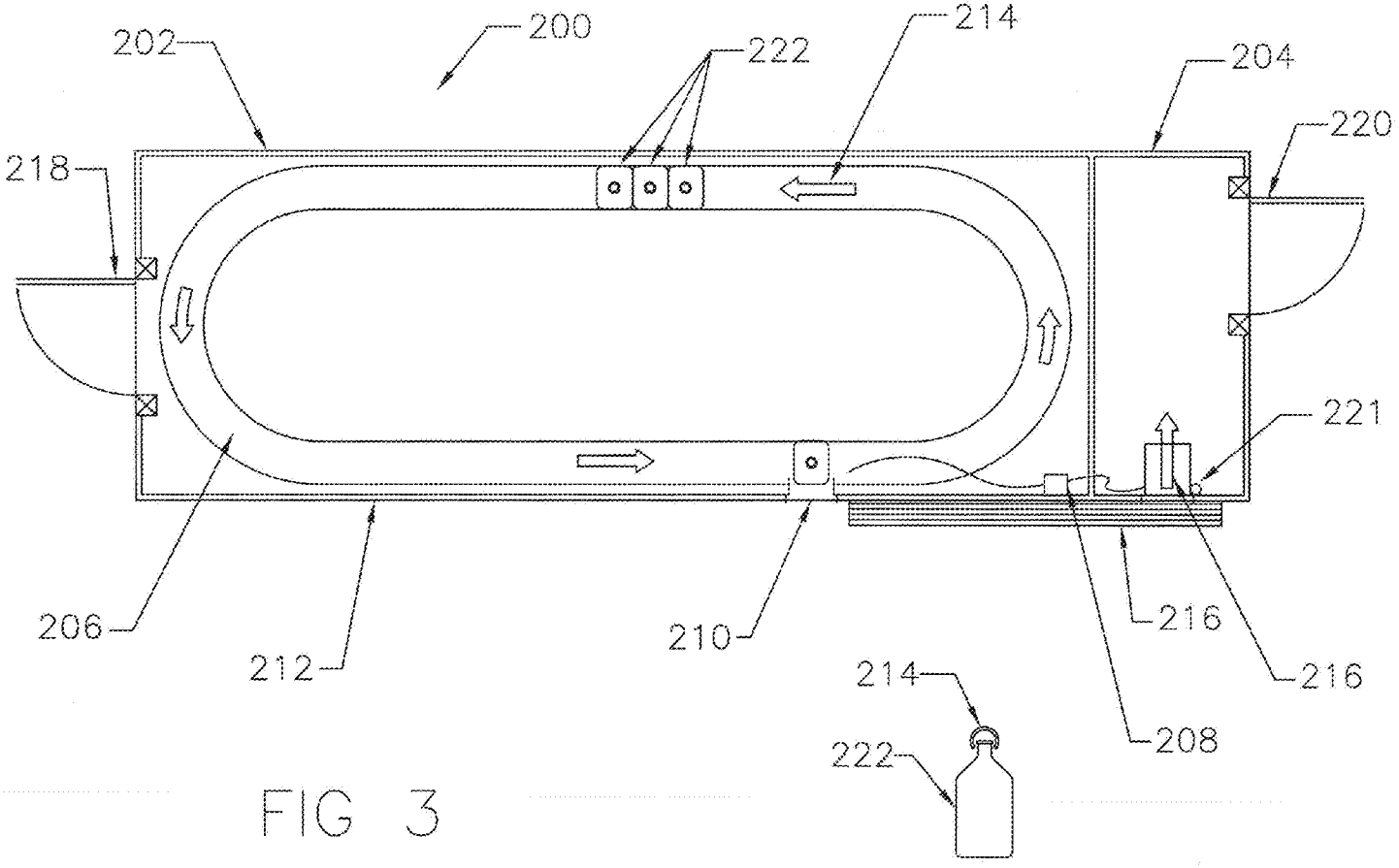
FIG. 3 is a top plan view of a vending/return apparatus according to another embodiment of the disclosure.
FIG. 3A is a sectional view of a bottle guide according to one embodiment of the disclosure.
Figure 4:
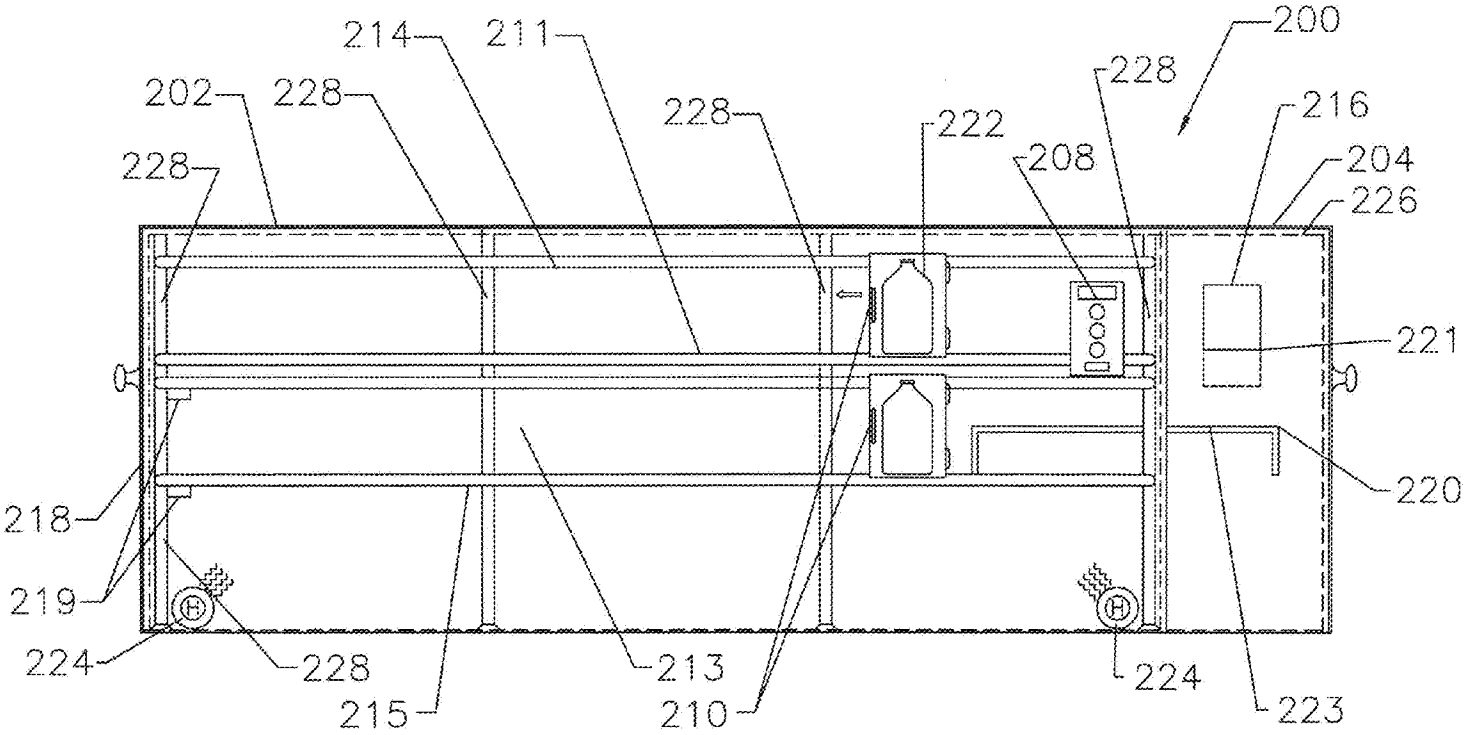
FIG. 4 is a side elevational view of a vending/return apparatus according to the embodiment shown in FIG. 3.

In another aspect of the disclosure as shown in FIGS. 3, 3A and 4, a conveyor belt driven bottle delivery system provides an additional bottle delivery option that increases the number of bottles storable in the apparatus within a given set of apparatus dimensions. The vending/return apparatus shown generally as 200 includes a modular vending segment 202 and a modular return segment 204. Making each segment modular facilitates delivery of the units meant to be stationary so as to maximize the number of units that may be carried by a single transporter. The design also improves ease of construction.

It is one aspect of the disclosure to keep the dimensions of the vending machine within "transportable dimensions" to allow transport by rail, box truck, or flat-bed ("low-boy") type trailers. Over the road regulations control the widths and heights of these dimensions and can have significant impact on end-destination costs from their original point of manufacture. it is also to be understood that the design of the vending apparatus for both the "vending" side and the "return bottle" side can be contained within a single enclosure for ease of manufacturing and shipping.

Vending segment 202 includes one or more conveyor belt assemblies 206, stackable, to receive and vend large bottles of water. The apparatus may be configured to dispense bottles sized from about 1 liter to about 5 gallons. A plurality of frame members 228 supports the conveyor assemblies throughout the apparatus. In a multiple conveyor embodiment as shown in FIG. 3, a top conveyor 211 is driven by a motor 219 having a geared shaft that engages a geared track formed or attached to a bottom of conveyor 211. Motor 219 may be a 3 hp 120 v motor with a geared shaft and is controlled by the processor described herein.

A bottle guide 214 is positioned above top conveyor 211 substantially in vertical alignment with a centerline of conveyor 211. Bottle guide 214 is dimensioned to receive the top ends of bottles carried by conveyor 214 so as to allow free movement of the bottles within the guide, but with sufficient restriction to prevent lateral displacement and tipping of the bottles while travelling on the circling conveyor 211. Guide 214 may be constructed from 4 inch PVC piping cut along a chord less than the diameter of the piping so as to have a cross-section profile larger than a semi-circle. The inward curvature of the cut piping edges provides an arresting surface that engages a bottom edge of a bottle top lip. The PVC material is sufficiently lubricious to permit the unimpeded movement of the bottles along guide 214.

Guide 214 may be either suspended from a top of vending segment 202, or secured to the frame elements. To accommodate different height bottles, guide 214 may be either set to a specific distance from conveyor 214, or attached to an adjustable series of posts to allow guide 214 to be raised or lowered depending upon the bottle size used for the particular conveyor.

If one or more additional conveyor assemblies are used, such as lower conveyor assembly 215 shown in FIG. 4, the assemblies are aligned substantially laterally and vertically with top conveyor 211. A lower bottle guide 213 performs the same function as guide 214 for bottles on lower conveyor 215. Guide 213 is secured to the frame elements and may be either set at a specific distance from conveyor 215 to accept one bottle size, or adjustable to accommodate a plurality of sizes. The means used to allow adjustability may be telescoping supports, segmented supports and the like.

The conveyors are housed in an enclosed structure made from polymeric material sheets or sheet metal, such as sheet steel 212. The walls and top are insulated with about 2 to about 3 inches of foam core insulation 226. Additionally, the floor of the enclosure may also be insulated with insulation 226. Other insulation materials may be used as are commonly known in the art. To counter freezing conditions, one or more heaters 224 are positioned in vending segment 202 and operated by the processor that also monitors temperature with a temperature sensor (not shown).

To access the conveyor system, at least two access doors are provided. A lockable service door 218, situated at a distal end of vending segment 202, provides access to the conveyor assemblies to load filled bottles. Motors 219 are situated in close proximity to door 218 and include manually operable start/stop controls to enable a user to load bottles onto the conveyor(s) and advance the conveyors to facilitate loading of additional bottles until the entire conveyor assembly is loaded with bottles.

Figure 25A:
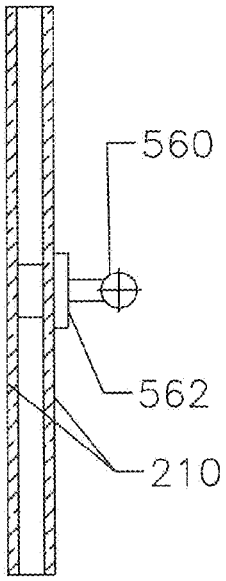
FIG. 25A is a side sectional view of the vending door shown in FIG. 23.
Figure 25:
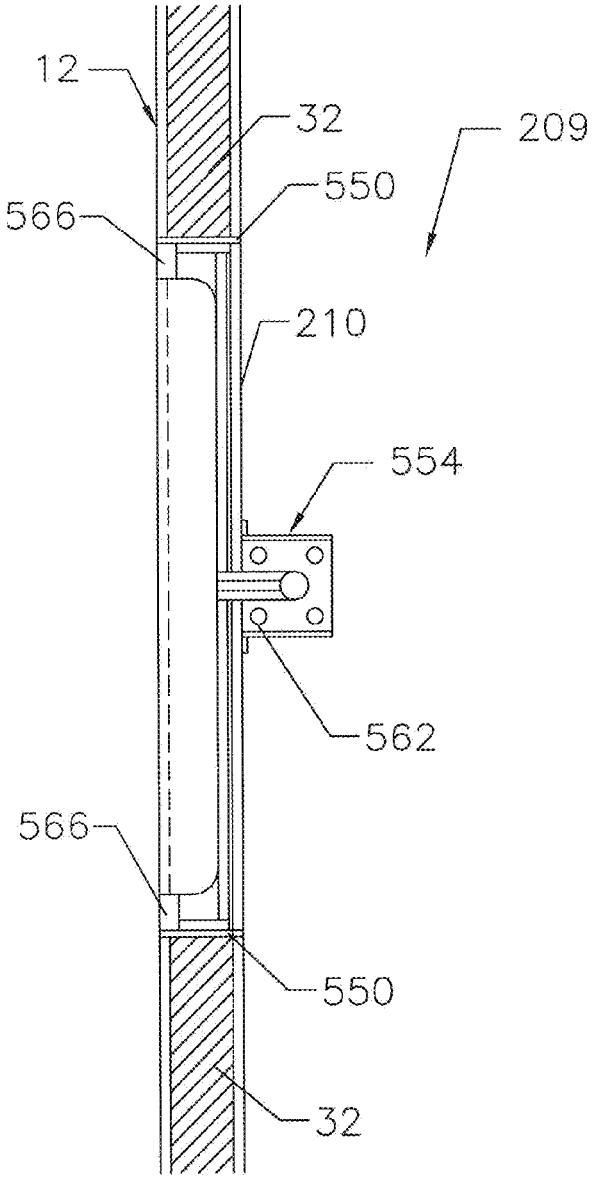
FIG. 25 is a side elevational view of the vending door shown in FIG. 23.

Referring now to FIGS. 23-25A, to allow access for customers, a vending door assembly 209 including door 210 is positioned in a front wall of vending segment 202. In one embodiment, each conveyor assembly is provided with a dedicated door 210 positioned so as to align a bottom end of the door substantially with a top surface of an adjacent conveyor assembly. Each door 210 is secured to a pair of rails 550 that permit horizontal movement of the door from closed to opened positions. In one embodiment, the doors are configured to open to the left, away from the adjacent return segment 204. Door 210 may be a double layer of Lexan® (as shown in FIG. 25A), to provide an added measure of insulation for the door area.

In one aspect of the disclosure, rails 550 extend into a pocket 552 dimensioned to receive door 210 when positioned in an open state. A rubber seal/gasket 566 secured to a perimeter of door 210 ensures a substantially air-tight seal when the door is positioned in a closed state. This ensures that any air conditioning (cooling and/or heating) of the internal atmosphere of apparatus 10 is maintained when door 210 is closed.

To electro-mechanically manipulate door 210, a door operating assembly 554 includes a linear actuator 556 secured to an inside of the front wall of apparatus 10. Actuator 556 is electrically connected to the processor and secured to the wall with mounting brackets 558. Extending laterally from actuator 556 is actuator arm 560. A distal end of arm 560 is secured to door 210 with door mounting bracket 562. If needed, a slot 564 is formed on the inside of the front wall to provide a clearance channel for arm 560 to slide and/or retreat and extend within.

Although door assembly 209 may be mounted and secured to the front surface of the front wall of apparatus 10 (with brackets 550 secured to the front surface), use of pocket 552 is an improved configuration as a security means to prevent unauthorized access to apparatus 10. Operation of door assembly 209 is controlled and coordinated with purchases by the processor as disclosed herein.

Door 210 is configured to be locked electronically. Successful completion of the financial portion of the transaction precedes the door being unlocked via a solenoid, or solenoid-like device controlled by the processor, which then initiates operation of actuator 556 to open and close door 210. The number of bottles purchased and permitted to be removed from the conveyor is controlled by individual locking yolks secured to each bottle. The processor unlocks each bottle in succession until the purchased number has been taken by the customer. Removal of a bottle can be confirmed by any number of means such as broken light beams, pressure sensors and the like. It is in the spirit of the disclosure that any detection means, known in the art, may be used to ascertain when a bottle has been removed by a customer.

Positioned in close proximity to door(s) 210 is vending shelf 223. Shelf 223 may be constructed from polished aluminum, or any weather-resistance material, such as fiberglass. Shelf 223 provides an accommodating surface to temporarily hold bottles for a multiple bottle purchase, or for a customer to temporarily place other items, e.g., shopping items, while making a purchase.

Referring again to FIGS. 3-4, return segment 204 is shown as a modular unit attached to vending segment 202. Segment 204 is essentially an enclosure for receiving used bottles for cleaning and reuse. As each bottle is provided with a serial number, a vendor can keep track of the bottle's use and recycle it after its intended lifespan. It should be understood that although the apparatus is described as vending reusable bottles, the apparatus may also be used with disposable bottles and adjusted to accommodate a variety of sizes of disposable bottles. If the apparatus is structured to vend disposable bottles, return segment 204 can be used to deposit disposable bottles for recycling.

Segment 204 includes a bottle return aperture 216 configured to match the cross-sectional dimensions of the bottles 222 offered in the vending segment. This ensures bottles returned to the return segment are bottles owned by the particular vendor that monitors the bottles with coded unique identification numbers. Bottles offered by other vendors having different dimensions will not be accepted in the return segment 204 and/or will not receive a credit without a properly authorized and recognized identification number.

Figure 15:
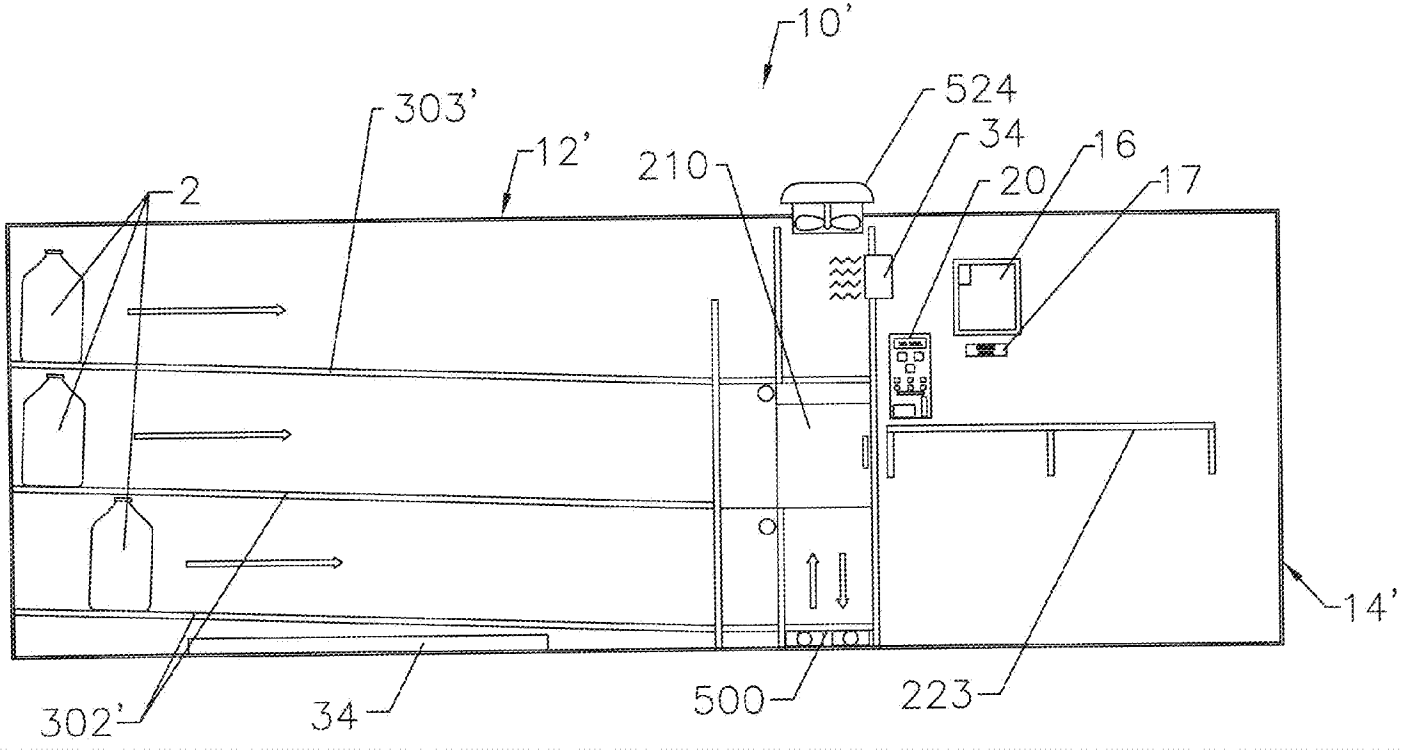
FIG. 15 is a front elevational view of the vending segment shown in FIG. 10 combined with a return segment to form a vending/return apparatus.

Referring again and also to FIG. 1, a sensor, or sensors, (not shown in FIG. 1) situated inside the chute face acts to sense the delivery of an emptied bottle to commence a credit transaction described hereinbelow. There is a barcoded UID and/or an RFID UID tag located on each bottle that identifies the exact vendor and individual bottle and the code is read by an atypical barcode reader device, or an atypical RFID device. The reading device 17 can be placed inside the chute, or on the surface of apparatus 10 as shown in FIG. 15.

All "tags" be they barcode or RFID are to be waterproof and abrasive proof so as to survive approximately 40-50 re-uses involving high temperature wash/rinse cycles and constant handling. Once read, the empty bottles slide down the chute 16 and become deposited in the return segment 14. A return door 18 allows access to the return segment space to retrieve emptied bottles for further processing, refilling, etc. A credit/debit card acceptor 20 provides an electronic interface between apparatus 10 and a customer to process vending/return transactions. The "reimbursement" for the previous purchase of the bottle is not credited to the customer card until the barcode/RDID is identified as one belonging to the proper manufacturer and then "credit" is posted. This process assures against receiving unacceptable bottles from some undesired source. The details of acceptor 20 are described further herein.

Figure 26:
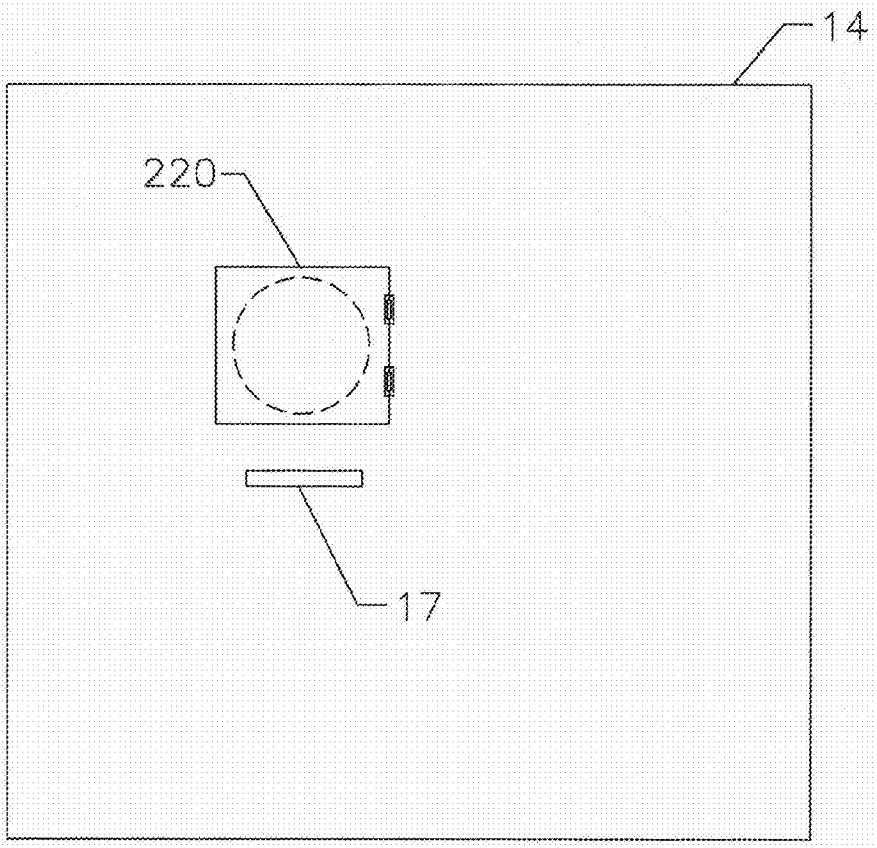
FIG. 26 is a front elevational view of a modular return door frame according to one embodiment of the disclosure.

Referring back to FIG. 4, to facilitate deposit of emptied bottles, a chute 217 may be appended to the inside of segment 204 so as to provide a smooth transition from aperture 216. Aperture 216 may be constructed with a modular frame that can be exchanged with other frames of different dimensions to accommodate differently-sized bottles, such as shown in FIG. 26.

Situated in close proximity to aperture 217 is one or more sensors 221 for detecting the presence of a return bottle being deposited in segment 204. Sensor 221 may be any well known in the art including, but not limited to, RFID reader, mechanical, optic, photoelectric, etc. Multiple sensors may be used and positioned to ensure a positive read of a unique identification number positioned on bottle 222. The identification number may be secured to the bottle in any number of methods including tag, laser engraving, sticker and like methods. Sensors 221 may also be configured and arranged so as to determine the dimensions of the bottle being deposited to ensure the bottle is a vendor bottle.

A further purpose of the sensors is to send a signal to the processor to create a bottle deposit credit as explained more fully below. By reading the unique identification number, one credit transaction is created regardless whether the attempt to deposit the bottle requires more than one try. This ensures a customer receives only one credit per bottle returned.

To enable a vendor to retrieve the returned bottles, a return door 220 is provided to allow access to the inner chamber of return segment 204. Return door 220 is shown attached to a side wall of segment 204. Door 220 may also be positioned on a back wall, or a front wall without departing from the spirit and scope of the disclosure.

Figure 21:
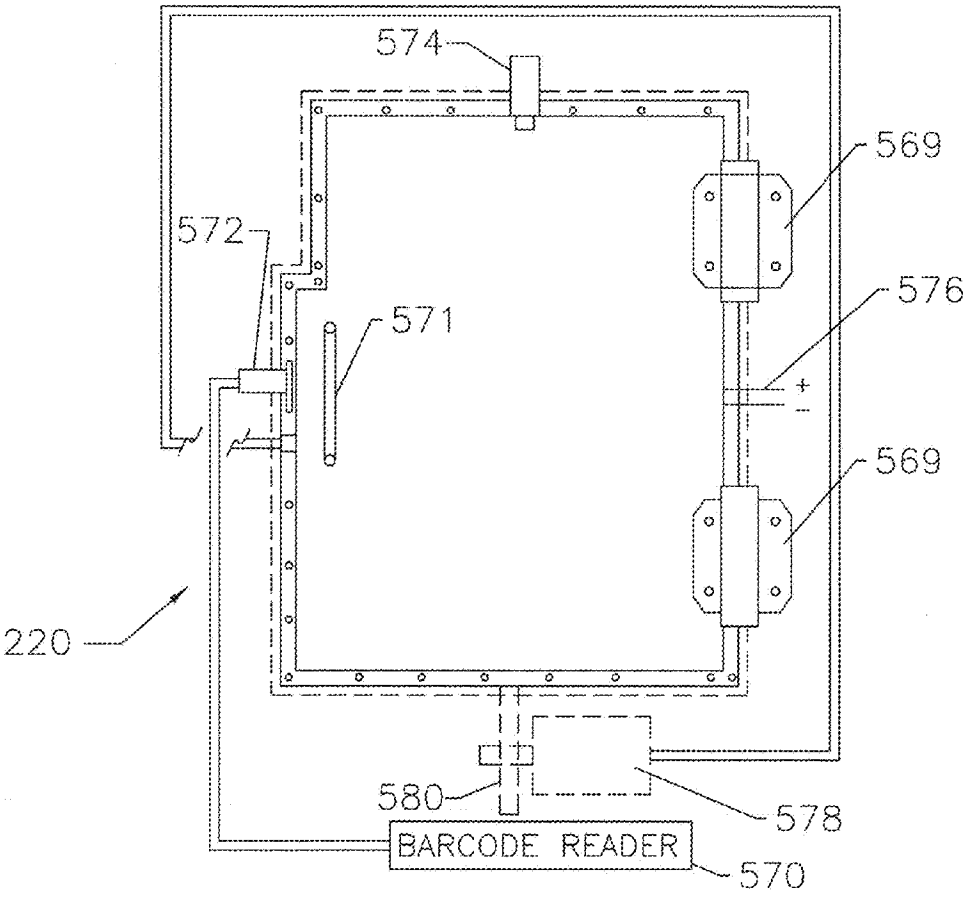
FIG. 21 is a front view of a return door for a return segment of a vending/return apparatus according to one embodiment of the disclosure.
Figure 22:
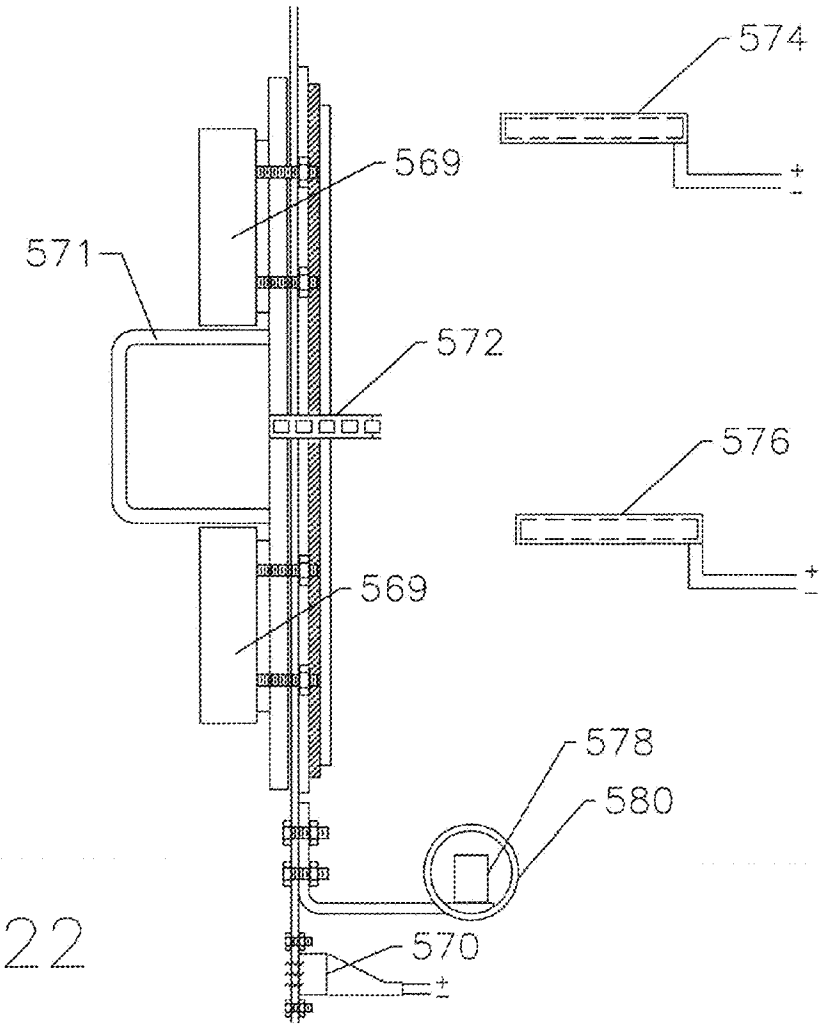
FIG. 22 is a side elevational view of a return door according to the embodiment shown in FIG. 21.
Figure 23:
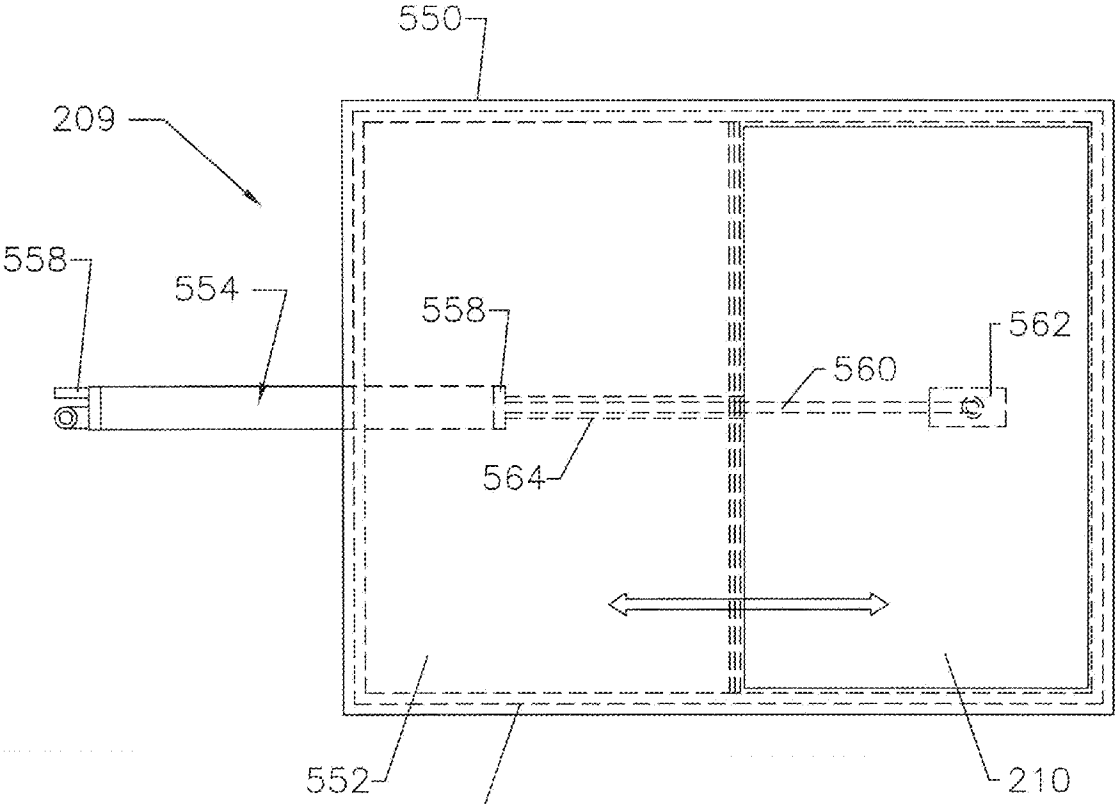
FIG. 23 is a front view in partial phantom of a vending door of a vending segment of a vending/return apparatus according to one embodiment of the disclosure.
Figure 24:
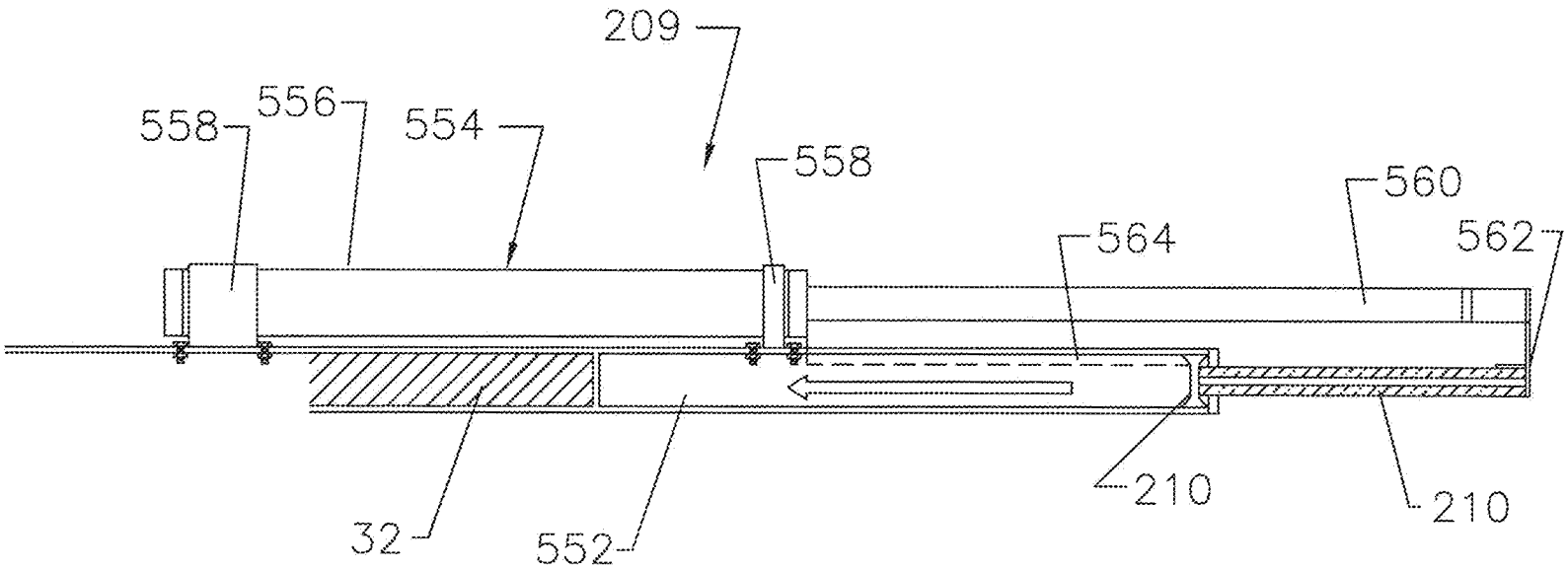
FIG. 24 is a top view of the vending door shown in FIG. 23.

In an alternative embodiment shown in FIGS. 21, 22 and 26, door 220 is configured as a locked door that requires bottle authentication before being unlocked. The door is secured to the face of return segment 14 with spring loaded hinges 569 and includes handle 571 to facilitate door opening. A bar code reader 570 is positioned on a front of return segment 14 to read bar codes secured to vendor water bottles. Reader 570 may be electrically connected to the processor to enable a credit transaction for the return bottle as disclosed herein. The customer moves the bottle into close proximity with reader 570 so that the bar code can be read. If there is no bar code, or the bar code is not recognized by the system, door 220 remains locked.

As shown in FIG. 26, door 220 may simply include a modular chute opening that conforms to the shape of bottles currently being offered by the vendor. In this embodiment, a successful bar code read sends a signal to a solenoid, or like device to unlock door 220 and allow the customer to deposit the empty return bottle. Sensors in the chute area send a signal back to the processor to enable a credit transaction as disclosed herein.

In an alternative embodiment, door 220 may be combined with a motor-driven bottle feed mechanism to detect and advance the return bottle into return segment 14. In this embodiment, door 220 includes an electric lock 572, e.g., a squiggle lock, operated when an electrical signal is received from barcode reader 570. As shown in FIG. 21, the general opening shape as well as door 220 is configured to conform to the shape of the vendor's bottles so as not to allow insertion of unauthorized bottles. Once the door is opened, a return bottle is inserted into the opening, a first solenoid-based toggle switch 574 detects the presence of the bottle and sends a signal to the processor to perform the credit transaction. A second toggle switch 576 senses a bottle and sends a signal to a gear motor 578 that operates a rubberized wheel 580 registered against the return bottle. Rotation of the wheel 580 urges the return bottle into return segment 14.

Figure 10:
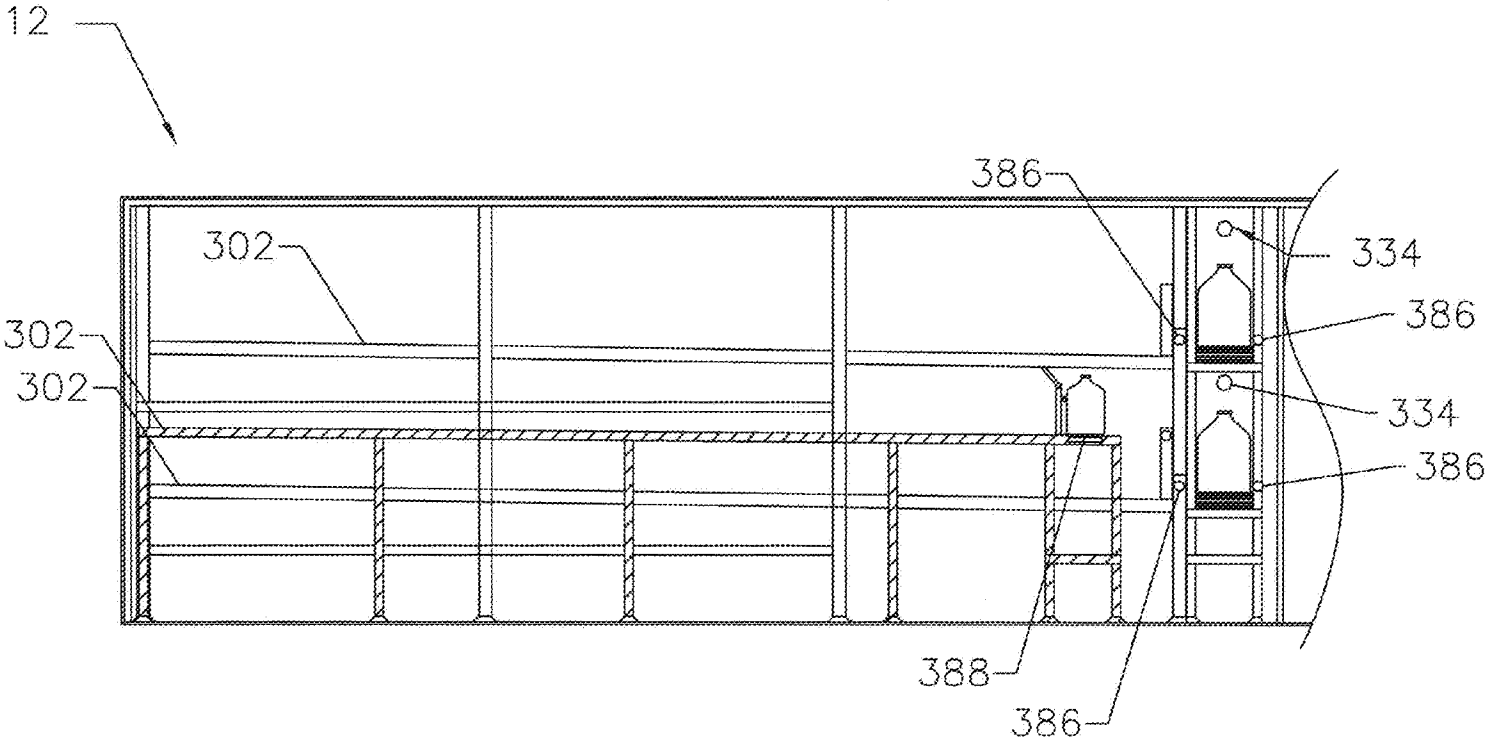
FIG. 10 is a side elevational view of a vending segment according to a yet further embodiment of the disclosure.
Figure 11:
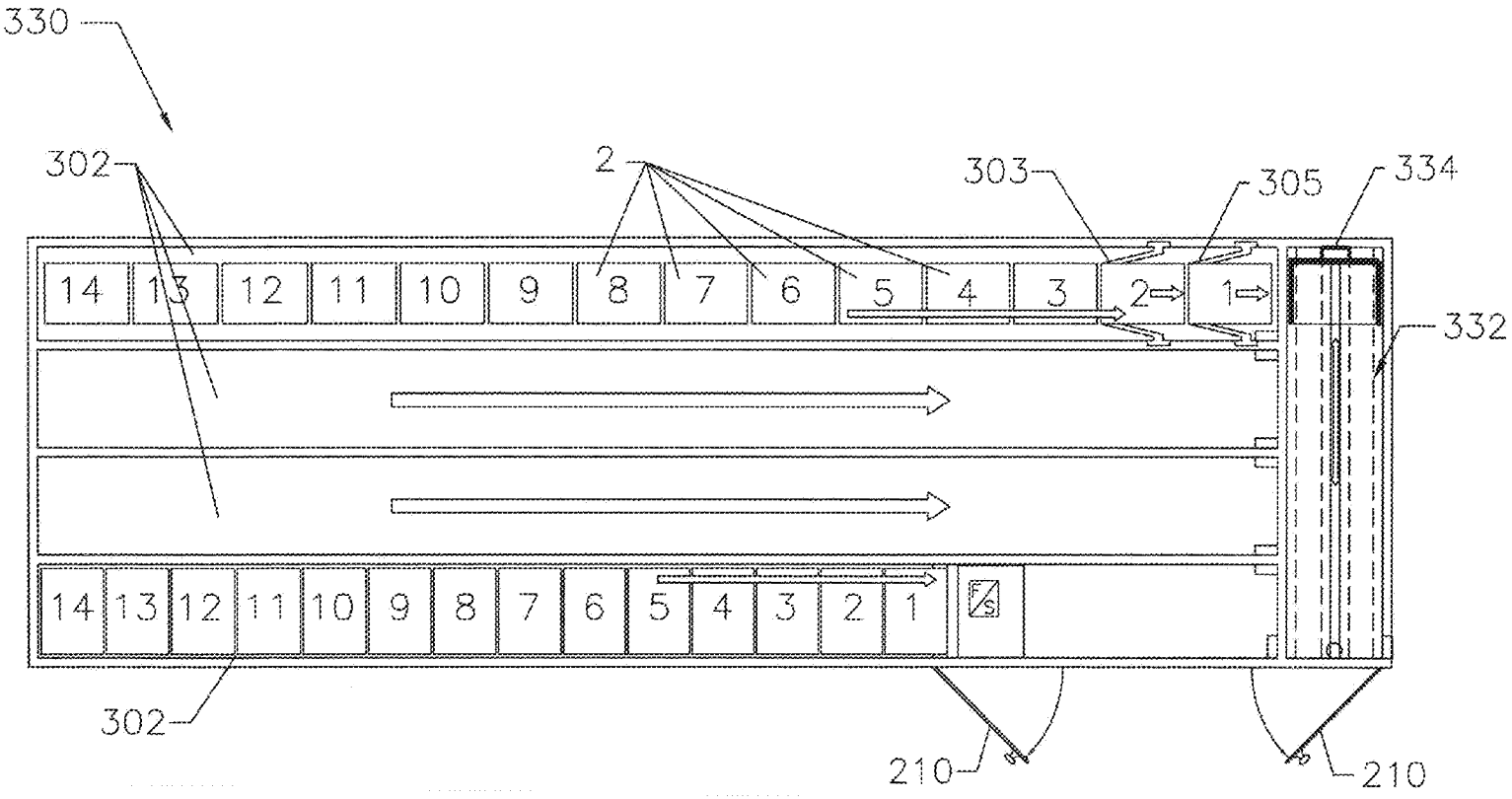
FIG. 11 is a top view of the vending segment shown in FIG. 10.
Figure 12:
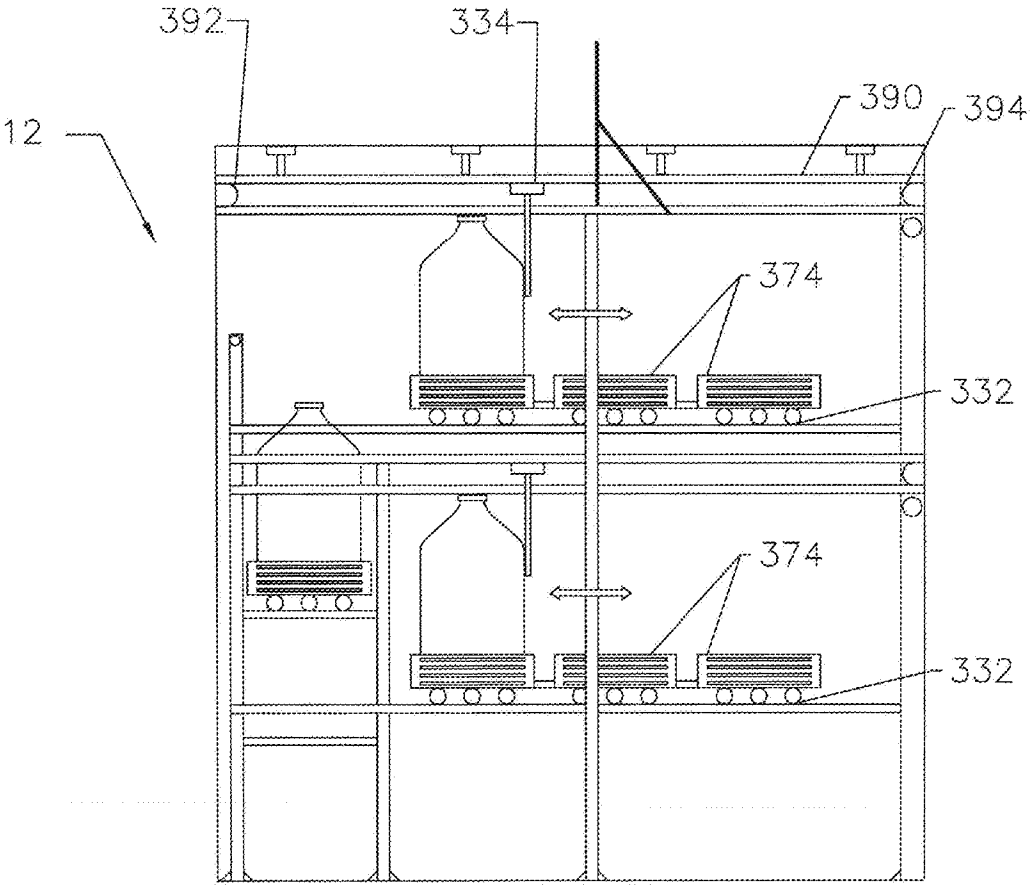
FIG. 12 is a side elevational view of the vending segment shown in FIG. 10.

Referring now to FIGS. 10, 11 and 12, a further aspect of the disclosure is shown. In this aspect, vending segment 12 includes a plurality of gravity-feed conveyor assemblies 302 that feed bottles 2 into a substantially orthogonal vending conveyor assembly 332. This embodiment increases the number of bottles deliverable to a single vending door. The conveyor assemblies in this embodiment may occupy one or multiple horizontal conveyor rows as shown in FIG. 10. Each row has a dedicated vending door from which customers can retrieve purchased bottles.

Figure 18:
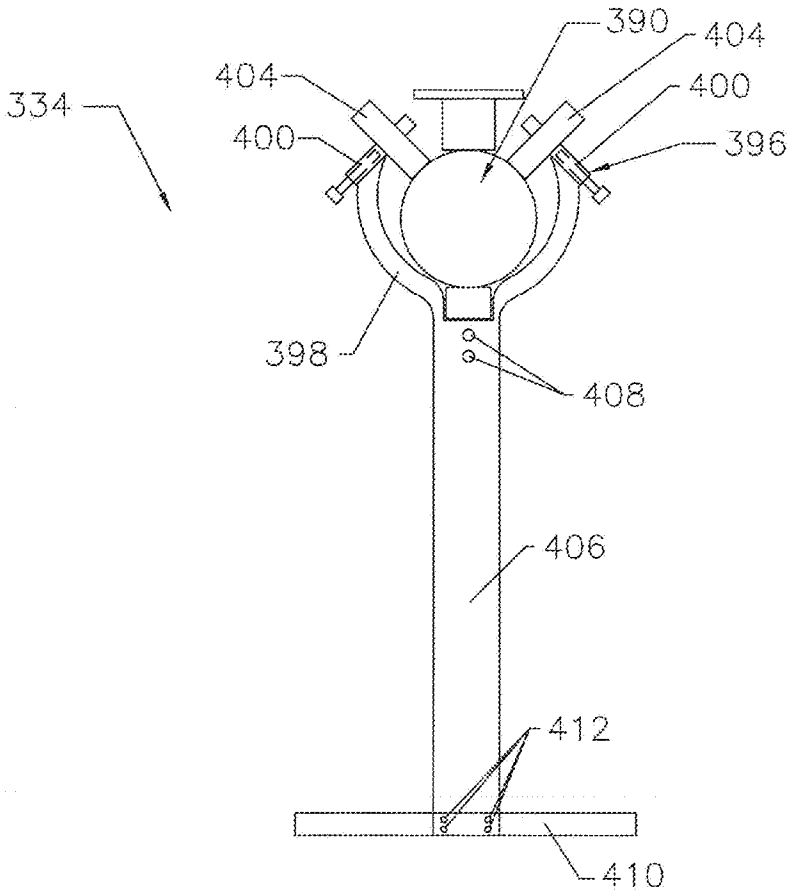
FIG. 18 is a front view of a yoke assembly according to one embodiment of the disclosure.
Figure 19:
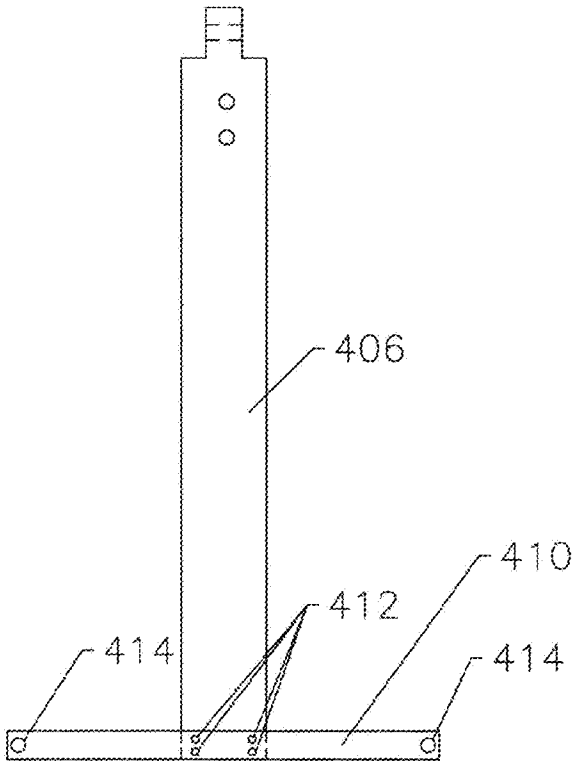
FIG. 19 is a front view of a yoke assembly pusher according to one embodiment of the disclosure.

In this embodiment, a yoke system 334 (shown in FIGS. 13, 18 and 19) secured to a guide bar and cable system urges bottles along vending conveyor 332 toward the vending door.

Figure 5:
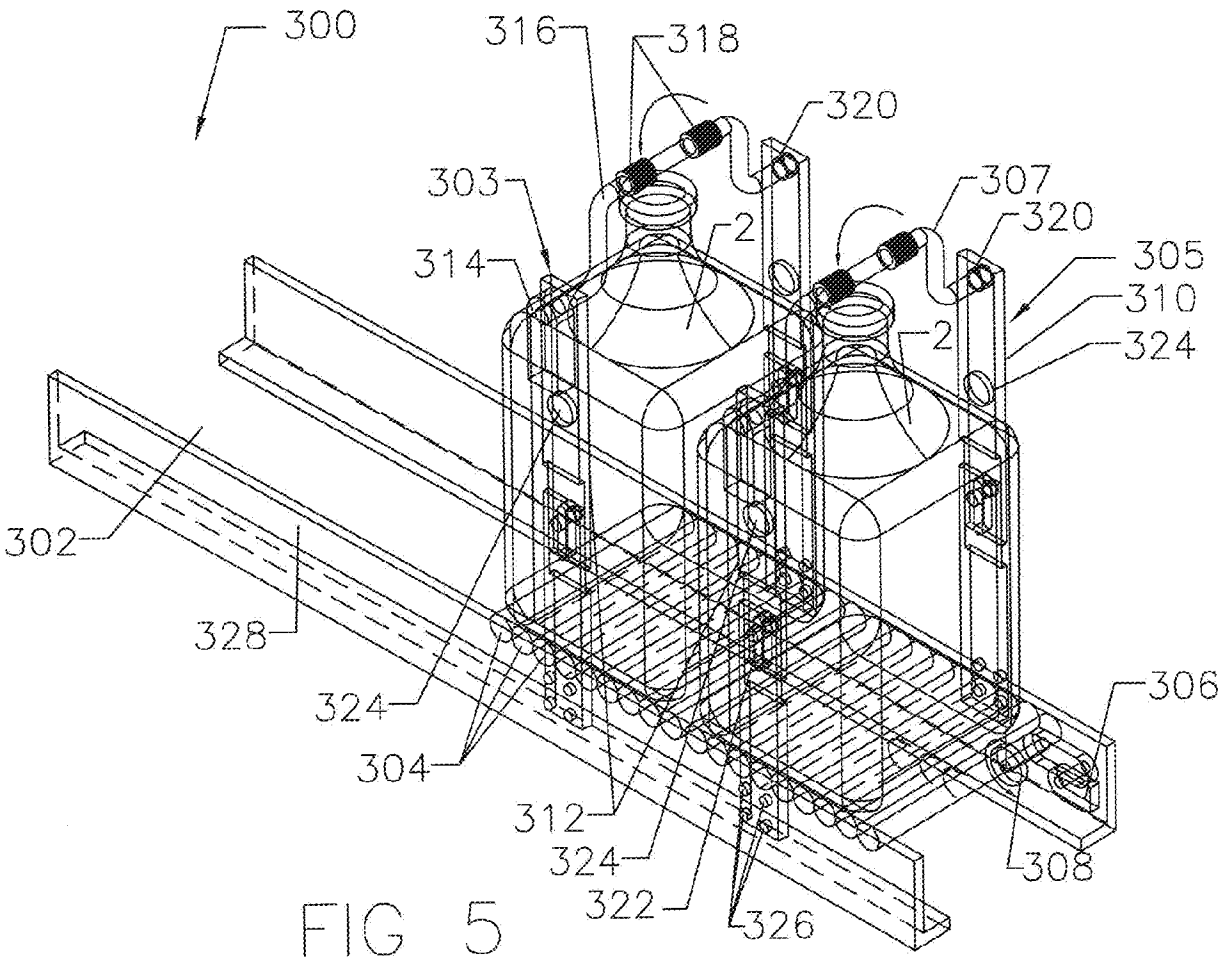
FIG. 5 is a perspective view of a bottle advancing assembly according to one embodiment of the disclosure.
Figure 6:
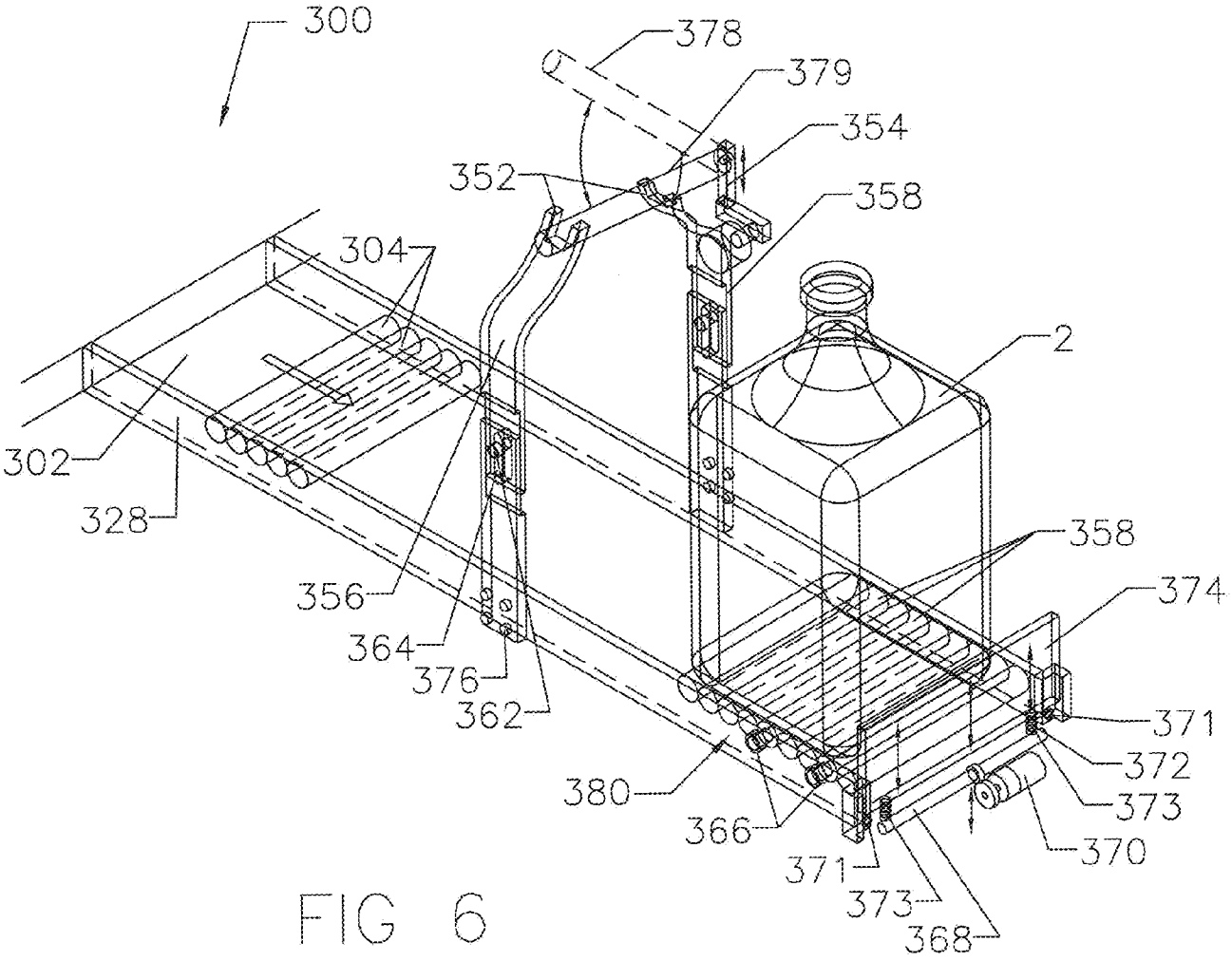
FIG. 6 is a top perspective view of a vending shelf and bottle restriction frame according to one embodiment of the disclosure.

Referring now to FIGS. 5 and 6, a bottle advancement assembly and a locking/latch assembly, respectively, are shown that control forward movement of bottles along conveyors 302 onto vending conveyor 332 and allow controlled access to individual bottles when a customer attempts to retrieve a bottle during a purchase. Advancement assembly, shown generally as 300, includes a pair of locking frames fixed to a pair of conveyor rails 302 that support rollers 304.

As shown in FIG. 5, a front advancement assembly, generally referred to as 305, includes a rotating rod 307 used to urge a forward-most bottle toward the vending door. Rod 307 includes a pair of rollers 318, preferably rubberized, or made from a polymeric material to enhance contact with bottle 2 to ensure positive grip while urging the bottle forward. Rod 307 is designed to rotate 360° to perform repeat bottle movement functions with each revolution. The process begins with rod 307 in a substantially upward or vertical position as shown in FIG. 5.

Rod 307 is supported by a pair of substantially parallel support bars 310 and 312 positioned on opposing sides of conveyor 302. A base of each support bar is affixed to the adjacent conveyor rail via mechanical fasteners 326, welded joint and like methods. Each support bar includes a bore at an upper end into which a ball-bearing sleeve/bushing 320 is secured to allow free rotational movement of rod 307. Each support bar also includes an adjustable bracket plate secured to each support bar with mechanical fasteners in a slot formed in each support bar to allow the height of assembly 305 to be adjusted for different sized bottles. Telescoping support bars may also be used for this purpose.

Attached to support bar 312 is motor 322 that connects to an end of rod 307 to rotate the rod when a signal is received from the processor to rotate the rod to advance a bottle. Motor 322 may be a 90° offset gear motor, or any motor suitable to rotate rod 307 with sufficient torque to propel a filled bottle forward.

To assist rod 307, advance wheel 308 is set in front of, or among rollers 304. Wheel 308 is comprised of a rubber or like material to provide positive traction when contacting bottle 2. A roller motor 306 operates wheel 308 to propel bottle 2 forward. Roller motor 306 may be a 90° offset gear motor, or any motor adequate to urge bottle 2 forward toward vending door 210.

To detect movement and ultimate removal of the forward-most bottle, photocells 324 are positioned on support bars 310 and 312 and aligned to create a beam, which when traversed by bottle 2 breaks the beam and sends a signal to the processor. The processor then accounts for the removed bottle for inventory and accounting purposes.

A secondary advance assembly 303 is positioned distal to forward advance assembly 305 to advance the bottle immediately preceding the forward-most bottle. Assembly 303 includes a substantially identical construction as that of assembly 305 including support bars 310 and 312 with adjustable bracket plates secured with wing nuts or similar mechanical fasteners 326 in slots formed in the bars to allow adjustment for differently-sized bottles. Bars 310 and 312 are attached to conveyor rails with mechanical fasteners, welding or like method. Assembly 303 further includes secondary rod 316 with rubber rollers 318 used to urge a second bottle 2 into the forward-most position previously occupied by the forward-most bottle, now removed.

Each support bar includes ball-bearing sleeve/bushing 320 to allow free rotation of rod 316. Secondary motor 314 is attached to bar 312 and attached to an end of rod 316 to operate the rod and move it in a rotational path to contact bottle 2, urge it forward, and then return to a starting position as shown in FIG. 5. Further advance assemblies are not required as bottles fill the second position when vacated by gravity feed.

Referring to FIG. 6, an alternative bottle advancement assembly is shown. In this embodiment, a locking/latch assembly 360 arrests forward movement of bottles on gravity-feed conveyor 302. On a forward side of assembly 360 is a bottle launch segment 380 that utilizes motor-driven geared rollers 366 and a spring loaded stop plate 374 to provide controlled delivery of bottles onto vending conveyor 332.

Assembly 360 includes a pair of substantially parallel support bars 356 and 358 positioned on opposing sides of conveyor 302. A base of each support bar is affixed to the adjacent conveyor rail via mechanical fasteners 376, welded joint and like methods. Each bar may be constructed as adjustable brackets with a first inner segment 362 having a pin, e.g., a threaded bolt, extending outwardly from the assembly. A second outer segment 364 includes a slot for receiving the pin. The segments have overlapping sections the register against each other and provide the necessary support to impart rigidity to the support bars. With the pin loose, the segments can be adjusted vertically to change the vertical height of the support bars to accommodate differently sized bottles.

Top ends of each support bar may be shaped to conform their collective shape to the cross-sectional profile of a bottle and its associated neck so as to reduce the distance between the support bars and consequently concentrate the force applied to the bottle at the point of contact. Each support bar includes a slot 352 at an upper end dimensioned to receive a restraining rod 378 that arrests movement of the bottles. Rod 378 is secured to an actuator 354 which, in turn, is secured to support bar 358. Rod 378 pivots from closed to open positions from its point of attachment to actuator 354. In a closed position, rod 378 rests within slots 352.

The orientation of restraining bar 378 is controlled ultimately by the processor in communication with actuator 354. Commands received from the processor operate the actuator to set the position of bar 378 in either a closed or open orientation. When bar 378 is in an open position, the lead-most bottle migrates onto launch segment 380 via gravity feed. Forward movement of the lead-most bottle, and any subsequent bottle that migrates onto launch segment 380, is arrested by stop plate 374.

Vendor personnel may also operate stop plate 374 at the front ends of each conveyor row to temporarily arrest forward movement of bottles while the conveyor line is being loaded. It has been discovered that commonly sized 2 inch rollers do not allow fluid movement with cylindrically shaped bottles. Rollers having a 1¼ inch diameter closely spaced provide a more advantageous surface for rolling bottles toward the front end of the vending/return apparatus.

Launch segment 380 includes a series of common rollers 358. Interspersed between rollers 358 are one or more motorized rollers 366 controlled by the processor. A pair of slots 371 formed on an end of launch segment 380 are dimensioned to receive stop plate 374 which slides vertically within the slots and to ensure proper alignment throughout plate 374 vertical movement. Stop plate 374 may include a pair of tension springs 373 positioned toward each end of plate 374 with distal ends attached to a roll bar 368. Roll bar 368 includes a gear mated to a gear of a geared motor 370. Motor 370 is also controlled by the processor.

The operation of motorized rollers 366 and stop plate 374 are coordinated by the processor when a vending command is issued. The process begins with stop plate 374 being transitioned from an up, closed position to a down, open position. In the open position, a top edge of plate 374 is substantially level with the highest points of the rollers so as to allow free movement from the launch segment to the vending conveyor 332. Once in a down position, rollers 366 are activated to urge a resident bottle off of launch segment 380 and onto adjacent and substantially orthogonally oriented vending segment 332 as shown in FIG. 11.

In an alternative embodiment, a sheet surface may be used in place of the rollers to facilitate movement of bottles loaded onto the conveyor lines. In a yet further embodiment, the rails may be coated with a lubricous surface treatment and act as support surfaces for the bottles to be placed and allowed to roll or migrate toward the front of the vending/return apparatus.

Figure 9:
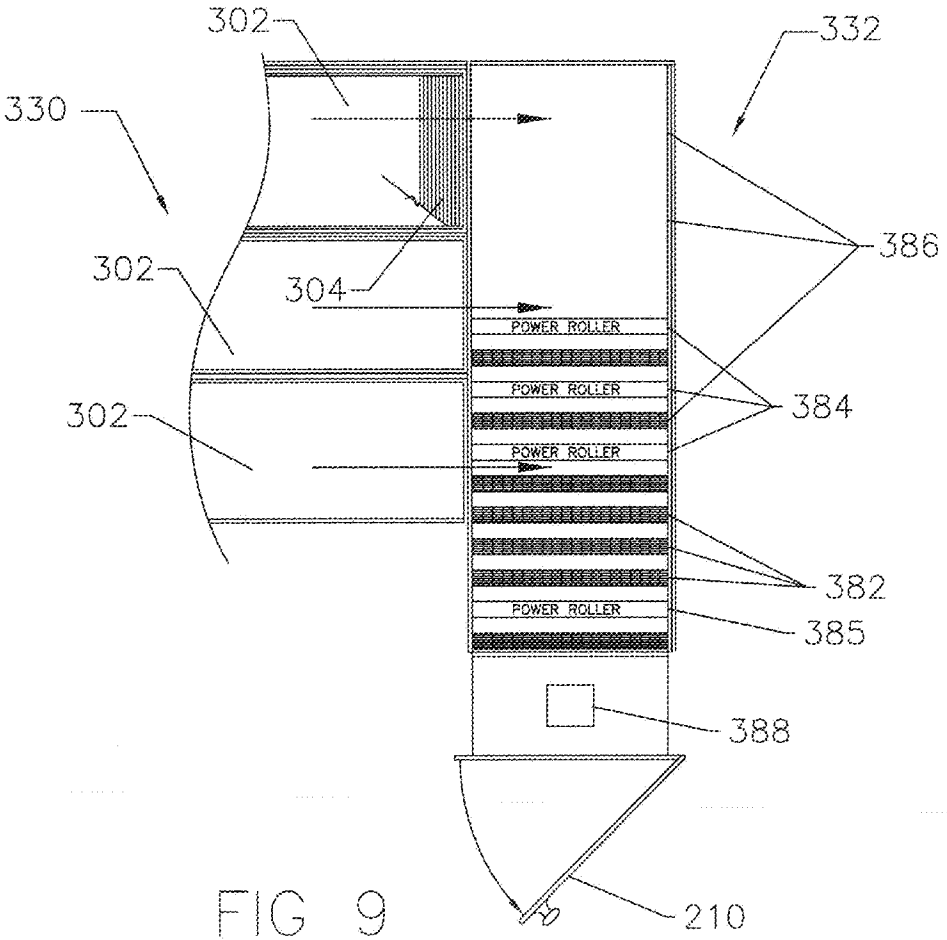
FIG. 9 is a top view of a conveyor assembly according to one embodiment of the disclosure.
Figure 13:
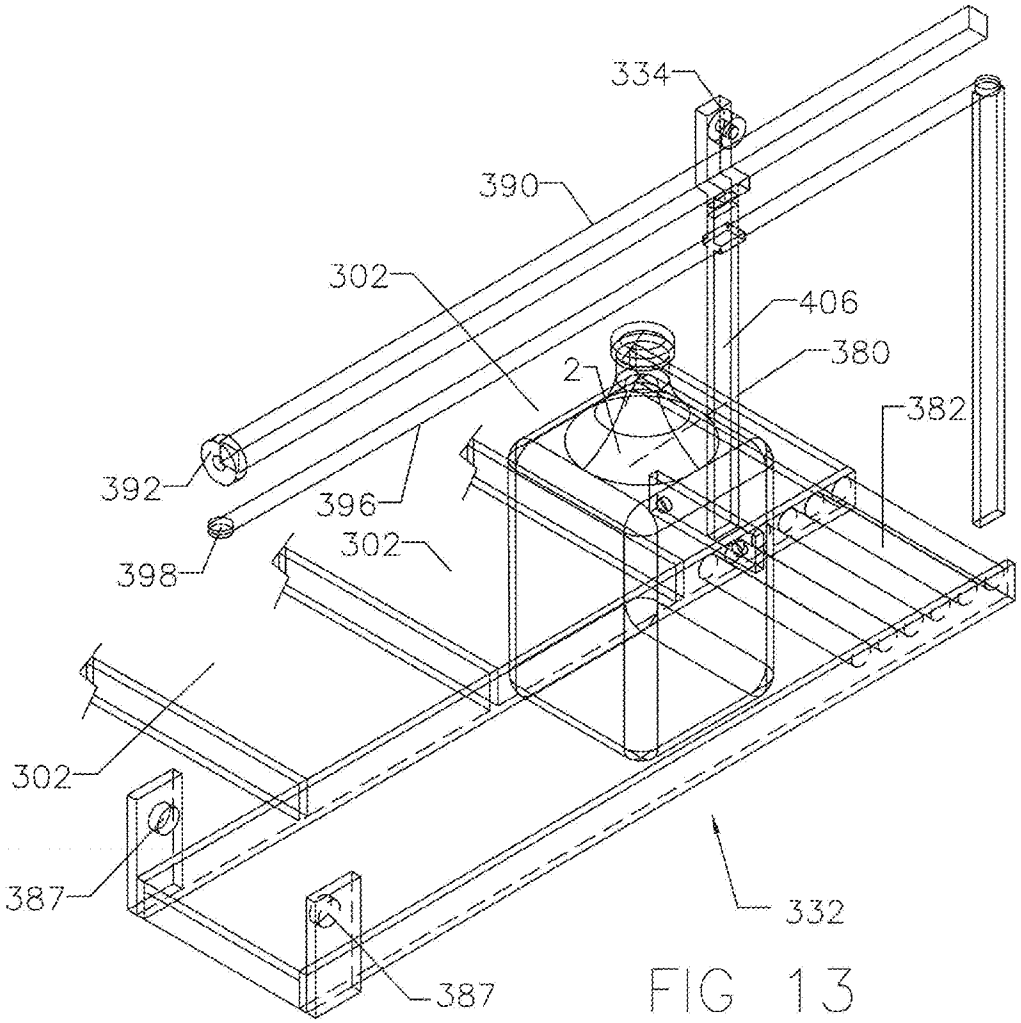
FIG. 13 is a top perspective view of a bottle control conveyor assembly according to one embodiment of the disclosure.

Referring now to FIGS. 9 and 13, vending conveyor 332 includes a pair of rails with a plurality of common rollers 382 and a plurality of power rollers 384, i.e., motorized rollers, secured between the rails so as to allow free rotation of the rollers. Power rollers 384 urge resident bottles toward a front of the vending apparatus toward door 210. A series of sensors 386 are strategically positioned in the rails to detect the presence of bottles coming from each conveyor 302. A sensor may be positioned to align with each conveyor 302 to ensure any bottles on the vending conveyor are sensed and accounted for by the processor that receives signals from the sensors.

When a vending transaction is processed, the processor initiates release of a bottle from one of the conveyors 302 onto the vending conveyor 332. The processor next signals motors connected to, or embedded within, each power roller 384 to begin rotation and urge the resident bottle toward the vending door 210. A modified power roller 385 may be situated in close proximity to the door end of conveyor 332 that can be controlled and used as a brake to arrest forward movement of the subject bottle 2. When bottle 2 arrives at the end of conveyor 332, it migrates onto and depresses a paddle switch 388 that activates the braking function of roller 385 (which occurs by virtue of rotating the roller in an opposite direction toward a back end of conveyor 332), and deactivates via the processor, or via direct connection, the door lock (not shown) that maintains door 210 in a locked position. The customer can then open the door and retrieve the bottle.

In a further aspect of the disclosure, as shown in FIGS. 10, 12, 13, 18 and 19, a yolk system 334 may be included to urge bottles on conveyor 332 toward door 210. The yolk system may be used in conjunction with the rollers of conveyor 332, or may perform the bottle movement function alone with either a conveyor constructed with rollers, or constructed with a smooth lubricious surface such as polished steel with or without a lubricious coating treatment such as Teflon®.

Yolk system 334 rides along a yolk rail 390 secured to the frame system of the vending segment 12. Positioned at each end of rail 390 are stops 392 and 394. Yolk system 334 includes yolk assembly 396, which includes a yolk frame 398 having shaft housings 400 formed on distal ends. Bearing shafts 402 are secured within each shaft housing 400 and rotate freely within the housings. Attached to each shaft 402 is a yolk wheel 404 each of which rotates freely and registers against opposing sides of rail 390. In an alternative embodiment. Shafts 402 are fixed to yolk frame 398 and yolk wheels 404 rotate freely about shafts 402. It should be understood that any combination of rotating shafts and/or rotating wheels may be used to produce the same function, i.e., to allow free movement of the yolk assembly 396 along rail 390.

Suspended downwardly from a proximal end of yolk frame 398 is yolk shaft 406. Shaft 406 may be welded to frame 398 or affixed via mechanical fasteners 408. A horizontal push bar 410 is secured to a distal end of shaft 406, again via weld or mechanical fasteners 412. Secured to the front surface of push bar 410 in substantial proximity to extreme ends are rubber stops 414. Stops 414 provide added cushion and grip when registering against a bottle being delivered to the front of the vending segment 12. The spacing of the stops assists maintaining bottles aligned with the direction of motion. As is well known in the art, however, the spacing may be altered to accommodate different sized bottles and different bottle configurations. For example, for cylindrical bottles, stops 414 may be positioned to engage tangential points on the bottle's sides to ensure the bottle does not rotate and drift out of alignment relative to the course of travel towards vending door 210.

Referring to FIG. 13, yolk assembly 334 is propelled along guide bar 390 via a geared motor 399 controlled by the processor. A pair of pulleys 398, positioned on the extreme ends of, and suspended above, the vending conveyor, guide a cable 396 attached to shaft 406. Signals received from the processor coordinate the position of yolk assembly 344 to receive the next bottle delivered onto the vending conveyor 332 to urge it forward toward door 210. A photocell 387 detects the presence of a bottle advanced to the front of the conveyor and sends a signal to the processor, which sends a signal to motor 399 to arrest forward movement. Yolk assembly 334 either remains positioned at the front until a new transaction is initiated, or is returned to the backmost position in a "ready" mode for the next transaction.

Figure 7:
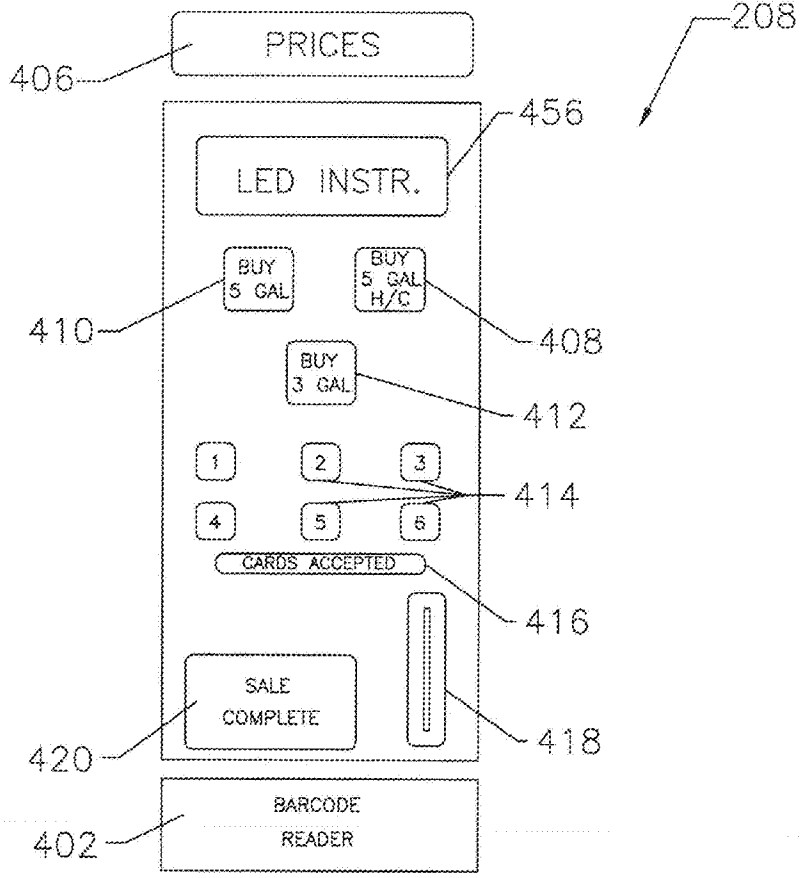
FIG. 7 is a plan view of an atypical credit/debit card acceptor and receipt printer according to one embodiment of the disclosure.
Figure 8:
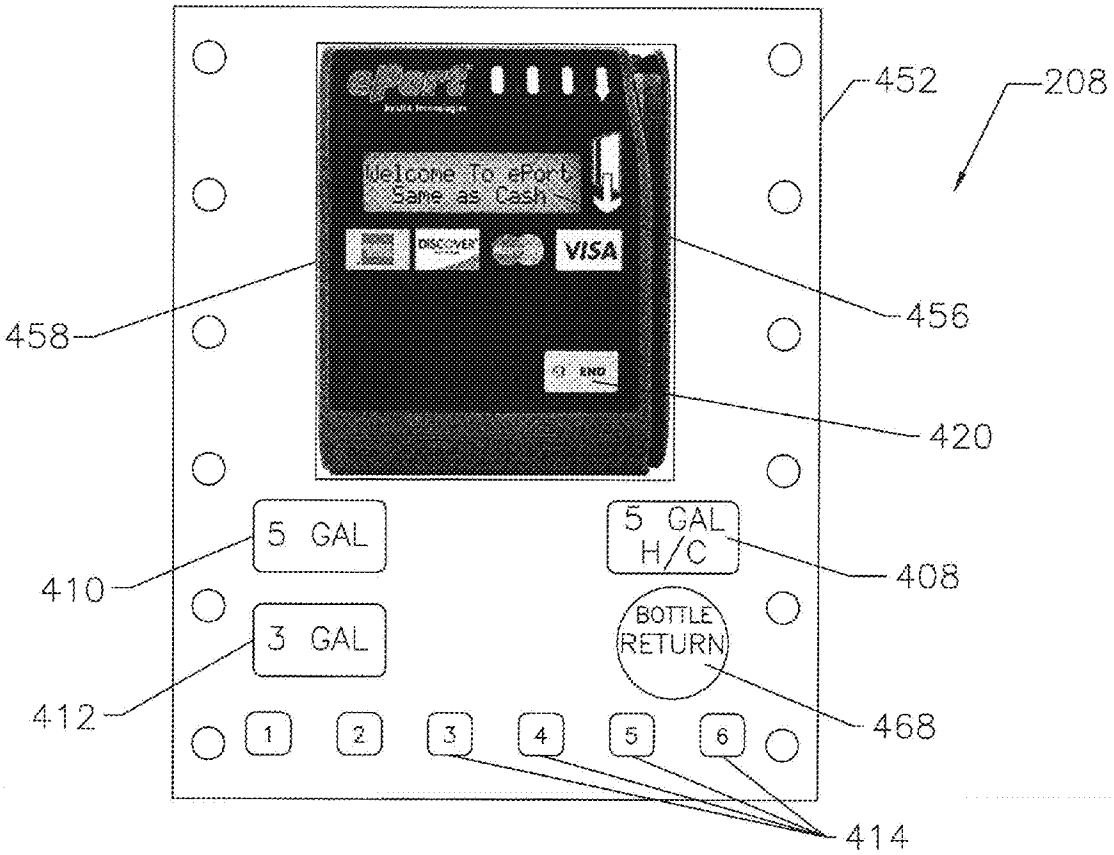
FIG. 8 is a plan view of an atypical credit/debit card acceptor and receipt printer according to another embodiment of the disclosure.

Referring to FIGS. 7 and 8, cashless customer interface keypad 208 positioned on a front wall of vending segment 202 (or alternatively, on return segment 204) provides customers with a means to perform paperless debit and credit transactions to obtain filled water bottles and to return emptied reusable bottles. To secure keypad 208 to the vending apparatus, a mounting plate 452 may be attached to, or integral with, the keypad. It should be understood keypad 208 is connected via hardwire or wireless connection to a central processor that processes information received from keypad 208 and controls operation of the vending/return apparatus.

Keypad 208 includes a credit/debit card reading slot 418 into which a card and attached magnetic strip are inserted to enable the system to read the account information embedded in the strip. An LED display window 456 provides a visual display of alpha-numeric based prompts to inform the customer of the transaction progress. Alternatively, a second display 416 may be included in the keypad to inform the customer whether the credit/debit card has been accepted. A further alternative addition is an acceptable credit/debit card list 458 to give customers advance notice of accepted accounts.

The process begins by having the customer swipe or insert a credit/debit card into the card reading slot 418. The customer then presses one of the selections for purchase. The shown options include purchase of a five gallon bottle button 410, a three gallon bottle button 412 and a handicap-access, five gallon bottle button 408. To that end, one or more conveyor rows in the apparatus are set at a height to facilitate handicap access. These conveyor rows operate in essentially the same manner as the other conveyor rows. Referring again to the button selections, to further enhance the distinction between the button choices, each can be colored coded with a different color. Of course, each button may be customized to identify any particular size bottle and more buttons may be added to reflect the bottle size choices offered. By way of example and not limitation, a dedicated button can be included for three gallon handicap access, one gallon bottle, one gallon handicap access bottle, etc.

The customer next selects the number of bottles of the selected bottle size the customer wishes to purchase by pressing one of the numeric keys 414. The illustrative examples shown in FIGS. 7 and 8 show six numerical key options. The interface keypad may be constructed with more or less numeric key options. Once a selection number has been made, the customer is prompted on LED screen 456, or by audio prompt to open one or more specified vending doors to retrieve purchased bottles.

If return bottles are to be added to the transaction, a return bottle button 468 is depressed by the customer. The customer then exposes a barcode, or other similar marking methodology, attached to the return bottle to a barcode reader 402. Once a bottle's bar code has been successfully read, the customer is prompted visually and/or audibly to open return door 220 and insert the bottle being returned. In an alternative embodiment, return door 220 may be substituted with a return slot dimensioned to receive bottles of the sizes offered in the vending apparatus.

To ensure proper credit, the apparatus does not allow the customer to return additional bottles until the bottle previously scanned is successfully deposited in return segment 204. Each successive return bottle has to be properly and successfully scanned before being deposited in the return segment in order to receive the desired credit for the return. Additional matters involving return bottles are described more fully hereinbelow. Once the last return bottle is processed, or if not return bottles are involved in the transaction, the customer may depress an optional sale complete button 420 to enable the vending system to tabulate the debits and/or credits and finalize the transaction. An application to process sales and return transactions is disclosed more fully below.

In a yet further embodiment of the disclosure, a vending elevator is provided to further increase the number of bottles storable and deliverable in a single apparatus. The apparatus includes a plurality of columns and rows to maximize bottle storage and delivery. As used herein, a column shall mean a vertical assembly of bottles supported by dedicated platforms, and a row shall mean a horizontal support for receiving and holding a plurality of bottles, or other desired objects.

Figure 16:
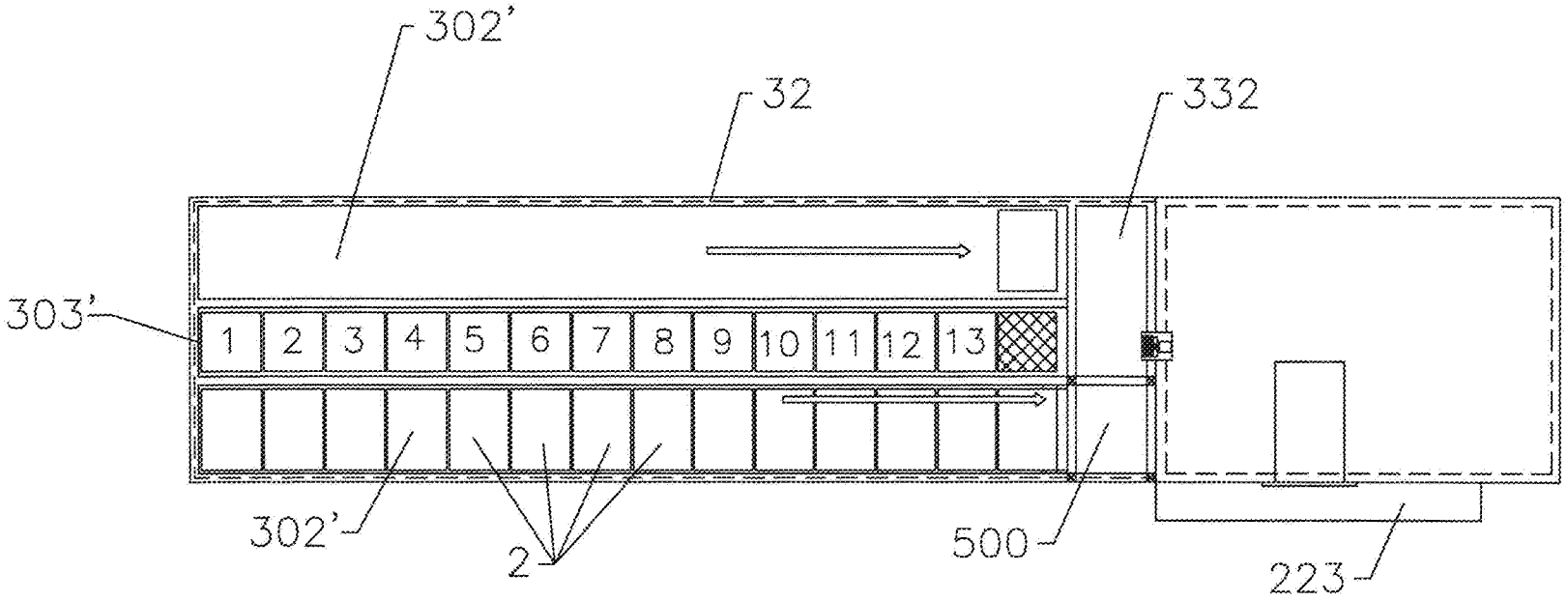
FIG. 16 is a top view of the vending/return apparatus shown in FIG. 15.

As shown in FIGS. 15 and 16, combined vending/return apparatus 10' (elements bearing primed reference character numbers correspond to elements bearing unprimed numbers), includes a combination of stacked gravity fed vending conveyors that merge onto substantially horizontal launch segments 380 used to initially arrest forward movement of each bottle advanced on the gravity feed conveyors 302' (5 gallon bottle conveyors) and 303' (3 gallon bottle conveyors). More specifically, launch segments 380 each include motor-driven conveyor belts 507 driven by dedicated computer-controlled conveyor motors 506. When activated, conveyor belts 507 urge bottles present on the conveyor belts onto a delivery elevator 500.

Figure 14:
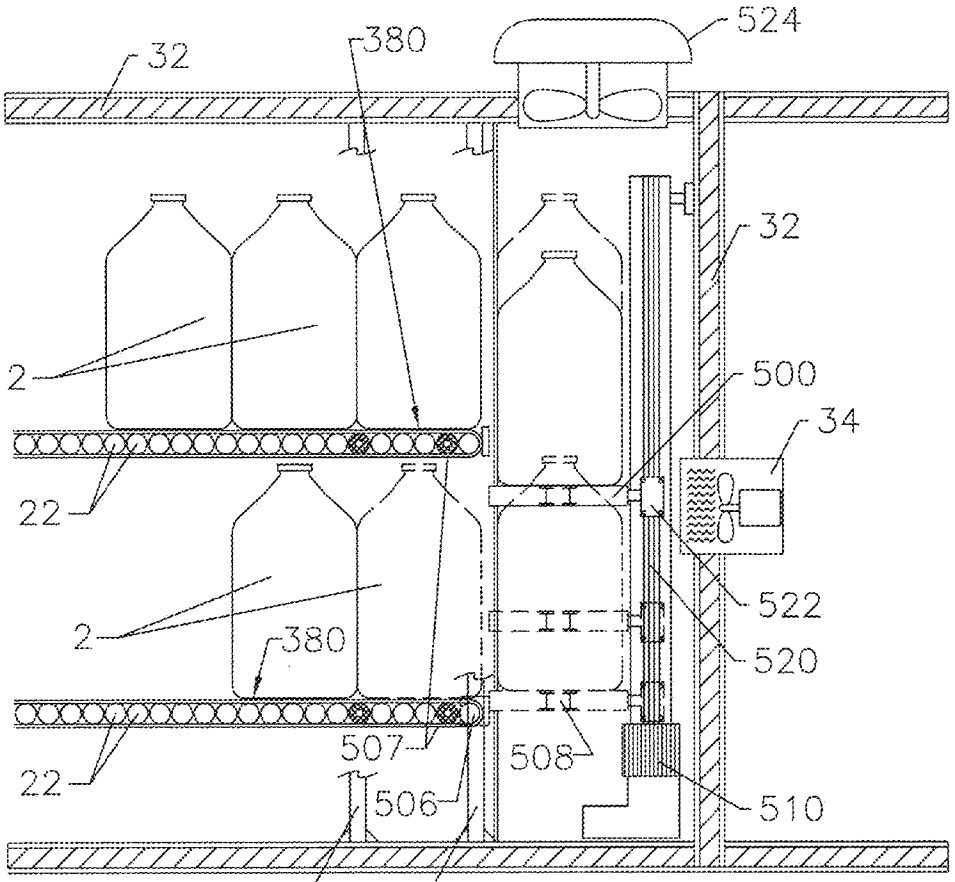
FIG. 14 is a side elevational view in partial phantom of the vending segment shown in FIG. 10.

Elevator 500 is connected to one or more linear actuators to position elevator 500 to receive bottles from launch segments 380 and to position received bottles into a proper location for bottle removal by a customer. As shown in FIG. 14, a first linear actuator motor 510 is connected to a lead screw 520 that controls elevational movement of elevator 500. Elevator 500 is connected to an anchor 522 having a threaded through-bore for receiving lead screw 520. Depending on the orientation of the threads on lead screw 520, forward and reverse modes of operation of motor 510 with either raise or lower elevator 500 to desired positions within apparatus 10'.

In one aspect of the disclosure, elevator 500 is combined with outgoing conveyor 332 to bring bottles from multiple rows and columns to vending door 210. In this aspect, conveyor 332 is configured substantially as shown in FIG. 6. The coordination of launch segments 380, conveyor 332 and elevator 500 is performed by the resident computer processor disclosed herein. When a customer makes a purchase selection, the computer process determines from which row and column a bottle should be retrieved and operates launch segment 380, conveyor 332 and elevator 500 to retrieve and deliver the selected bottle.

Figure 17:
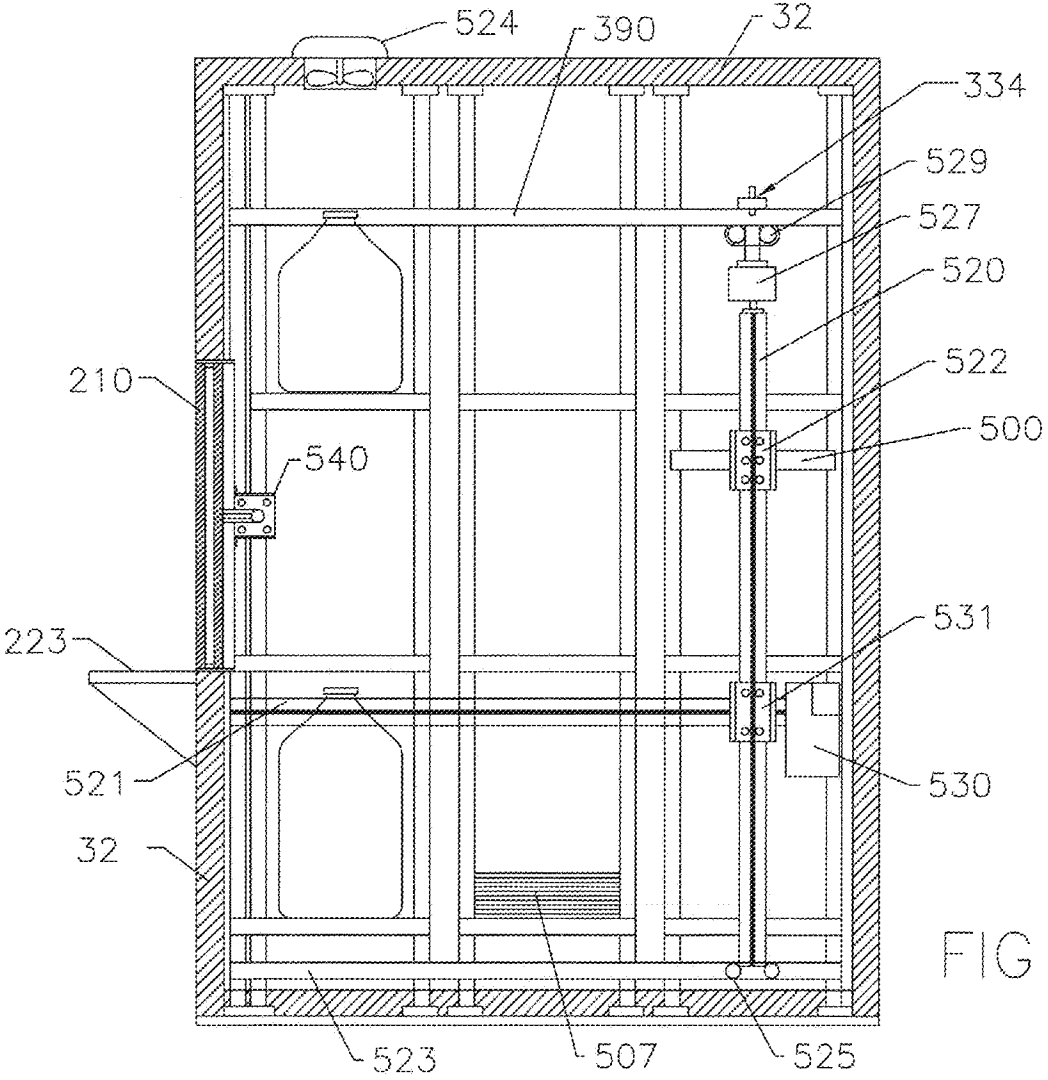
FIG. 17 is a side sectional view of the vending/return apparatus shown in FIG. 15.
Figure 20:
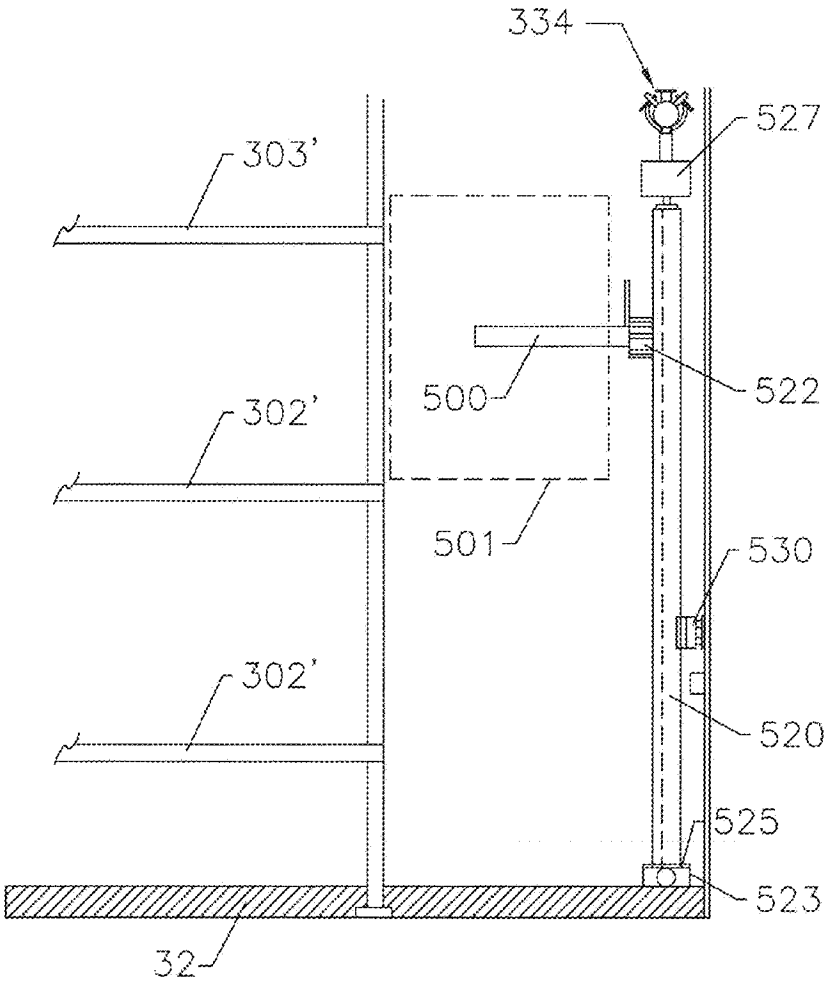
FIG. 20 is a front sectional view of a vending elevator assembly of the vending/return apparatus shown in FIG. 15.

In another aspect of the disclosure, elevator 500 is not combined with outgoing conveyor 332. Instead, elevator 500 is connected to a second linear actuator to move along a second horizontal axis. As shown in FIGS. 17 and 20, elevator 500 is connected to lead screw 520, which is driven by overhead mounted motor 527 to effectuate vertical movement of elevator 500. Lead screw 520 is further connected to horizontal anchor 531 that includes a threaded bore to receive a second lead screw 521 and a through-bore and bushing for receiving lead screw 520. Lead screw 521 is operated by attached horizontal motor 530.

To enable horizontal movement of elevator 500, a lower track 523 having a cross-sectional shape of a flattened "u" is configured to receive actuator roller wheels 525 secured to a lower end of lead screw assembly 520. To secure an upper end of lead screw assembly 520, slide bar 390 is positioned to extend substantially along a top end of the apparatus' sidewall to guide horizontal movement of the vertical lead screw assembly. Yolk assembly 334 (shown more particularly in FIGS. 18 and 19), has motor-driven wheels 529 that propel lead screw assembly 520 along slide bar 390. Both lead screws may be operated simultaneously or serially to align elevator 500 with a specific column and row location and/or align the elevator with access door 210 at an outgoing vend position 501.

Figure 28:
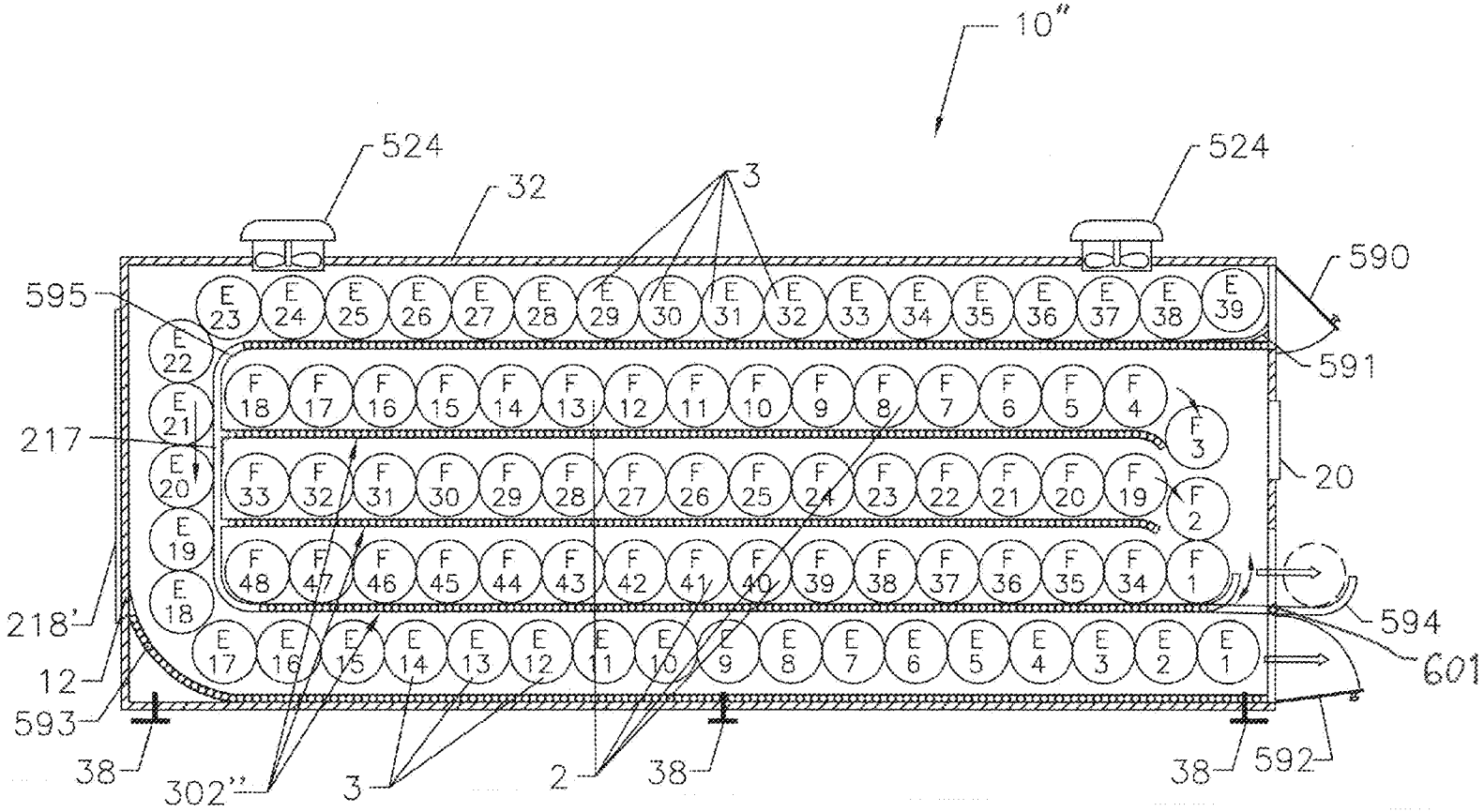
FIG. 28 is a side sectional view of a vending/return apparatus according to another embodiment of the disclosure.
Figure 29:
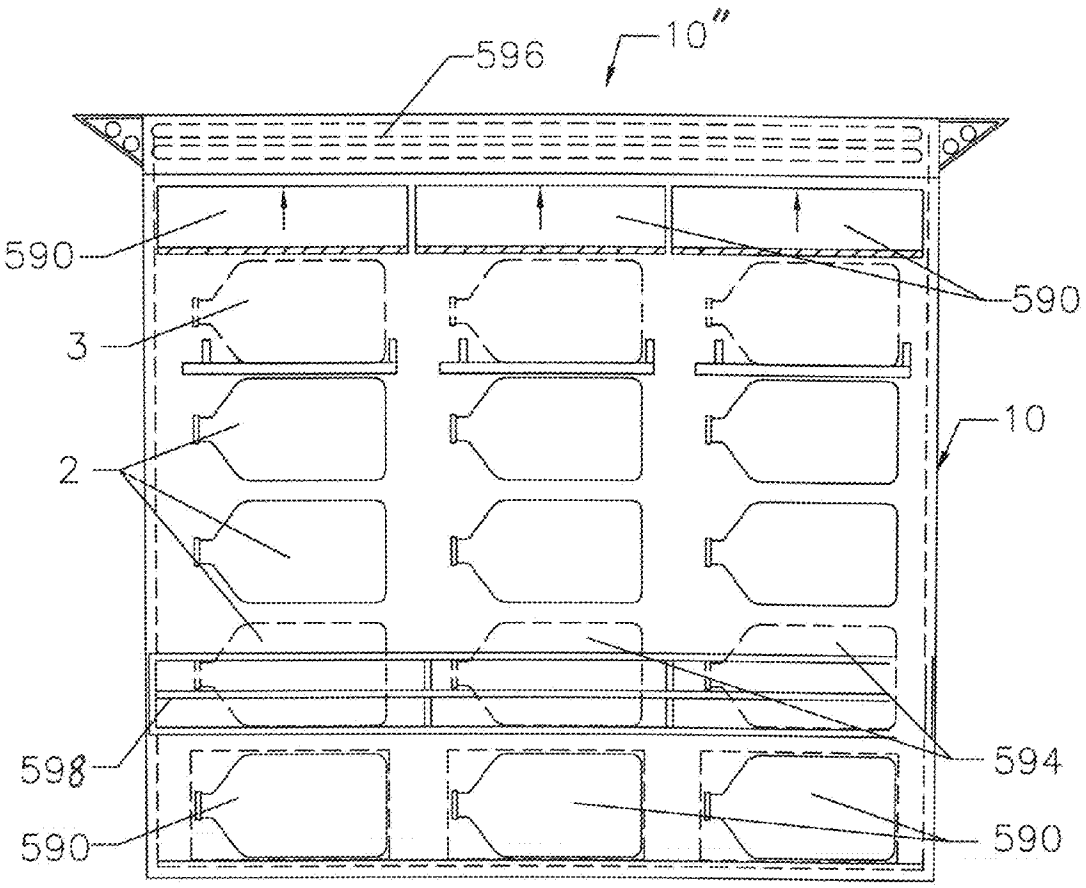
FIG. 29 is a front sectional view of a vending apparatus according to the embodiment shown in FIG. 28.
Figure 30:
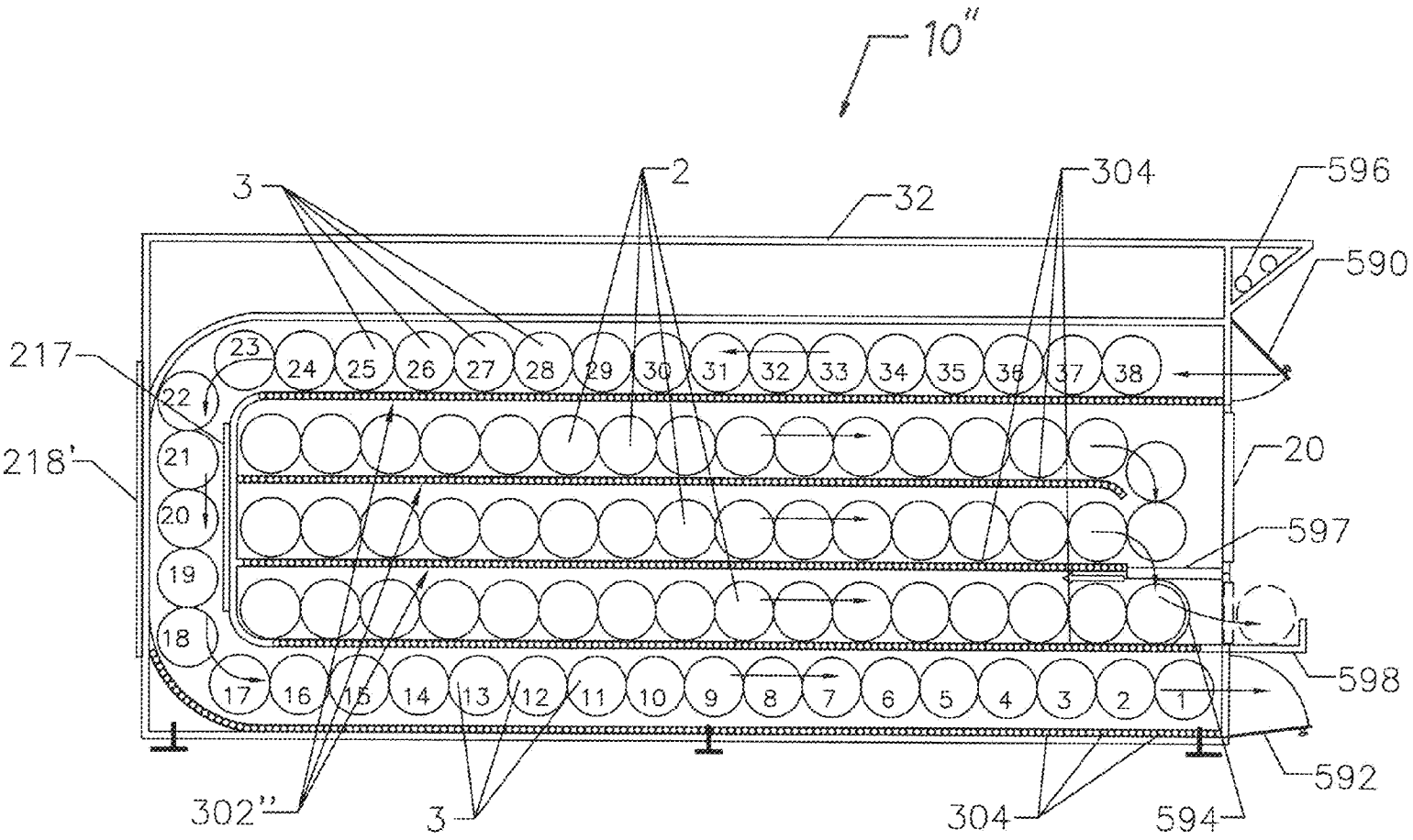
FIG. 30 is a side sectional view of a vending apparatus according to a yet further embodiment of the disclosure.
Figure 31:
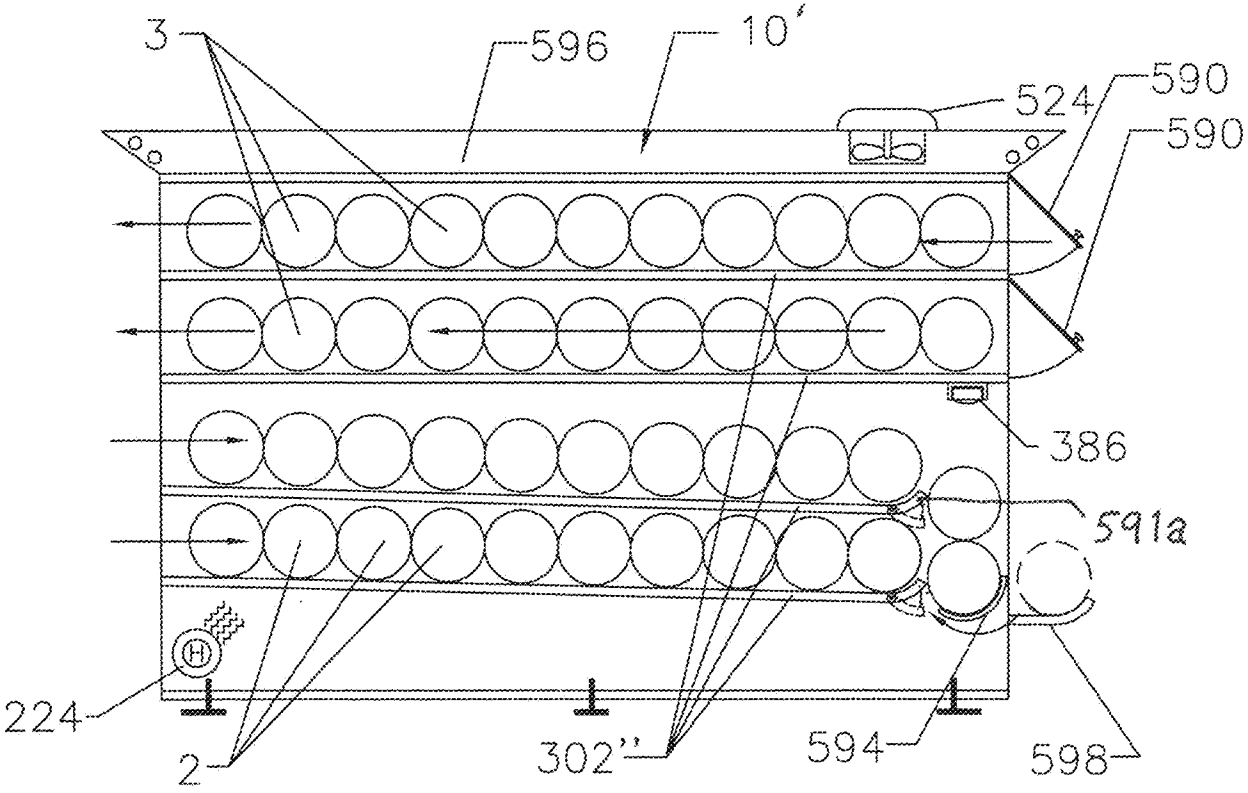
FIG. 31 shows perspective views of a vending door according to another embodiment of the disclosure.

In a yet further aspect of the disclosure as shown in FIGS. 28, 29 and 30, an integrated vending/return apparatus 10 includes a series of stacked gravity fed vending conveyors having open front ends to permit delivery of individual bottles from a single exit point, and a return bottle conveyor superposed about the vending conveyors along a perimeter of the apparatus. This configuration minimizes the amount of space necessary to perform bottle vend and return functions from a single, streamlined, simplified and integrated unit. This embodiment further substantially reduces the number of operating parts needed to perform the desired functions.

In this embodiment, apparatus 10 includes a plurality of stacked conveyors 302" constructed from paired rails (as shown in FIG. 5) between which are secured a plurality of rollers 304 that allow water-laden bottles to move freely toward a front end. In an alternate embodiment, Teflon® coated slick-rails may be used rather than rollers. The stacked rows can be contained within a number of columns aligned along the width of the apparatus as shown in FIG. 29. Each water bottle delivery conveyor extends from a back wall—having an access door 217 to load the conveyors—to a point short of the apparatus front wall. The distance between a front end of the conveyors to the front wall is greater than the bottle size used in the apparatus.

To access the vending conveyors from the exterior, a full swing door 218' is secured to a back wall of apparatus 10. Both door 218' and door 217 have to be opened to provide access to vending conveyors 302". To access the vending conveyors, return bottles 3 must be removed from apparatus 10.

To return bottles, a customer exposes a bar code on the return bottle to the bar code reader 17 that sends a signal to the processor to unlock return door 590. The customer places the bottle in the upper conveyor return channel to return the bottle. A sensor positioned in close proximity to the front opening ensures the bottle is inserted into the return channel before a credit is given. Although the return channel is sloped to urge return bottles 3 towards the back of the apparatus, a front radius ramp 591 may be used to prevent return bottles from inadvertently spilling out of the front end of apparatus 10 before door 590 is returned to a closed position.

To ease the movement of return bottles along the upper return channel and down a substantially vertical connected channel as the back of apparatus 10, a radius 595 may be formed at the juncture of the return channel and the vertical channel. To further ease movement of the return bottles a second radius 593 may be formed at a bottom outside corner formed by the junction of the vertical channel and a bottom return channel. The bottom return channel is sloped toward the front of apparatus 10 to urge return bottles 3 toward the front of the apparatus.

To retrieve return bottles, a front unload door 592 is secured to the front wall of apparatus 10 to provide access to the bottom return channel. For ease of use, unload door 592 is hinged at a bottom edge to allow the door to function as a ramp and to allow gravity to keep the door open while return bottles 2 are removed. Due to the structure of the return bottle channels, the entire insertion and removal procedure may be achieved without the use of power-assisted rollers as gravity provides the necessary force to urge the bottles to the front of apparatus 10 adjacent to unload door 592. In an alternative embodiment, a radius may be formed at the front end of the bottom return channel to prevent bottles from spilling out of apparatus 10 when unload door 592 is opened.

To ensure the slope of each conveyor is set properly, leveling feet 38 are provided on a bottom of apparatus 10 to ensure the apparatus' casing is level and square. The slope of the conveyors are set relative to the plane occupied by the bottom or floor of apparatus 10.

To retrieve a full bottle, a customer has to operate credit card acceptor 20 as described herein. Once the credit transaction and number of bottles are approved, the processor operates a radius door 594. Radius door 594 is secured to a welded rod 601. One end of rod 601 is secured to a pillow bearing 602 and the other end is secured to gear motor 600. Motor 600 is operated by the processor. In one embodiment, a shelf basket 598 is secured to the front of apparatus 10 below the lowest point of door 594 when in an open position. When a bottle is purchased, door 594 rotates open. The radius of the door, conformed to the shape of the bottle, cradles the bottle until retrieved by the customer. With the embodiment employing basket 598, a purchased bottle exits apparatus 10 via gravity and comes to rest in basket 598. The basket shelf has openings between rails that provides further access points for a customer to remove the purchased bottle from apparatus 10.

In a yet further embodiment, a retractable, substantially horizontal slide door 597 may be secured to a front end of the second highest vending conveyor 302" to prevent full bottles from collapsing on bottles being vended from the primary of lowest vending row to which door 594 is aligned. Door 597 is secured to an actuator that can retract the door when the primary vending row is depleted of full bottles. The processor either receives a signal, or does not receive a signal from a sensor placed in the primary vending row to indicate an empty row status. Once this signal, or absent signal is received, the processor sends an "open" signal to the actuator to open door 597 to allow the migration of one bottle onto the primary vending row for delivery to a customer. Door 597 is closed after a single bottle is released to ensure additional bottles do not collapse on the bottle to be delivered to the next customer.

As with the other disclosed embodiments, this embodiment includes solar-powered vents 524 that operate continuously to adjust pressure and temperature with the heating and/or cooling units. A series of lights 596, e.g., fluorescent, may be secured to an eaves of the apparatus' top to provide adequate lighting and added security during night time purchases. Consistent with the other embodiments, this embodiment also includes credit card acceptor 20 positioned on the front wall of apparatus 10. Credit card acceptor 20 may also be positioned on a sidewall depending upon the orientation of apparatus 10 relative to surrounding structures, e.g., a grocery store.

Figures 32, 33:
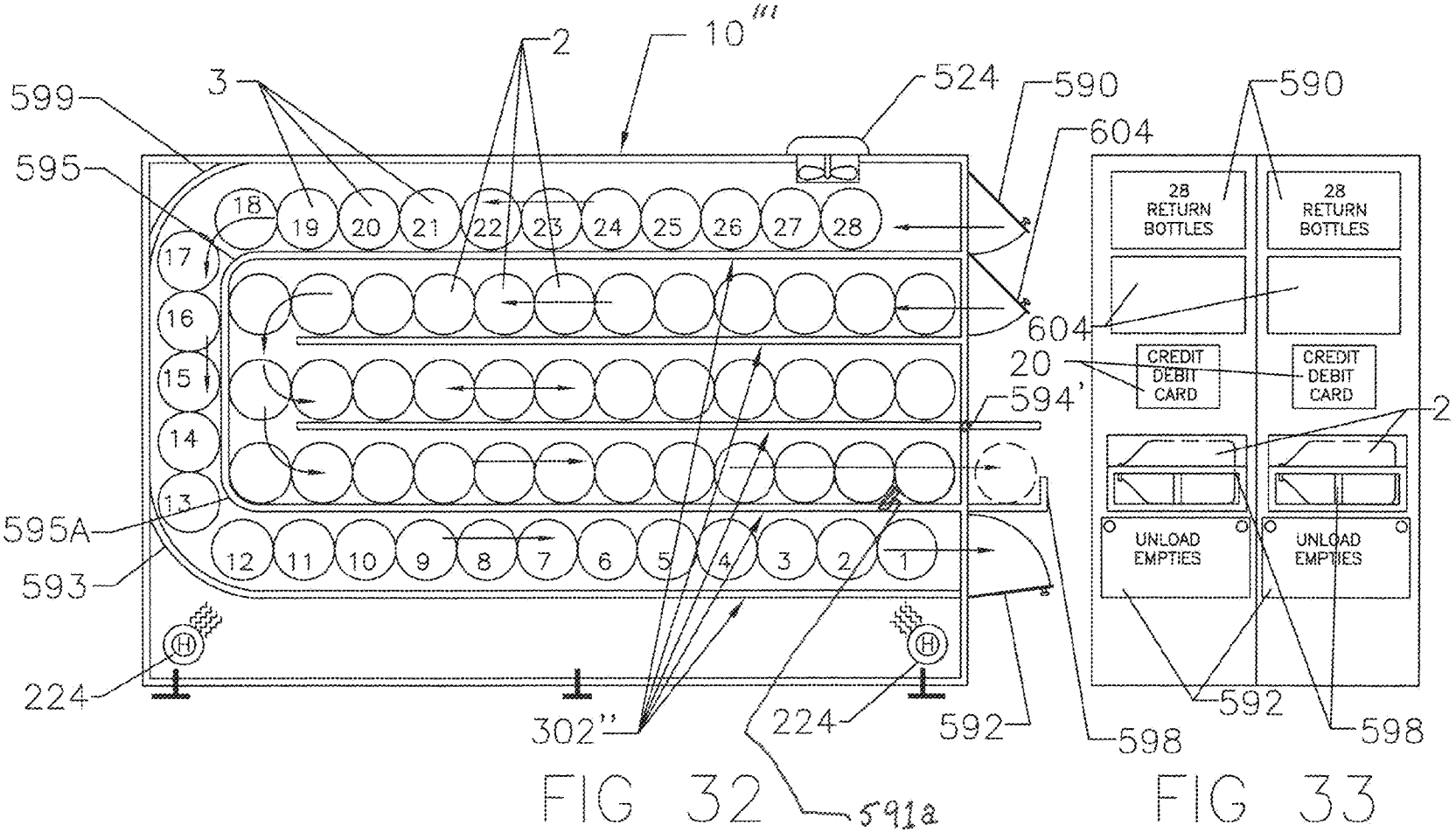
FIG. 32 is a side sectional view of a vending apparatus according to a yet further embodiment of the disclosure.
FIG. 33 is a side sectional view of the embodiment shown in FIG. 32.
Figure 34:
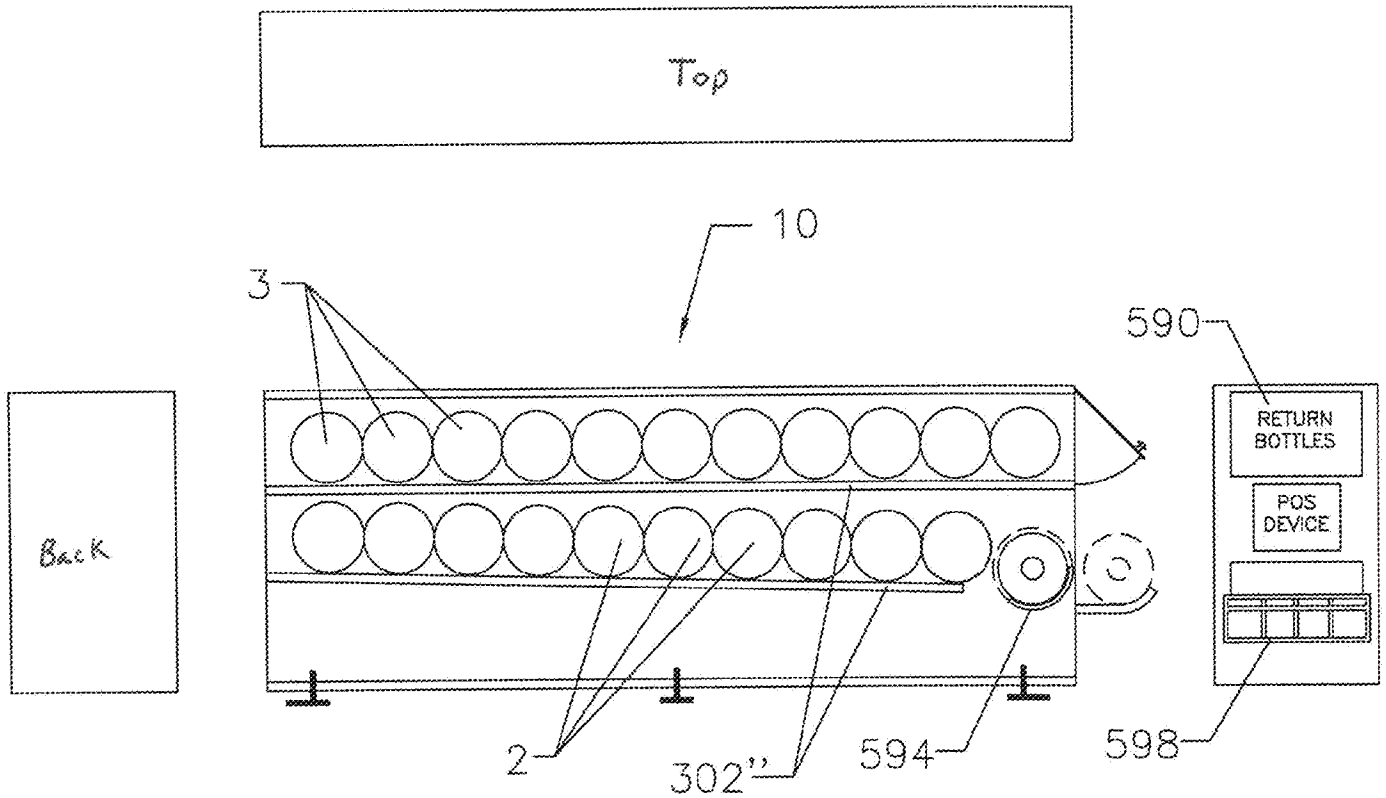
FIG. 34 is a side sectional view of a further embodiment of the disclosure.
Figure 35:
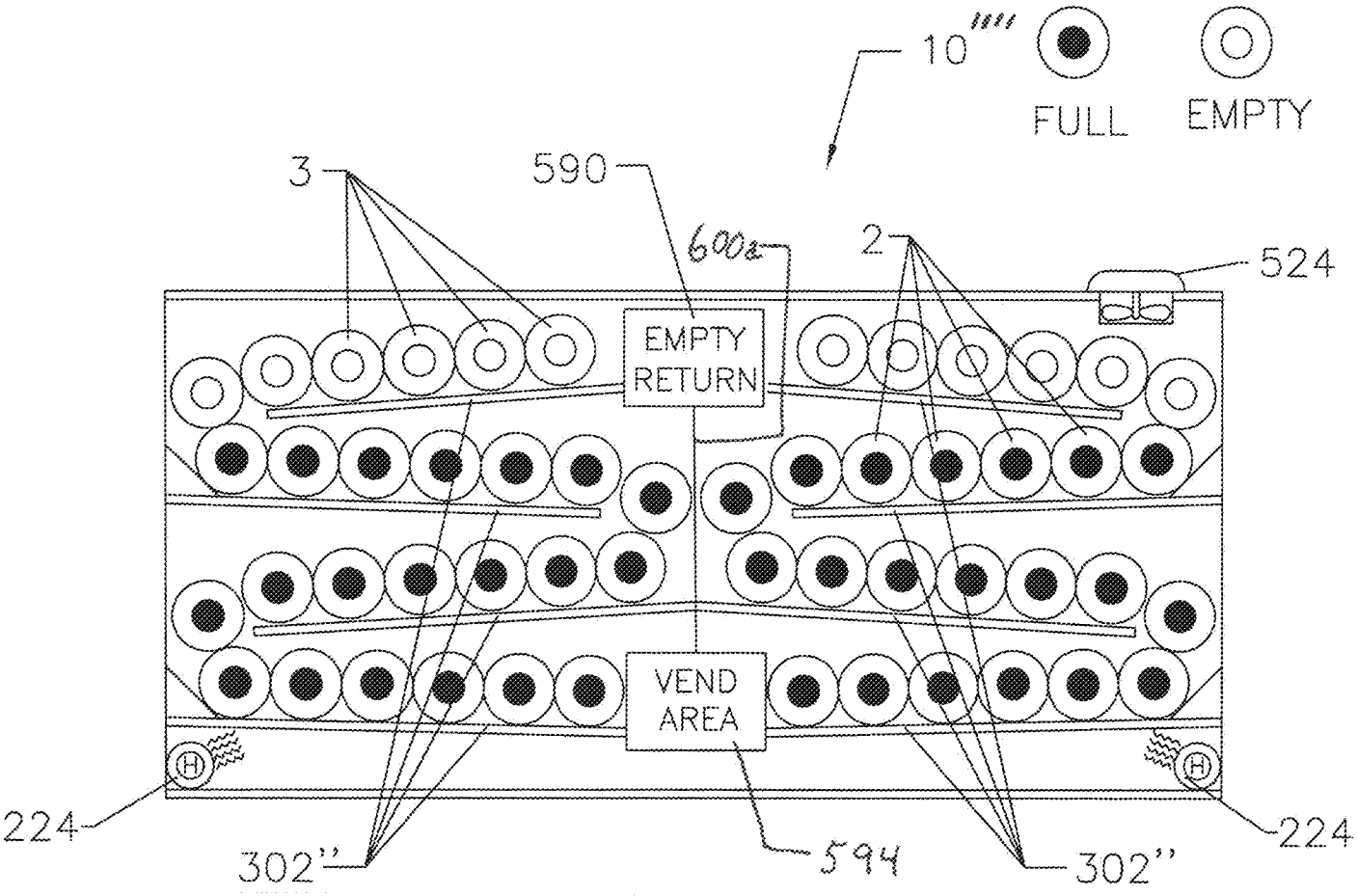
FIG. 35 is a side sectional view of a yet further embodiment of the disclosure.
Figure 37:
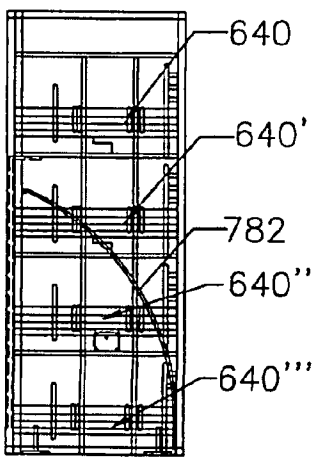
FIG. 37 is a front elevational view of the vending apparatus shown in FIG. 36.

In a yet further aspect of the disclosure, integrated vending/return apparatus 10 shown in FIGS. 28-31 may be modified to include shortened vending rows to allow front loading of full bottles. As shown in FIGS. 32 and 33, vending apparatus 10 includes a plurality of conveyors to receive and vend bottles. The rows may be sloped purposefully to allow gravity to urge bottles in a desired direction. As with other gravity feed embodiments, sloped conveyors may be substituted with substantially level conveyors having power rollers as described herein, or a combination of both.

As shown in FIGS. 32 and 33, apparatus 10 includes a series of stacked conveyors 302". An uppermost conveyor is dedicated to receive return bottles using door 596 as an access way. As with the prior embodiment, the uppermost conveyor includes a radiused transition 595 to a substantially vertical wall that in part defines a substantially vertical return bottle channel connected to a lowermost conveyor that leads to access door 592. As with the prior embodiment, door 592 allows return bottles 3 to be retrieved by the vendor.

To ensure the return bottles travel in the correct direction, the uppermost conveyor is configured with a downward slope going from a front end to a back end of apparatus 10. The lowermost conveyor is configured with a downward slope going from a back end to a front end of apparatus 10. To prevent return bottles 3 from becoming impinged at any of the conveyor transition points, radius 595*a* and 599 may be formed at the junctions. It should be noted that in this embodiment, the back wall of apparatus 10 as well as the back wall of the vending conveyor segment do not include doors. The vending conveyors are completely isolated from the return conveyors.

With respect to the vending conveyors, two or more conveyor rows are stacked as shown in FIG. 32. A topmost vending conveyor extends from a front wall of apparatus 10 to a point distal to a back wall of the vending conveyor segment. The distance between the end of the uppermost conveyor and back wall is dimensioned to allow filled bottles to migrate freely from the uppermost conveyor to one or more lower rows of vending conveyors. The uppermost vending conveyor is configured with a downward slope going from a front end to a back end of apparatus 10. This ensures filled bottles travel to the end of the uppermost vending conveyor and down onto the stacked vending conveyors.

With the exception of the uppermost vending conveyor and the lowermost vending conveyor, each intermediate vending conveyor in this embodiment extends from a point distal to the front wall of apparatus 10 to a point dimensionally similar to the end point of the uppermost vending conveyor. The distance between the front end of the intermediate vending conveyor and the front wall is sufficient to allow filled bottles to travel freely from the intermediate row to the lowermost vending conveyor row. This ensures the free flow of filled bottles along the entire length of the vending conveyors.

With the exception of the uppermost vending conveyor, each vending conveyor, including the lowermost conveyor, is configured with a downward slope going from a back end to a front end of apparatus 10. This ensures bottles 2 move toward the front of apparatus 10 via gravity and/or power roller feed.

The lowermost vending conveyor extends from a front end of apparatus 10 to the vending conveyor segment back wall. Radius 595*a* ensures bottles 2 travelling from the uppermost conveyor will flow freely and smoothly onto the lowermost vending conveyor and toward vend door 594. Like the prior embodiment, apparatus 10 may include a basket 598 to present purchased bottles 2 for retrieval by a customer.

The methods used to return empty bottles 3 and to purchase filled bottles 2 via acceptor 20 is the same as any of the other embodiments disclosed herein. As with the other embodiments, vending doors 594 and return doors 596 are electromechanically locked and unlocked to disallow and allow access, respectively.

To load this embodiment with filled bottles 2, a vendor unlocks and opens fill door 604. In this embodiment, each column in apparatus 10 has a dedicated fill door 604. Bottles are inserted through the door and allowed to travel down the uppermost vending conveyor and to travel down to the lowermost vending conveyor. Once the lowermost vending conveyor is full, the next successive bottle will contact the last bottle in the lower most vending conveyor row and migrate onto the lowest intermediate vending conveyor row until that row is filled as well. The process is continued until each successive intermediate vending conveyor row is filled followed by the uppermost vending conveyor row.

When a purchase is made, the bottle closest to door 594 travels off the front end of the lowermost vending conveyor for retrieval by the purchaser. The filled bottle immediately behind or above the vended bottle will move into the first position adjacent the now closed door 594, ready for the next purchase. A rotating stop rotates into an upward position to arrest movement of the bottle adjacent to the bottle being vended. The rotation of the stop is coordinated with the rotation of door 594 to an open position. When rotating to a closed position, the stop rotates to a down position to allow the next bottle to migrate to the first position via gravity. A similar stop may be positioned at a front end of the row above the vending row to arrest downward migration of bottles from the upper row into the vending position.

Figure 27A:
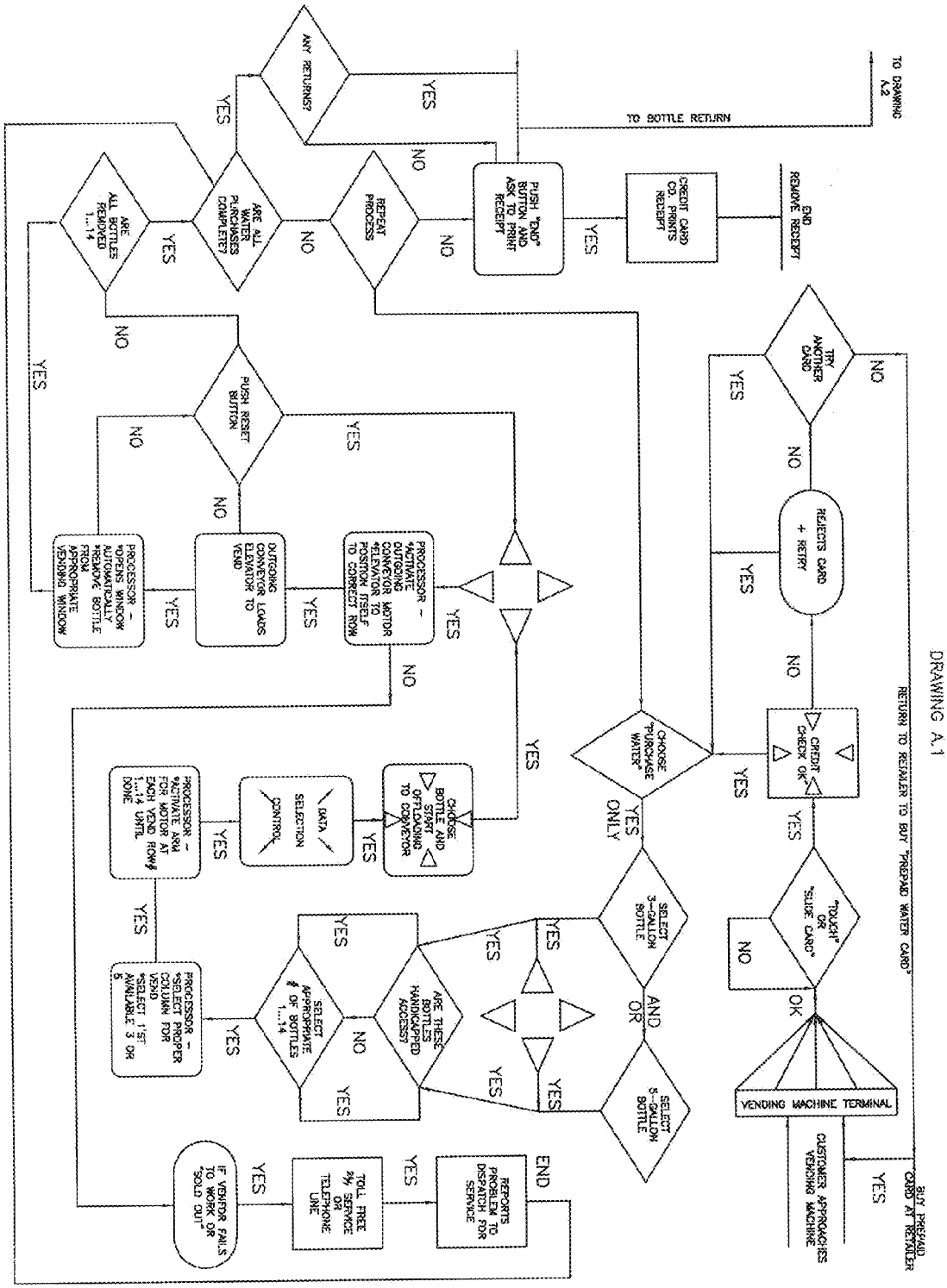
FIG. 27A is a system flow chart for retrieving and returning water bottles, and conducting a paperless transaction for the purchasing and crediting sales/return transactions according to one embodiment of the disclosure.
Figure 27B:
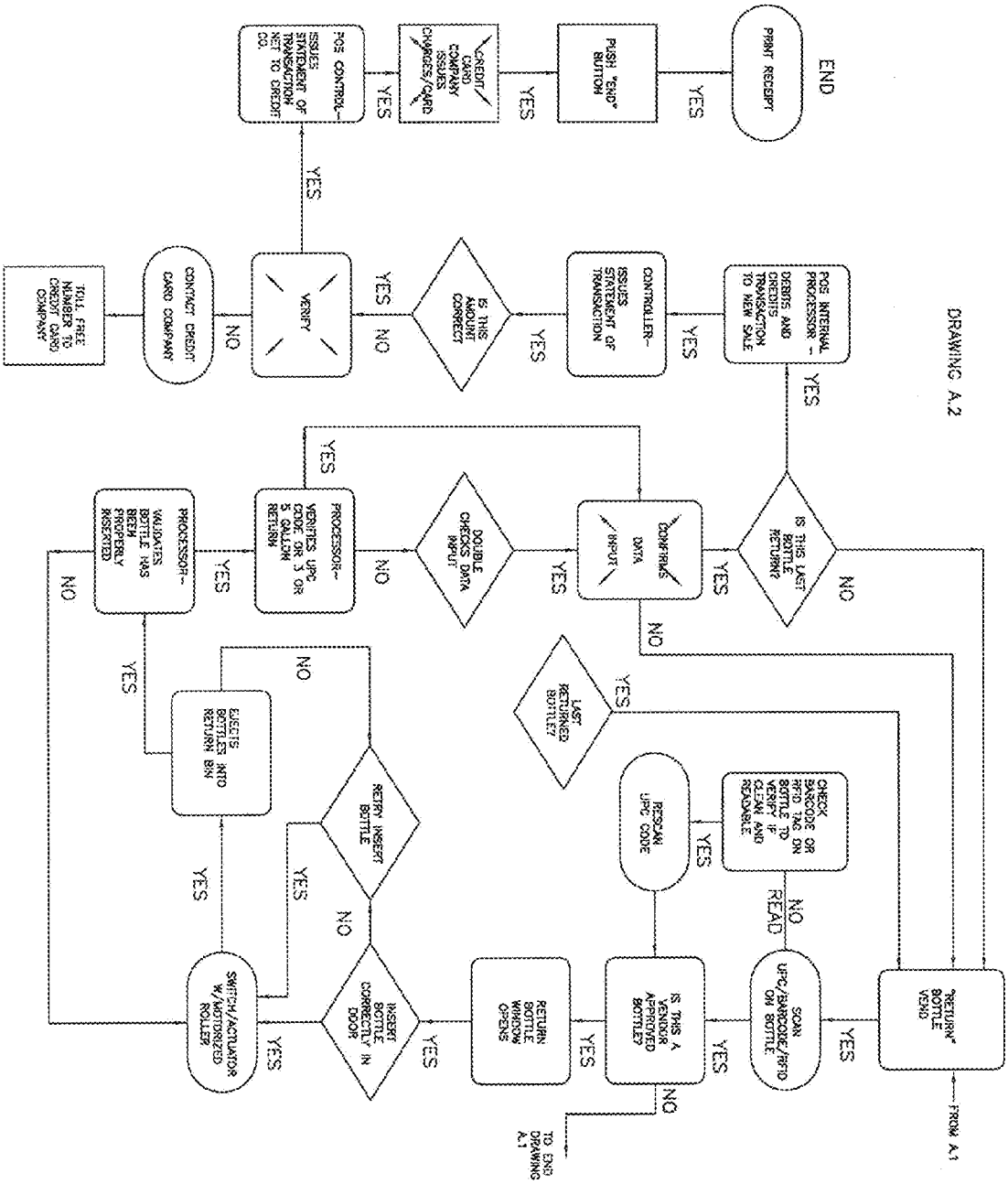
FIG. 27B is a continuation of the system flow chart of FIG. 27A.

In another aspect of the disclosure as shown in FIGS. 27*a* and 27*b*, a bottle vending application is shown generally as 100. The application begins with the customer approaching and operating the vending machine terminal 104. Terminal 104 is configured to receive credit/debit cards and/or prepaid purchase cards 102 purchased from the retailer adjacent the vending apparatus. Depending on the configuration, the customer touches or slides the card in the reader at step 106. If the attempt to engage the reader is unsuccessful, the customer is prompted to try again after a predetermined time period to read the card information lapses. The system may be configured to allow for a predetermined number of tries to have the card read before the system declines to read the card.

If the card is read successfully with the first attempt, or any successive attempt, the system performs a credit check by logging onto the credit card company's website at step 108. If the credit check returns a negative result, the system rejects the card at step 110 and informs the customer with a visual and/or audible prompt to retry entering the card. The system may be configured to allow a predetermined number of tries to retry the card and receive a positive credit check result.

If the customer retries the same card up to the predetermined allotted tries and receives the same negative result, the system prompts the customer to try another card at step 112. The customer can either go or return to the retailer to purchase a prepaid card, or have a defective prepaid card replaced, and try the new or replaced prepaid card. Alternatively, the customer can use a different credit/debit card and engage the card reader at step 106. The presence of a new card resets the predetermined number of tries to either read and/or verify positive credit at steps 106 and 108 respectively.

Once a credit check result is positive, the customer is prompted to purchase water at step 114. To ensure the vendor does not give out credits for third party bottles or for bottles retrieved from prior customers without subsequent purchases, the choice is limited initially to a purchase transaction. The system allows customers the option to obtain credit after the purchase portion of the transaction has been completed as disclosed below. Thus, the first purchase by any customer results in the cost of the bottle being borne by the customer. The customer can also re-sell an empty bottle back to the creditor by purchasing additional units and returning emptied bottles. Thus, a customer may choose to buy only one bottle and leave without a return, or upon a subsequent purchase return the empty from a previous purchase.

In one embodiment, the customer is given the option to select 3-gallon bottles at step 116, 5-gallon bottles at step 118, or a combination of the two by selecting the combo option at step 120. With respect to a vending apparatus incorporating an elevator delivery shelf, the bottles are delivered at approximately a 30 inch height to ensure handicap access. In another embodiment, wherein there are multiple vending doors at different heights, the customer is prompted to select whether the bottles to be delivered require handicap access at step 122. If yes, the vending apparatus discharges purchased bottles from a lower door rather than a higher door. The customer next selects the number of bottles to be purchased in the transaction at step 124.

Once the number (1 . . . n) and size of bottles have been selected, the system processor selects the column from which the bottles will be distributed at step 126 so as to select the first available bottle in a specified row, which represents the oldest bottle present in the vending apparatus. The system processor next selects the row from which the purchased bottles will be delivered at step 128 and activates the motor associated with the particular row until the correct number of bottles purchased has been fed into the vending segment of the vending apparatus. The system then enacts a data selection control to ensure proper alignment of purchase request and vended bottles.

Once a bottle is selected for vending at step 132, the vending apparatus starts the offloading to conveyor process. The processor then selects the row at step 134 and activates the outgoing conveyor motor and operates the elevator to position it to the correct row at step 136. Once the elevator is in the correct position, the outgoing conveyor loads the elevator to vend the bottle at step 144. If the elevator is not loaded, the processor prompts the customer to push a reset button at step 146. The processor then returns to the select row step 134, and again activates the conveyor motor and operates the elevator if not in the correct position relative to the selected row. If either the conveyor motor fails to operate, or the elevator is not positioned correctly relative to the selected row for a second cycle, i.e., a vend failure, or the bottles are in a sold out condition determined at step 138, the processor prompts the customer to call a toll free number for a 24/7 service line at step 140. The customer then reports the problem to a dispatcher for service at step 142.

If the outgoing conveyor successfully loads the elevator to vend at step 144, the processor operates an automated window to open it at step 148. The customer can now remove the selected bottle from the vending apparatus. If the door fails to open, the processor returns to the reset step 146, which either attempts the cycle for a second time, or directs the customer to call the dispatcher if the failure is a second cumulative failure. The row selection, conveyor operation, elevator operation, and door operation cycle is repeated for as many bottles as are purchased.

The system then determines if all purchased bottles have been removed successfully from the appropriate vending window at step 150. If not, the system returns, repeatedly if necessary, to step 148. The system next prompts the customer to confirm whether the water purchase is complete at step 152. If the customer decides to purchase additional bottles at step 154, the system returns to step 114 to allow the customer to select additional bottles. If the customer decides not to purchase additional bottles, the system asks the customer whether the customer wishes to return any empty bottles at step 153. If no, the customer is prompted to push an "End" button and request a printed receipt at step 156. The credit card company processes the transaction and sends instructions back to the system that prompt the system to print a receipt at step 158. The receipt is removed and the transaction completed at step 160.

If the customer selects returns at step 153, the system goes to the return bottle cycle at step 162. The customer is prompted to scan a UPC and/or barcode, RFID marking/label at step 164. If the system fails to read the code, the customer is prompted to check the barcode label to determine if it is clean and readable at step 166. The customer is then prompted to try to rescan the code at step 168.

If the scan is successful at either step 164, or upon retry at step 168, the system determines if the return bottle is a "vendor approved" bottle at step 170. If not, the customer is asked whether this is the last return bottle at step 171. If yes, the system goes to 156 and prompts the customer to push the "End" button to begin the final transaction sequence. If not the last return bottle, the system returns the customer to step 162 to begin the next return bottle cycle.

If the bottle is determined to be a vendor approved bottle at step 170, the return bottle window opens at step 172. The customer then inserts the bottle in the correct geometric orientation to match the geometric configuration of the return bottle window opening at step 174. If the bottle is successfully inserted, a switch/activator with motorized roller is activated at step 180 to eject the bottle into the return bin at step 178.

If the bottle is not properly inserted into the return bottle window, the customer is prompted to retry at step 176. If successful, the switch/activator is activated at step 180. If not, the customer is directed to call the toll free 24/7 service number at step 138. If the problem is not resolved, the customer is next asked if there are any other return bottles at step 177. If yes, the system returns to step 162. If no, the system goes to step 156 to complete the transaction.

If the bottle is successfully deposited into the return bin, the processor validates that the bottle has been properly inserted at step 182. If no, the system returns to step 180 to begin the insertion process again. If yes, the system verifies the "serialized" UPC and/or RFID code of the 3 or 5 gallon bottle return at step 184. If verification is not successful, the system rechecks the code at step 186. If the code isn't verified, the system cancels the original UPC code scan and sends the customer back to step 162 to start the return process again. If the code is confirmed at step 188, the system queries the customer whether the processed return bottle is the last bottle at step 190. If no, the system returns the customer to step 162 to begin processing the next return bottle. If yes, the system combines the debit and credit transactions to arrive at a net sale at step 192.

If the customer uses a pre-paid card to pay for water and has returns, the customer may simply return the bottle as usual and the "prepaid water card" will be reimbursed for the transaction as if the customer had "paid additional funds"—similar to a prepaid "transit card" whereby the card can be "recharged by putting it back into a transit card machine and paying additional money. The system controller issues a net statement of transaction at step 194. The customer is now queried as to the correctness of the amount at step 196. The system receives the customer's verification input at step 198. If the amount is disputed, the system prompts the customer to contact the credit card company at step 200. The customer is given a toll-free number to the credit card company at step 202.

If the amount is correct, the system issues a statement of the net transaction to the credit card company at step 204. The charges are processed by the credit card company and transmitted to the vendor's account at step 206. Once the system receives verification that the transaction has been completed with the credit card company, the customer is prompted to push an "END" button at step 208 to end the transaction. The system prints a receipt and the transaction is completed at step 210.

Figure 36:
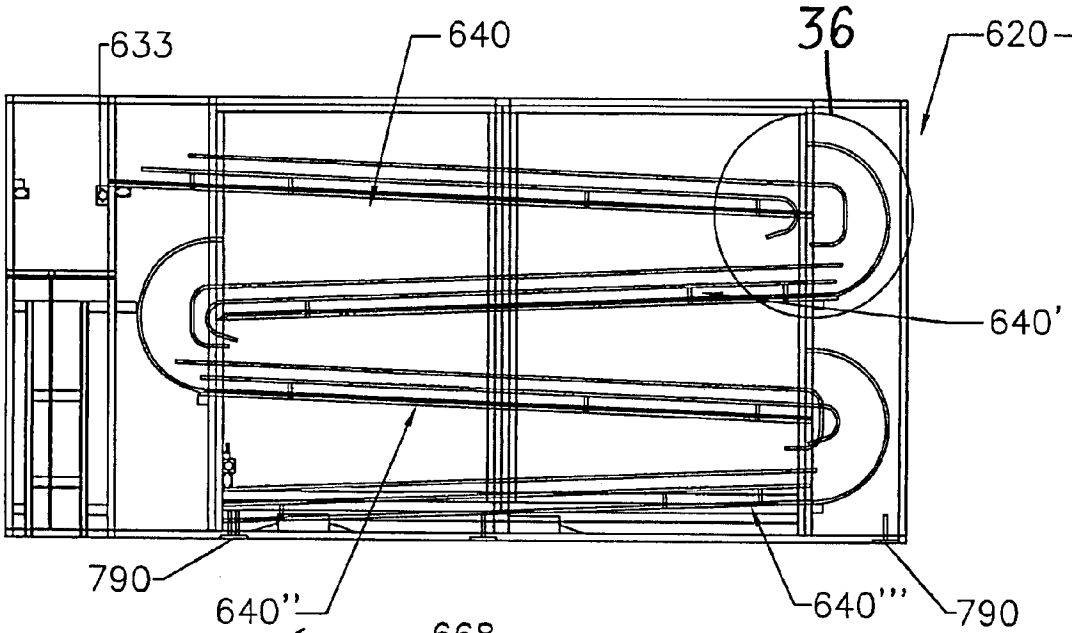
FIG. 36 is a side elevational view of a vending apparatus according to a still further embodiment of the disclosure.
Figure 38:
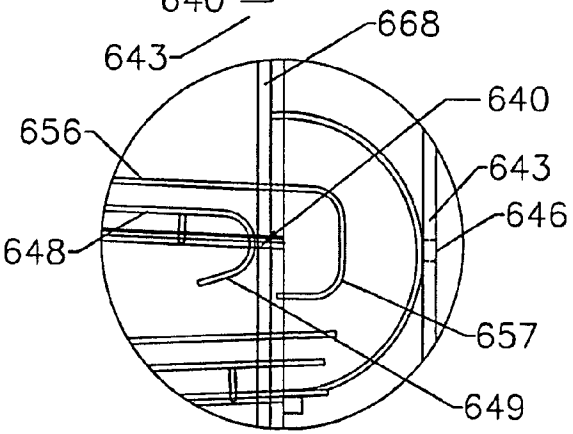
FIG. 38 is an expanded view of area A shown in FIG. 36.
Figure 87:
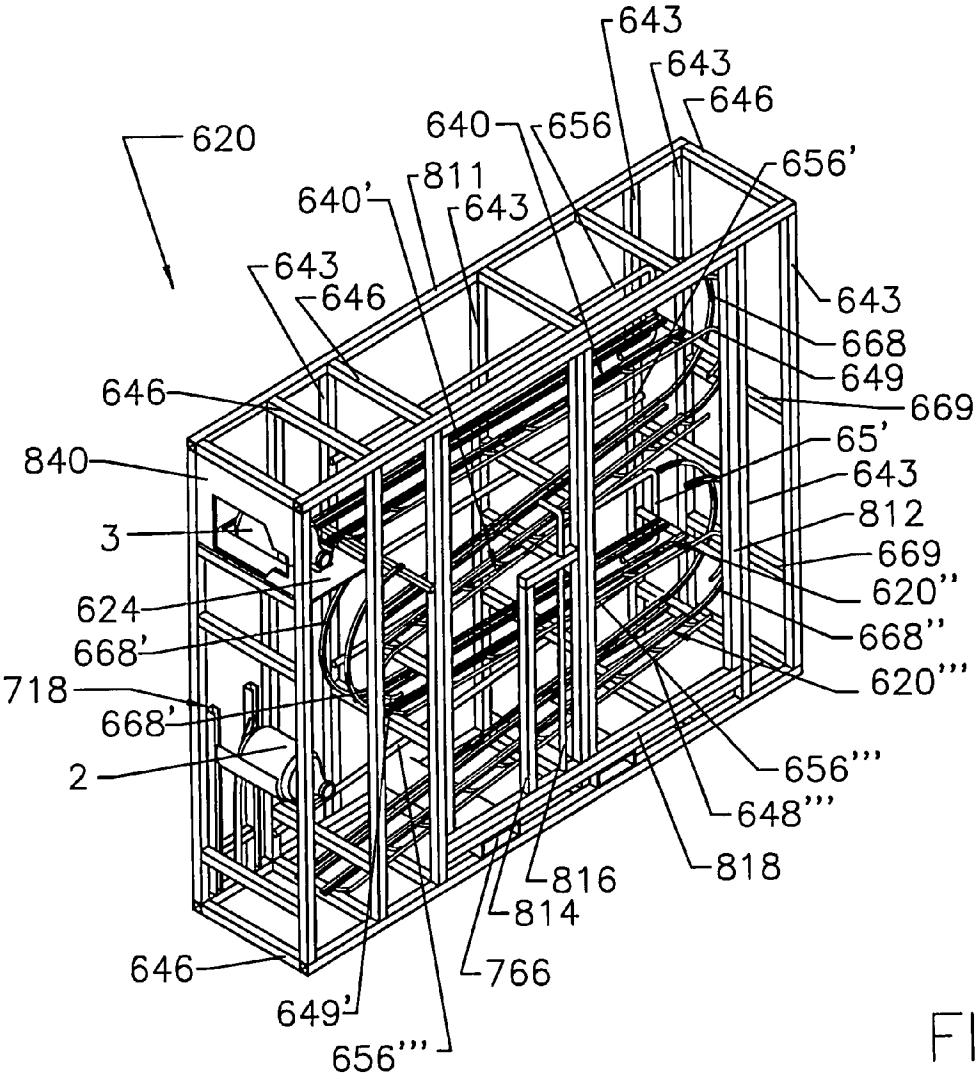
FIG. 87 is a perspective view of the vending apparatus according to the embodiment of the disclosure shown in FIG. 36.

In a still further aspect of the disclosure, a unified bottle vend/bottle return apparatus, shown generally as 620 in FIGS. 36 and 87, is configured to receive return bottles 3 and vend full bottles 2 using the same conveyor track assemblies. This embodiment incorporates a series of gravity-fed conveyor track assemblies arranged in alternating grade orientations with each conveyor track set to a precise grade range and coupled with a series of strategically-positioned inertia restriction devices to accommodate both full and empty bottles in a wide variety of commercially available sizes. The combination of conveyor track assemblies and inertia restrictors enables a gravity fed conveyor system to advance bottles to a vending segment without the need of power assistance.

In its broadest aspect, a power-actuated cradle receives empty return bottles and delivers them to the conveyor system. A power-actuated elevator receives filled bottles from the conveyor system and elevates the bottles to a universally accommodating height for customer retrieval. A series of sensors monitors return bottles and full bottles to ensure proper receipt of vendor-accepted empty bottles and proper delivery of full bottles from the supply stored on the conveyor system.

In this embodiment, return bottles 3 are loaded into the apparatus via a return door 622 having a solenoid-actuated lock 623, such as an Eaton solenoid interlock (Eaton Corp., Windsor, Conn.). A door lock sensor 625 which may be in the form of an Eaton limit switch may be used to detect door orientation status. Lock 623 is disengaged by receiving a signal from the processor when a customer has initiated a vend event.

Once return door 622 has been opened, the customer may be confronted by a form configured in the shape of acceptable return bottles positioned inside door 622 on a plane orthogonal to the plane occupied by the door. It should be understood that the form is an optional element that can be removed without compromising the function of the apparatus. Its use, however, should improve reception of vendor-approved empty bottles 3. When used, the form provides a visual and physical alignment system to ensure customers orient the return bottles in one orientation to allow the sensors to determine if the bottle is a vendor accepted variety. Once a return bottle is placed into the form, the bottle falls onto a bottle cradle 624. Bottle cradle 624 receives return bottle 3 and allows for sensors to ascertain whether return bottle 3 is a vendor approved bottle subject to a credit transaction. If approved, cradle 624 is rotated to urge the bottle onto a first track assembly 640.

Figure 48:
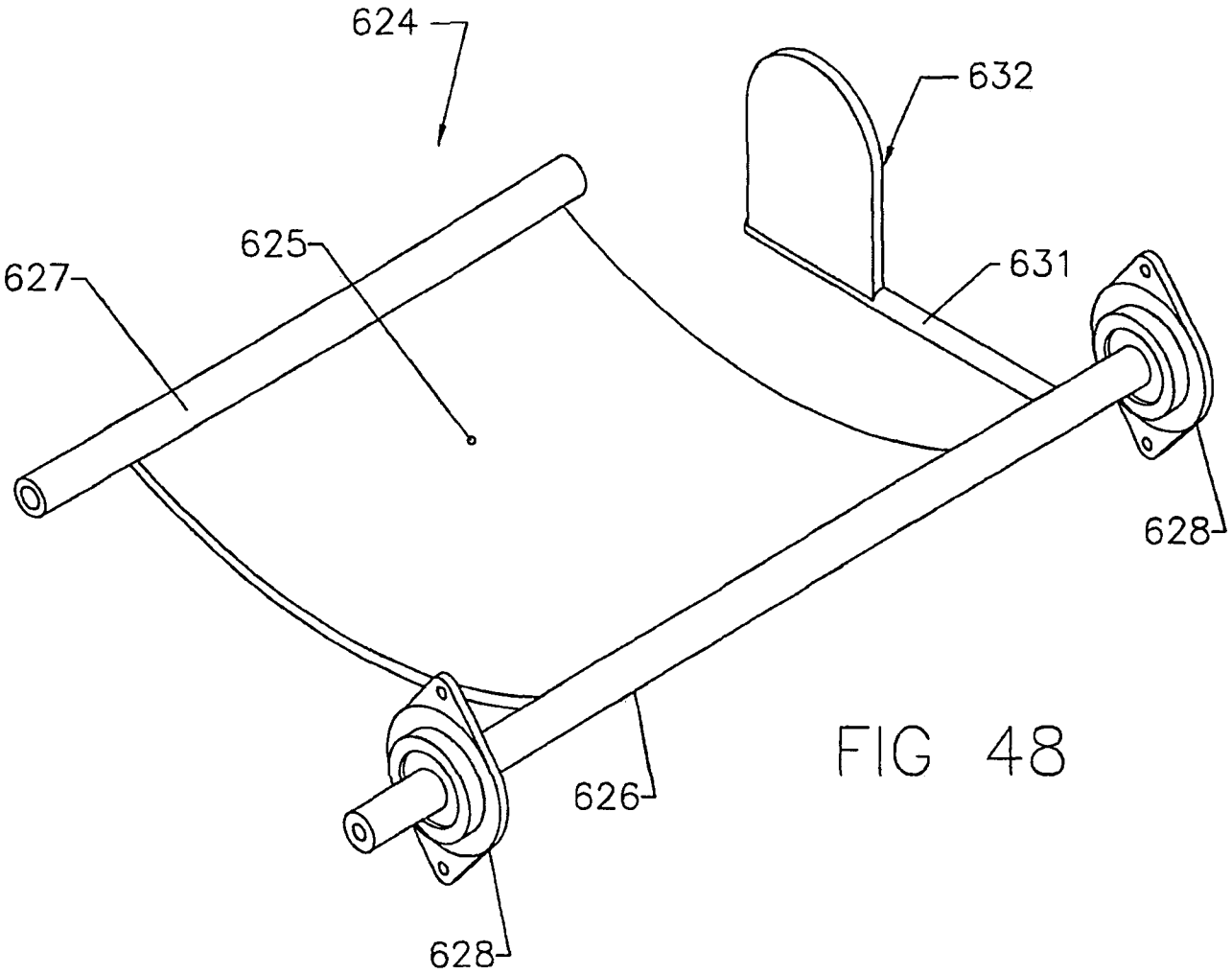
FIG. 48 is a perspective view of a return bottle cradle assembly according to the embodiment shown in FIG. 36.
Figures 49, 50, 51, 52:
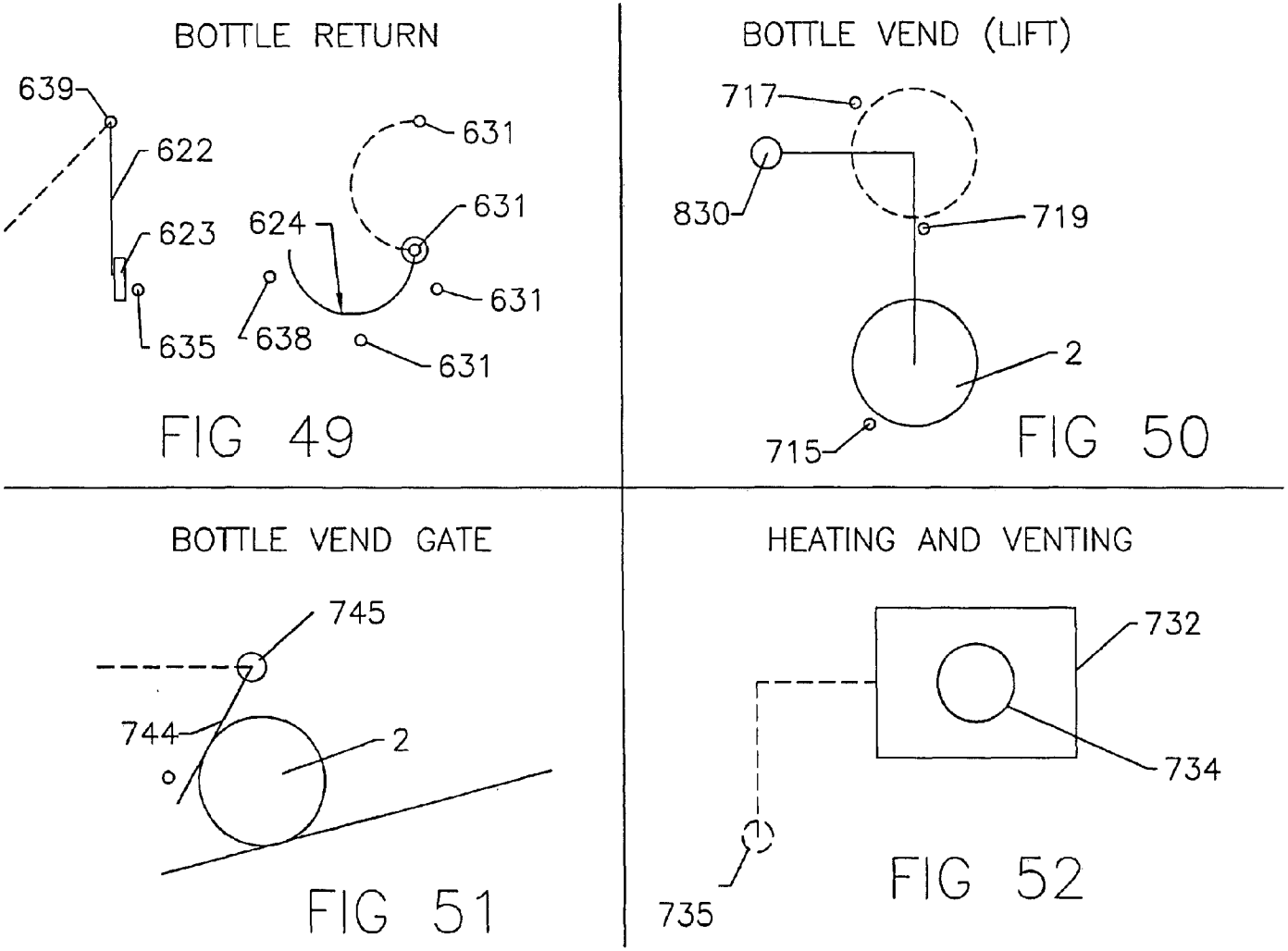
FIG. 49 is an operational schematic in partial phantom of the combination return door and return bottle cradle assembly according to the embodiment shown in FIG. 36.
FIG. 50 is an operational schematic in partial phantom of the elevator according to the embodiment shown in FIG. 36.
FIG. 51 is an operational schematic in partial phantom of the bottle vend gate according to the embodiment shown in FIG. 36.
FIG. 52 is an operational schematic of the heating and venting assembly according to the embodiment shown in FIG. 36.

More specifically as shown in FIGS. 48 and 49, cradle 624 is configured as a partial cylindrical segment to substantially conform to the basic shape of the vendor-approved round bottles. The complimentary shape of cradle 624 allows return bottles introduced into apparatus 620 to loosely nest in the cradle so as to become stationary. A front edge of cradle 624 is secured to a rotatable axle 626 the ends of which are secured in bearing mounts 628 to allow rotation of the axle. A "c-axis" motor 630 is connected to one end of axle 626 to provide a means to rotate the axle and attached cradle. Motor 630 may be a Molon 24v gear motor (McMaster Carr, New Brunswick, N.J.).

To determine if a bottle placed in the return bin is a vendor approved bottle, a series of sensors are strategically placed in the return bin segment to sense and retrieve the data necessary to make the determination. An optional empty bottle back rest 632 is secured to and extends from axle 626 so as to substantially align with the center axis of cradle 624. Back rest 632 ensures proper horizontal alignment of a return bottle to allow for transmission of the return bottle further into the apparatus.

A first sensor 634 is positioned relative to cradle 624 to sense the length of return bottle 3. A second sensor 636 senses a second length of the bottle so as to distinguish between 3 gallon and 5 gallon bottles. Two outside diameter sensors, 637 and 638, are used to determine bottle diameter to ensure a vendor-approved bottle has been deposited in the return bin. The O.D. sensors are positioned on either side of cradle 624 (as shown in FIG. 49), to ensure any bottle placed in the return bin will be detected and identified. Eaton limit switches, which require mechanical registration with triggers may be used for this purpose. (Eaton Corp., Windsor, Conn.).

Each sensor determines length relative to a back rest 632 used as a reference point. If neither sensor is tripped, the return bottle is rejected and the customer is instructed to remove the bottle with a prompt described below. If a valid bottle is detected, the customer is given the designated credit and the system sends a signal to motor 633 to rotate cradle 624 to propel return bottle 3 onto first track assembly 640. A cradle limit switch 636 is used to determine when cradle 624 has rotated sufficiently to propel empty bottle 3 onto track assembly 640 described below. Mechanical registration against the trigger of limit switch 636 sends a signal to the processor, which sends a signal to motor 633 to reverse and return cradle 624 to a start position, ready to receive another empty bottle 3.

To control the travel velocity of return bottle 3, an arrestor flap 638 creates drag to offset the kinetic energy imparted to return bottle 3 by the rotation of cradle 624. Arrestor flap 628 also provides a secondary function by acting as a barrier to weather related elements entering the apparatus from the return bottle segment.

To the inventors' surprise, the use of the same track assemblies to vend filled bottles and receive empty bottles required specific track assembly configurations and selectively placed inertia retarders to ensure continuous aligned travel of each bottle to forward positions regardless of the wide disparity in weights and moments of inertia prevalent with bottles having different sizes and different fill conditions. The specifics of those findings are as follows.

First track assembly 640 is positioned to the side of cradle 624 as shown in FIG. 36. Assembly 640 employs a series of tracks and asymmetric rails to accommodate bottles having asymmetric longitudinal cross sections due to the bottle necks presenting a different cross-sectional profile than the bottle bottoms. As shown more particularly in FIGS. 39-41, track rails 642 are substantially parallel and spaced to match the spacing of annular channels formed on the outside of the bottles. Rails 642 may be coated with a lubricous surface treatment such as Teflon® to reduce frictional resistance of bottle travel. Rails 642 may be constructed from steel, iron-based materials, engineering-grade plastics and the like. Bottles introduced into the apparatus travel along track rails 642 by engaging the rails with the annular channels. This interaction assists in the alignment of the bottles as they travel along the track system.

Track rails 642 are secured to support plates 644. A single support plate 644 may secure both rails to the apparatus, or two plates may be used, each dedicated to a single rail. Support plates 644 are secured to rail support beams 645, which lie substantially below track rails 642 and are intersected by substantially orthogonally oriented cross beams 646. Cross beams 646 are secured, in turn, to the apparatus' internal framework—including vertical frame members 643.

To further assist the alignment function of track rails 642, a pair of asymmetrically positioned guide rails are provided on either sides of the track rails to prevent lateral migration of bottles as they move along the rails, or while the bottles remain stationary waiting for further advancement along the rail system as bottles are purchased and removed from the apparatus. More specifically, neck rail 648 is positioned on the side of track rails 642 that receives the bottle neck portion of the bottles. Neck rail 648 is secured to rail support beam 645 by a plurality of rail connectors 650 that extend laterally from beams 645. Connectors 650 have an elbow-shaped profile and extend upwardly above the plane of track rails 642 to support neck rail 648 above the track rails.

To ensure the smooth flow of bottles along neck rail 648, the end of rail 648 proximal to the cradle 624 may have a radiused curve 649 that extends laterally so that the proximal end is joined to the apparatus frame. A distal end of the rail is bent into a circular shape that extends downwardly past and below the end of track rails 642. When a bottle is thrust onto track assembly 640, rail 648 presents a smooth surface to transition and urge the bottle to an aligned position on track rails 642.

To prevent lateral migration of the bottles from the bottom end side of the bottles, bottom guide rail 656 is positioned above, and lateral to, track rail 642 on the side opposite neck rail 648. Do to the substantially planar surface of the bottle bottom surface, bottom guide rail 656 is positioned higher than neck rail 648 to provide better support for the relatively larger bottom surface. Bottom rail 656 may be positioned to contact the bottles throughout their travel along track assembly 640, or may be positioned to leave a relatively small gap between the bottle and rail to reduce or eliminate frictional resistance to bottle movement.

Figure 40:
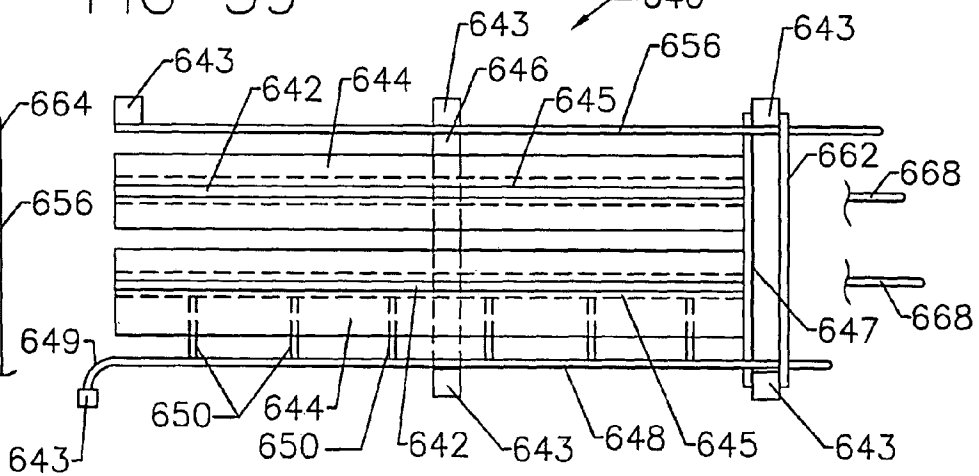
FIG. 40 is a top view of the track subassembly shown in FIG. 39.
Figure 41:
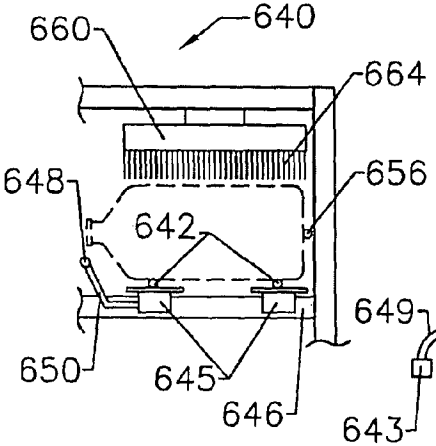
FIG. 41 is an end view of the track subassembly shown in FIG. 39.

In an embodiment where bottom guide rail 656 is positioned toward the back of the apparatus, rail 656 is secured directly to the apparatus frame rather than rail support beam 645 as shown in FIGS. 40 and 41. Alternatively, bottom guide rail 656 can be connected and supported by rail support beam 645 with the use of rail connectors as used for neck rail 648. An end of bottom rail 656 proximal to cradle 624 is secured to the apparatus frame via welding, mechanical fasteners and the like. It may be secured directly to a frame member, or separated as its positioning may require. It can end as a blunt rod, or include a radiused curve to provide a smooth transitional surface to receive a bottle pushed onto track assembly 640 by cradle 624.

It should be understood the orientation of the guide rails relative to the apparatus is dictated by the orientation of the bottles placed on the conveyor system. In an alternative embodiment, the necks of the bottles can be oriented toward the back of the apparatus whereby the guide rails are reversed with the neck rail positioned toward the back of the apparatus and the bottom rail positioned toward the front of the apparatus. Either configuration should be well within the contemplation of this disclosure and fully understood by those having ordinary skill in the art.

Figure 39:
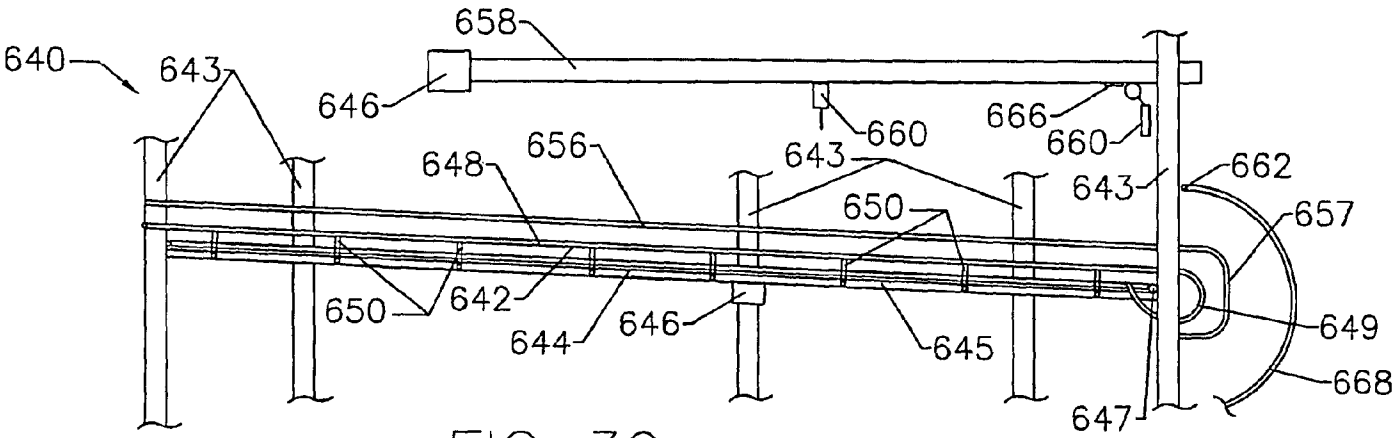
FIG. 39 is a side elevational view of a combination first track subassembly and curve according to the embodiment shown in FIG. 36.

As shown in FIGS. 39 and 41, an inertia restrictor support beam 658 is secured above track assembly 640 to support inertia restrictors 660. Beam 658 is secured to the apparatus via cross beam 646 and supported at a distal end by cross rod 662. Cross rod 662 is positioned on, and secured to vertical frame member 643 to align cross beam 646 in a substantially parallel orientation to the plane occupied by track assembly 640. Suspended from beam 658 are inertia restrictors 660 that include brush-like bristles 664 configured and positioned to contact bottles and reduce the inertia of bottles traveling past the restrictor as well as to align empty bottles with track assembly 640. Bristles 664 may be constructed from synthetic materials that exhibit little or no movement memory so as to return to a start position after flexing from the force imparted by a passing bottle. To provide further control over the amount of inertia restriction imparted onto the bottles, one or more inertia restrictors may be secured to beam 658 via hinge 666. Hinged restrictors as shown in FIG. 39, allow additional resistive force to be applied to bottles without halting forward progress of the bottles based upon gravity driven motion.

Location of the inertia restrictors 660 is driven by a need to align empty bottles as they travel along the conveyor path. It has been discovered that placement of inertia restrictors is particularly advantageous if placed at or in close proximity to the end of a track assembly such as track assembly 640. This allows sufficient kinetic energy to be drawn from the empty bottle to allow a smooth transition to a lower track assembly when the bottle enters radiused track assembly transition guide rails 668. As can be seen in the drawings, once in the transition guide rail area, the bottle experiences a moment of free fall that dramatically increases its kinetic energy that is, in part, imparted to the immediately preceding bottle. An additional inertia restrictor 660 may also be secured at, or in close proximity to, the beginning of a track assembly to reduce the kinetic energy generated in the transition area. Further inertia restrictors 660 may be located along a track assembly spaced approximately two bottle widths apart. More inertia restrictors may be placed on the lowest most track assembly as that is where kinetic energy buildup is greatest. However, it has been found that inertia restrictors are needed more on the intermediate track assembly levels than the first level due to the buildup of kinetic energy. It has been further discovered that no inertia restrictors are needed on the fourth and final track assembly as the assembly is filled with full and empty bottles at all times such that bottles on this track assembly only move in incremental, one-bottle diameter distances at a time.

A particularly robust inertia restrictor 660*a* (similar to inertia restrictor 660' shown in FIGS. 75 and 76), may be used at, or in close proximity to, the proximal end of track assembly 640 to absorb the relatively large amount of kinetic energy imparted on empty bottles urged onto the track assembly by cradle 624. Inertia restrictor 660*a* may be constructed as a solid hinged panel that rotates with the force exerted by an empty bottle being urged onto track assembly 640. Inertia restrictor 660*a* returns to its resting position either via gravity and/or spring actuated means.

Figure 42:
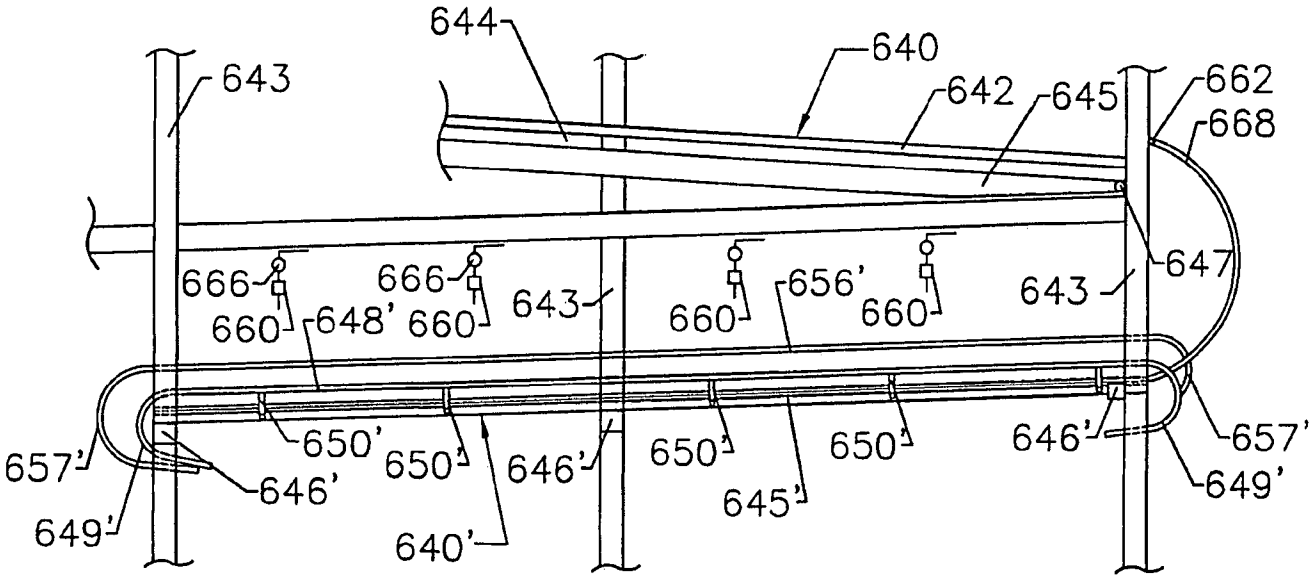
FIG. 42 is a side elevational view of a combination second track subassembly and curve according to the embodiment shown in FIG. 36.
Figures 43, 44:
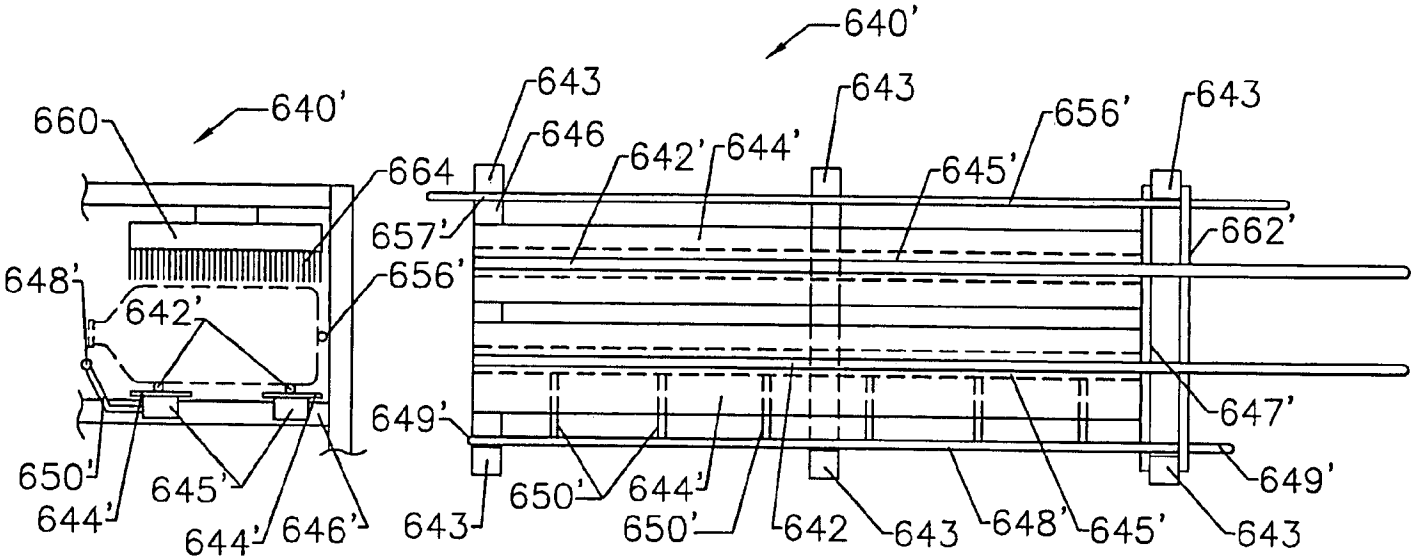
FIG. 43 is a top view of the track subassembly shown in FIG. 42.
FIG. 44 is an end view of the track subassembly shown in FIG. 42.

Referring now to FIGS. 42-44, second track assembly 640' is shown positioned below first track assembly 640. Second track assembly 640' is constructed from substantially the same components as first track assembly 640 with the notable exception the leading end of the second track assembly has substantially the same radiused or turned bottle rail guide ends as its trailing end. This substantially mirror image configuration conforms with one of the primary purposes of second track assembly 640' as a transitional track assembly that allows bottles, filled or empty, to transition from the first track assembly to lower track assemblies and ultimately, to elevator 702. And, of course, the slope or grade of second track assembly 640' is opposite that of first track assembly 640 to continue the gravity assisted migration of bottles from the high point of first track assembly 640 to the end of a fourth track assembly 640''' described below.

More specifically, second track assembly 640' comprises second track rails 642' configured to be substantially parallel and spaced to substantially match the spacing of the annular channels formed on the outside of the bottles. Rails 642' may be coated also with a lubricous surface treatment such as Teflon® to reduce frictional resistance of bottle travel. Rails 642' may be constructed from steel, iron-based materials, engineering-grade plastics and the like. Bottles introduced into the apparatus travel along track rails 642' by engaging the rails with the annular channels. This interaction assists in the alignment of the bottles as they travel along the track system.

Track rails 642' are secured to support plates 644'. A single support plate 644' may secure both rails to the apparatus, or two plates may be used, each dedicated to a single rail. Support plates 644' are secured to rail support beams 645', which lie substantially below track rails 642' and are intersected by substantially orthogonally oriented cross beams 646'. Cross beams 646' are secured, in turn, to the apparatus' internal framework—including vertical frame members 643.

To further assist the alignment function of track rails 642', a pair of asymmetrically positioned guide rails are provided on either sides of the track rails to prevent lateral migration of bottles as they move along the rails, or while the bottles remain stationary waiting for further advancement along the rail system as bottles are purchased and removed from the apparatus. More specifically, neck rail 648' is positioned on the side of track rails 642' that receives the bottle neck portion of the bottles. Neck rail 648' is secured to rail support beam 645' by a plurality of rail connectors 650' that extend laterally from beams 645'. Connectors 650' have an elbow-shaped profile and extend upwardly above the plane of track rails 642' to support neck rail 648' above the track rails.

To ensure the smooth flow of bottles along neck rail 648', the end of rail 648' proximal to the end of first track assembly 640 may have a radiused curve 649'. A distal end of the rail is bent into a circular shape that extends downwardly past and below the end of track rails 642'. When a bottle is thrust onto second track assembly 640', rail 648' presents a smooth surface to transition and urge the bottle to an aligned position on second track rails 642'.

To prevent lateral migration of the bottles from the bottom end side of the bottles, bottom guide rail 656' is positioned above, and lateral to, track rail 642' on the side opposite neck rail 648'. Do to the substantially planar surface of the bottle bottom surface, bottom guide rail 656' is positioned higher than neck rail 648' to provide better support for the relatively larger bottom surface. Bottom rail 656' may be positioned to contact the bottles throughout their travel along track assembly 640', or may be positioned to leave a relatively small gap between the bottle and rail to reduce or eliminate frictional resistance to bottle movement.

In an embodiment where bottom guide rail 656' is positioned toward the back of the apparatus, rail 656' is secured directly to the apparatus frame rather than rail support beam 645' as shown in FIGS. 40 and 41. Alternatively, bottom guide rail 656' can be connected and supported by rail support beam 645 with the use of rail connectors as used for neck rail 648'. An end of bottom rail 656' proximal to first track assembly 640 is secured to the apparatus frame via welding, mechanical fasteners and the like. It may be secured directly to a frame member, or separated as its positioning may require. It can end as a blunt rod, or include a radiused curve to provide a smooth transitional surface to receive a bottle migrating onto second track assembly 640'.

It should be understood the orientation of the guide rails relative to the apparatus is dictated by the orientation of the bottles placed on the conveyor system. In an alternative embodiment, the necks of the bottles can be oriented toward the back of the apparatus whereby the guide rails are reversed with the neck rail positioned toward the back of the apparatus and the bottom rail positioned toward the front of the apparatus. Either configuration should be well within the contemplation of this disclosure and fully understood by those having ordinary skill in the art.

As shown in FIGS. 39 and 41, an inertia restrictor support beam 658' is secured above track assembly 640' to support inertia restrictors 660'. Beam 658' is secured to the apparatus via cross beam 646 and supported at a distal end by cross rod 662. Cross rod 662 is positioned on, and secured to vertical frame member 643 to align cross beam 646 in a substantially parallel orientation to the plane occupied by second track assembly 640'. Suspended from beam 658' are inertia restrictors 660' that include brush-like bristles 664' configured and positioned to contact bottles and reduce the inertia of bottles traveling past the restrictor as well as to align empty bottles with track assembly 640'. Bristles 664' may be constructed from synthetic materials that exhibit little or no movement memory so as to return to a start position after flexing from the force imparted by a passing bottle. To provide further control over the amount of inertia restriction imparted onto the bottles, one or more inertia restrictors may be secured to beam 658' via hinge 666'. Hinged restrictors as shown in FIG. 39, allow additional resistive force to be applied to bottles without halting forward progress of the bottles based upon gravity driven motion.

Location of the inertia restrictors 660' is driven by a need to align empty bottles as they travel along the conveyor path. It has been discovered that placement of inertia restrictors is particularly advantageous if placed at or in close proximity to the end of a track assembly such as second track assembly 640'. This allows sufficient kinetic energy to be drawn from the empty bottle to allow a smooth transition to a lower track assembly when the bottle enters radiused track assembly transition guide rails 668'. As can be seen in the drawings, once in the transition guide rail area, the bottle experiences a moment of free fall that dramatically increases its kinetic energy that is, in part, imparted to the immediately preceding bottle. An additional inertia restrictor 660' may also be secured at, or in close proximity to, the beginning of a track assembly to reduce the kinetic energy generated in the transition area. Further inertia restrictors 660' may be located along a track assembly and may be spaced approximately two bottle widths apart in one configuration. More inertia restrictors may be placed on the lowest most track assembly as that is where kinetic energy buildup is greatest.

Figure 45:
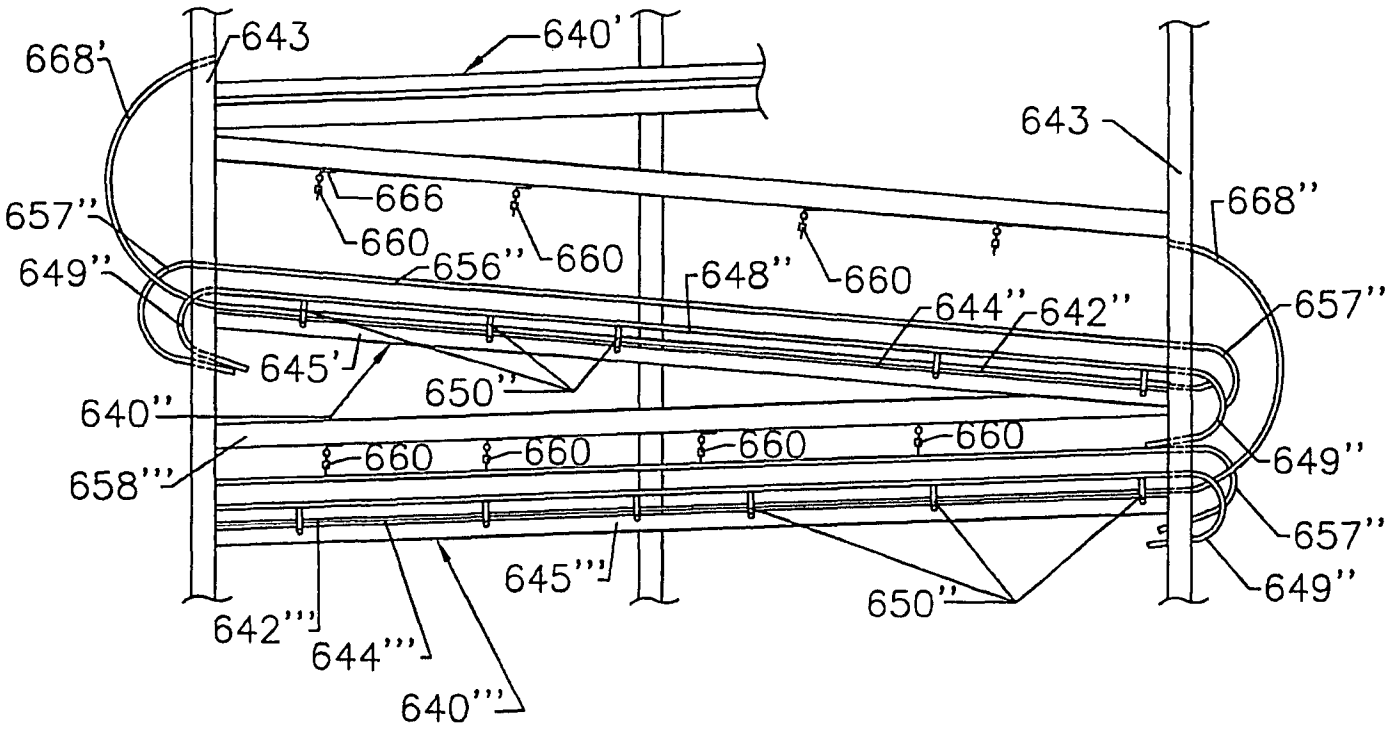
FIG. 45 is a side elevational view of a combination third and fourth track subassemblies according to the embodiment shown in FIG. 36.
Figure 46:
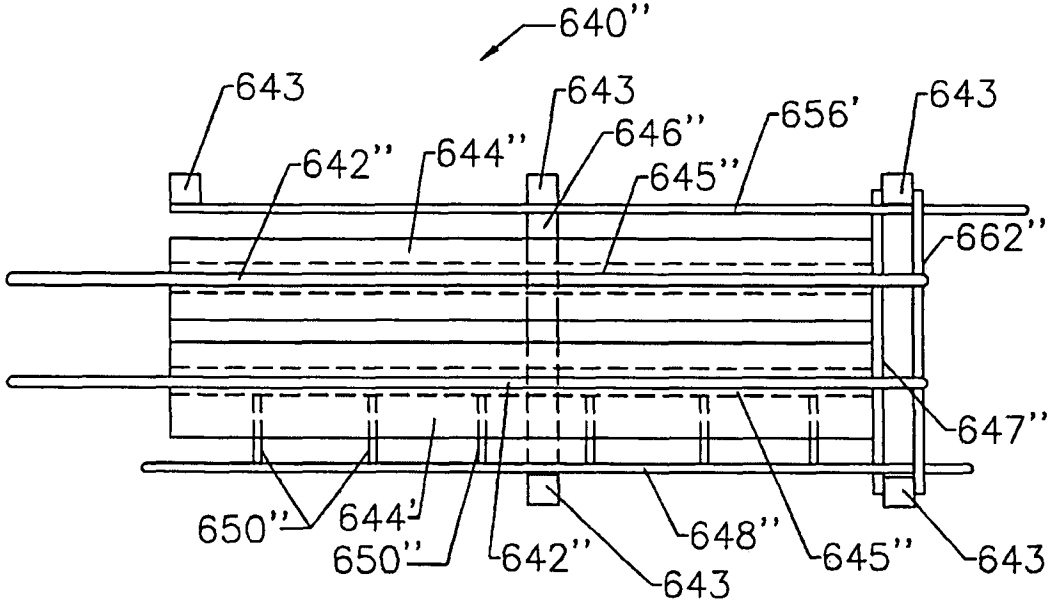
FIG. 46 is a top view of the third track subassembly shown in FIG. 45.

Referring to FIGS. 45 and 46, a third and fourth track assembly are shown positioned below second track assembly 640'. Third track assembly 640" is constructed from substantially the same components as first track assembly 640 with the notable exception the leading end of the third track assembly has substantially the same radiused or turned bottle rail guide ends as its trailing end. As with second track assembly 640', this substantially mirror image configuration conforms with one of the primary purposes of third track assembly 640" as a transitional track assembly that allows bottles, filled or empty, to transition from the first track assembly to lower track assemblies and ultimately, to elevator 702. And, of course, the slope or grade of third track assembly 640" is opposite that of second track assembly 640' and substantially the same as first track assembly 640 to continue the gravity assisted migration of bottles from the high point of first track assembly 640 to the end of fourth track assembly 640'''.

More specifically, third track assembly 640" comprises third track rails 642" configured to be substantially parallel and spaced to substantially match the spacing of the annular channels formed on the outside of the bottles. Rails 642" may be coated also with a lubricous surface treatment such as Teflon® to reduce frictional resistance of bottle travel. Rails 642" may be constructed from steel, iron-based materials, engineering-grade plastics and the like. Bottles introduced into the apparatus travel along track rails 642" by engaging the rails with the annular channels. This interaction assists in the alignment of the bottles as they travel along the track system.

Track rails 642" are secured to third support plates 644". A single support plate 644" may secure both rails to the apparatus, or two plates may be used, each dedicated to a single rail. Support plates 644" are secured to rail support beams 645", which lie substantially below track rails 642" and are intersected by substantially orthogonally oriented third cross beams 646". Cross beams 646" are secured, in turn, to the apparatus' internal framework—including vertical frame members 643.

To further assist the alignment function of track rails 642", a pair of asymmetrically positioned guide rails are provided on either sides of the track rails to prevent lateral migration of bottles as they move along the rails, or while the bottles remain stationary waiting for further advancement along the rail system as bottles are purchased and removed from the apparatus. More specifically, third neck rail 648" is positioned on the side of track rails 642" that receives the bottle neck portion of the bottles. Neck rail 648" is secured to third rail support beam 645" by a plurality of third rail connectors 650" that extend laterally from beams 645". Connectors 650" have an elbow-shaped profile and extend upwardly above the plane of track rails 642" to support third neck rail 648" above the track rails.

To ensure the smooth flow of bottles along neck rail 648", a proximal end of rail 648" has a radiused curve 649". A distal end of the rail is bent into a circular shape that extends downwardly past and below the end of track rails 642". When a bottle migrates onto third track assembly 640", rail 648" presents a smooth surface to transition and urge the bottle to an aligned position on track rails 642".

To prevent lateral migration of the bottles from the bottom end side of the bottles, third bottom guide rail 656" is positioned above, and lateral to, track rail 642" on the side opposite third neck rail 648". Do to the substantially planar surface of the bottle bottom surface, bottom guide rail 656" is positioned higher than neck rail 648" to provide better support for the relatively larger bottom surface. Bottom rail 656" may be positioned to contact the bottles throughout their travel along third track assembly 640", or may be positioned to leave a relatively small gap between the bottle and rail to reduce or eliminate frictional resistance to bottle movement.

Figure 47:
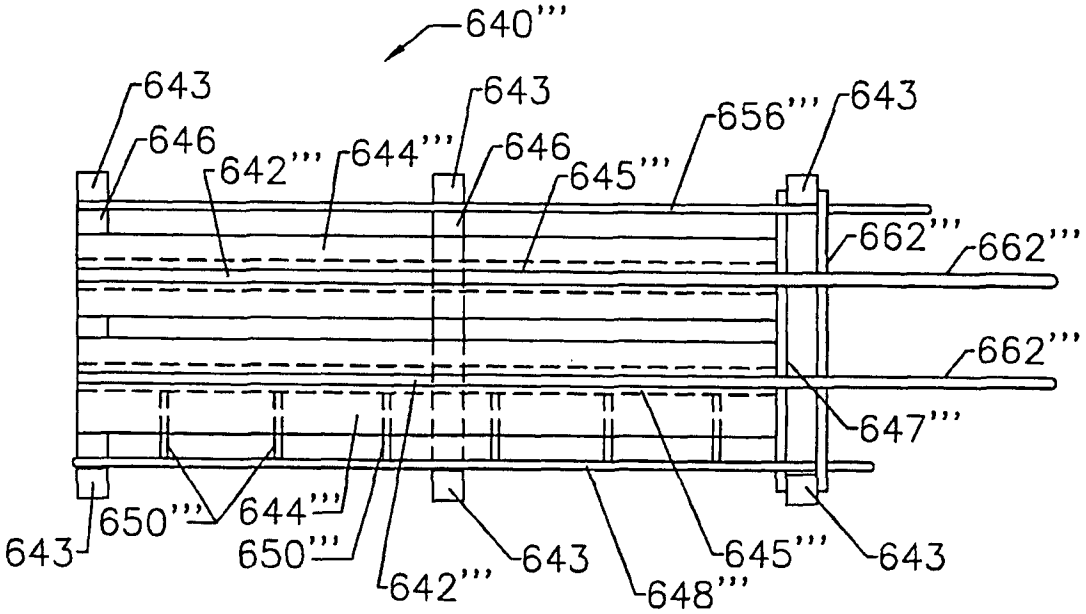
FIG. 47 is a top view of the fourth track subassembly shown in FIG. 45.

Referring still to FIG. 45 and also now to FIG. 47, fourth track assembly 640''' is constructed from substantially the same components as first track assembly 640 with the notable exception the leading end of the fourth track assembly has substantially the same radiused or turned bottle rail guide ends as the trailing end of first track assembly 640 and a trailing end has rail guide ends that terminate against a floor of the apparatus. Alternatively, the ends may also terminate, and be connected to, vertical frame members of the apparatus. Unlike the second and third track assemblies, fourth track assembly 640''' does not include a substantially mirror image configuration as the purpose of the fourth track assembly is to transition filled bottles from the track assemblies directly to elevator 702. And, of course, the slope or grade of fourth track assembly 640''' is opposite that of third track assembly 640" and substantially the same as second track assembly 640' to continue the gravity assisted migration of bottles from the high point of first track assembly 640 to the end of fourth track assembly 640'''.

As can be appreciated by those having ordinary skill in the art, the number of track assemblies can be modified in even increments to increase or decrease the number of bottles the apparatus can accommodate. The number of track assemblies could also be altered in odd numbers, which would require the return segment to be placed opposite the end from which filled bottles are retrieved by customers. The number of tracks will also affect the overall height of the apparatus as well as the return door height. Increases in track assemblies will increase the height of the return door.

More specifically, fourth track assembly 640''' comprises fourth track rails 642''' configured to be substantially parallel and spaced to substantially match the spacing of the annular channels formed on the outside of the bottles. Rails 642''' may be coated also with a lubricous surface treatment such as Teflon® to reduce frictional resistance of bottle travel. Rails 642''' may be constructed from steel, iron-based materials, engineering-grade plastics and the like. Bottles introduced into the apparatus travel along track rails 642''' by engaging the rails with the annular channels. This interaction assists in the alignment of the bottles as they travel along the track system.

Track rails 642''' are secured to support plates 644'''. A single support plate 644''' may secure both rails to the apparatus, or two plates may be used, each dedicated to a single rail. Support plates 644''' are secured to rail support beams 645''', which lie substantially below track rails 642''' and are intersected by substantially orthogonally oriented cross beams 646'''. Cross beams 646''' are secured, in turn, to the apparatus' internal framework—including vertical frame members 643.

To further assist the alignment function of track rails 642''', a pair of asymmetrically positioned guide rails are provided on either sides of the track rails to prevent lateral migration of bottles as they move along the rails, or while the bottles remain stationary waiting for further advancement along the rail system as bottles are purchased and removed from the apparatus. More specifically, fourth neck rail 648''' is positioned on the side of track rails 642''' that receives the bottle neck portion of the bottles. Neck rail 648''' is secured to fourth rail support beam 645''' by a plurality of fourth rail connectors 650''' that extend laterally from fourth beams 645'''. Connectors 650''' have an elbow-shaped profile and extend upwardly above the plane of track rails 642''' to support neck rail 648''' above the track rails.

To ensure the smooth flow of bottles along neck rail 648''', a proximal end of rail 648''' has a radiused curve 649'''. A distal end of the rail remains substantially straight and terminates adjacent to an elevator shaft described below. When a bottle migrates from third track assembly 640" onto fourth track assembly 640", rail 648'" presents a smooth surface to transition and urge the bottle to an aligned position on track rails 642'".

To prevent lateral migration of the bottles from the bottom end side of the bottles, fourth bottom guide rail 656'" is positioned above, and lateral to, track rail 642'" on the side opposite neck rail 648'". Do to the substantially planar surface of the bottle bottom surface, bottom guide rail 656'" is positioned higher than neck rail 648'" to provide better support for the relatively larger bottom surface. Bottom rail 656'" may be positioned to contact the bottles throughout their travel along third track assembly 640'", or may be positioned to leave a relatively small gap between the bottle and rail to reduce or eliminate frictional resistance to bottle movement. No inertia restrictors are required for fourth track assembly 640'" as the assembly is filled with bottles, full or empty at all times. The bottles act as their own inertia restrictors by taking up space on the track assembly.

Figure 54:
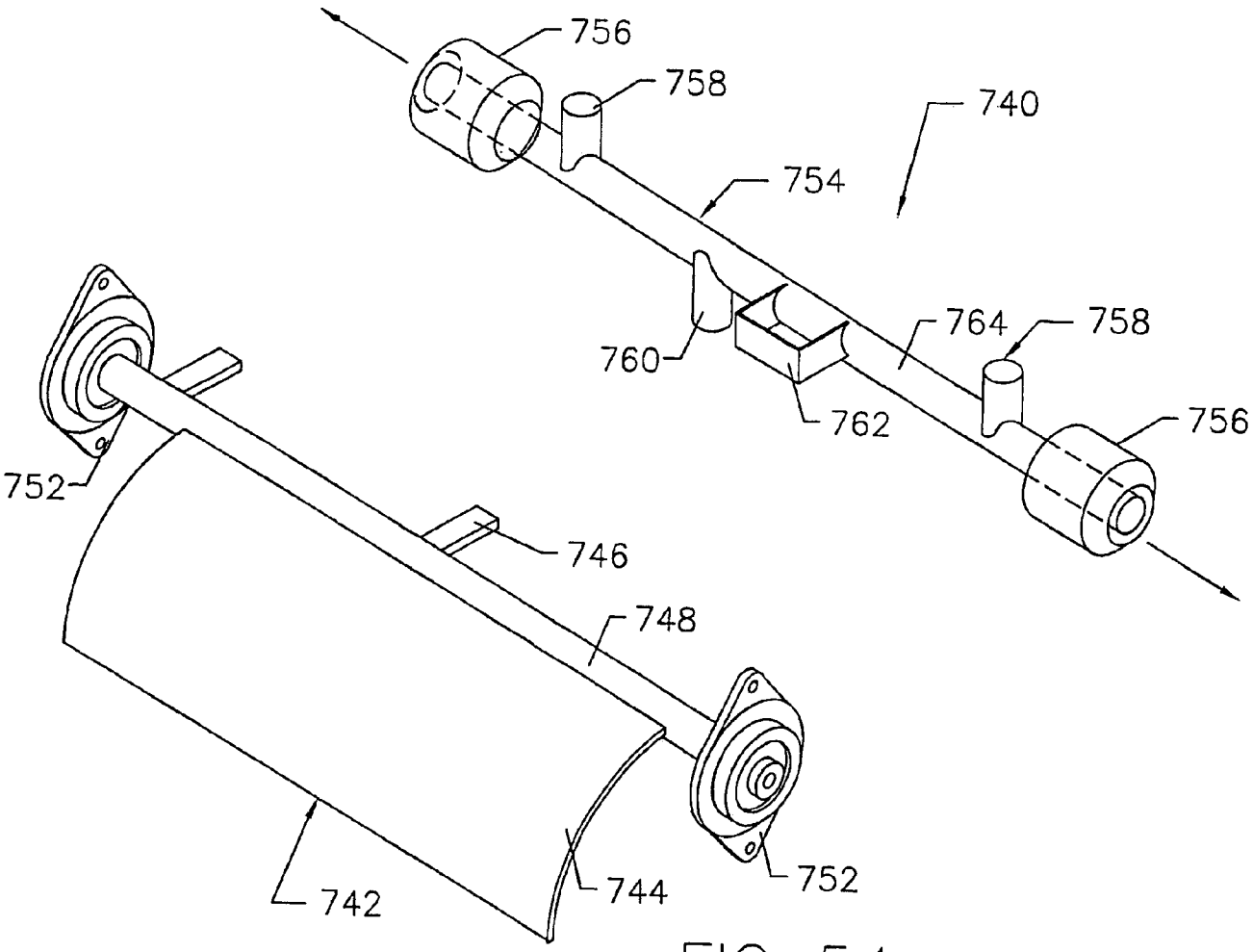
FIG. 54 shows a perspective view of a vend gate according to the embodiment shown in FIG. 36.

Referring now to FIGS. 51 and 54, a bottle vending gate assembly is shown generally as 740. Gate assembly 740 includes bottle restrictor assembly 742 that includes a bottle restrictor plate 744 configured as a partial cylinder to provide a nesting surface for the lead-most bottle to register against with a large contact area to disperse the force exerted by the lead-most bottle and subsequent bottles pressing against the lead-most bottle. This ensures no particular area of the lead-most bottle is bearing the weight of the entire train of bottles.

Restrictor plate 744 is attached to gate axle 748 secured at each end to gate bearing assemblies 752 attached to the apparatus framework. One end is connected to gate motor 745 which rotates restrictor plate 744 from open and closed, (bottle restriction), positions. Motor 745 may be a Molon 24v gear motor (McMaster Carr, New Brunswick, N.J.). A rectangular arrestor tab 746 is attached to axle 748 and extends upwardly, in a general direction away from restrictor plate 744. Tab 746 is configured to engage features of gate lock rod 754 that comprises the remainder of gate assembly 740. Restrictor assembly rotates from a closed, bottle-arresting position to an open position that permits bottle migration from the track assemblies to an elevator assembly described below.

To control the operation of restrictor assembly 742, lock rod 754 includes features to engage restrictor assembly 742 to either lock assembly 742 in a closed position when engaged, or allow the free rotation of assembly 742 when disengaged. As shown in FIG. 54, rod 754 includes a lock rod shaft 764 secured to bearings 756 positioned at either end of the shaft. A restrictor pin 760 is attached to a lower edge of shaft 764 and extends downwardly from the shaft. A pair of limit pins 758 placed proximal to the ends of shaft 764 extend upwardly from the shaft and are configured to engage limit switches, such as those made by Eaton Corporation (Windsor, Conn.) to ascertain the spatial orientation of lock rod 754 relative to restrictor assembly 742.

Rod 754 translates laterally to perform the locking and unlocking functions. When translated in an extreme position in one direction, restrictor pin 760 engages arrestor tab 746 and locks restrictor assembly in a closed position. When translated in the extreme opposite direction, pin 760 is disengaged from arrestor tab 746 so as to allow the free movement, i.e., rotation, of restrictor assembly 742. When reaching either extreme location, one of the limit pins will register against one of the prepositioned limit switches that results in a signal being sent to the processor to identify the current location and orientation of rod 754.

Figure 92:
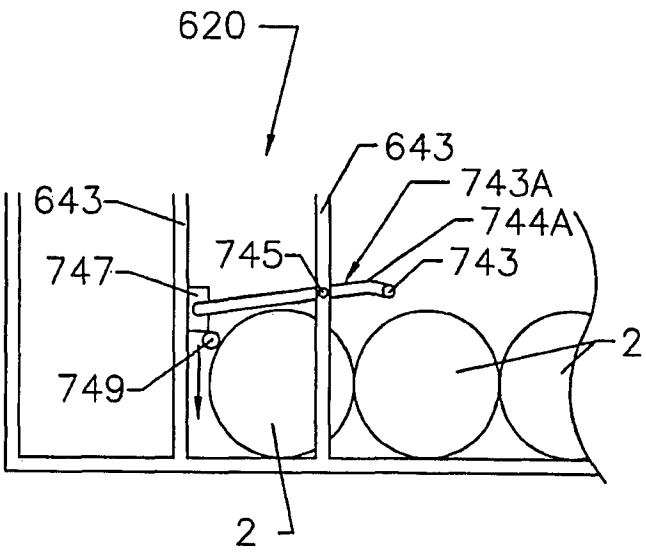
FIG. 92 shows the bottle arrestor assembly shown in FIG. 89 in a lead-bottle-arrested orientation.
Figure 89:
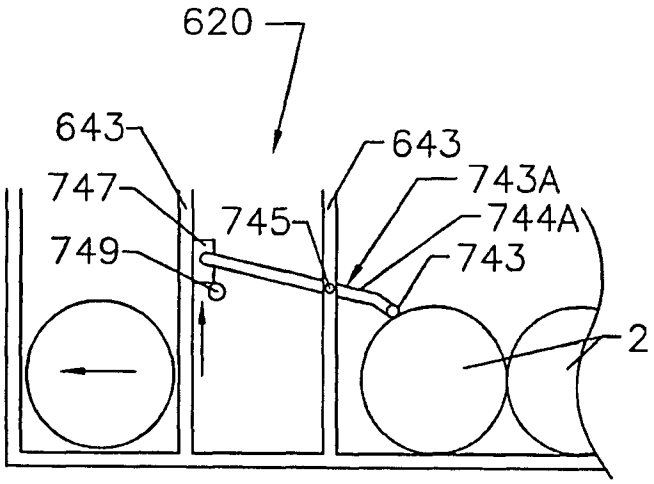
FIG. 89 is a bottle arrestor assembly according to another embodiment of the disclosure.

Translational movement of lock rod 754 is accomplished by rod motor 761. Locking and unlocking restrictor assembly 742 is coordinated by the processor to ensure a lock mode is achieved when assembly 742 is in a closed gate orientation. To achieve this result, the processor coordinates the function of rod motor 761 and gate motor 745. Motor 761 may be a Molon 24v gear motor In an alternative embodiment shown in FIGS. 89 and 92, a pivoting bottle arrestor rod assembly **743*a* may be used to control migration of bottles 2 onto elevator assembly 702. Assembly 743*a* includes arrestor rod 744*a* secured with a pin or like item to a frame member 643 so as to allow rod 744*a* to rotate freely about the pin. A distal end of the rod has a bottle registration knob 743 that contacts a bottle 2 behind lead-most bottle 2 to prevent its migration into the lead-most position. A proximal end of the rod is connected via pin or like item to slide bar 747 which translates vertically via a motor (not shown). This end of rod 744*a* may pivot relative to slide bar 747 as the slide bar translates vertically. A bottom end of slide bar 747 has a second knob 749 configured to arrest movement of a lead-most bottle 2**.

When slide bar 747 is in a down position, second knob 749 registers against lead-most bottle 2 and prevents the bottle from migrating into the elevator area. In this position, knob 743 is positioned above the second bottle out of contact with the bottle. When slide bar 747 is translated vertically upwardly, second knob 749 is removed from lead-most bottle 2, which migrates into the elevator area. Knob 743 is simultaneously rotated downward into contact with the second bottle 2 to prevent it from migrating into the first position. To prepare second bottle 2 for delivery to the elevator area, slide bar 747 is translated vertically upwardly for a second time in the cycle, which allows second bottle 2 to migrate into the first position where its movement is arrested by registration against second knob 749. The two-step process is repeated for each bottle to ensure controlled movement of the bottles from the second position to the first position to the elevator area.

Figure 53:
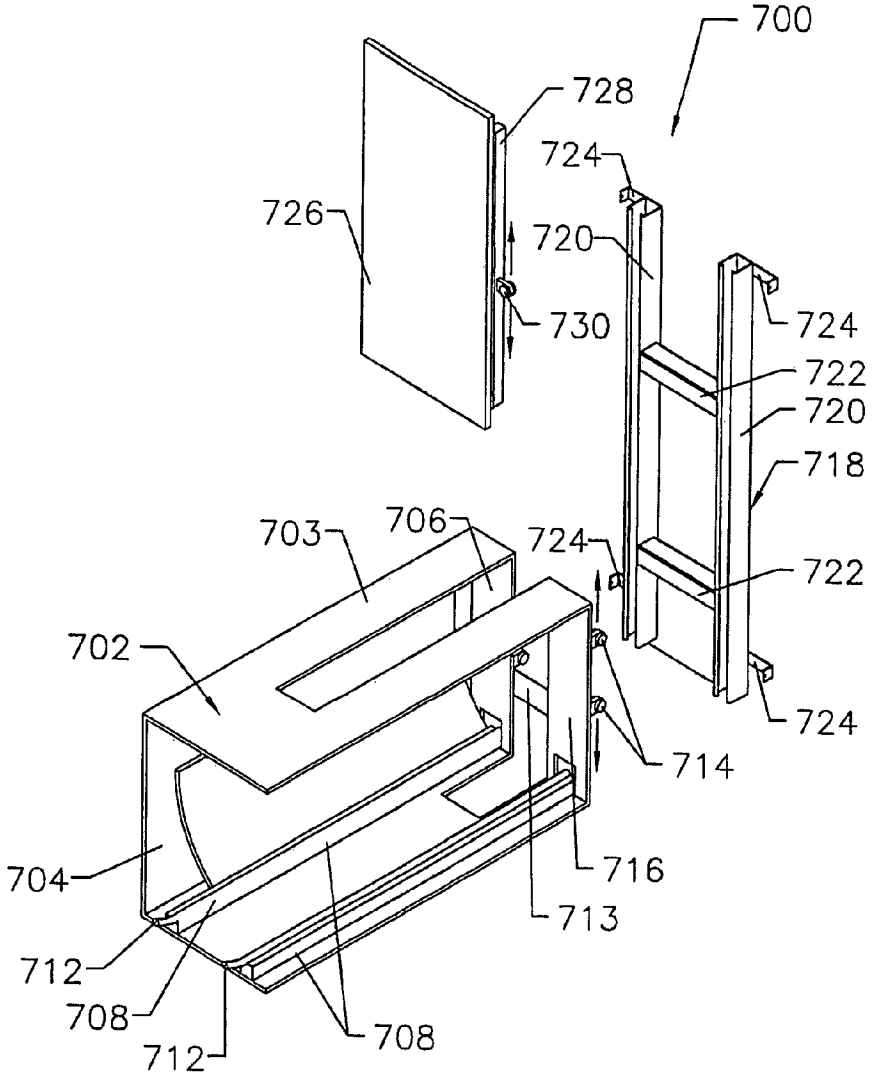
FIG. 53 is an exploded view of an elevator assembly according to the embodiment shown in FIG. 36.

Referring now to FIGS. 50 and 53, a combination bottle elevator and bottle retrieval door assembly is shown generally as 700. Assembly 700 includes elevator assembly 702, elevator vertical guide 718 and bottle retrieval door 726. Elevator assembly 702 is configured and dimensioned to receive multiple size bottles including, but not limited to, three gallon and five gallon bottles have a substantially cylindrical shape. Elevator assembly 702 includes a substantially rectangular shell 703 with a front end open to allow bottle retrieval and a side, proximal to the track assemblies, open to receive bottles from the track assemblies.

Shell 703 includes a slot 706 configured and dimensioned to allow the free passage of a bottle ejection rod 782 described below. Slot 706 may extend partially into a top surface of shell 703 and extend continuously through a back end 716 and still continuously and partially through a bottom surface. Due to the configuration and orientation of ejection rod 782, the portion off the slot formed in the top surface may be longer than the slot formed in the bottom surface.

Secured to the bottom surface of shell 703 are substantially parallel spacer tubes 708. Tubes 708 may be hollow or solid, and are spaced so that the distance between the spacer tubes are less than the largest cross-sectional diameter of the bottles to be carried by elevator assembly 702. Tubes 708 are dimensioned lengthwise to span substantially the entire length of shell 703, but may be configured shorter so long as the length is sufficient to stably support any bottle carried by elevator assembly 702. The height of the tubes is dimensioned to ensure no part of a bottle carried by elevator assembly 703 rests upon the bottom surface of shell 703, or only contacts the bottom surface at a tangential point along the circumference of the carried bottle.

Secured to top surfaces of tubes 708 are bottle support rails 712. Rails 712 are substantially cylindrical in shape and provide a lubricious surface to facilitate movement of water bottles parallel to the longitudinal axis of the rails. Rails 712 are spaced a distance less than the largest cross-sectional diameter of any bottle used by the apparatus. This ensures the rails "carry" the bottles rather than act as position restriction devices by pinning the bottle between the rails. By setting the distance less than the cross-sectional diameter, the entire bottle and its contents will be supported by the rails. Rails 712 may be hollow or solid, and are configured with upturned ends proximal to the shell 703 open front end. The upturned ends prevent bottles from being launched from elevator assembly 702 by ejector rod 782. By design, the application of manual force is required to remove a bottle from elevator assembly 702. In an alternate embodiment, support rails 702 may be integral to tubes 708, and in a further alternate embodiment, may be integral to shell 703. Any engineering grade plastic, metal or metal alloy may be used in the construction of shell 703, tubes 708 and support rails 712.

Secured to a side wall opposite the open side wall is optional bottle movement restriction plate 704. Plate 704 is configured as a partially cylindrically shaped that substantially conforms to the outer cylindrical shape of a water bottle. Plate 704 provides a motion restriction surface against which a bottle moving with kinetic energy off the track assemblies will register against and become deposited on support rails 712.

Secured to the back end 716 of shell 703 are a plurality of rollers 714. To provide directional stability and to counter torsional forces that may be imparted on elevator assembly 702 by a bottle containing water and having a shifting center of gravity due to water movement, at least two sets of rollers are used with one set being positioned in closer proximity to the shell top surface than the second roller set. Rollers 714 are dimensioned to roll within roller slots formed in vertical guide 718. Rollers 714 may be constructed from any lubricous material that reduces frictional resistance while translating along vertical guide 718.

Vertical guide 718 is dimensioned and configured to provide a support system to allow for the vertical movement of elevator assembly 702 from a downward load position to an upward unload position. Guide 718 includes a pair of substantially vertical beams 720 having portions defining slots for receiving rollers 714. The slots are dimensioned to allow for the substantially friction-free movement of rollers 714 along the length of the slots.

Beams 720 are connected with horizontal spacers 722 dimensioned to set the distance between the beams to accommodate the spacing of rollers 714. A plurality of brackets 724 positioned on lateral edges and ends of beams 720 provide a means to secure guide 718 to vending apparatus 620. As should be understood by those having skill in the art, brackets 724 may be secured to beams 720 in a wide variety of configurations to accommodate the structural components of apparatus 620.

In an alternative embodiment, a single vertical beam may be used with a single set of rollers to provide for vertical translation of elevator assembly 702. In this embodiment, at least two rollers having a vertical orientation are used to ensure proper alignment of elevator assembly 702 while translating along beams 720.

Suspended above and in contact with elevator assembly 702 is retrieval door 726. Door 726 is substantially rectangular in shape with a pair of door beams 728 secured to a back side along opposing lateral edges. Door rollers 730 are secured to lateral edges of door beams 728 to control and facilitate vertical translation of door 726 when travelling vertically with elevator assembly 702. Door rollers 730 roll within a pair of beams having portions defining slots to receive door rollers 730. The construction of the beams is similar to that of beams 720.

Door 726 does not have a dedicated power source to effectuate door elevation and descent. Vertical operation of door 726 is controlled by movement of elevator assembly 702. A bottom edge of door 726 registers against the top surface of shell 702. When elevator assembly 702 of lifted upwardly by a winch (described below), elevator assembly 702 urges door 726 in the same upwardly direction. When elevator assembly 702 is lowered by reversing the winch, door 726 descends via gravitational force. By refraining from using powered operation of door 726, a customer's hand placed into elevator assembly 702 to retrieve a bottle will not be subjected to an impingement injury with power-actuated closure of door 726.

Figure 88:
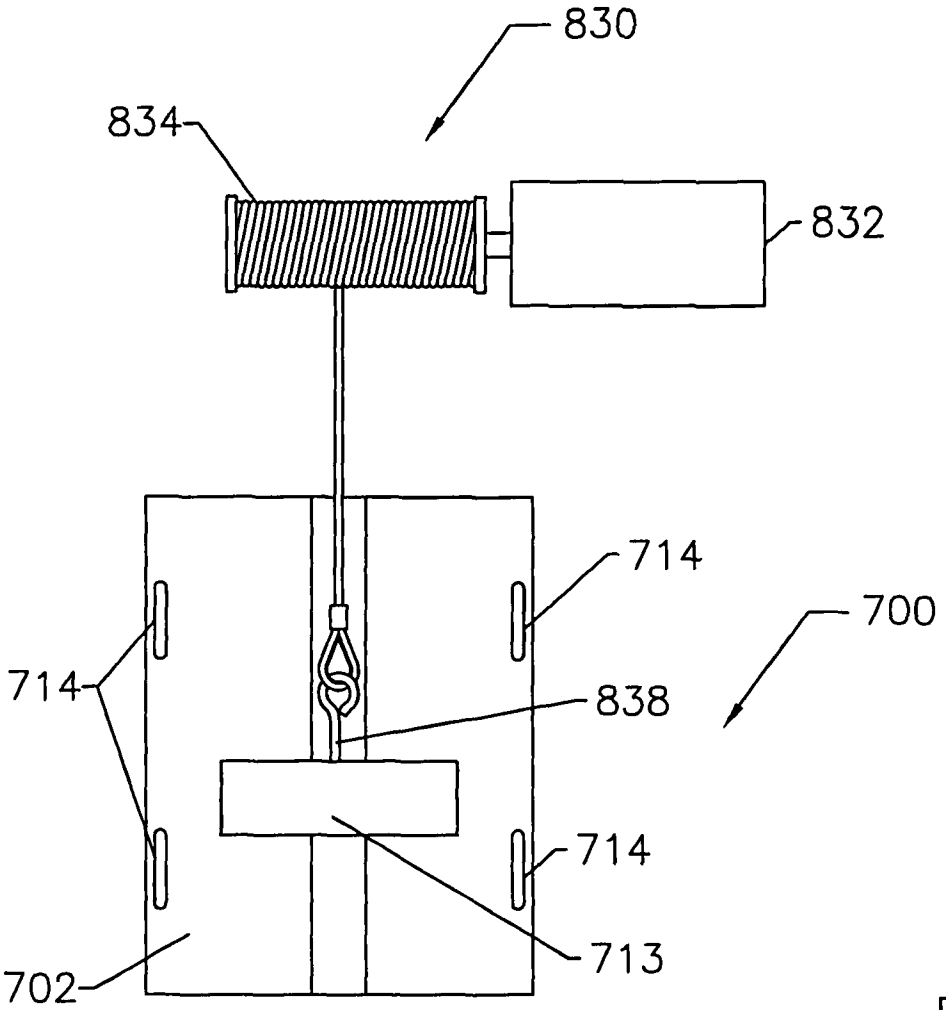
FIG. 88 is a back elevational view of the elevator and elevator winch assembly according to the embodiment of the disclosure shown in FIG. 36.

As shown in FIG. 50, elevator movement is performed by a motorized winch 830 assembly, which may include a 12 volt DC type motor 832 such as those produced by Harbor Freight (West Springfield, Mass.). Winch 830 is secured to the apparatus frame above the vertically oriented service area of elevator assembly 702. A steel cable 834 (shown in FIG. 88), secured to an axle extending from motor 832 has a distal end attached to an eyelet 838 secured to a substantially horizontal cable support beam 713 secured to back end 716. The means to secure cable 834 to elevator assembly 702 may be any connection means well known in the art including direct fusion to support beam 713 via welding and the like. Power for motor 832 may be derived from a 12vDC batter such as those manufactured by NAPA. A trickle charger that draws electricity from the attached 120V current may be used to maintain the battery's charge. The Schumacher trickle charger available at department stores such as Wal-Mart may be used for this purpose.

Winch assembly 830 is controlled by a series of sensors that sense and report elevator location and loading. A down limit sensor 715 is placed at the bottom of the elevator shaft to detect when elevator assembly 702 is at its lowest-most point of travel. Location of elevator assembly 702 at this point is a precondition for operation of bottle gate and lock assembly 740 described above. Limit sensor 715 is triggered by mechanical engagement of the sensor's switch trigger by elevator assembly 702. Once triggered, a signal is sent to the processor so as to allow gate operation for the next bottle-advance event to load the elevator. It should be understood that it is in the scope and contemplation of the disclosure that any of the mechanically triggered switches may be replaced with other sensing devices such as infra-red switches and the like.

Once a bottle is advanced past the vend gate assembly, a bottle sensor 719 secured to elevator assembly 702 is triggered and a signal is sent to the processor to set a "bottle-present" condition. Elevator assembly 702 remains at the lower-most position until a vend event is initiated by a customer. Once a successful purchase transaction is completed, a signal is sent from the processor to initiate ascension of elevator assembly 702 via winch assembly 830. Elevator assembly 702 ascends until an upper limit sensor 717 is triggered by mechanical engagement with elevator assembly 702. Sensor 717 is positioned at the elevator's upper limit of travel, which places the bottle carried by the elevator in position for removal by the customer. Once triggered, sensor 717 sends a signal to the processor, which, in turn, sends a signal to winch assembly 830 to stop elevating elevator assembly 702.

Figure 63:
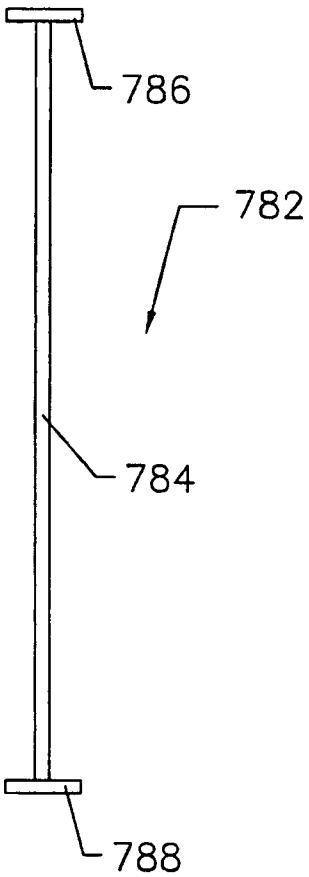
FIG. 63 is a front view of the bottle advancing rod shown in FIG. 62.
Figure 62:
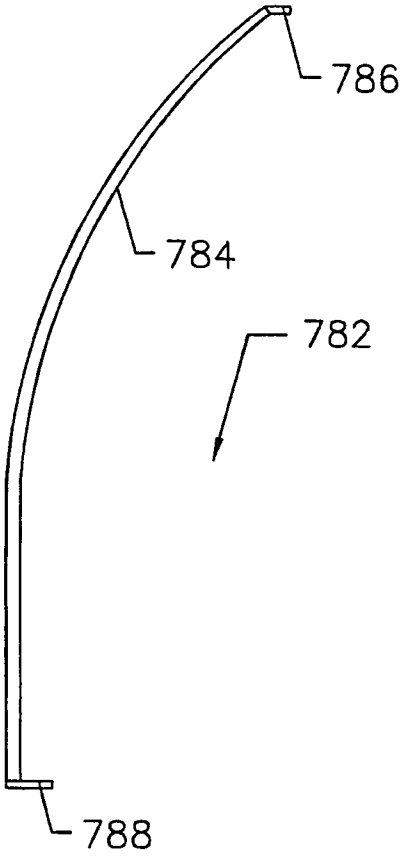
FIG. 62 is a side view of a bottle advancing rod according to the embodiment of the disclosure shown in FIG. 36.

As elevator assembly rises, the resident bottle 2 engages ejection rod 782 shown in FIGS. 62 and 63. Rod 782 includes a main body 784 with attachment tabs 788 and 786 located at the extreme ends of the rod. Rod 782 is constructed with an arc configuration in side profile with a bottom positioned toward the back of the apparatus and a top positioned in close proximity to the front of the apparatus. This configuration, in combination with the upward movement of the elevator assembly 702, causes bottle 2 to engage rod 782 that urges bottle 2 toward the front of apparatus 10 on support rails 712. This positions the bottle to facilitate manual removal from elevator assembly 702. Once removed, weight sensor 719 positioned at the bottom of elevator shell 703 is activated to send a signal to the processor to confirm removal of bottle 2. This resets the vending apparatus for the next transaction as described more fully below.

In an alternate embodiment shown in FIGS. 145 and 146, an ejector plate 782' is used in place of rod 782. Plate 782' has a radiused edge 783 that conforms to the basic shape of rod 782 and provides the same function, i.e., to urge bottle 2 toward the front of elevator assembly 702 as elevator assembly 702 ascends. A sensor 779 is positioned on edge 783 to detect the presence of bottle 2 on elevator assembly 702. After bottle 2 is removed from the elevator, a signal is sent back to the processor to confirm the bottle's removal so as to initiate another vend cycle by lowering elevator assembly to the start position.

Figure 55:
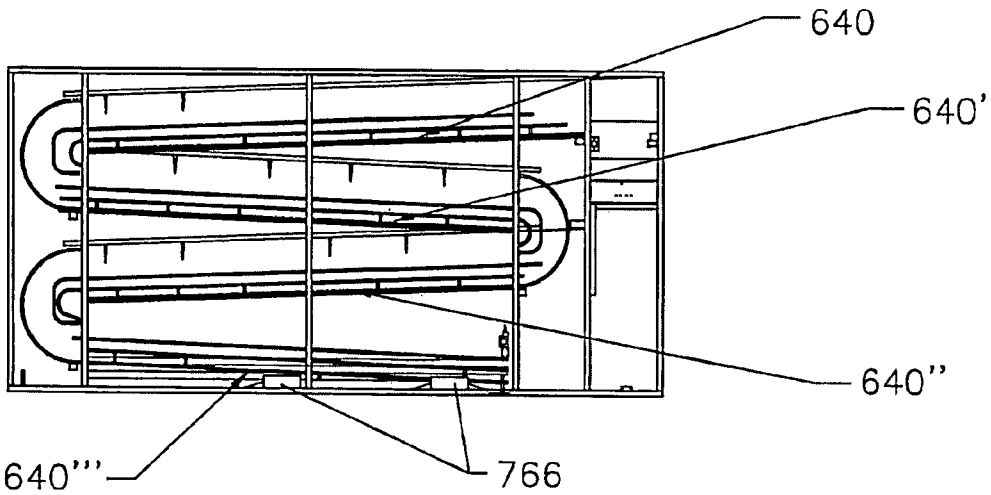
FIG. 55 shows a rear elevational view of the internal components of a vending apparatus according to the embodiment of the disclosure shown in FIG. 36.
Figure 56:
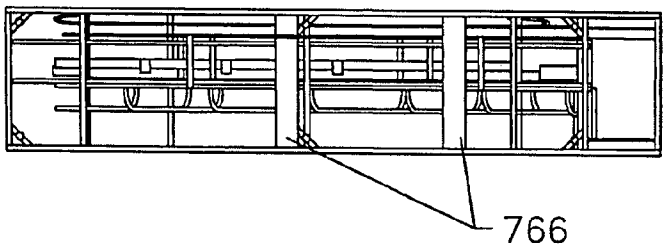
FIG. 56 is a bottom view of the vending apparatus shown in FIG. 55.
Figure 57:
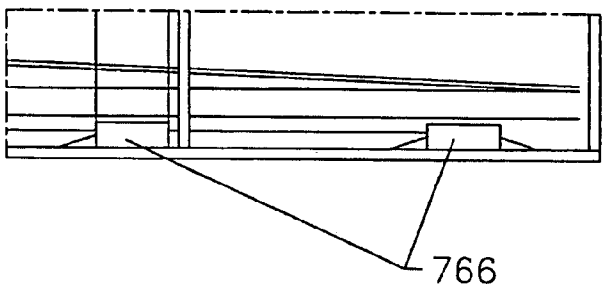
FIG. 57 is a partial back view of a vending apparatus loading assembly of the vending apparatus shown in FIG. 55.
Figures 58, 59, 60, 61:
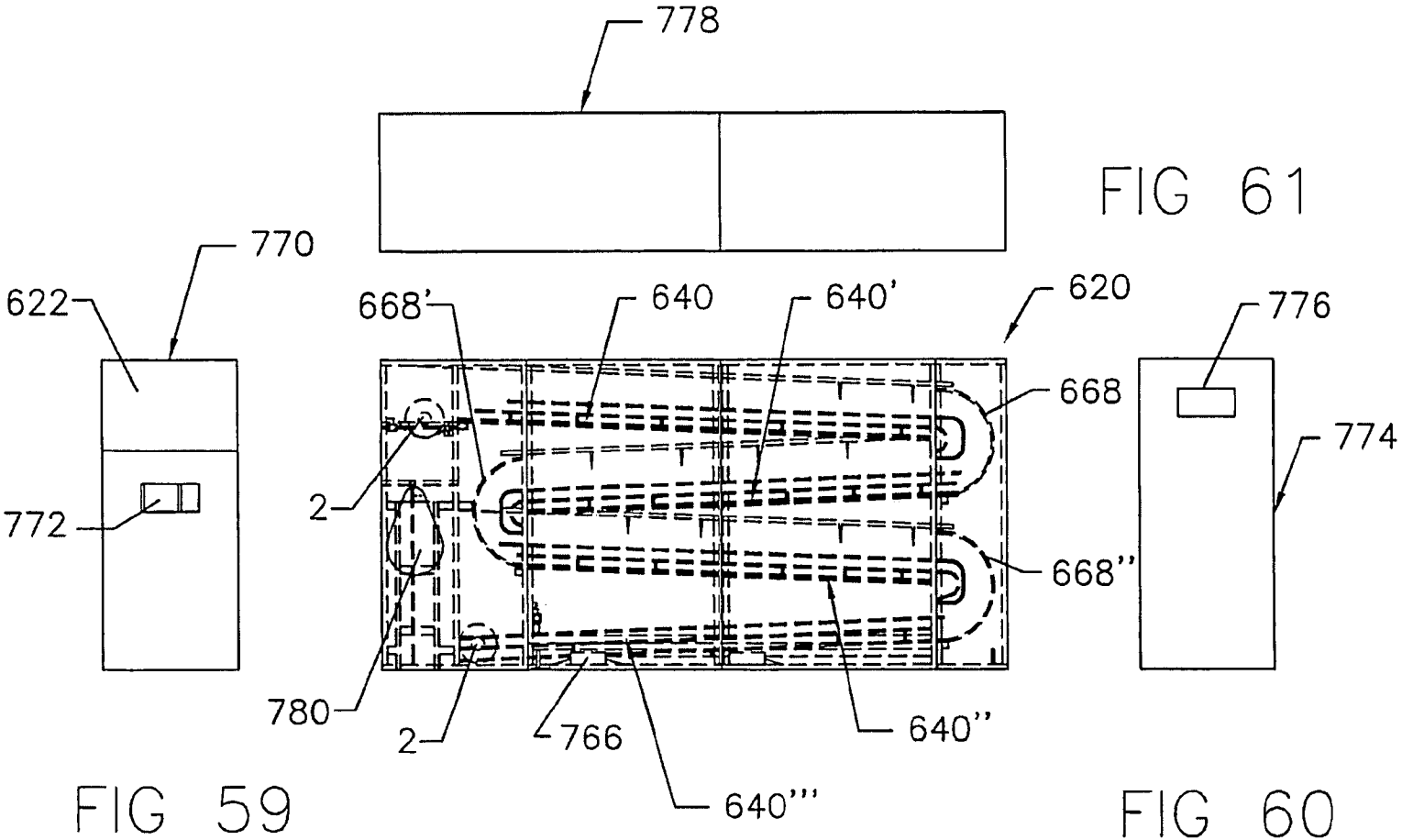
FIG. 58 is a front elevational view in partial phantom of the vending apparatus shown in FIG. 55.
FIG. 59 is a side elevational view of the vending apparatus shown in FIG. 58.
FIG. 60 is a side elevational view of a side of the vending apparatus opposite the side shown in FIG. 59.
FIG. 61 is a top view of the vending apparatus shown in FIG. 58.

As shown in FIGS. 55-57, a pair of loading ports 766 configured in the form of metallic tubes are used to provide a means to move and transport apparatus 620. Tubular steel may be used for this purpose. Ports 766 are dimensioned and spaced to receive the forks of a fork lift truck so as to facilitate the controlled movement of the apparatus. Ports 766 may extend the entire front-to-back dimension of the apparatus and be open at both the back and front ends to allow variability for placement of the apparatus either on a transportation vehicle, such as a flatbed truck, or for placement in a particular location that may require a specific orientation of access.

Figure 66:
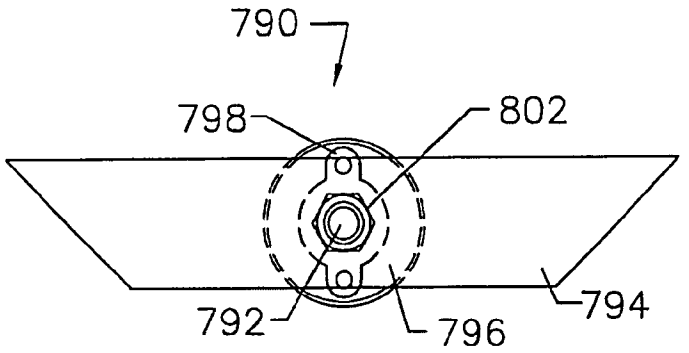
FIG. 66 is a top view in partial phantom of the leveling assembly shown in FIG. 64.
Figure 65:
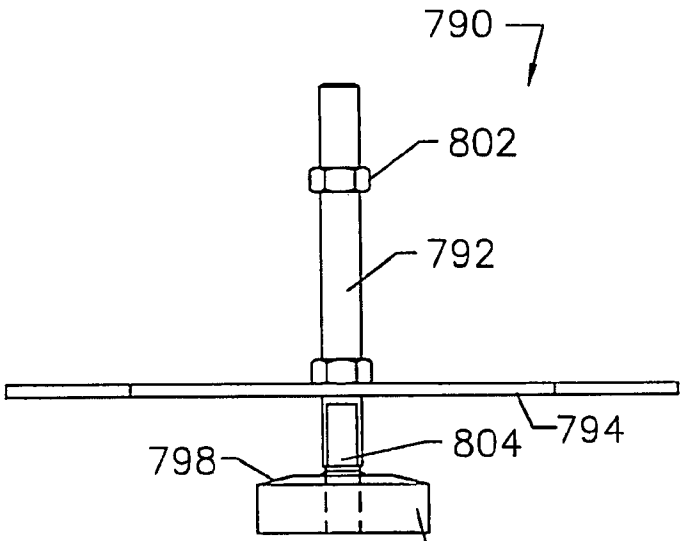
FIG. 65 is a front elevational view in partial phantom of the leveling assembly shown in FIG. 64.
Figure 64:
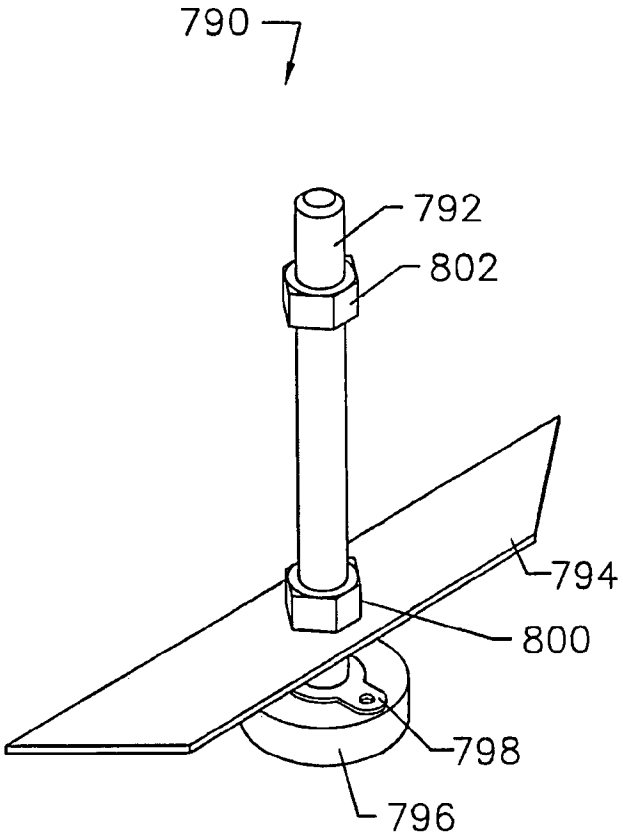
FIG. 64 is a perspective view of a vending apparatus leveling assembly according to the embodiment of the disclosure shown in FIG. 36.
Figure 69:
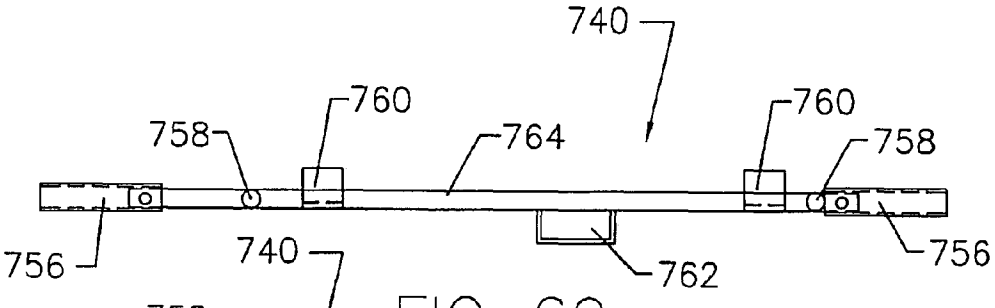
FIG. 69 is a top view of the lock assembly in partial phantom shown in FIG. 67.
Figure 68:
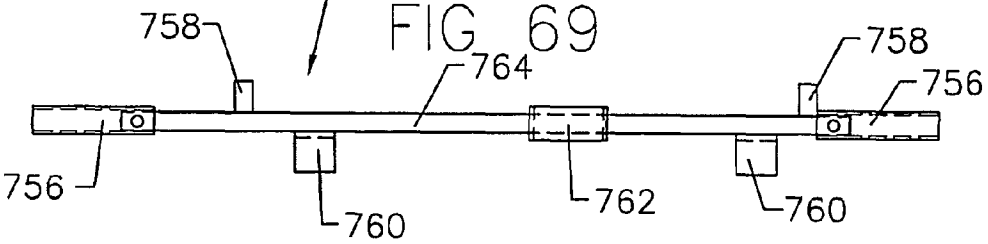
FIG. 68 is a front view in partial phantom of the lock assembly shown in FIG. 67.
Figure 67:
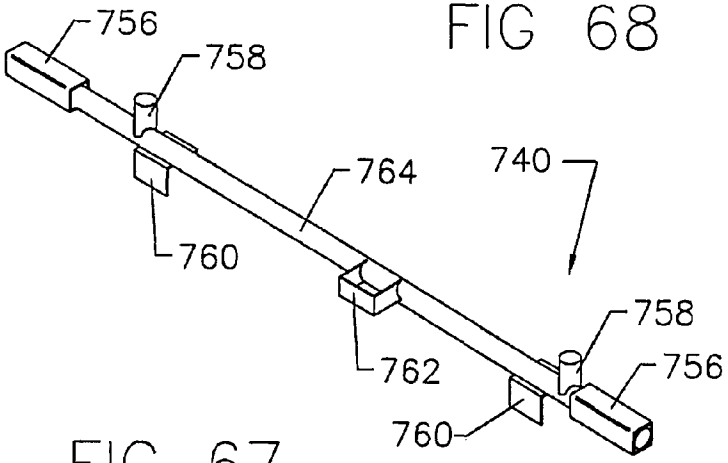
FIG. 67 is a perspective view of a vending gate lock assembly according to the embodiment of the disclosure shown in FIG. 36.
Figure 70:
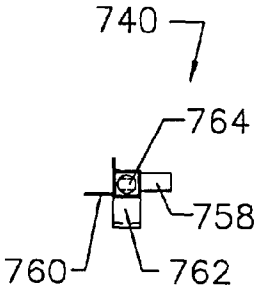
FIG. 70 is a side elevational view of the lock assembly shown in FIG. 67.

Referring now to FIGS. 64-66, an apparatus leveling device is shown generally as 790. Device 790 includes a mounting plate 794 configured for attachment to a bottom of apparatus 620. Mechanical fasteners, welding and the like may be used to secure plate 794 to apparatus 620. A threaded foot rod 792 is provided as a means to impart adjustability to leveling device 790. Plate 794 has portions defining a threaded bore (not shown) dimensioned and configured to receive foot rod 792. The threading of foot rod 792 engages the threading of the plate bore. Torquing the rod in either direction will either raise or lower the device relative to apparatus 620. A pair of threaded nuts, 800 and 802, may be included to lock the vertical orientation of rod 792 relative to plate 794 by registering the nuts against plate 792 and each other in a method of locking a threaded rod in place well known in the art.

Appended to a bottom end of rod 792 is foot pad 796. A pad frame 798 may be included as a junction between rod 792 and pad 796. Pad 796 may be secured to frame 798 with mechanical fasteners, or may be connected via any other means known in the art such as welding. Pad 796 may be circular in shape, or may conform to any regular or irregular geometric pattern. A bottom surface of pad 796 may be made smooth and planar, or may be formed with knurls or other surface treatments to impart better grip and traction when placed on a variety of surfaces.

Figure 71:
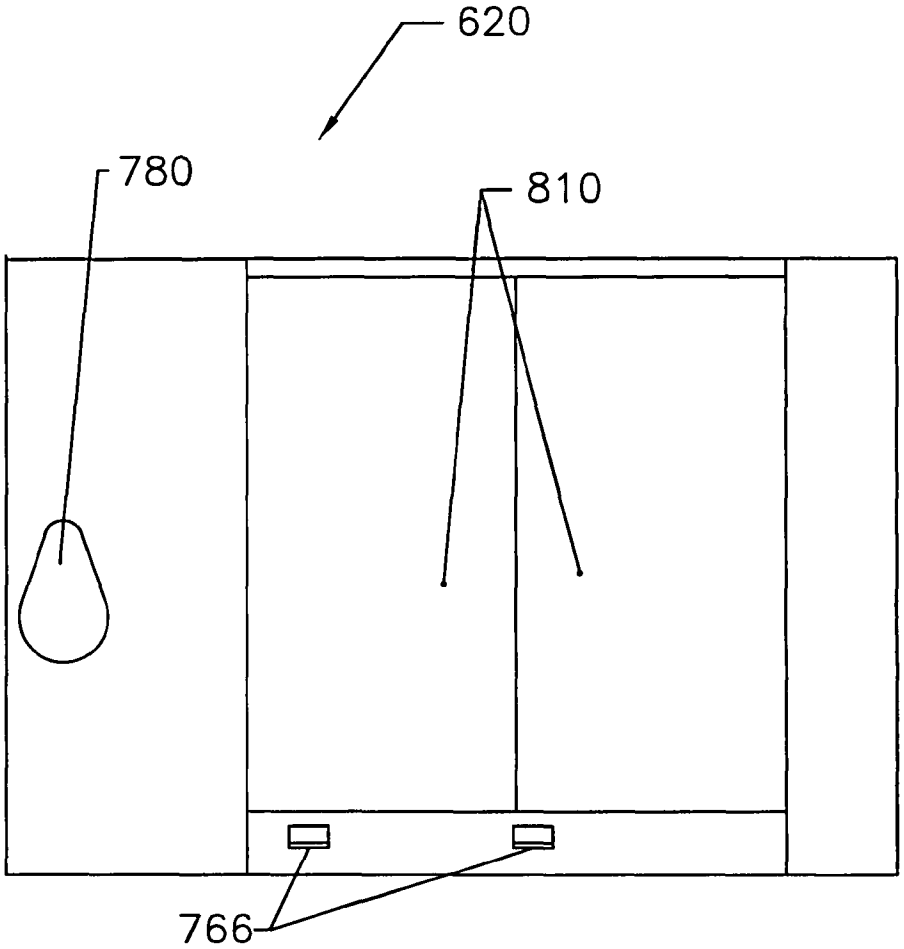
FIG. 71 is a front elevational view of the exterior of the vending apparatus according the embodiment of the disclosure shown in FIG. 36.
Figure 72:
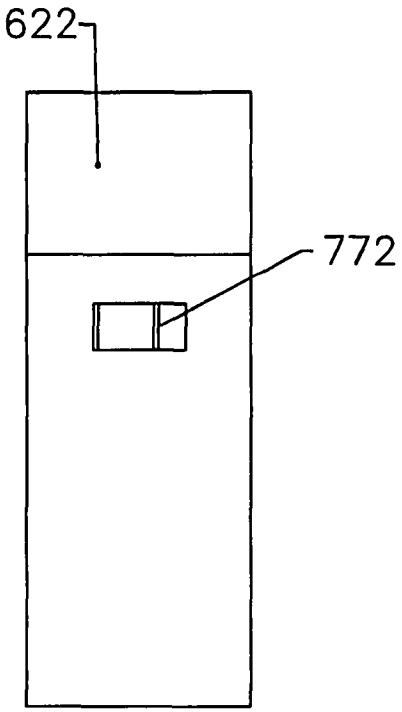
FIG. 72 is a side elevational view of the exterior of the vending apparatus shown in FIG. 71.

Referring now to FIGS. 71 and 72, an outer shell of apparatus 620 is shown. In one embodiment, the outer shell is comprised of a series of metal sheets, each custom fit to specific segments of the apparatus. Alternatively, the outer shell may be fabricated with other materials such as fiber glass and carbon-based composites. These latter materials provide an additional benefit of being electrically neutral and unable to carry electric current.

Positioned on the interior of the shell is insulation which may be configured in a variety of forms including foam sheets, bat insulation, sprayed foam and the like. To ensure the enclosed water remains in fluid form, particularly in colder climates, complete insulation of the exterior surfaces should be achieved. The importance is diminished in warmer climates although the apparatus may be configured for refrigerated use with the addition of refrigeration equipment as is well known in the art.

Referring now to FIG. 52, heating and venting may also be incorporated into apparatus 620. A resident temperature sensor 735 is connected to a programmable heater 732 and impeller 734 to maintain apparatus 620 above freezing temperatures in cold weather and to circulate air in warmer temperatures to help protect the electronic components of the apparatus. For this purpose an 880W 120vac McMaster heater may be used (McMaster Carr, New Brunswick, N.J.). A McMaster 120vac heater fan may also be used.

Referring to FIGS. 134-139, LED lighting may be affixed to soffit surfaces of apparatus 620 to provide night time illumination of the entire unit and the loading and unloading features in particular. For this purpose, LED lights from Elemental Led Company, Emeryville, Calif. may be used.

As shown in FIG. 71, apparatus 620 includes a pair of access doors 810 configured to open in opposing directions. Doors 810 provide access to the track assemblies to allow the removal of empty bottles 3 and the placement of filled bottles 2. A bottle removal slot 780 is formed in a front face of apparatus 620 in alignment with the elevator shaft and oriented to be substantially planar with elevator shell 703 when in an upper most orientation. This orientation permits customers to retrieve filled bottles when a transaction has been successfully accomplished. As previously described, the upward movement of elevator assembly 702 causes a corresponding upward movement of retrieval door 726 that occludes removal slot 780 when in a closed position. Removal slot 780 may be configured with a reduced diameter upper portion with continuously radiused edges to prevent impingement injuries when retrieving a filled bottle 2 from elevator assembly 702.

Figure 73:
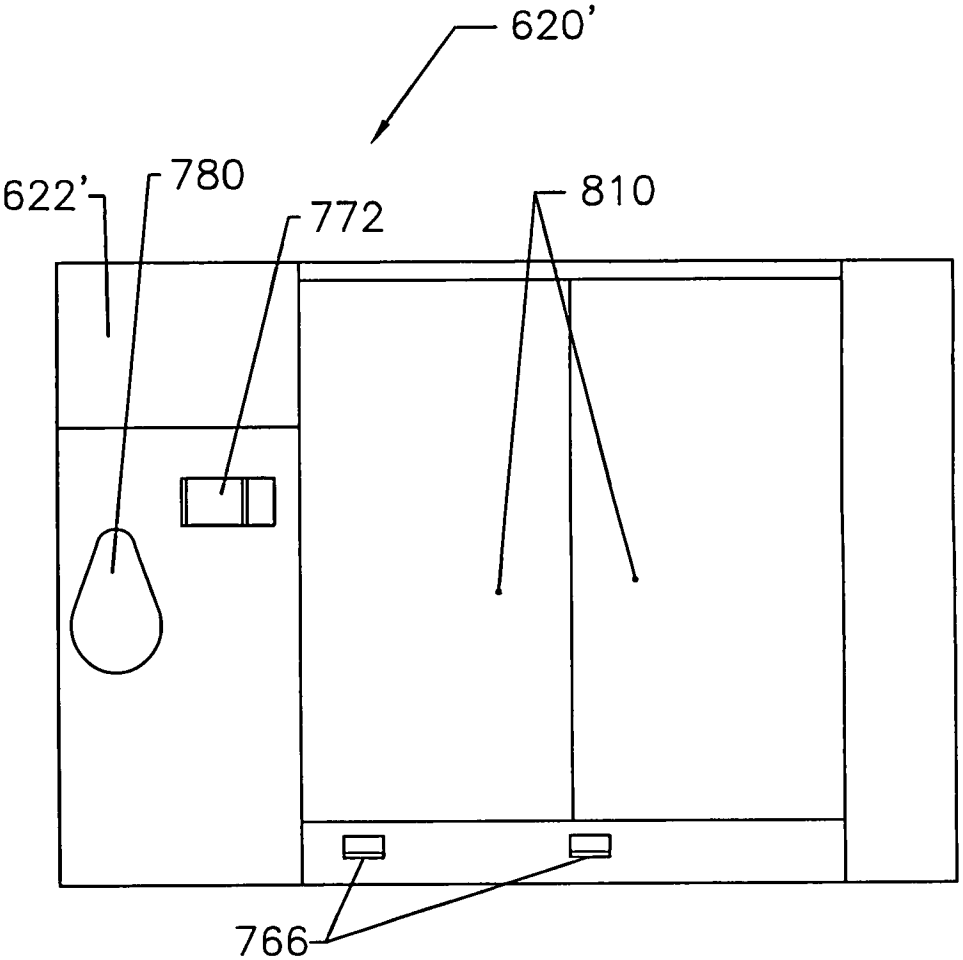
FIG. 73 is a side elevational view of the exterior of the vending apparatus according to another embodiment of the disclosure.
Figure 74:
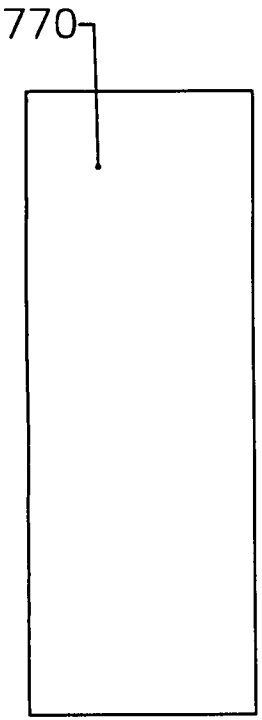
FIG. 74 is a side elevational view of the exterior of the vending apparatus shown in FIG. 73.

Referring to FIG. 72, a side wall of apparatus 620 is shown. Return door 622 is positioned in this side wall above customer interface touch screen 772. In an alternate embodiment shown in FIGS. 73 and 74, return door 622 is positioned on the front wall above removal slot 780. This "front return" embodiment requires empty bottles 3 are loaded bottom first to align the bottles for transfer to first track assembly 640.

Figure 76:
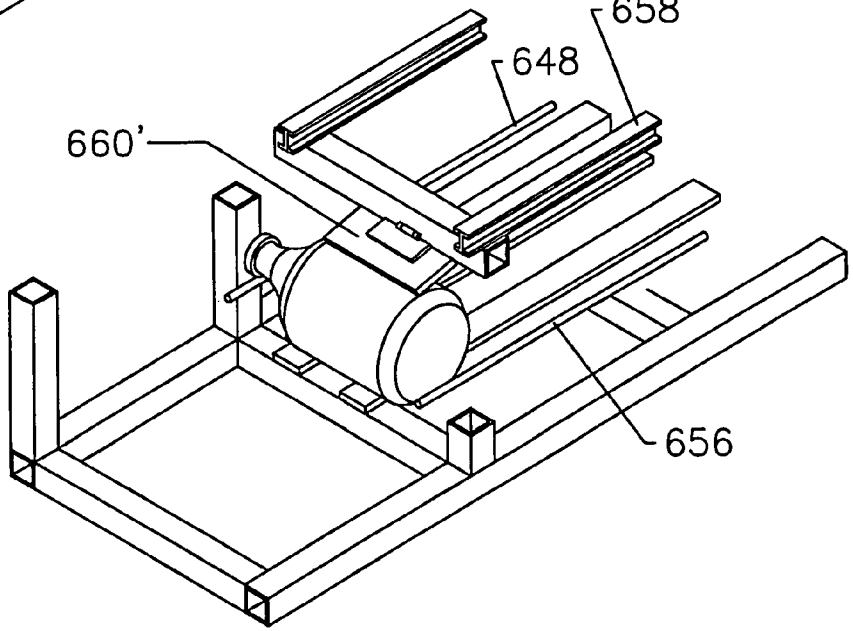
FIG. 76 is a perspective view of an adjustable inertia restriction flapper shown in FIG. 75 in an actuated position engaged by a filled bottle.
Figure 75:
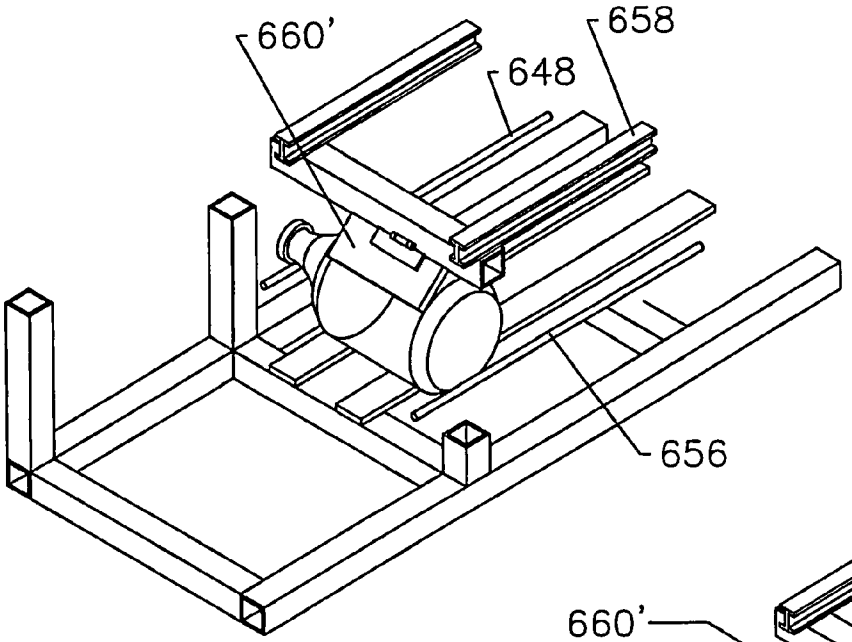
FIG. 75 is a perspective view of an adjustable inertia restriction flapper according to a further embodiment of the disclosure.
Figure 77:
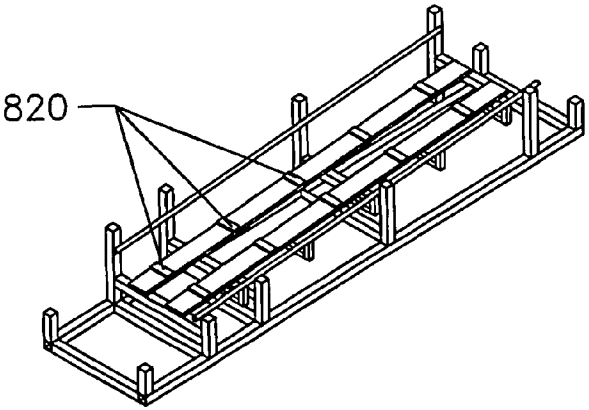
FIG. 77 is a perspective view of a plurality of stationary inertia restrictors according to a yet further embodiment of the disclosure.

Referring now to FIGS. 75 and 76, a solid body inertia restrictor 660' is suspended from hinge 666 attached to beam 658. Restrictor 660' is weighted to counter kinetic energy buildup in return bottle 3. Hinge 666 is preloaded to return to a start position after passage of bottle 3.

Referring now to FIGS. 77, 78 and 81-86, speed bump inertia retrictors 820 are shown. Restrictors 820 provide a traversable inertia-limiting barrier to reduce kinetic energy buildup in bottles traveling along the graded track assemblies. Each speed bump inertia restrictor is secured to track rails 642 in a substantially orthogonal orientation to the track rails. Restrictor spacing may be set at approximately twice the cross-sectional diameter of bottle 2. Other spacing may be used to tailor the velocity at which bottles travel down the track assemblies. The thickness of restrictors 820 may be varied to increase or decrease bottle kinetic energy reduction. In general, thinner restrictors will impart less kinetic energy reduction while thicker restrictors will impart greater kinetic energy reduction. In one embodiment shown in FIGS. 84 and 86, leading and/or trailing edges of restrictors 820 may be beveled to provide a smoother transitional surface for bottle traversal.

Figure 78:
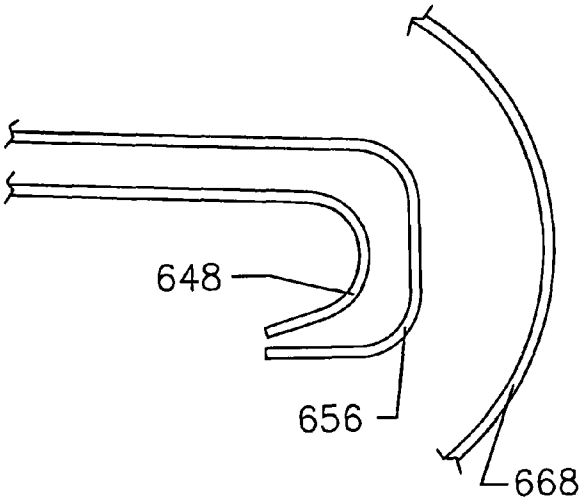
FIG. 78 is a side view of the rail guides and transition guide rails according to the embodiment of the disclosure shown in FIG. 36.
Figure 79:
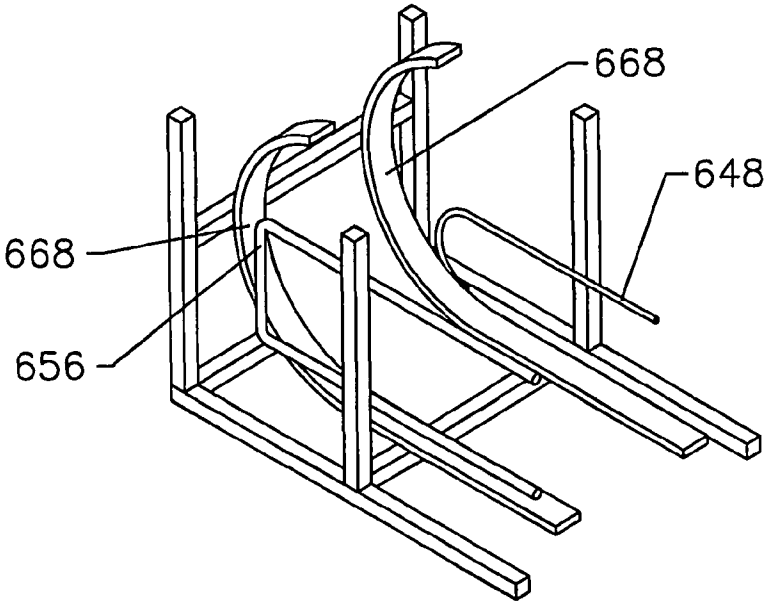
FIG. 79 is a perspective view of the transition guide rails shown in FIG. 78.

FIG. 78 shows one embodiment of the guide rails with a radius of 11.5 inches throughout the turn. As shown in FIG. 79, guide rails from the start of the curve to the end of the curve may be 23 inches. These dimensions have proven effective to guide the movement of both 3 gallon and 5 gallon water bottles. As should be understood by those having ordinary skill in the art, the dimensions may be modified to accommodate different sized bottles having different cross-sectional diameters.

Figure 90A:
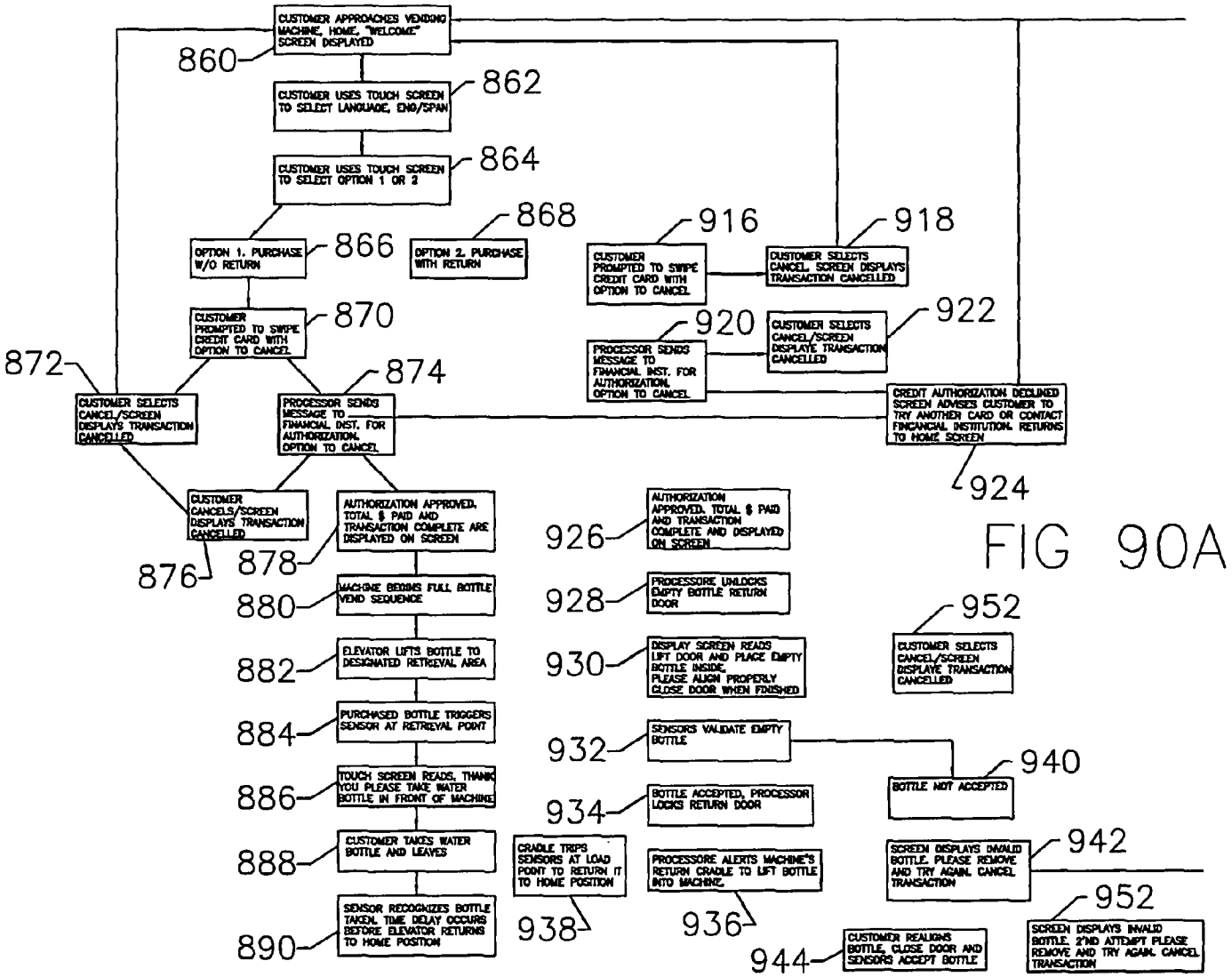
FIG. 90A is a system flow chart for retrieving and returning water bottles, and conducting a paperless transaction for the purchasing and crediting sales/return transactions according to the embodiment of the disclosure shown in FIG. 36.
Figure 90B:
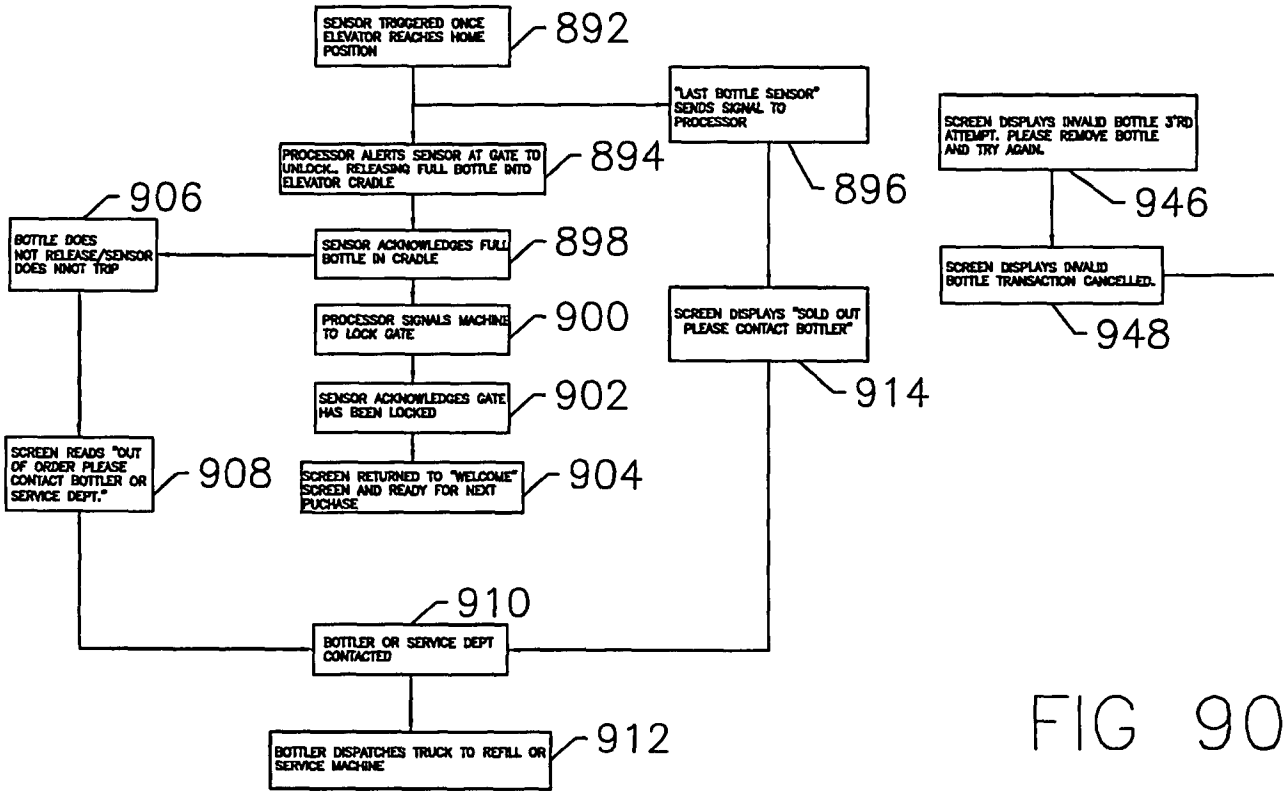
FIG. 90B is a continuation of the system flow chart shown in FIG. 90A.
Figure 91A:
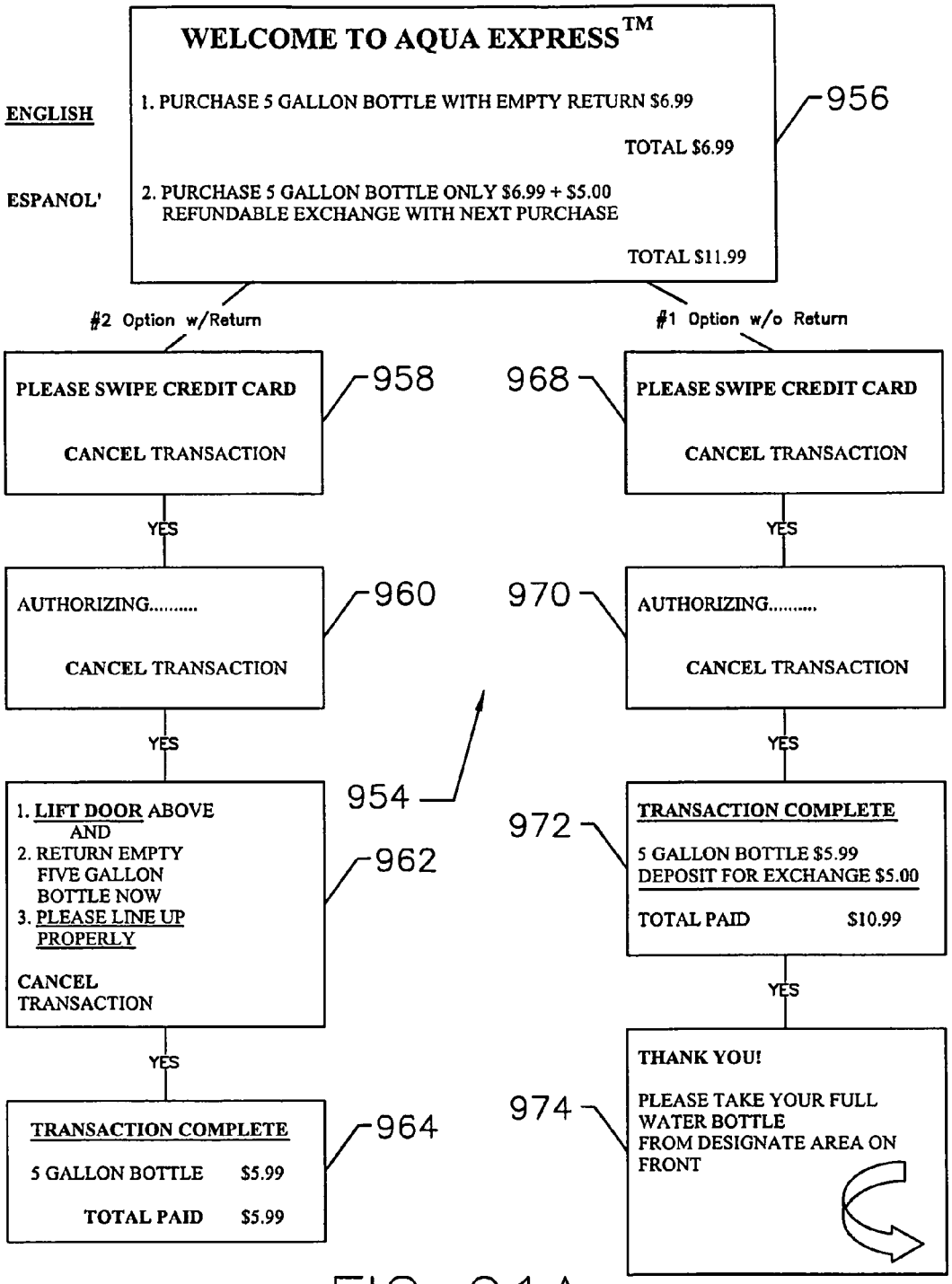
FIG. 91A is a flow chart of vending apparatus screen shots according to one embodiment of the disclosure.
Figure 93:
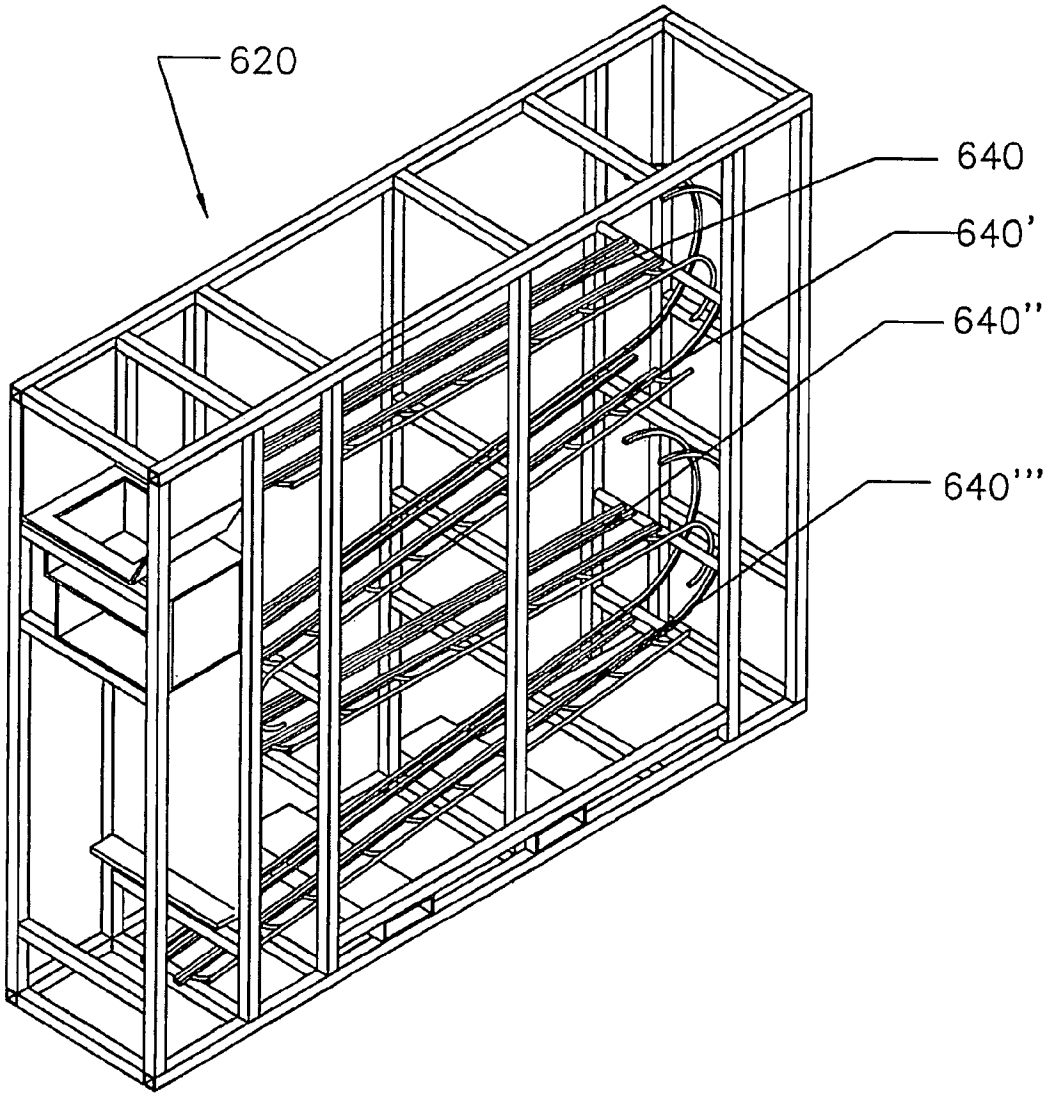
FIG. 93 is a top perspective view of apparatus 620 according to one embodiment of the disclosure.
Figure 95:
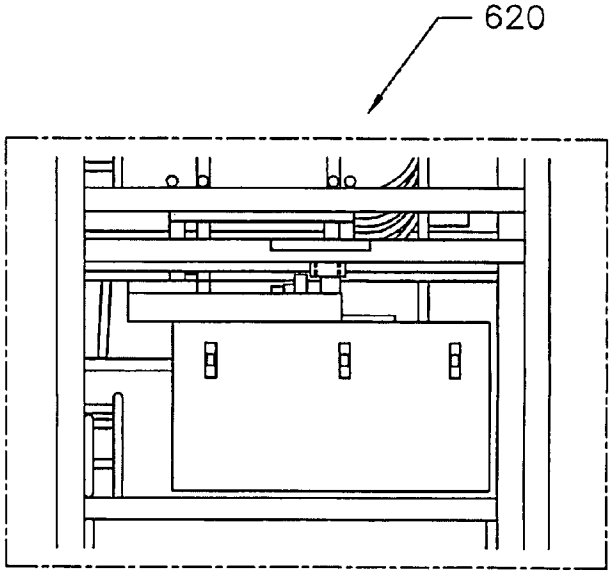
FIG. 95 is a close-up view of detail "C" in FIG. 94.
Figure 94:
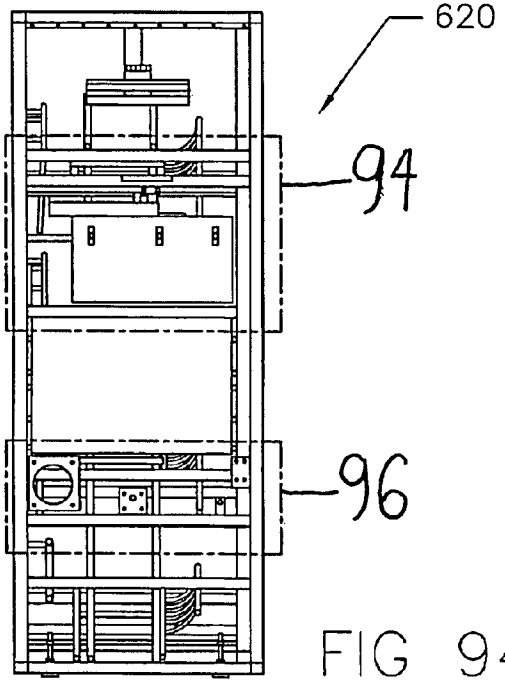
FIG. 94 is a side view of apparatus 620 according to one embodiment of the disclosure.
Figure 96:
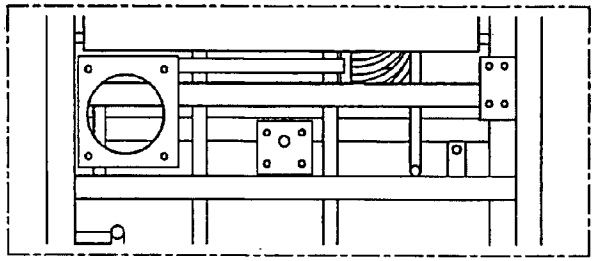
FIG. 96 is a close-up view of detail "D" in FIG. 94.
Figure 98:
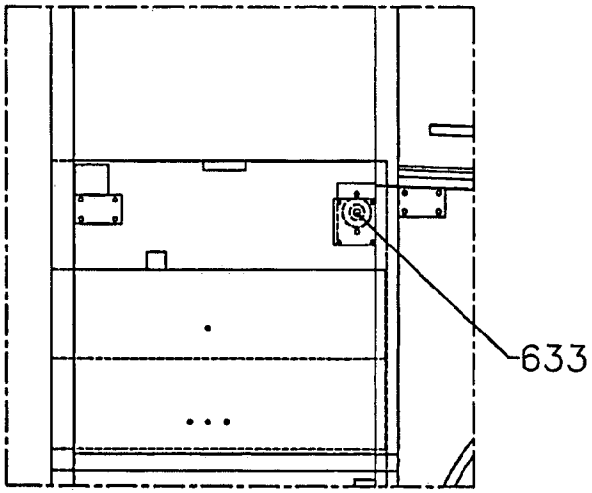
FIG. 98 is a close-up of detail "A" in FIG. 97.
Figure 99:
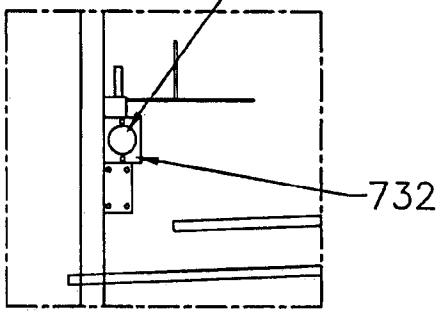
FIG. 99 is a close-up view of detail "B" in FIG. 97.
Figure 97:
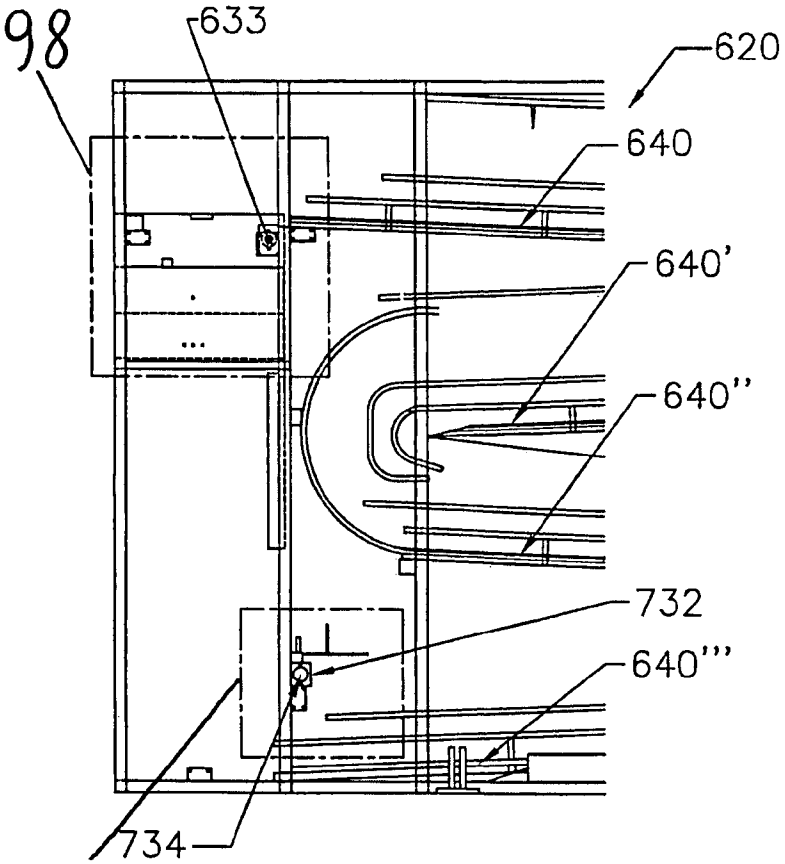
FIG. 97 is a partial sectional front view of apparatus 620 according to one embodiment of the disclosure.
Figure 100:
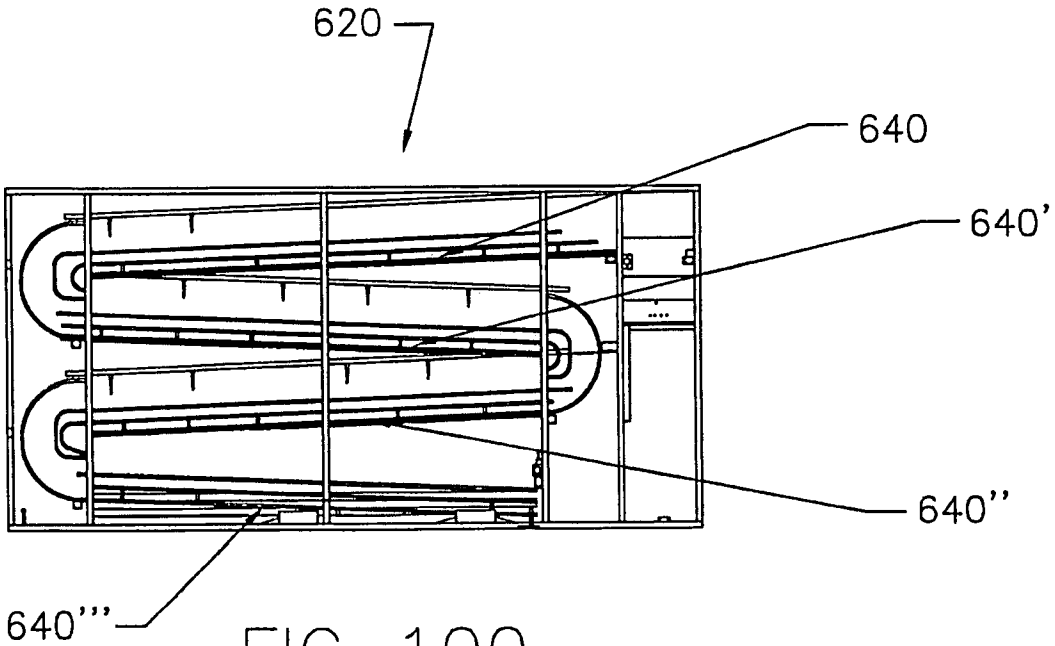
FIG. 100 is a back elevational view of apparatus 620 according to one embodiment of the disclosure.
Figure 101:
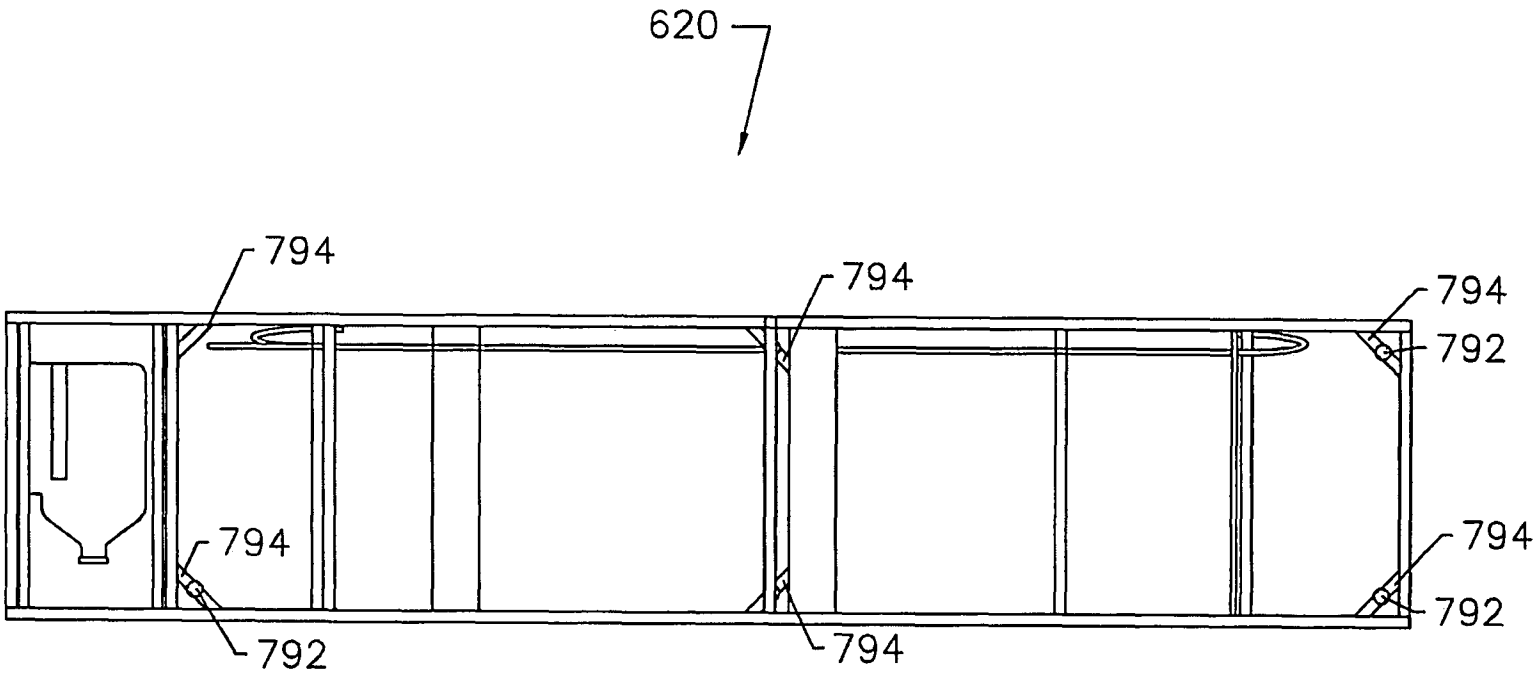
FIG. 101 is a top view of apparatus 620 according to one embodiment of the disclosure.
Figure 102:
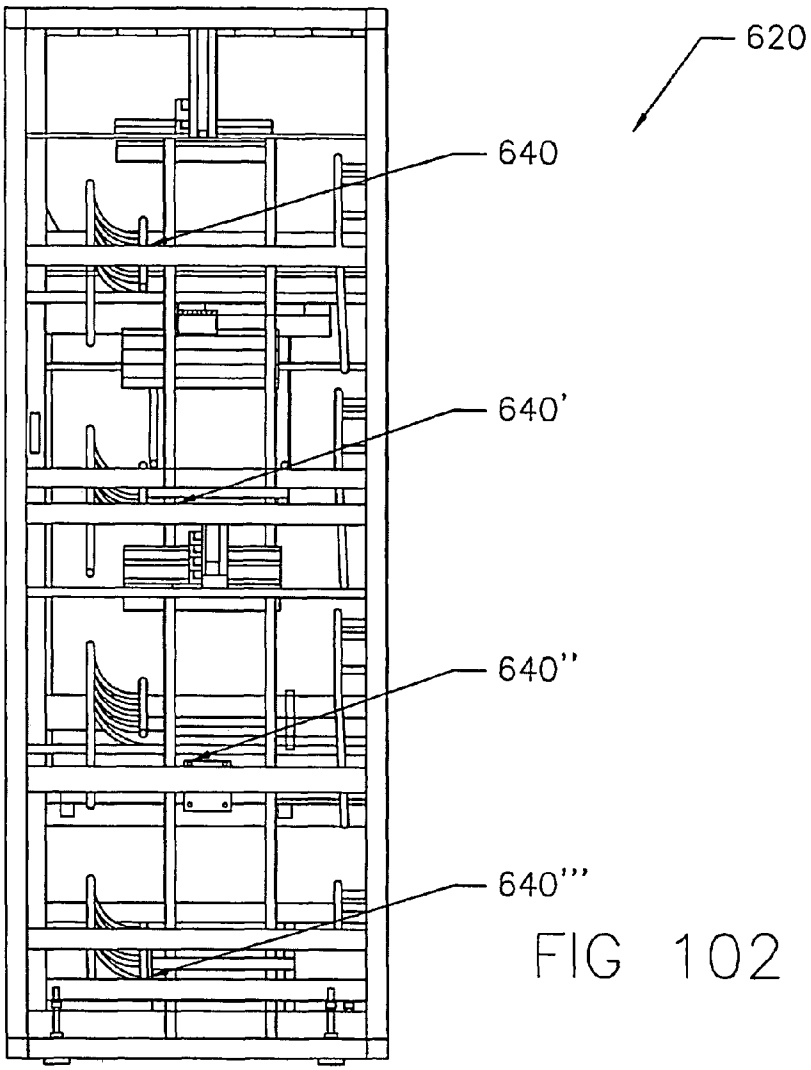
FIG. 102 is a right elevational view of apparatus 620 according to one embodiment of the disclosure.
Figure 103:
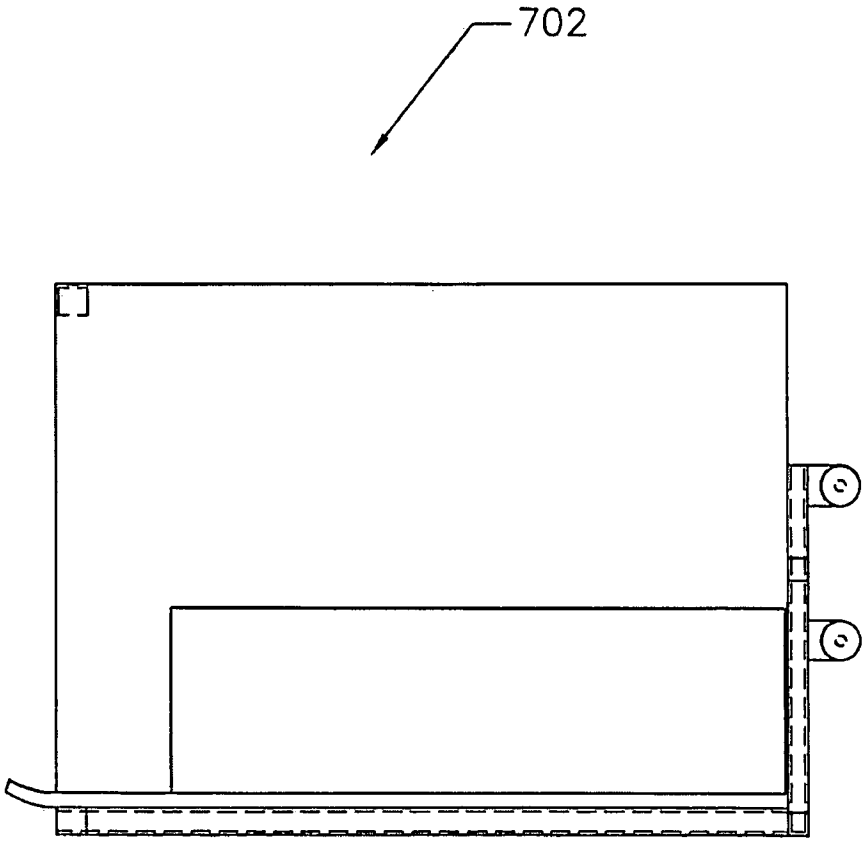
FIG. 103 is a side elevation view of elevator assembly 702 according to one embodiment of the disclosure.
Figure 104:
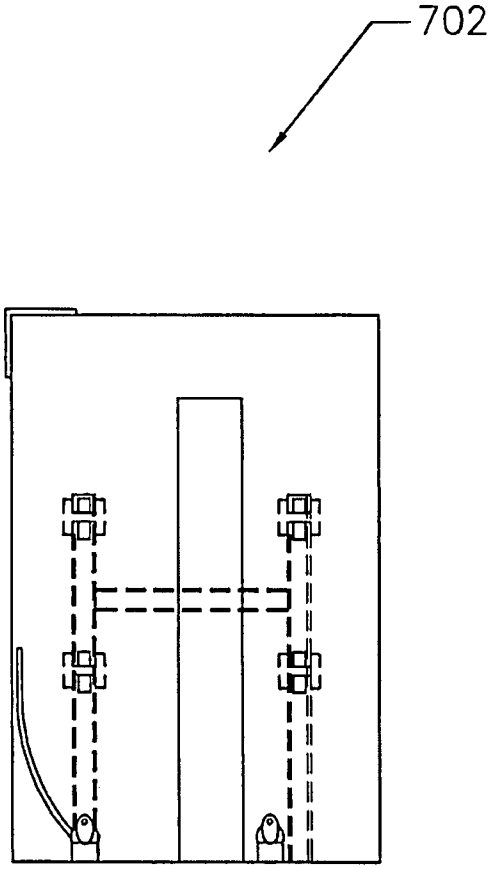
FIG. 104 is a front elevational view of elevator assembly 702 shown in FIG. 103.
Figure 105:
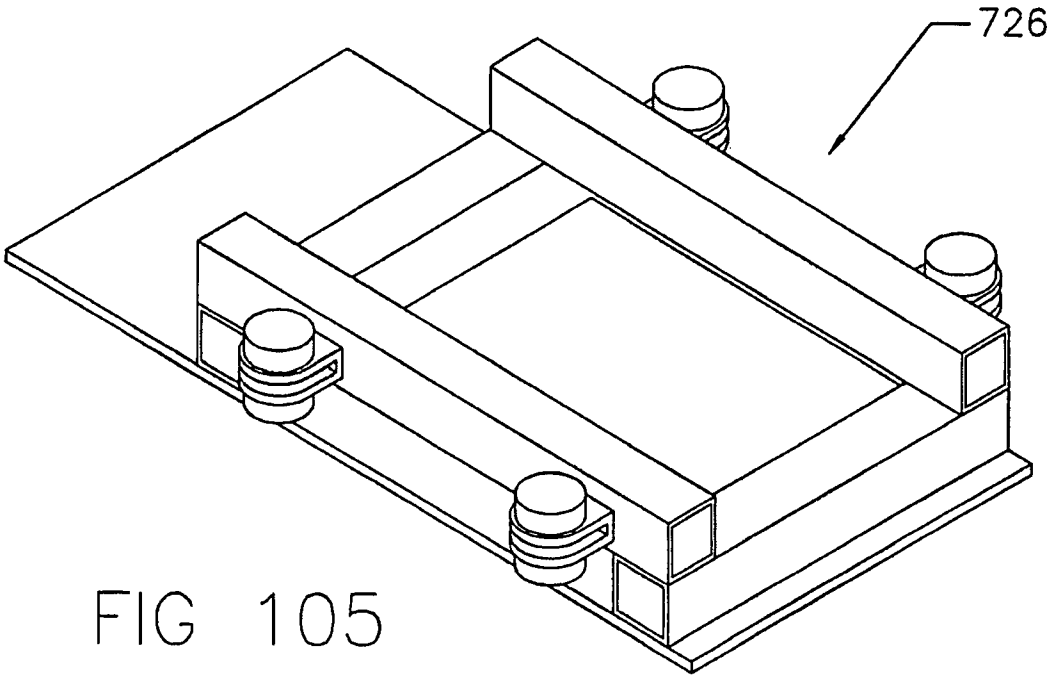
FIG. 105 is a top back perspective view of vend door 726 according to one embodiment of the disclosure.
Figure 106:
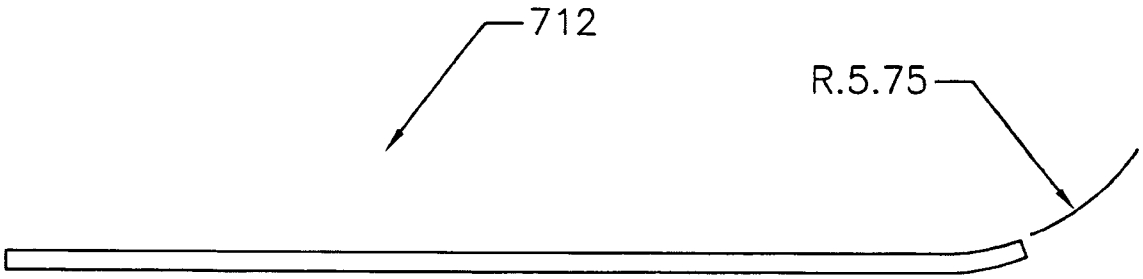
FIG. 106 is a side view of bottle support rod 712 according to one embodiment of the disclosure.
Figure 107:
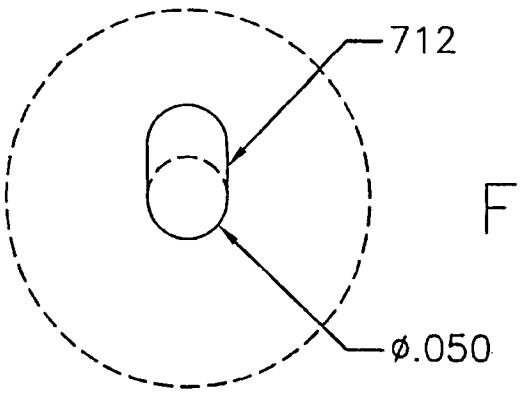
FIG. 107 is a front elevational view of support rod 712 shown in FIG. 106.
Figure 108:
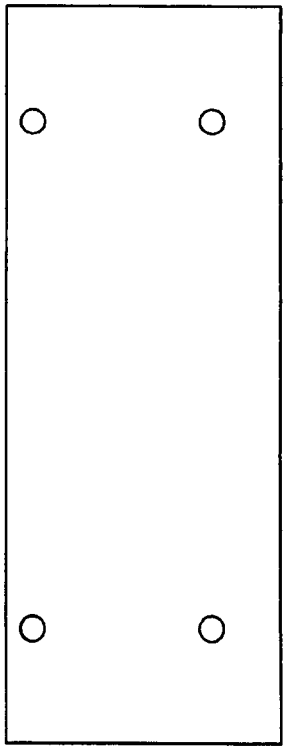
FIG. 108 is a front elevational view of plate according to one embodiment of the disclosure.
Figure 109:
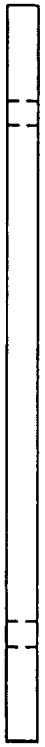
FIG. 109 is a side elevational view of the plate shown in FIG. 108.
Figures 110, 111:
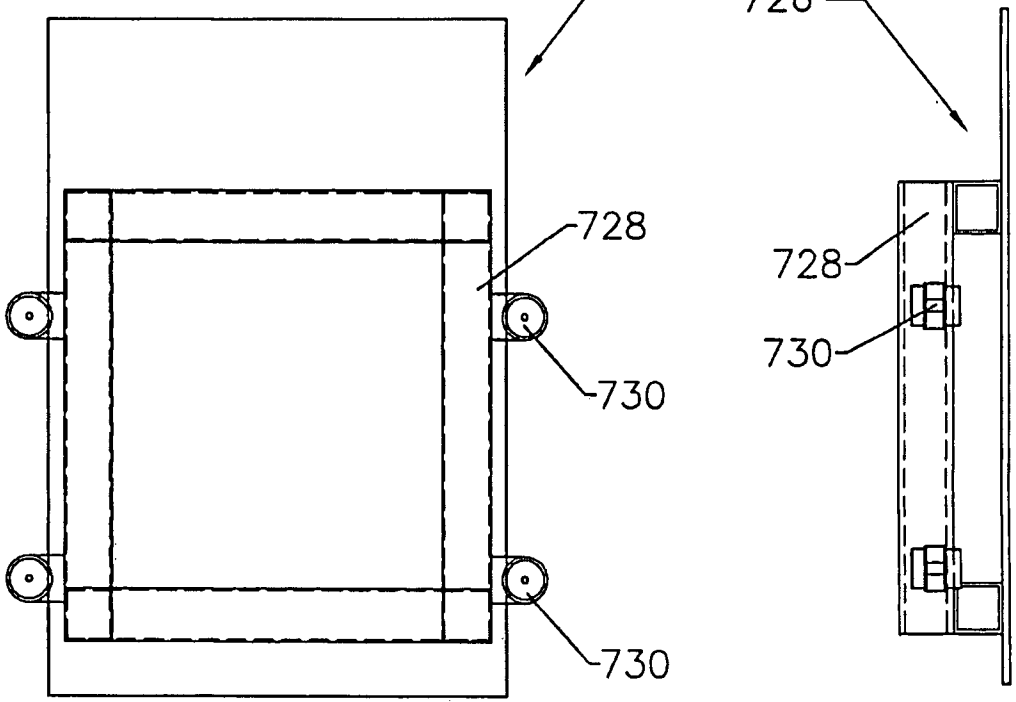
FIG. 110 is a back elevational view of vend door 726 according to one embodiment of the disclosure.
Figure 112:
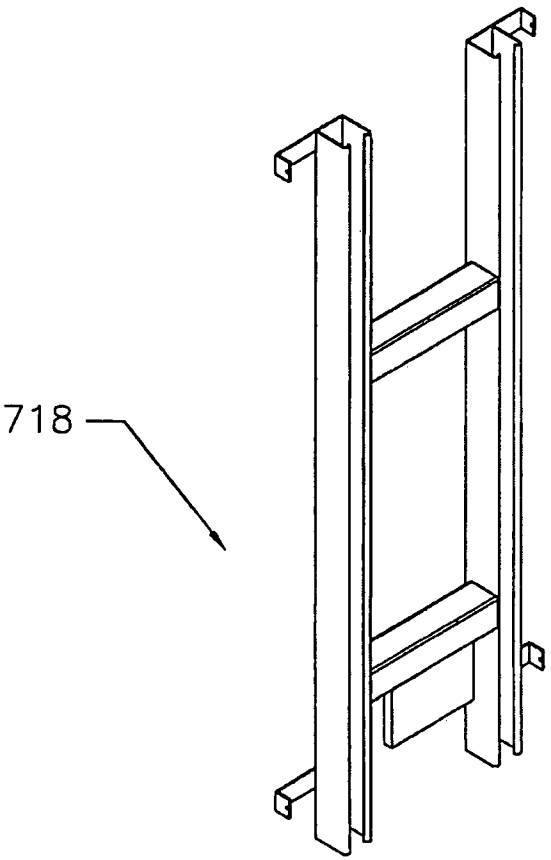
Figure 114:
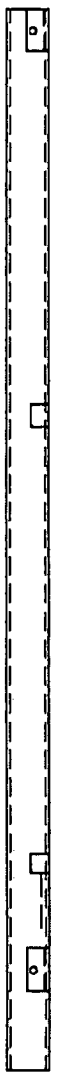
Figure 113:
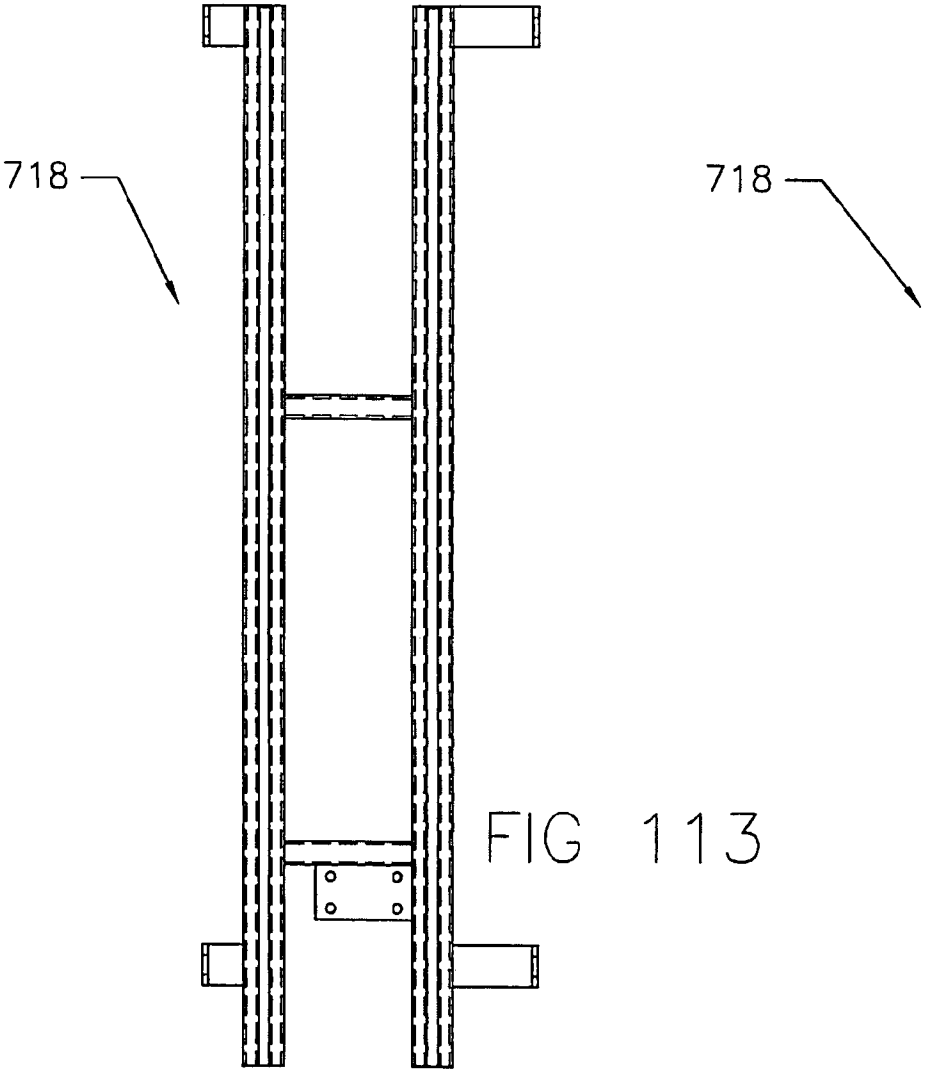
Figure 116:
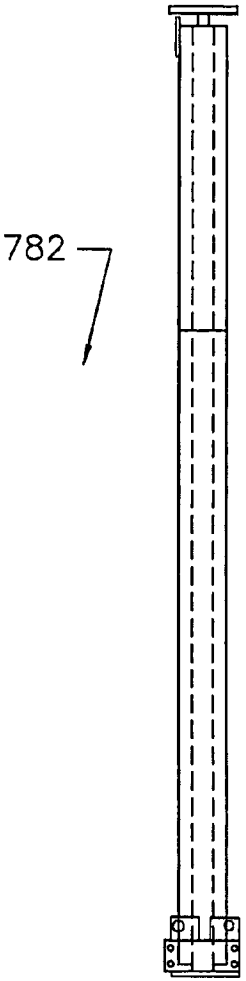
Figure 115:
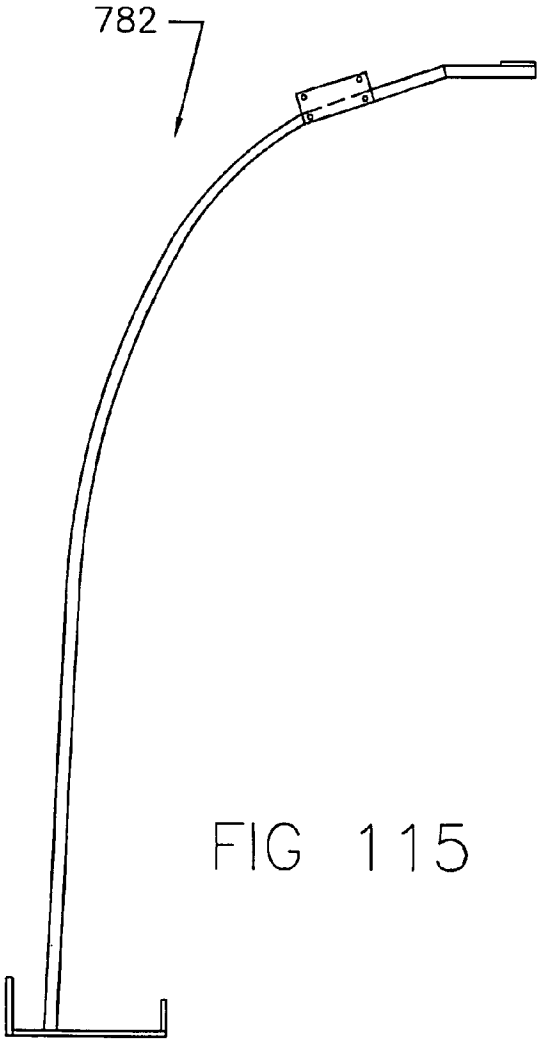
Figures 117, 118:
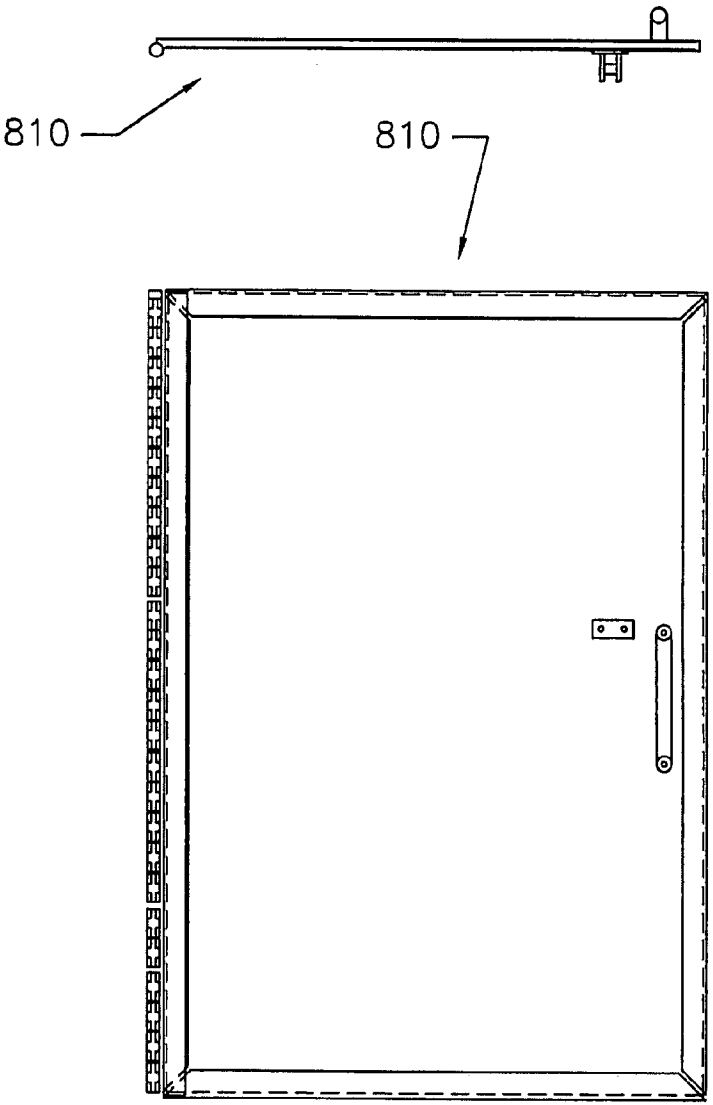
Figure 119:
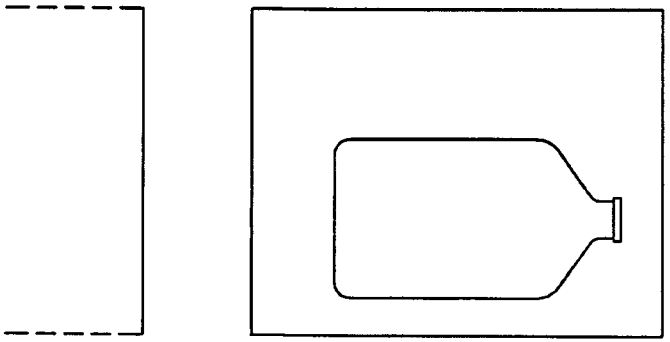
Figure 120:
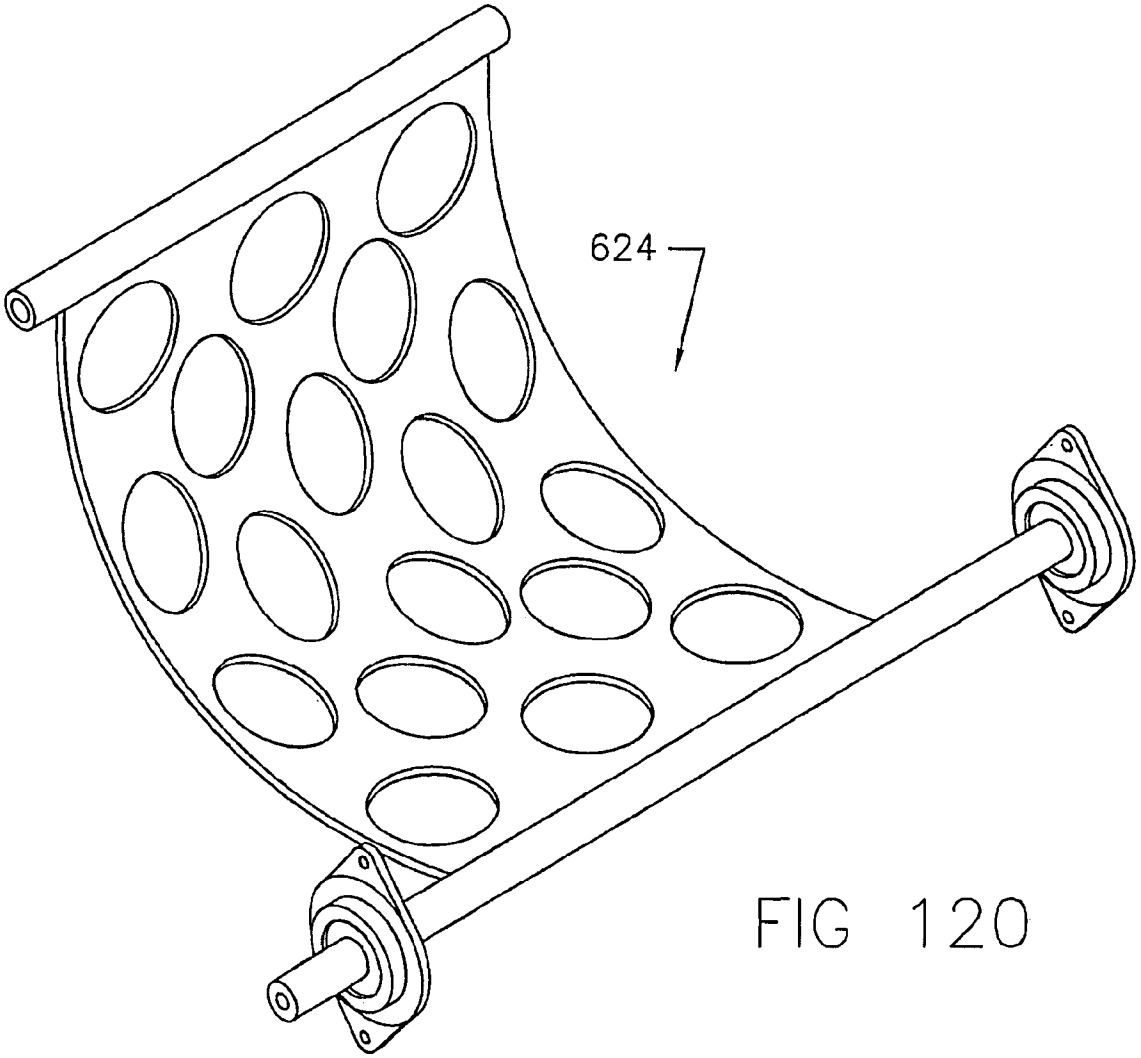
Figure 122:
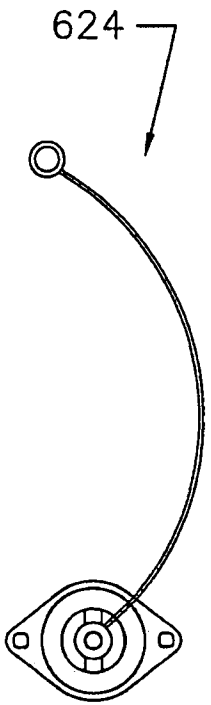
Figure 121:
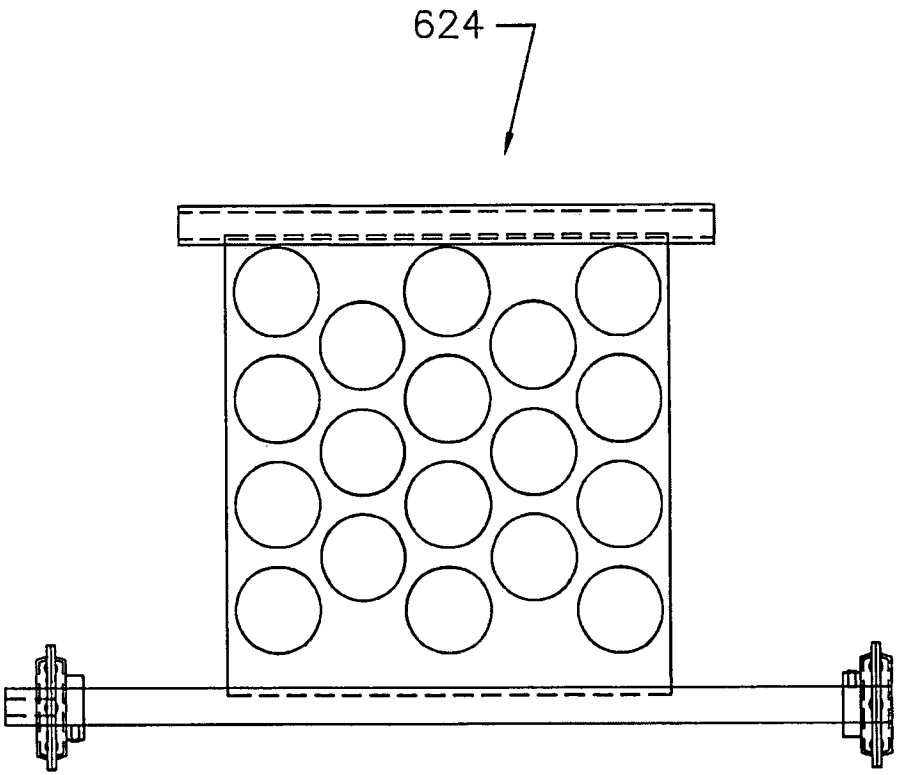

In another aspect of the disclosure as shown in FIGS. 90A and 90B, a combined bottle vending/bottle return application is shown generally as 859. The application begins with the customer approaching and operating the vending machine touch screen 772. Screen 772 is configured to receive credit/debit cards and/or prepaid purchase cards purchased from the retailer adjacent the vending apparatus. In one embodiment, the customer is first presented with a welcome screen at step 860. The welcome screen is shown generally as 956 in FIG. 91A. Welcome screen 956 includes information about purchase options with and without return bottles. The ability to change the displayed price is available in the touchscreen software. The customer is also prompted to select a language among choices shown on the touch screen at step 862. Once a language has been selected, all further screen prompts are shown in the selected language. For purposes of illustration and not limitation, the drawings show English and Spanish as language selections. The application may be programmed for any combination of languages desired by the apparatus owner/licensee.

The customer is next prompted to select a purchase option at step 864. In the illustrative embodiment, two selections are provided: 1) a bottle purchase without a return 866, and 2) a bottle purchase with a return 868. The selection of one of the purchase options will lead to a dedicated series of further prompts and customer initiated steps.

Should the customer select the bottle-only (shown as option 1), option 866, depending on the configuration, the customer is prompted to touch, insert, or slide a credit/debit/prepaid water card in the reader at step 870. The customer is also provided with a cancel option at this step, if needed. The screen display may be substantially like that shown as 968 in FIG. 91A. If the attempt to engage the reader is unsuccessful, the customer is prompted to try again after a predetermined time period to read the card information lapses. The system may be configured to allow for a predetermined number of tries to have the card read before the system declines to read the card.

If after successfully swiping the card, the customer wishes to cancel the transaction, the customer can cancel the transaction by the selecting the cancel option at step 872. The screen will display the transaction has been canceled. If the customer does not select the cancel option, the system processor sends an electronic signal to the customer's financial institution to request transaction authorization at step 874. The customer will have the option to cancel the transaction again at step 874. While the application is seeking authorization, the screen may include a display such as that shown as 970 in FIG. 91A. If canceled, the screen will display the cancellation at step 876. A message may be displayed on screen 772 substantially similar to that shown as 984 in FIG. 91C.

If the transaction is declined, screen 772 displays a "credit authorization declined" message at step 924 and further instructs the customer to try another card, or contact their financial institution. The displayed message may also be substantially similar to that shown as 982 in FIG. 91C. The system returns to the home screen 860. If, at any point, the application fails for any reason, a message may be displayed on screen 772 substantially similar to that shown as 980 in FIG. 91C.

If the transaction request is approved, the system debits the designated amount from the customer's account at step 878. The screen will display a "transaction complete" notification to inform the customer of the successful electronic transaction. A screen message may be displayed substantially similar to that shown as 972 in FIG. 91A at this step. Completion of the financial transaction prompts the processor to initiate the full bottle vend function at step 880. Elevator assembly 702 is operated by activating winch assembly 830 to lift the enclosed full bottle 2 to the designated bottle retrieval zone at step 882. As the bottle is being elevated, bottle 2 is registered against ejector bar 782 that urges bottle 2 toward the front open end of elevator assembly 702. Once elevator assembly 702 reaches the predetermined retrieval location, upper limit sensor 717 is triggered by elevator assembly 702 and the bottle is fully within the vend position. With the simultaneous elevation of door 726, full bottle 2 is ready for customer retrieval. At this step, a message may be displayed on screen 772 substantially similar to that shown as 974 in FIG. 91A.

Once sensor 717 is triggered and a signal is relayed to the processor, a message is displayed on screen 772 to thank and inform the customer the bottle is ready for retrieval at the front of apparatus 620 at step 886. The customer retrieves bottle 2 at step 888. Once the customer removes bottle 2 from elevator assembly 702, sensor 719 is triggered to confirm bottle removal at step 884. A preset time delay may be incorporated into the application at this step to ensure the customer is safely removed from the retrieval zone before a signal is sent to begin the elevator assembly descend process at step 890. Door 726 does not close until sensor 719 is triggered. With removal of the full bottle, a message may be displayed on screen 772 substantially similar to that shown as 964 in FIG. 91A.

Elevator assembly 702 progresses downwardly until down limit sensor 715 is triggered at step 892. Sensor 715 sends a signal to the processor regarding the elevator assembly's current location. This prompts the processor to send a "stop" signal to winch assembly 830. The cessation of winch activity is followed by a signal sent from the processor to the lock motor 745 to disengage lock rod 740 from gate assembly 744 at step 894. The lead bottle 2 is thus released into elevator assembly 702 to await the next bottle purchase event. Sensor 719 is triggered by the now resident bottle 2 and sends a signal to the processor to confirm the presence of bottle 2 in elevator assembly 702 at step 898 so as to make the bottle available for purchase by the next customer.

If a bottle 2 does not enter elevator assembly 702 when gate assembly 710 is disengaged from lock rod 725, sensor 719 is not triggered at step 906. After a preselected time period—from about 0 seconds to about 20 seconds—the absence of a signal from sensor 719 after disengagement of lock rod 725 due to lead bottle 2 not migrating into elevator assembly 702, an out-of-order message is displayed on screen 772 with, or without, an instruction to contact the bottler, vending company, and/or service department at step 908.

If an instruction is given to contact the bottler/vendor/service department, and the bottler/vendor/service department is contacted at step 910, a truck is dispatched to refill or service apparatus 620. In an alternative embodiment, the apparatus processor automatically sends a signal via wireless and/or wired methods well known in the art and commonly known to the bottler/vendor/service department to attend to apparatus 620.

When the last filled bottle 2 is positioned for migration into elevator assembly 702, a signal is sent to the processor via bottle sensor 777 to identify the last bottle at step 896. Alternatively, sensor 777 may be set at any point along the track assemblies to indicate any pre-designated number of remaining filled bottles 2. For example, sensor 777 may be positioned to detect when 10 filled bottles remain in apparatus 620. A signal is sent to the processor to register the remaining full bottle count. The processor then sends a signal to screen 772 to display a "Sold Out" message with an optional additional message to contact the bottler/vendor. In an alternative embodiment, the processor automatically sends a signal to the bottler/vendor when the "last bottle" signal is received. Automated, or customer initiated contact takes place at step 910. The automated embodiment ensures apparatus 620 is timely resupplied before more customers make purchases. With either embodiment, a truck is dispatched to fill the apparatus as step 912.

Referring back to step 864, if the customer selects the second option, a purchase with a return bottle at step 868, the customer is prompted to swipe, insert and/or pass the card across the card reader at step 916. A screen message may be displayed at this step substantially similar to that shown as 958 in FIG. 91A. The customer is given the option to cancel the transaction at this step and may do so at step 918. This sends the application back to the start screen 860.

If the cancel option is not selected, the processor sends a message to the customer's financial institution for authorization to process the transaction at step 920. The customer is again given the option to cancel and may do so at step 922. If the cancel option is selected, the application returns to home screen 860. If cancel is not selected, the application waits for a response to the authorization request. If the authorization is declined, a "credit authorization declined" message is displayed on screen 772 at step 924 and the customer is prompted to try another card, or to contact their financial institution. The application thereafter returns to home screen 860.

If the authorization is approved and the funds are successfully transferred, a message is displayed on screen 772 indicating the amount paid and the transaction complete at step 926. Subsequently, or substantially simultaneously, the processor sends a signal to return door lock 623 to initiate a door unlock sequence at step 928. A message 962 is displayed on screen 772 to prompt the customer to lift the door and properly align and place the empty return bottle 3 inside the return bin with a further prompt to properly align the bottle and close the door when finished at step 930. Sensors 638, 634 and 637 validate the empty bottle as being the correct size bottle (for example a 5 gallon bottle), at step 932. The message displayed on screen 772 at this step may be substantially similar to that shown as 962 in FIG. 91A. It should be understood that apparatus 620 may be configured to accommodate a single size bottle, multiple size bottles in a range from about 1 gallon bottles to about 5 gallon bottles.

If the bottle is not accepted at step 940, a message is displayed on screen 772 to indicate the bottle is invalid and to prompt the customer to remove the bottle and try again at step 942. The customer is also given the option to cancel the transaction. A message may be displayed on screen 772 at this step substantially similar to that shown as 976 in FIG. 91B. If the customer selects the cancel transaction option, a transaction cancelled message is displayed on screen 772 at step 952 and the application returns to home screen 860. As no funds are transferred until the bottle is successfully removed from the apparatus, any cancellation procedure that takes place prior to bottle removal will not result in a fund transfer event that eliminates the need to institute a refund sequence.

If the customer elects to retry, the customer removes the bottle and realigns it with the bottle form and deposits it a second time at step 944. If rejected again, an invalid bottle message is displayed on the screen at step 950. The message may include a further prompt to try again as well as a cancellation option. If the customer selects the cancellation option, a "transaction cancelled" message is displayed at step 952, and the application returns to home screen 860.

If a third attempt is made to deposit a return bottle, the customer again removes the return bottle, realigns it with the return bottle form and deposits the bottle in a repeat of step 944. If the return bottle is rejected yet again, a message is displayed on screen 772 indicating invalid bottle $3^{rd}$ attempt at step 946. If the application is set for three tries, an "invalid bottle, transaction cancelled" message is displayed on the screen at step 948 and the application returns to home screen 860. A message such as that shown as 978 in FIG. 91B may be shown at this step if no more tries are allowed. If set for more than three tries, the application returns to step 944 for another try. If the third attempt is successful, the application proceeds to step 932 where the sensors validate empty bottle 3.

Once a return bottle has been accepted, a signal is sent by the processor to lock return door 622 with door lock 623 at step 934. Sensor 635 detects whether the return door is locked and sends a corresponding signal to the processor. The processor next sends a signal to cradle motor 633 to rotate cradle 624 to deposit the return bottle onto track assembly 640 at step 936. Cradle motor 633 continues to rotate toward track assembly 640 until sensor 636 is tripped, which sends a signal to the processor that the cradle has reached maximum rotation to deliver the return bottle at step 938. At the same step, the processor sends a signal to motor 633 to reverse direction and return cradle 624 to a "home" or start position, ready to receive the next return bottle 3. The application next initiates step 880 to initiate the full bottle 2 vend sequence previously described. Screen messages substantially similar to those shown as 964 and 966 in FIGS. 91A and 91B, respectively, may be displayed following step 880. FIGS. 90A1-90C1 show an alternative combined bottle vending/return application that may be used with the disclosed vending/return apparatus embodiments. The alternate application steps are self-evident as set forth in the drawings.

Figure 80:
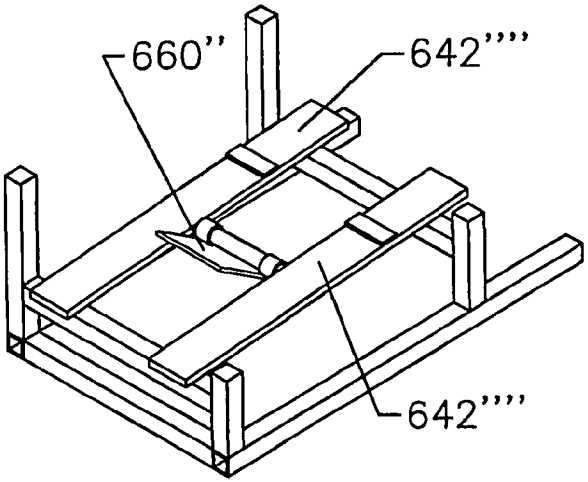
FIG. 80 is a perspective view of a spring actuated inertia restrictor flapper positioned between track guide rails according to a still further embodiment of the disclosure.
Figure 81:
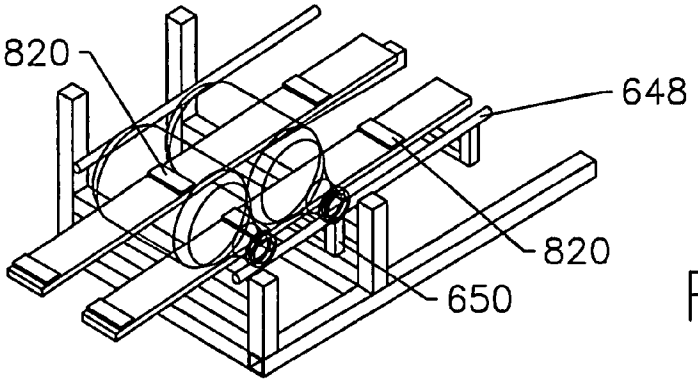
FIG. 81 is a side view of a stationary inertia restrictor according to the embodiment shown in FIG. 77.
Figure 82:
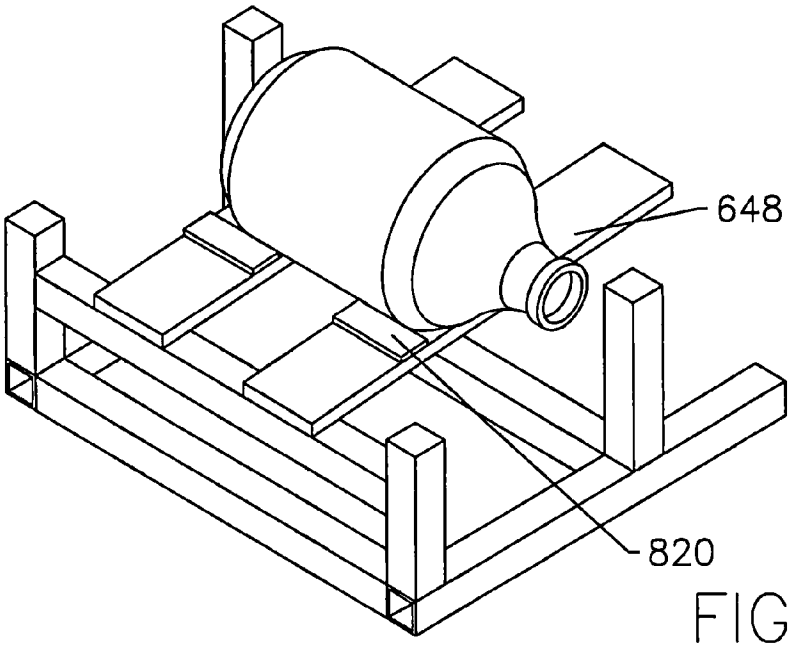
FIG. 82 is a close-up view of the stationery inertia restrictor shown in FIG. 77.
Figure 83:
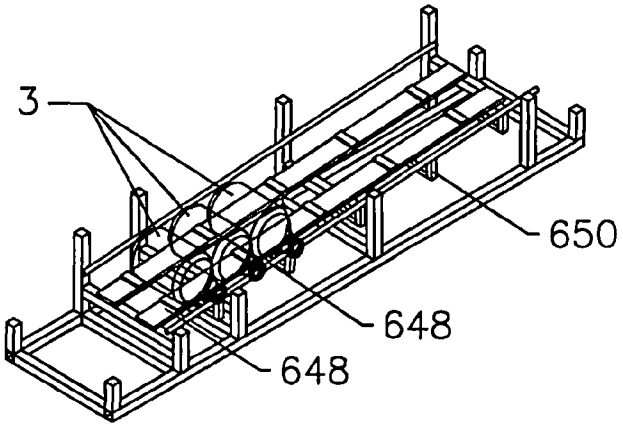
FIG. 83 is a side elevational view of a track assembly with stationary inertia restrictors according to the embodiment of the disclosure shown in FIG. 77.
Figure 84:
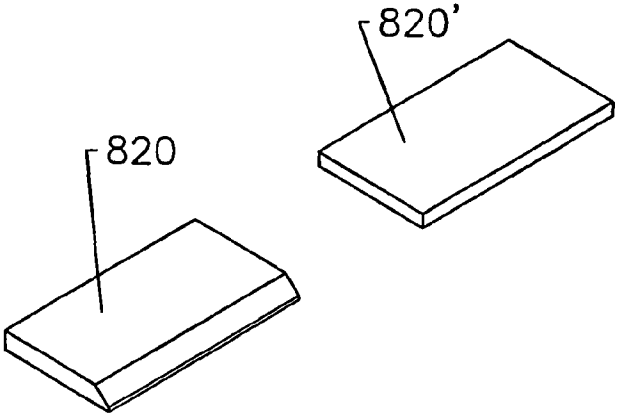
FIG. 84 is a comparison view of stationary inertia restrictors having different thicknesses.
Figure 85:
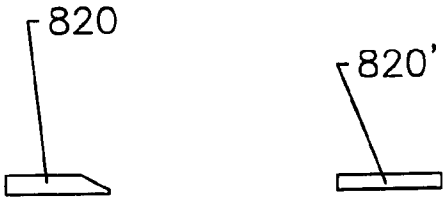
FIG. 85 is a side elevational view of the stationary inertia restrictors shown in FIG. 84.
Figure 86:
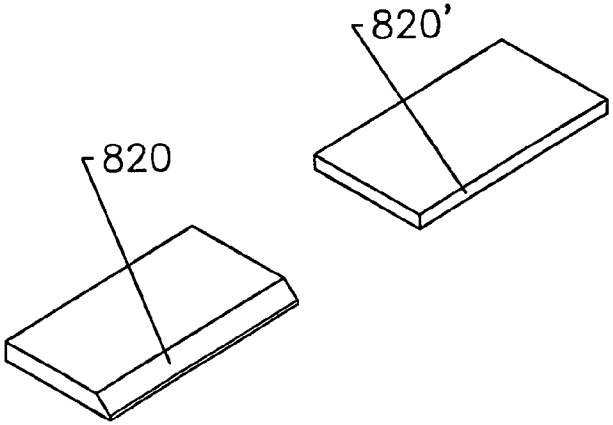
FIG. 86 is a side elevational view of beveled and unbeveled stationary inertia restrictors.

Referring now to FIG. 80, lower inertia restrictor 660"" is secured between track rails 642 to reduce kinetic energy of bottles 2 and 3 traversing the restrictor. A torsional spring (not shown) returns restrictor 660"" to a start position.

In a yet further aspect of the disclosure, the track assemblies are modified with substantially flat boards replacing the rails to provide a solid surface upon which both filled bottles and empty bottles can traverse from the return segment to the elevator segment. In this embodiment, each track assembly is further altered by elevating the side of the track assemblies that support the neck portions of the bottles relative to the side of the track assemblies that support the bottom ends of the bottles so as to create a lateral angle of incline of the neck portion side. This configuration imparts several benefits as disclosed below.

More specifically, referring now to FIGS. 147-156, the track assemblies have about a 6° grade from left to right for the first and third assemblies and from right to left for the second and $4^{th}$ assemblies. Each track assembly also has about a 4° grade from the neck side of the track assembly to the bottle bottom side. Either grade can be enlarged + or − about 5°. The side angle is particularly advantageous as it solves a problem with leakage from the interface of the bottle and bottle cap.

A first segment 641.5 of the first track assembly does not include the side angle and remains along a horizontal plane to align with the orientation of cradle 624 that deposits the return bottles 3 onto the track assembly. When a return bottle 3 is urged onto the first track assembly, a track ramp 641.7 shown in FIG. 156 prevents the bottle from advancing on the track assembly. Instead, the bottle is urged against the inertia retarding flap 660, which has a one-way hinge. The bottle is urged up the ramp and onto the declining portion of the track assembly when a second return bottle is urged onto the track assembly by cradle 624. The side angle transition from the relatively flat first segment to the angled track assembly occurs on ramp 641.7.

In place of rails 642 and their equivalent structures on the second, third and fourth track assemblies in the prior disclosed embodiment, flat boards such as starboard from King Plastics is used. The boards are of a food-grade quality and are resistant to temperature and pressure fluctuations. This substitution eliminates the need for a neck guide rail when the boards are placed on an angle as disclosed.

The last portion of the fourth track assembly transitions to a substantially flat horizontally planar surface to align the bottle for positioning on the elevator assembly. The entire configuration eliminates the need for any inertia restrictors except for the first restrictor 660 shown in FIG. 156.

While the present disclosure has been described in connection with one or more embodiments thereof, it will be apparent to those skilled in the art that many changes and modifications may be made without departing from the true spirit and scope of the disclosure. Accordingly, it is intended by the appended claims to cover all such changes and modifications as come within the true spirit and scope of the disclosure.

We claim:

1. A combination bottle vending/return apparatus comprising:

a front wall, a back wall, and side walls connecting the front wall to the back wall, the combination defining a single vend/return compartment;

an internal bottle receiving and vending segment having a back wall and comprising at least one column of a plurality of stacked stationary gravity fed linear conveyor assemblies having at least one top stationary linear vending conveyor assembly and at least one bottom stationary linear vending conveyor assembly, wherein the conveyor assemblies support filled or empty bottles and combinations of filled and empty bottles;

a single vend/return door secured to the front wall, wherein the door permits access to the vend/return compartment and permits the retrieval of filled bottles from, and the deposit of empty bottles into, the compartment; and, a bottle return/bottle vend elevator assembly secured adjacent to the internal bottle receiving and vending segment, wherein the elevator assembly moves along a vertical axis from the at least one bottom vending conveyor assembly to the at least one top vending conveyor assembly, wherein the elevator aligns with the bottom vending conveyor to receive a filled bottle for vending, rises to be substantially aligned with the door to permit filled bottle removal and empty bottle deposit and rises to be substantially aligned with the top conveyor to permit empty bottles, when positioned on the elevator, to migrate from the elevator to the at least one top conveyor assembly.

2. The apparatus of claim 1, wherein the top vending segment conveyor is pitched downwardly from a front end of the apparatus toward a back end of the apparatus.

3. The apparatus of claim 2, wherein the bottom vending segment conveyor is pitched downwardly from a back end of the apparatus toward a front end of the apparatus.

4. The apparatus of claim 3, wherein the top vending conveyor assembly extends from a front wall of the apparatus to a distal point or plane spaced from a back wall of the vending segment wherein the distance between the distal point or plane and the back wall is larger than the cross-sectional diameter or cross-sectional dimensions of a water bottle.

5. The apparatus of claim 4, wherein the bottom vending conveyor assembly extends from the front wall of the apparatus to the back wall of the vending segment.

6. The apparatus of claim 5, wherein the plurality of vending conveyor assemblies, excluding the top vending conveyor assembly and the bottom conveyor assembly, extend from a point or plane spaced from the front wall of the apparatus to a point or plane spaced from the back wall of the vending segment, wherein the distance between the conveyor assemblies from the front wall is greater than the lateral dimensions of a water bottle and wherein the distance between the conveyor assemblies and the vending segment back wall is greater than the lateral dimensions of a water bottle.

7. The apparatus of claim 6, further comprising an identification tag reader secured to the front wall of the apparatus.

8. The apparatus of claim 7, further comprising a shelf secured to the front wall of the apparatus below a bottom edge of the vending retrieval door.

9. The apparatus of claim 8, further comprising a credit/debit/prepaid card reader secured to the front wall of the apparatus.

10. The apparatus of claim 9, further comprising a sensor set in proximity to the return/vend door to sense the removal of a filled water bottle.

11. The apparatus of claim 10, further comprising a sensor set in proximity to the return/vend door to sense the presence of an empty water bottle on the elevator assembly.

12. The apparatus of claim 11, further comprising electromechanically operated door locks for the return/vend door in the apparatus.

13. The apparatus of claim 1, wherein the elevator assembly comprises a shell with a slot formed in at least a back wall of the assembly.

14. The apparatus of claim 13, wherein the apparatus further comprises an ejection rod secured inside the apparatus and positioned to fit within the slot formed in the elevator assembly.

15. The apparatus of claim 14 ,further comprising a winch assembly secured to the elevator assembly and a processor secured in the apparatus, wherein the processor controls operation of the winch assembly.

16. The apparatus of claim 15, further comprising a bottle sensor secured in the elevator assembly to detect the presence of a bottle in the elevator assembly.

17. The apparatus of claim 16, further comprising an upper limit sensor secured in an elevator shaft within which is located the elevator assembly, wherein the upper limit sensor detects the presence of the elevator assembly at a designated upper limit of travel.

18. The apparatus of claim 17, further comprising a down limit sensor secured in the elevator shaft, wherein the down limit sensor detects the presence of the elevator assembly at a designated lower limit of travel.

19. The apparatus of claim 18, further comprising a bottle gate and lock assembly secured in the apparatus adjacent to an end of the at least one bottom vending conveyor assembly.

* * * * *